US010378431B2

(12) United States Patent
Tour et al.

(10) Patent No.: US 10,378,431 B2
(45) Date of Patent: Aug. 13, 2019

(54) SPLIT CYCLE ENGINE WITH CROSSOVER SHUTTLE VALVE

(71) Applicant: Tour Engine, Inc., San Diego, CA (US)

(72) Inventors: Gilad Tour, Rehovot (IL); Oded Tour, San Diego, CA (US); Hugo Benjamin Tour, Rehovot (IL)

(73) Assignee: Tour Engine, Inc., San Diego, CA (US)

( * ) Notice: Subject to any disclaimer, the term of this patent is extended or adjusted under 35 U.S.C. 154(b) by 122 days.

(21) Appl. No.: 15/544,497

(22) PCT Filed: Jan. 19, 2016

(86) PCT No.: PCT/IL2016/050061

§ 371 (c)(1),
(2) Date: Jul. 18, 2017

(87) PCT Pub. No.: WO2016/116928

PCT Pub. Date: Jul. 28, 2016

(65) Prior Publication Data

US 2018/0266308 A1 Sep. 20, 2018

Related U.S. Application Data

(60) Provisional application No. 62/197,582, filed on Jul. 28, 2015, provisional application No. 62/138,435,
(Continued)

(51) Int. Cl.
*F01L 5/04* (2006.01)
*F01L 7/02* (2006.01)
(Continued)

(52) U.S. Cl.
CPC ..... *F02B 33/22* (2013.01); *F01L 5/045* (2013.01); *F01L 7/02* (2013.01); *F02B 33/44* (2013.01); *F02B 41/06* (2013.01)

(58) Field of Classification Search
CPC ..... F02B 33/22; F02B 33/44; F02B 41/06; F01L 7/02; F01L 5/045
(Continued)

(56) References Cited

U.S. PATENT DOCUMENTS 1,372,216 A 3/1921 Casaday
1,374,140 A 4/1921 Dock
(Continued)

FOREIGN PATENT DOCUMENTS

FR 1 084 655 1/1955
FR 2 963 644 2/2012
(Continued)

OTHER PUBLICATIONS

European Search Report for EP 15736989.3, dated Sep. 13, 2017, 6 pages.
(Continued)

*Primary Examiner* — Joseph J Dallo
*Assistant Examiner* — Scott A Reinbold
(74) *Attorney, Agent, or Firm* — Morrison & Foerster LLP

(57) ABSTRACT

A split-cycle internal combustion engine (ICE) is provided, comprising a compression cylinder, an expansion cylinder and a crossover valve having a valve cylinder housing inside a shuttle and a combustion chamber structure defining a combustion chamber. The shuttle is configured to perform reciprocating motion inside the valve cylinder synchronously with a compression piston and an expansion piston, thereby alternatingly fluidly coupling and decoupling the combustion chamber with the compression cylinder and with the expansion cylinder, selectively. Sealing rings positioned between the valve cylinder and the shuttle prevent gas leaks between them during the reciprocating motion. In some embodiments, a phase shift between the pistons may
(Continued)

be set or varied by a piston phase transmission gear. A bi-directional fluid flow split-cycle internal combustion engine (ICE) is also provided having a first cylinder, a second cylinder, a combustion chamber and a single cross-over valve fluidly communicating them.

16 Claims, 91 Drawing Sheets

Related U.S. Application Data filed on Mar. 26, 2015, provisional application No. 62/104,885, filed on Jan. 19, 2015.

(51) Int. Cl.
*F02B 33/22* (2006.01)
*F02B 33/44* (2006.01)
*F02B 41/06* (2006.01)

(58) Field of Classification Search
USPC ..... 123/58.1, 47 R
See application file for complete search history.

(56) References Cited

U.S. PATENT DOCUMENTS

| | | | |
|---|---|---|---|
| 2,302,442 | A | 11/1942 | Hickey |
| 2,522,649 | A | 10/1945 | Tenney |
| 2,404,395 | A | 7/1946 | Humphreys |
| 2,657,553 | A | 11/1953 | Jonkers |
| 3,145,527 | A | 8/1964 | Morgenroth |
| 3,522,797 | A | 8/1970 | Stinebaugh |
| 3,880,126 | A | 4/1975 | Thurston et al. |
| 4,202,300 | A | 5/1980 | Skay |
| 4,630,447 | A | 12/1986 | Webber |
| 4,663,938 | A | 5/1987 | Colgate |
| 4,794,752 | A | 1/1989 | Redderson |
| 5,040,498 | A | 8/1991 | Scherer |
| 5,345,765 | A | 9/1994 | Kinnersly |
| 5,546,897 | A | 8/1996 | Brackett |
| 5,551,382 | A | 9/1996 | Bauer |
| 6,205,788 | B1 | 3/2001 | Warren |
| 6,487,858 | B2 | 12/2002 | Cammack |
| 6,880,501 | B2 | 4/2005 | Suh et al. |
| 7,050,900 | B2 | 5/2006 | Miller |
| 7,177,751 | B2 | 2/2007 | Froloff |
| 7,178,324 | B2 | 2/2007 | Sakita |
| 7,263,963 | B2 | 9/2007 | Price |
| 7,806,101 | B2 | 10/2010 | Hu |
| 8,006,656 | B2 | 8/2011 | Branyon |
| 8,082,892 | B2 | 12/2011 | Zhao |
| 8,210,138 | B2 | 7/2012 | Scuderi |
| 8,210,147 | B2 | 7/2012 | Cotton |
| 8,371,256 | B2 | 2/2013 | Durrett et al. |
| 8,459,227 | B2 | 6/2013 | Cotton |
| 8,590,497 | B2 | 11/2013 | Meldolesi |
| 8,714,121 | B2 | 5/2014 | Philips |
| 8,904,981 | B2 | 12/2014 | Fiveland |
| 2003/0015171 | A1 | 1/2003 | Scuderi |
| 2009/0056670 | A1 | 3/2009 | Zhao et al. |
| 2009/0150060 | A1 | 6/2009 | Branyon |
| 2009/0199829 | A1 | 8/2009 | Branyon et al. |
| 2009/0250046 | A1 | 10/2009 | Scuderi |
| 2010/0012071 | A1 * | 1/2010 | Cotton ..... F01L 7/02 123/188.5 |
| 2010/0186689 | A1 | 7/2010 | Tour et al. |
| 2010/0269806 | A1 | 10/2010 | Kreuter |
| 2011/0149034 | A1 | 6/2011 | Tsukagoshi |
| 2011/0220075 | A1 * | 9/2011 | Meldolesi ..... F02B 33/22 123/70 R |
| 2012/0080017 | A1 * | 4/2012 | Phillips ..... F02B 33/22 123/70 R |
| 2012/0192841 | A1 | 8/2012 | Medolesi |
| 2012/0255296 | A1 | 10/2012 | Philips |
| 2012/0298086 | A1 | 11/2012 | Scuderi |
| 2016/0040623 | A1 | 2/2016 | Spiesberger |

FOREIGN PATENT DOCUMENTS

| | | | |
|---|---|---|---|
| FR | 2963644 A1 * | 2/2012 | ..... F01K 25/00 |
| GB | 135 571 | 11/1918 | |
| GB | 2 135 423 | 8/1984 | |
| GB | 2 469 939 | 11/2010 | |
| WO | WO-2006/099106 | 9/2006 | |
| WO | WO-2011/115868 | 9/2011 | |
| WO | WO-2012/044723 | 4/2012 | |

OTHER PUBLICATIONS

First Office Action (translation) for CN 201480050777.7, dated Sep. 27, 2017, 4 pages.
International Preliminary Report on Patentability for PCT/US14/47076, dated Jan. 19, 2016, 4 pages.
International Search Report and Written Opinion for PCT/US14/47076, dated Nov. 25, 2014, 5 pages.
International Search Report and Written Opinion for PCT/US2015/011856, dated May 11, 2015, 7 pages.
Notice of Reasons for Rejection (translation) for JP 2016-527108, dated Apr. 18, 2018 7 pages.
Notice of Reasons for Rejection (translation) for JP 2016-565121, dated May 16, 2018, 8 pages.
Supplementary European Search Report for EP 14825949.2, dated Feb. 17, 2017, 5 pages.

* cited by examiner

SPLIT CYCLE ENGINE WITH CROSSOVER SHUTTLE VALVE

CROSS-REFERENCE TO RELATED APPLICATIONS

This application is a U.S. National Stage of International Application No. PCT/IL2016/050061 filed Jan. 19, 2016 which claims priority to U.S. Provisional Application No. 62/104,885 filed Jan. 19, 2015; No. 62/138,435 filed Mar. 26, 2015; and No. 62/197,582 filed Jul. 28, 2015. The contents of these applications are incorporated herein by reference in their entirety.

FIELD OF THE INVENTION

Aspects of the invention, in some embodiments thereof, relate to split-cycle Internal Combustion Engines (ICE), and more particularly, but not exclusively, to split-cycle engines having a crossover valve regulating fluid flow between a compression chamber and an expansion chamber.

BACKGROUND OF THE INVENTION

Conventional four-stroke internal combustion engines include one or more cylinders. Each cylinder includes a single piston that performs four strokes, commonly referred to as the intake, compression, combustion/power/expansion, and exhaust strokes. Together, these four strokes form a complete cycle of the engine, carried out during two complete revolutions of the crankshaft.

In a conventional internal combustion engine, each part of the cycle is affected differently by the heat rejected from the working fluid into the piston and cylinder walls: during intake and compression a high rate of heat rejection improves efficiency whereas during combustion/expansion, little or no heat rejection leads to best efficiency. This conflicting requirement cannot be satisfied by a single cylinder since the piston and cylinder wall temperature cannot readily change from cold to hot and back to cold within each cycle. A single cylinder of a conventional internal combustion engine cannot be optimized both as a compressor (requires cold environment for optimal efficiency performance) and a combustor/expander (requires hot environment and optimal expansion of the working fluid for optimal efficiency performance) at the same time and space.

Conventional internal combustion engines have low fuel efficiency—more than one half of the fuel energy is lost as heat through the engine structure and exhaust outlet, without adding any useful mechanical work. A major cause of thermal waste in conventional internal combustion engines is the essential cooling system (e.g., radiator), which alone dissipates heat at a greater rate and quantity than the total heat actually transformed into useful work. Furthermore, conventional internal combustion engines are able to increase efficiencies only marginally by employing low heat rejection methods in the cylinders, pistons and combustion chambers and by waste-heat recovery methodologies that add substantial complexity and cost.

Further inefficiency results from high-temperature in the cylinder during the intake and compression strokes. This high temperature reduces engine volumetric efficiency and makes the piston work harder and, hence, reduces efficiency during these strokes.

Another shortcoming of conventional internal combustion engines is an incomplete chemical combustion process, which reduces efficiency and causes harmful exhaust emissions.

To address these problems, others have previously disclosed dual-piston combustion engine configurations. For example, U.S. Pat. No. 1,372,216 to Casaday discloses a dual piston combustion engine in which cylinders and pistons are arranged in respective pairs. The piston of the firing cylinder moves in advance of the piston of the compression cylinder. U.S. Pat. No. 3,880,126 to Thurston et al. discloses a two-stroke split-cycle internal combustion engine. The piston of the induction cylinder moves somewhat less than one-half stroke in advance of the piston of the power cylinder. The induction cylinder compresses a charge, and transfers the charge to the power cylinder where it is mixed with a residual charge of burned products from the previous cycle, and further compressed before igniting.

U.S. Pat. No. 6,609,371 to Scuderi discloses a four-stroke cycle internal combustion engine. A power piston within a first cylinder (power cylinder) is connected to a crankshaft and performs power and exhaust strokes of the four-stroke cycle. A compression piston within a second cylinder (compression cylinder) is also connected to the crankshaft and performs the intake and compression strokes of a four-stroke cycle during the same rotation of the crankshaft. The power piston of the first cylinder moves in advance of the compression piston of the second cylinder. U.S. Pat. No. 6,880,501 to Suh et al. discloses an internal combustion engine that has a pair of cylinders, each cylinder containing a piston connected to a crankshaft. One cylinder is adapted for intake and compression strokes. The other cylinder is adapted for power and exhaust strokes. U.S. Pat. No. 5,546,897 to Brackett discloses a multi-cylinder reciprocating piston internal combustion engine divided into a working section and a compressor section. The working section supports the combustion function and the compressor is dedicated solely to infusion of intake charge into the working section.

U.S. Pat. No. 8,584,629 to Tour et al., incorporated herein as reference in its entirety, discloses a two-cylinder, double piston combustion engine with an interstage valve for fluidly coupling the two cylinders. In one embodiment the internal volume of the compression cylinder is smaller than the internal volume of the expansion cylinder, thus enabling additional conversion of heat and pressure to mechanical work. In another embodiment the internal volume of the compression cylinder is larger than the internal volume of the expansion cylinder, thereby allowing for a greater amount and/or higher pressure of fuel mixture (i.e., "supercharged" fuel mixture) to be injected into the combustion chamber and, hence, provide more energy and work, during the expansion stroke.

SUMMARY OF THE INVENTION

Aspects of the invention, in some embodiments thereof, relate to split-cycle Internal Combustion Engines (ICE). More specifically, aspects of the invention, in some embodiments thereof, relate to a to bi-directional fluid flow split-cycle engine.

Aspects of the invention, in some embodiments thereof, relate to split-cycle Internal Combustion Engines (ICE). More specifically, aspects of the invention, in some embodiments thereof, relate to split-cycle engines having a single crossover valve that regulates flow between a compression chamber and a combustion chamber and between the combustion chamber and an expansion chamber.

The references described above fail to disclose how to effectively govern the transfer of the working fluid in a timely manner and without pressure loss from the compression cylinder to the power cylinder, using a valve system that is durable with high level of sealing. In addition, the separate cylinders disclosed in these references are typically connected by a transfer valve or intermediate passageway (connecting tube) of some sort that yields a substantial volume of "dead space" between cylinders, reducing the engine efficiency. PCT application publication number WO2015009959 to Tour et al., incorporated herein as reference in its entirety, discloses a split-cycle engine which includes: a first cylinder housing a first piston performing an intake stroke and a compression stroke, but not an exhaust stroke, a second cylinder housing a second piston performing an expansion stroke and an exhaust stroke, but not an intake stroke, and a valve cylinder housing a valve. The valve comprises an internal chamber that selectively fluidly couples to the first and second cylinders, wherein the valve and internal chamber move inearly and reciprocally within the valve cylinder and relative to the first and second cylinders, and wherein the valve has a port that fluidly couples the internal chamber to the first and second cylinders simultaneously. In view of disadvantages inherent in known types of internal combustion engine now present in the prior art, embodiments described herein include a split-cycle internal combustion engine comprising a compression chamber, a combustion chamber and an expansion chamber, and a crossover valve that consecutively fluidly couples the compression chamber with the combustion chamber and the combustion chamber with the expansion chamber. The crossover valve has a cylinder and a shuttle configured to slide inside the cylinder in a reciprocating motion wherein sealing rings positioned between the cylinder and the shuttle, prevent gas leaks between them during the reciprocating motion. Some exemplary embodiments utilize a novel sleeve shuttle crossover valve for facilitating the efficient and reliable transfer of working fluid from the compression chamber to the combustion chamber and from the combustion chamber to the expansion chamber. Although sleeve shuttle crossover valves are used, in some examples herein, to demonstrate some benefits of the embodiments, it should be realized that the claims may not be limited to a sleeve shuttle valve and may include other valves, particularly other cylindrical sliding valves with sealing rings for sealing against high-pressure leaks. The engine may utilize temperature differentiated cylinders (e.g. the compression chamber and the expansion chamber) thus enabling converting fuel energy into mechanical work more efficiently than conventional internal combustion engines.

In an exemplary embodiment, a split-cycle internal combustion engine (ICE) comprises a compression cylinder housing a compression piston, the compression piston being configured to perform an intake stroke and a compression stroke, but not perform an exhaust stroke. The split-cycle ICE further comprises an expansion cylinder housing an expansion piston, the expansion piston being configured to perform an expansion stroke and an exhaust stroke, but not perform an intake stroke. The compression chamber and the expansion chamber are defined between the compression cylinder and the compression piston, and between the expansion cylinder and the expansion piston, respectively. The split-cycle ICE further comprises a valve cylinder housing a shuttle configured to perform reciprocating motion synchronously with the pistons, and a combustion chamber structure defining a combustion chamber therein, fixed inside the valve cylinder. The valve moves within the valve cylinder relative to the combustion chamber, thereby intermittently fluidly coupling the compression chamber with the combustion chamber and intermittently fluidly coupling the expansion chamber with the combustion chamber.

According to some embodiments the valve comprises a first port, a second port and a cylindrical sleeve having at least one sleeve port. The cylindrical sleeve is dimensioned and configured to slide in a reciprocating motion along the valve cylinder, thereby coupling the compression chamber with the combustion chamber via the first port and the sleeve port and the expansion chamber with the combustion chamber, via the second port and the sleeve port.

According to some embodiments the combustion chamber structure may define a combustion chamber having a spherical or an oval shape or a circular or oval cross-section. According to some embodiments the combustion chamber structure may have an external cylindrical shape dimensioned to fit inside the cylindrical sleeve, so that the cylindrical sleeve may slide along the valve cylinder between an internal surface of the valve cylinder and an external surface of the combustion chamber structure. According to some embodiments the cylindrical sleeve is dimensioned and configured to slide along the valve cylinder, maintaining high pressure sealing between the valve cylinder and the cylindrical sleeve and between the cylindrical sleeve and the combustion chamber structure. Maintaining sealing here means effective prevention or reduction (posing resistance) to lateral flow of a fluid along the cylinders between the valve cylinder and the cylindrical sleeve and between the cylindrical sleeve and the combustion chamber structure. In some exemplary embodiments, sealing rings, substantially similar to sealing rings between a piston and a cylinder in a conventional ICE, are used for maintaining high pressure sealing.

According to some embodiments the compression cylinder and the expansion cylinder are arranged in an in-line configuration, side-by-side, and the valve cylinder is arranged on top and perpendicular to both cylinders. The compression piston and the expansion piston may be connected e.g. via connecting rods to a same crankshaft. According to some embodiments the compression cylinder and the expansion cylinder are arranged in an opposed configuration, and the valve cylinder is arranged perpendicular to both cylinders, between the cylinders. The compression piston and the expansion piston may be connected to two different crankshafts, the crankshafts being mechanically associated e.g. through a gear mechanism so as to revolve synchronously with each other.

According to some embodiments, the split-cycle engine further comprises a piston phase transmission gear allowing for controllably setting a phase shift between the first piston and the second piston during engine operation. According to some embodiments the piston phase transmission gear comprises an open differential. According to some embodiments the piston phase transmission gear comprises first axle, a second axle revolving synchronously with the first axle and a control shaft configured to set and to vary a phase shift between the first axle and the second axle. According to some embodiments, the piston phase transmission gear may be employed to set a zero phase shift between the compression piston and the expansion piston, or to advance the compression piston relative to the expansion piston by a controllable phase shift, or to retard the compression piston relative to the expansion piston by a controllable phase shift. According to some embodiments, phase shifting between the pitons using the piston phase transmission gear may be employed during the normal operation of the engine. According to some embodiments the engine's cycle may comprise:

- An intake stroke, wherein a working fluid such as air-fuel charge, flows, or is forced into, the compression cylinder, optionally through an open intake port (or through an intake valve) of the compression cylinder.
- A compression stroke, wherein the intake port is closed and the compression piston compresses the working fluid into the combustion chamber through a first valve port that fluidly couples the compression cylinder and the combustion chamber.
- Combustion of the working fluid in the combustion chamber. The engine may be configured and operated so as to activate the combustion when the combustion chamber is fluidly coupled to either one of the compression cylinder and the expansion cylinder, or to both cylinders, or when the combustion chamber is fluidly sealed.
- An expansion stroke, wherein a valve fluidly couples the combustion chamber with the expansion cylinder via a second valve port, and the high-pressure combusted fluid thrusts the expansion piston.
- An exhaust stroke, wherein the valve fluidly decouples the combustion chamber from the expansion cylinder and the burnt gases are exhaled through an open exhaust port (or through an exhaust valve) of the expansion cylinder.

According to some embodiments, an intake stroke and a compression stroke are carried out concurrently, or roughly concurrently, with an expansion stroke and an exhaust stroke, respectively.

According so some embodiments, a single valve is employed to open and close the intake port, the exhaust port, and to allow or prevent fluid communication between the compression chamber and the combustion chamber, and between the combustion chamber and the expansion chamber. According so some embodiments, a first valve, e.g. a poppet valve, is employed to open and close the intake port, a second valve, also, for example, a poppet valve, may be used to open and close the exhaust port, and yet a third valve to allow or prevent the fluid communication between the compression chamber and the combustion chamber, and between the combustion chamber and the expansion chamber.

According to some embodiments the compression chamber has a different maximum volume from the maximum volume of the expansion chamber. According to some embodiments the split-cycle ICE utilizes a different compression ratio than an expansion ratio. In some known examples of ICEs, in order to increase fuel efficiency, the compression cylinder is of smaller internal volume than the expansion cylinder. In other known examples, in order to increase the power output of the engine, the compression cylinder is of greater internal volume than the expansion cylinder. A compression cylinder smaller than the expansion cylinder results in less fuel being consumed per unit work, and hence higher fuel efficiency, but also results in lower power output. According to such examples, an engine may thus be either fuel efficient or it may have high power output, but it cannot provide both.

In view of the foregoing disadvantages inherent in the known types of internal combustion engines now present in the prior art, embodiments described herein include a bi-directional fluid flow split-cycle internal combustion engine which has at least a first cylinder housing a first piston and a second cylinder housing a second piston, the engine affording two modes of operation: a first mode in which working fluid flows from the first cylinder to the second cylinder, and a second mode in which working fluid flows from the second cylinder to the first cylinder. In the first mode the first cylinder serves for the intake and compression strokes and the second cylinder serves for the expansion and exhaust strokes, an in the second mode the second cylinder serves for the intake and compression strokes and the first cylinder serves for the expansion and exhaust strokes. The two modes of operation can be changed from one to the other during operation of the engine. In some embodiments, the first cylinder is smaller than the second cylinder. The engine may then be more fuel efficient in the first mode than in the second mode, and may provide more power in the second mode than in the first mode.

Thus, according to an aspect of some embodiments, there is provided a bi-directional fluid flow split-cycle internal combustion engine (ICE) comprising a first cylinder housing a first piston, defining a first chamber therebetween, and a second cylinder housing a second piston, defining a second chamber therebetween. The engine also comprises at least one movable valve, operating, during the first mode of operation and during the second mode of operation, synchronously with the first and second pistons, thereby regulating fluid flow between the first and second chambers. The split-cycle engine further comprises a phase shifting module controlling the movable valve by controllably setting a phase shift between the movable valve and the first piston (and therefore, between the movable valve and the second piston), such that for a first phase shift value, the engine is in the first mode, and for a second phase shift value, the engine is in the second mode. In some embodiments, the pistons may move synchronously with one another yet out phase relative to one another.

According to some embodiments the split-cycle bi-directional engine further comprises a combustion chamber structure defining a combustion chamber therein, and the valve intermittently fluidly couples the first chamber to the combustion chamber and intermittently fluidly couples the second chamber to the combustion chamber, thereby regulating fluid flow between the first chamber and the second chamber. In the first mode unexploited working fluid flows into the first cylinder during the intake stroke and is compressed into the combustion chamber during the compression stroke. Burnt fuel gas expands from the combustion chamber into the second cylinder during the expansion stroke, and exhausts from the second cylinder during the exhaust stroke. In the second mode unexploited working fluid flows into the second cylinder wherein only intake and compression strokes are performed, and burnt fuel gas exhausts from the first cylinder wherein only expansion and exhaust strokes are performed.

According to some embodiments the split-cycle bi-directional engine further comprises a valve cylinder housing shuttle, wherein the combustion chamber structure is inside the valve cylinder, and the shuttle moves reciprocally within the valve cylinder, and relative to the first and second cylinders, to intermittently fluidly couple the first chamber to the combustion chamber and intermittently fluidly couple the second chamber to the combustion chamber.

According to some embodiments the shuttle comprises the combustion chamber structure, so that the combustion chamber structure moves reciprocally within the valve cylinder, relative to the first and second cylinders. According to some embodiments the combustion chamber structure is fixed inside the valve cylinder, and the shuttle moves within the valve cylinder relative to the combustion chamber structure and relative to the first and second cylinders, thereby intermittently fluidly coupling the first chamber with the combustion chamber and intermittently fluidly coupling the second chamber with the combustion chamber.

According to some embodiments, the valve comprises a cylindrical sleeve with a sleeve port, and the combustion chamber structure has an external cylindrical shape dimensioned to fit inside the cylindrical sleeve. The cylindrical sleeve is dimensioned and configured to slide in a reciprocating motion along the valve cylinder between the valve cylinder and the combustion chamber structure. High-pressure sealing between the cylindrical sleeve, the combustion chamber structure and the valve cylinder is maintained using sealing rings, respectively, as explained above. According to some embodiments the phase shifting module comprises a phase shifting transmission gear. According to some embodiments the phase shifting transmission gear comprises an open differential. According to some embodiments the phase shifting transmission gear comprises an input axle, an output axle revolving synchronously with the input axle and a control shaft configured to set and to vary a phase shift between the input axle and the output axle.

According to some embodiments the first cylinder is smaller than the second cylinder, that is to say, the maximum internal volume of the first chamber is smaller than the maximum internal volume of the second chamber. According to some embodiments the bi-directional engine further comprises an auxiliary combustion chamber fluidly connectable, through an auxiliary valve, to the combustion chamber. According to some embodiments, in the first mode of operation of the engine, the auxiliary combustion chamber is disconnected from the combustion chamber by the auxiliary valve, and therefore out of use. In the second mode of operation, where the compression chamber is larger than in the first mode, the auxiliary combustion chamber is fluidly connected to the combustion chamber by the auxiliary valve, thereby increasing the total volume wherein combustion occurs, and thereby accommodating combustion of higher volume of working fluid while maintaining the compression ratio below a suitable value.

According to some embodiments, the split-cycle bi directional engine further comprises a piston phase transmission gear allowing for controllably setting a phase shift between the first piston and the second piston during engine operation.

According to some embodiments, wherein the first cylinder is smaller than the second cylinder, and wherein the movable valve is dimensioned and configured to simultaneously couple the first chamber and the second chamber with the combustion chamber, the piston phase transmission gear may be employed to set a zero phase shift between the pistons during the first mode of operation, and to retard the second piston relative to the first piston during the second mode of operation. Thus, during the second mode of operation, combustion may be initiated when the ascent velocity of the second piston, while effecting a compression stroke, is equal to the descent velocity of the first piston, while effecting an expansion stroke. Thus, in the second mode of operation the effective volume wherein combustion occurs is increased, and combustion of higher volume of working fluid is accommodated while maintaining the compression ratio below a suitable value.

According to some embodiments, the engine is more fuel efficient in the first mode than in the second mode, and provides more power in the second mode than in the first mode. According to some embodiments in the first mode the engine's cycle may comprise:

An intake stroke, wherein a working fluid such as air-fuel charge, flows, or is forced into, the first cylinder, optionally through the first port.

A compression stroke, wherein the first port is closed and the first piston compresses the working fluid into the combustion chamber through the second port and a valve port that fluidly couples the first cylinder to the combustion chamber.

Combustion of the working fluid in the combustion chamber. The engine may be configured and operated so as to initiate combustion when the combustion chamber is fluidly coupled to either one of the first cylinder and second cylinder, or to both cylinders, or when the combustion chamber is fluidly disconnected from both cylinders.

An expansion stroke, wherein the third port fluidly couples the combustion chamber to the second cylinder via the valve port, and the high-pressure combusted fluid thrusts the second piston.

An exhaust stroke, wherein the valve fluidly decouples the combustion chamber from the second cylinder and the burnt gases are exhaled through the fourth port.

In the second mode the engine's cycle may comprise:

An intake stroke, wherein a working fluid such as air-fuel charge, flows, or is forced into, the second cylinder through the fourth port.

A compression stroke, wherein the fourth port is closed and the second piston compresses the working fluid into the combustion chamber through the third port and the valve port.

Combustion of the working fluid in the combustion chamber. The engine may be configured and operated so as to initiate combustion when the combustion chamber is fluidly coupled to either one of the first cylinder and second cylinder, or to both cylinders, or when the combustion chamber is fluidly sealed.

An expansion stroke, wherein the second port fluidly couples the combustion chamber to the first cylinder via the valve port, and the high-pressure combusted fluid thrusts the first piston.

An exhaust stroke, wherein the valve fluidly decouples the combustion chamber from the first cylinder and the burnt gases are exhaled through the first port.

This invention separately provides a split cycle ICE having a compression cylinder, an expansion cylinder and a combustion chamber, wherein a single crossover valve alternatingly and selectively fluidly associates and disassociates the compression cylinder and the expansion cylinder with the combustion chamber.

This invention separately provides a split cycle ICE having a compression cylinder, an expansion cylinder and a combustion chamber, wherein a single crossover valve regulates the flow of compressed working fluid from the compression cylinder to the combustion chamber, and the flow of burnt gas from the combustion chamber to the expansion cylinder.

This invention separately provides a split cycle ICE having a compression cylinder, an expansion cylinder, a combustion chamber and a single crossover valve comprising a shuttle sliding back and forth within a cylinder, and sealing rings between the shuttle and the cylinder.

This invention separately provides a split cycle ICE having a compression chamber defined between a compression piston and a compression cylinder, an expansion chamber defined between an expansion piston and an expansion cylinder, a combustion chamber and a single crossover valve comprising a shuttle that moves synchronously with the compression piston and the expansion piston.

This invention separately provides a split cycle ICE having a compression piston, an expansion piston and a single crossover valve comprising a shuttle and a phase shifting module that can accelerate or decelerate the shuttle' motion relative to the piston's motion.

This invention separately provides a split cycle ICE having a compression piston, an expansion piston, a single crossover valve and a phase shifting module that can accelerate or decelerate the compression piston relative to the expansion piston (or vice versa).

This invention separately provides a split cycle ICE capable for two modes of operation and having a first cylinder, a second cylinder and a combustion chamber, wherein a single crossover valve regulates the flow of compressed working fluid in the first mode of operation from the first cylinder to the combustion chamber, and the flow of burnt gas from the combustion chamber to the second cylinder, and in the second mode the flow of compressed working fluid from the second cylinder to the combustion chamber, and the flow of burnt gas from the combustion chamber to the first cylinder.

This invention separately provides a split cycle ICE in which a working fluid from one compression cylinder is used in two or more expansion cylinders, alternatingly.

This invention separately provides a split cycle ICE in which a working fluid from one compression cylinder is distributed alternatingly to two or more expansion cylinders using a sleeve shuttle valve.

This invention separately provides a 3-cylinders split cycle ICE having two expansion chambers, each chamber defined between a piston moving reciprocally and a respective cylinder, each piston performing one expansion stroke and one exhaust stroke in every cycle of the piston.

This invention separately provides a split cycle ICE having a sleeve shuttle valve for distribution of a working fluid from a compression chamber to two or more expansion chambers, which is more compact and/or more light-weight than split-cycle ICE's having a sleeve shuttle and providing a same power, or force, or moment, known in the art.

Certain embodiments of the present invention may include some, all, or none of the above advantages. Further advantages may be readily apparent to those skilled in the art from the figures, descriptions, and claims included herein. Aspects and embodiments of the invention are further described in the specification hereinbelow and in the appended claims.

Unless otherwise defined, all technical and scientific terms used herein have the same meaning as commonly understood by one of ordinary skill in the art to which this invention pertains. In case of conflict, the patent specification, including definitions, governs. As used herein, the indefinite articles "a" and "an" mean "at least one" or "one or more" unless the context clearly dictates otherwise.

BRIEF DESCRIPTION OF THE FIGURES

Some embodiments of the invention are described herein with reference to the accompanying figures. The description, together with the figures, makes apparent to a person having ordinary skill in the art how some embodiments may be practiced. The figures are for the purpose of illustrative description and no attempt is made to show structural details of an embodiment in more detail than is necessary for a fundamental understanding of the invention. For the sake of clarity, some objects depicted in the figures are not to scale.

In the Figures.

DETAILED DESCRIPTION OF SOME EMBODIMENTS

Figure 1:
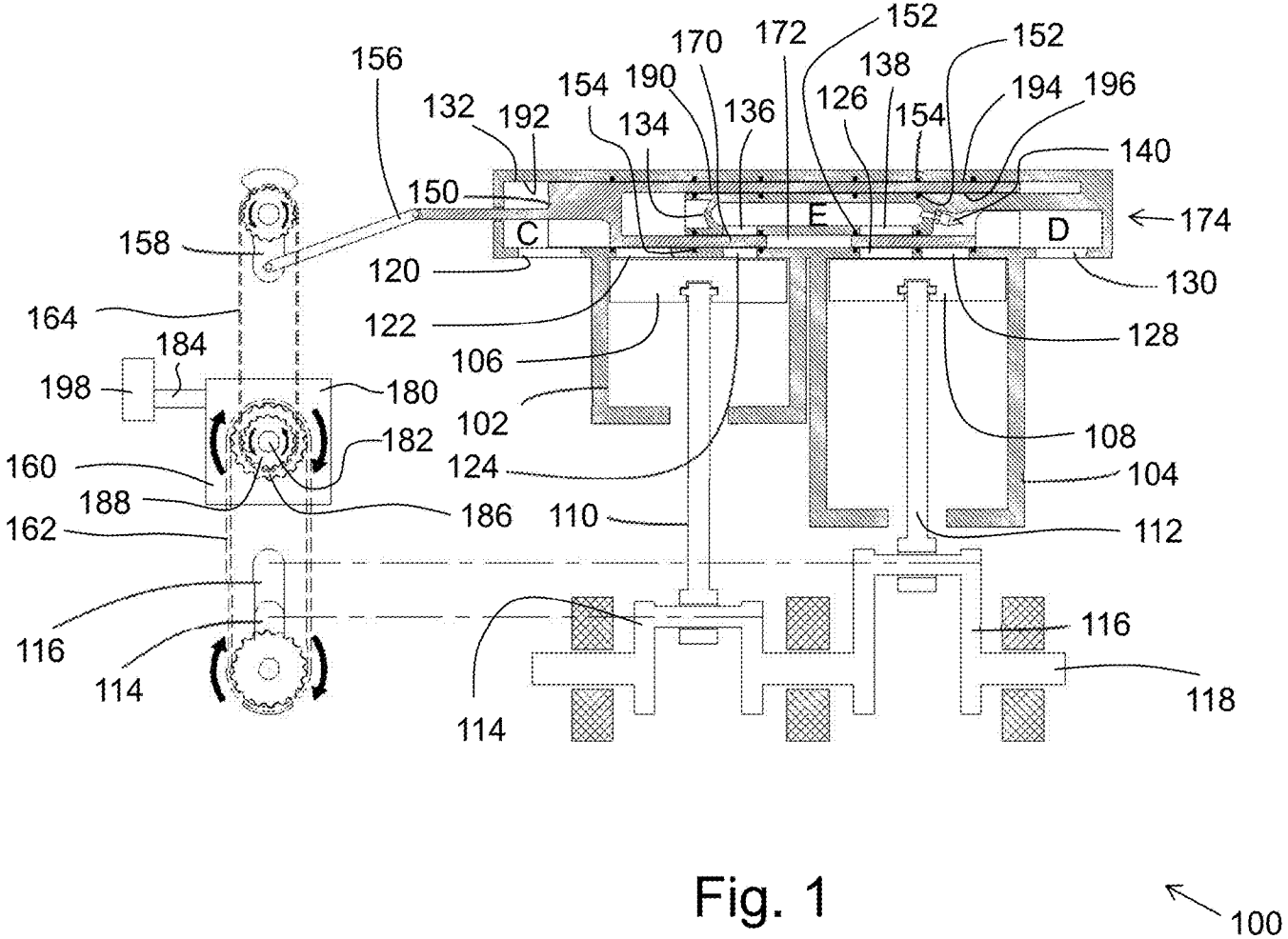
FIG. 1 schematically depicts a cross-sectional side view of a bi-directional fluid flow split-cycle engine, in accordance with exemplary embodiments, in a first mode of operation. The pistons are illustrated at their respective Top Dead Center (TDC) points. A movable valve comprises a sleeve shuttle illustrated at crankshaft 90 degrees before its TDC point.
Figure 2:
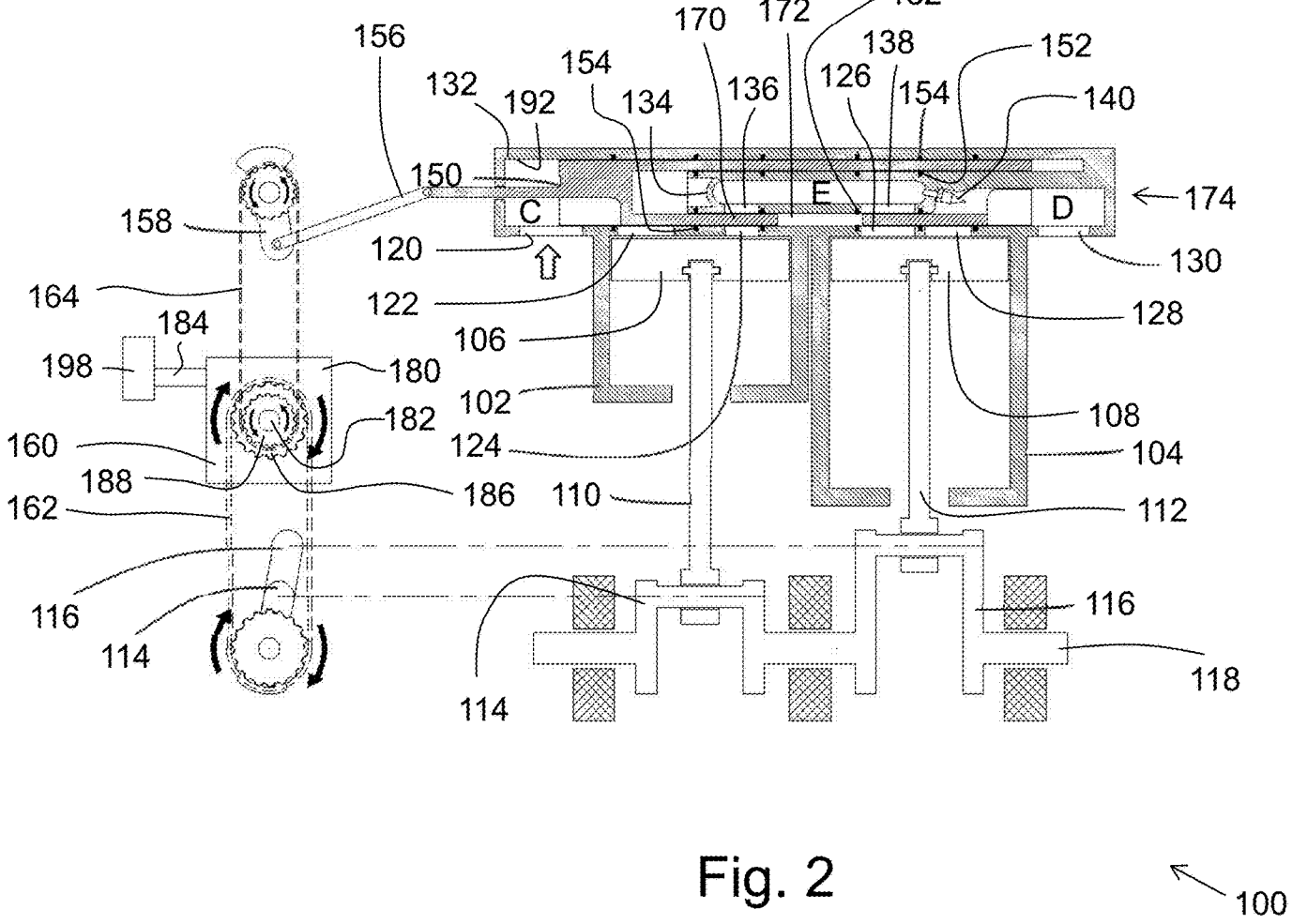
FIG. 2 schematically depicts the engine of FIG. 1 in the first mode of operation. The pistons are illustrated at 10 crankshaft degrees after their respective TDC points, and the sleeve shuttle is illustrated at 80 crankshaft degrees before its TDC point.
Figure 3:
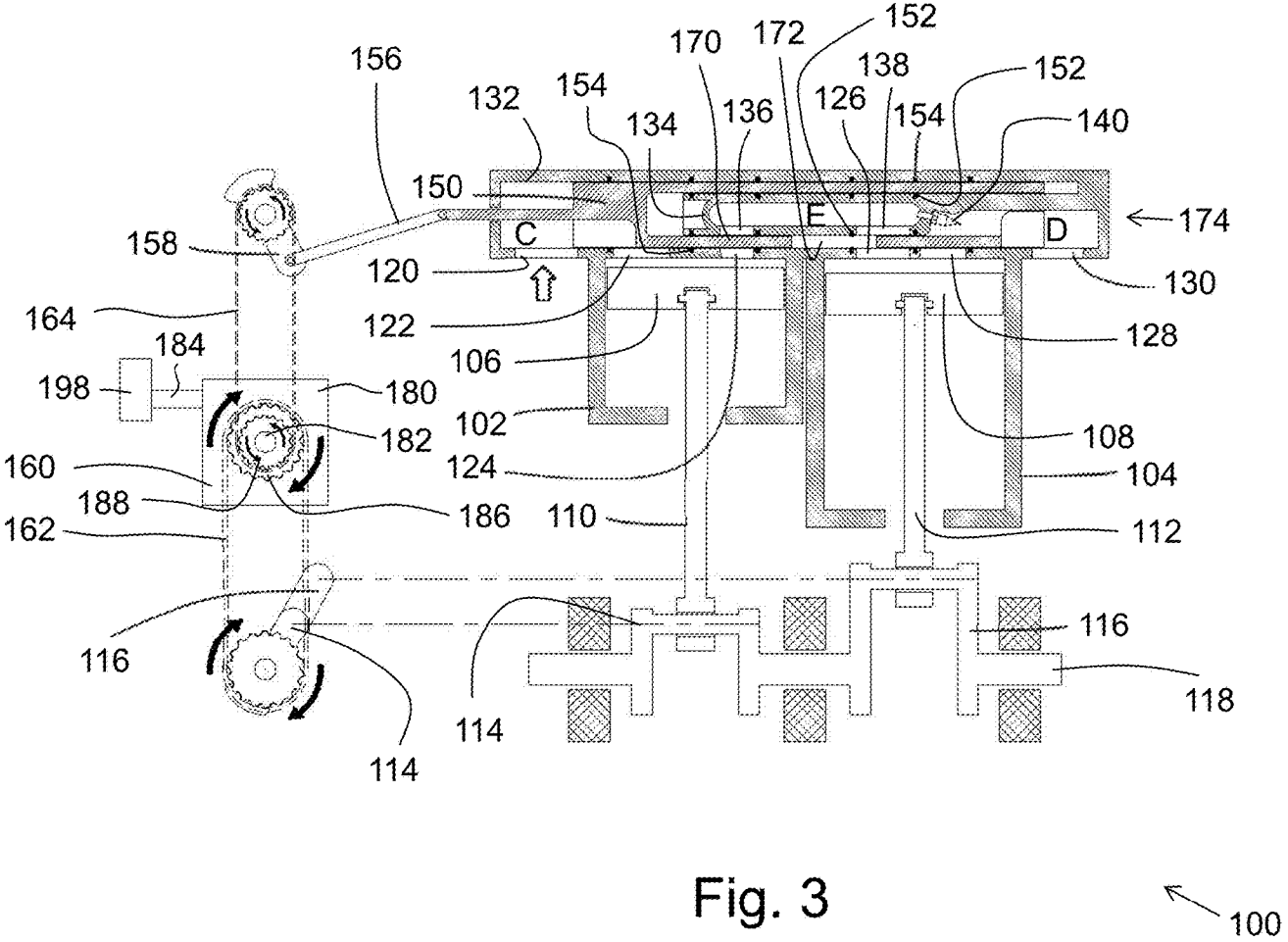
FIG. 3 schematically depicts the engine of FIG. 1 in the first mode of operation. The pistons are illustrated at 30 crankshaft degrees after their respective TDC points, and the sleeve shuttle is illustrated at 60 crankshaft degrees before its TDC point.
Figure 4:
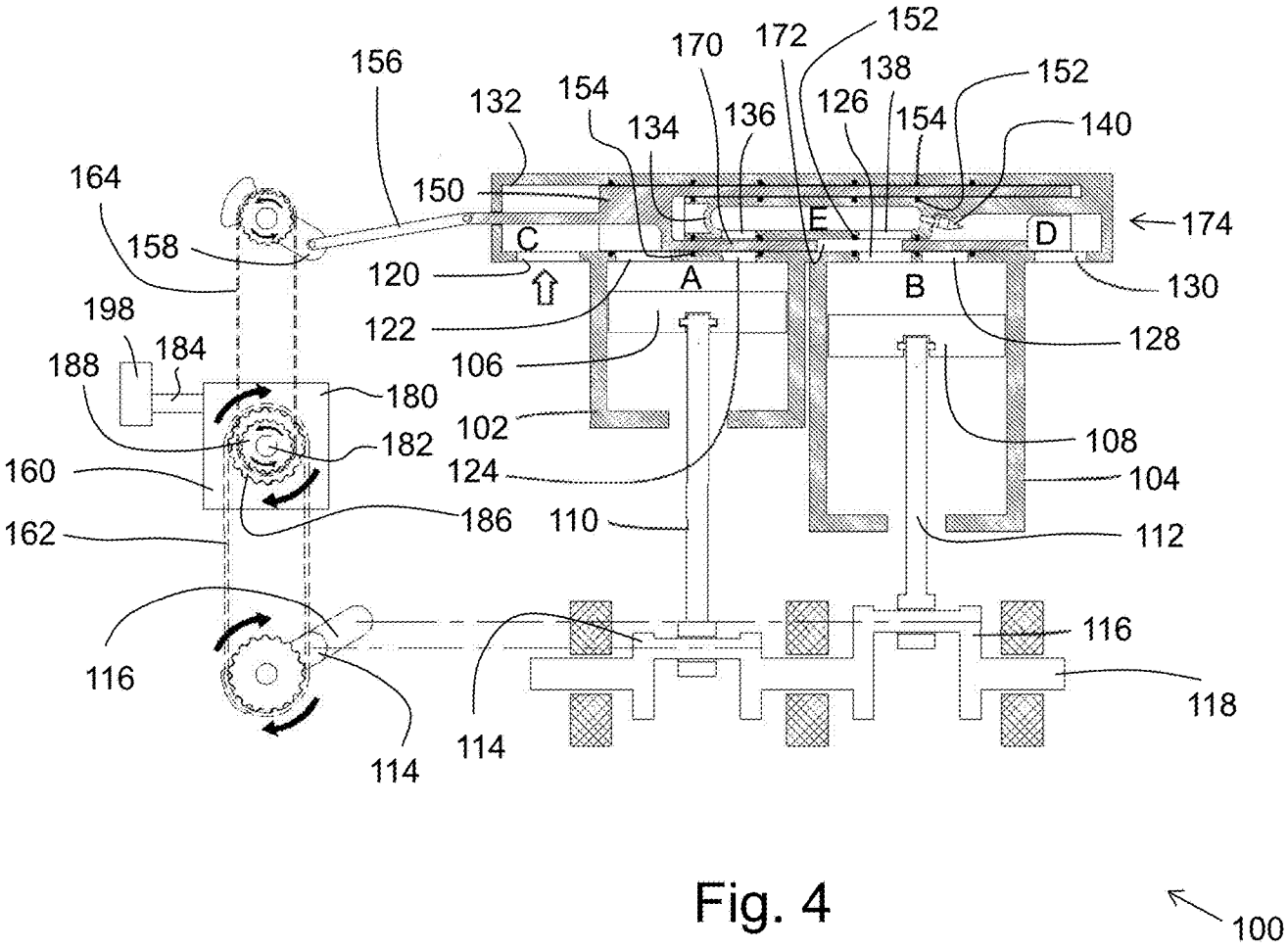
FIG. 4 schematically depicts the engine of FIG. 1 in the first mode of operation. The pistons are illustrated at 60 crankshaft degrees after their respective TDC points, and the sleeve shuttle is illustrated at 30 crankshaft degrees before its TDC point.
Figure 5:
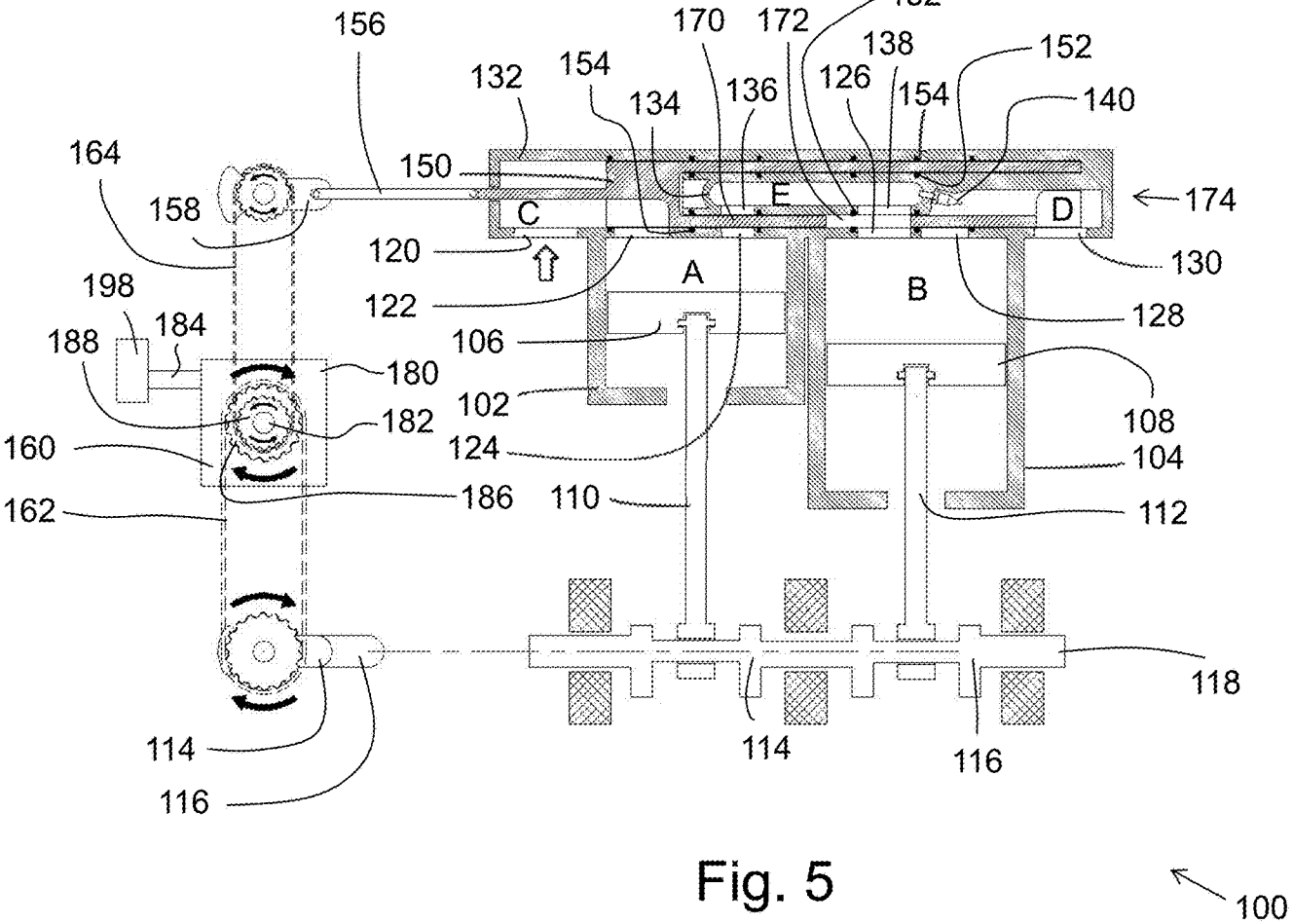
FIG. 5 schematically depicts the engine of FIG. 1 in the first mode of operation. The pistons are illustrated at 90 crankshaft degrees after their respective TDC points, and the sleeve shuttle is illustrated at its TDC point.
Figure 6:
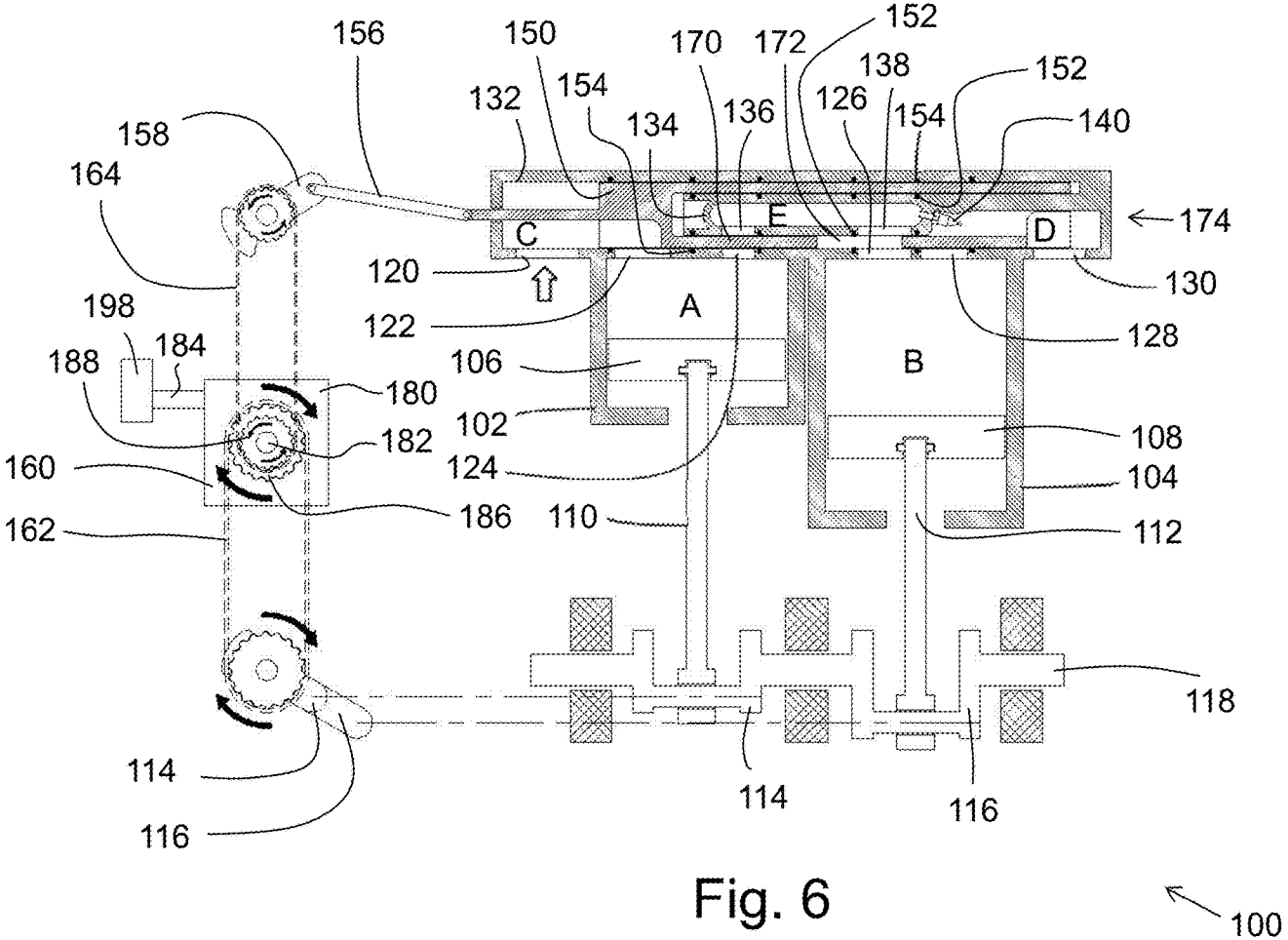
FIG. 6 schematically depicts the engine of FIG. 1 in the first mode of operation. The pistons are illustrated at 120 crankshaft degrees after their respective TDC points, and the sleeve shuttle is illustrated at 30 crankshaft degrees after its TDC point.
Figure 7:
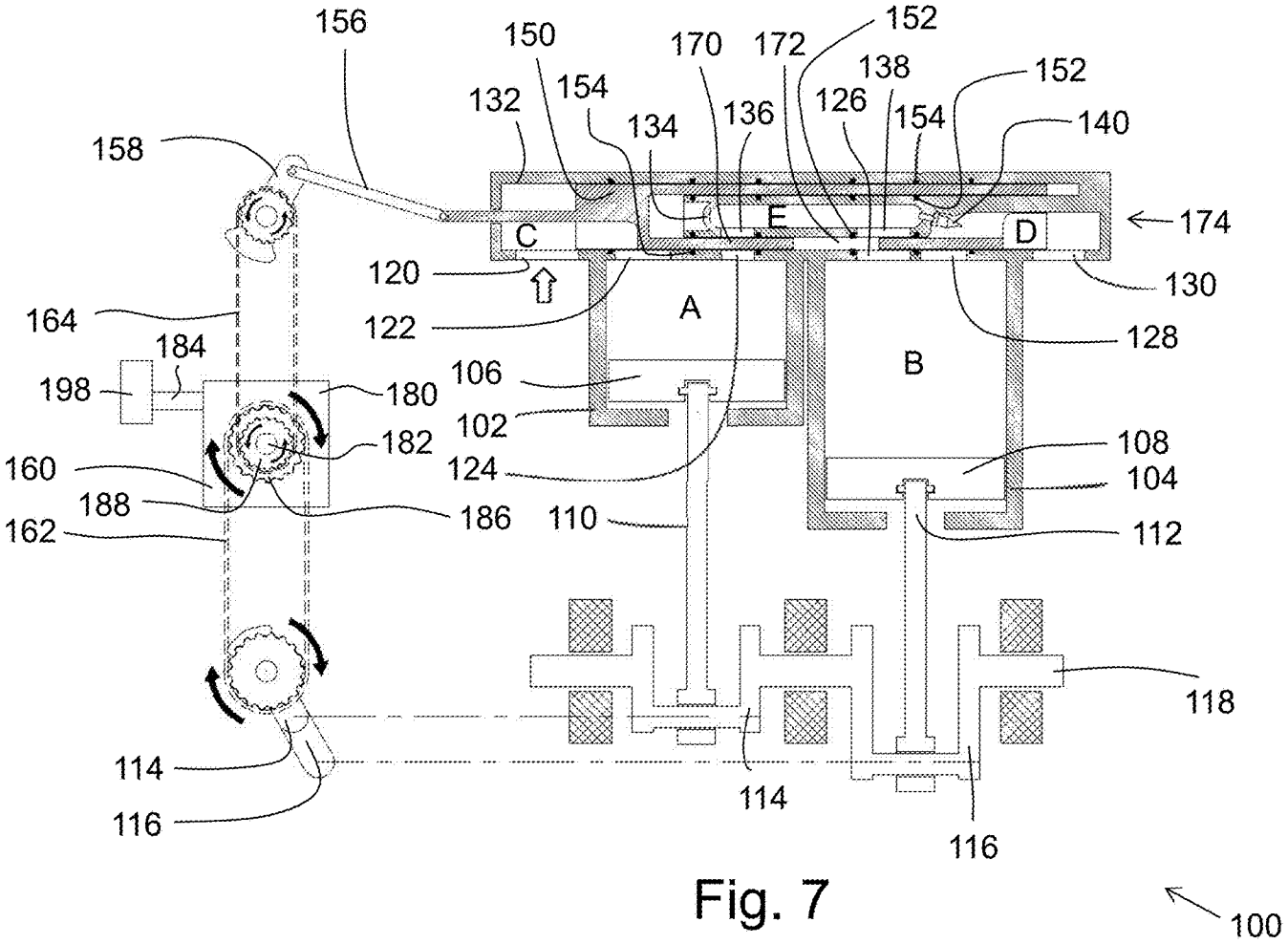
FIG. 7 schematically depicts the engine of FIG. 1 in the first mode of operation. The pistons are illustrated at 150 crankshaft degrees after their respective TDC points, and the sleeve shuttle is illustrated at 60 crankshaft degrees after its TDC point.
Figure 8:
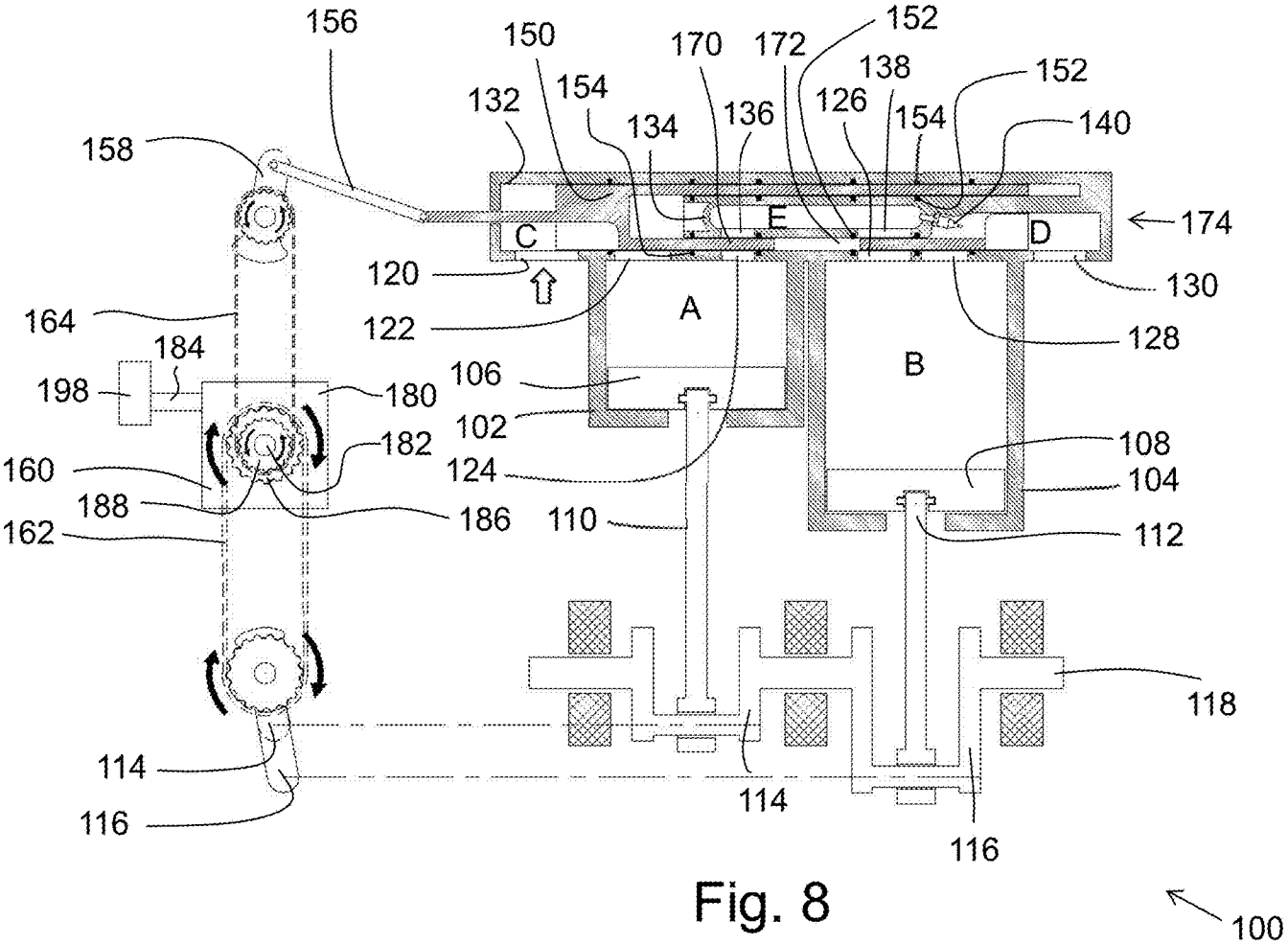
FIG. 8 schematically depicts the engine of FIG. 1 in the first mode of operation. The pistons are illustrated at 170 crankshaft degrees after their respective TDC points, and the sleeve shuttle is illustrated at 80 crankshaft degrees after its TDC point.

The principles, uses and implementations of the teachings herein may be better understood with reference to the accompanying description and figures. Upon perusal of the description and figures present herein, one skilled in the art is able to implement the teachings herein without undue effort or experimentation. In the figures, like reference numerals refer to like parts throughout.

In-Line Configuration of a Split-Cycle Engine

Referring to FIGS. 1-17, in accordance with one embodiment, an in-line configuration of a split-cycle engine 100 includes: a first cylinder 102, a second cylinder 104, a first piston 106, a second piston 108, a first chamber A defined between first cylinder 102 and first piston 106 (shown in FIGS. 4-14, 20-30, 36-46, 52-62), and a second chamber B defined between second cylinder 104 and second piston 108 (shown in FIGS. 4-14, 20-30, 36-46, 52-62). The split-cycle engine also includes a first piston connecting rod 110, a second piston connecting rod 112, a first crankshaft 114, a second crankshaft 116, and an engine power shaft 118. The split-cycle engine also includes a first manifold 120, chamber C, a first port 122, which, when open, fluidly connects chamber A and chamber C, a second port 124, a third port 126, chamber D, a fourth port 128, which, when open, fluidly connects chamber B and chamber D, and a second manifold 130.

The split-cycle engine 100 also includes a sleeve cylinder 132, a combustion chamber structure 134 fixed within sleeve cylinder 132 and defining chamber E therein, a first combustion chamber port 136 and a second combustion chamber port 138. In some embodiments engine 100 includes a spark plug 140, which is positioned in combustion chamber structure 134 and configured to ignite a spark within chamber E. The split-cycle engine also includes a sleeve shuttle 150, chamber sealing rings 152 mounted in annular grooves on an external surface 190 of combustion chamber structure 134, cylinder sealing rings 154 mounted in annular grooves on an internal surface 192 of sleeve cylinder 132, a sleeve connecting rod 156, and a sleeve crankshaft 158.

First connecting rod 110 connects first crankshaft 114 with first piston 106, and is configured to convert first crankshaft 114 rotation to first piston 106 reciprocating motion in first cylinder 102, and first piston 106 reciprocating motion to first crankshaft rotation. Second connecting rod 112 connects second crankshaft 116 with second piston 108, and is configured to convert second crankshaft 116 rotation to first piston 108 reciprocating motion in second cylinder 104, and second piston 108 reciprocating motion to second crankshaft 116 rotation. Engine power shaft 118 is connected with first crankshaft 114 and with second crankshaft 116 and rotates synchronously with them.

Sleeve cylinder 132 houses sleeve shuttle 150 and both are placed on top of, and perpendicular to, both first cylinder 102 and second cylinder 104. Sleeve connecting rod 156 connects sleeve shuttle 150 to sleeve crankshaft 158. Sleeve crankshaft 158 converts rotational motion into sleeve shuttle 150 reciprocating motion. In other exemplary embodiments, a swash plate mechanism or a camshaft mechanism (not shown in the Figures) could be used to drive sleeve shuttle 150.

Engine power shaft 118 is mechanically associated with sleeve crankshaft 158 via an optional phase shifting module 160. A first timing belt 162 connects engine power shaft 118 with phase shifting module 160 possibly through gear wheels or a gear train (not exemplified in these figures). A second timing belt 164 connects phase shifting module 160, possibly through gear wheels or a gear train (not exemplified in the figures), with sleeve crankshaft 158. During operation of engine 100 according to some embodiments, engine power shaft 118 and sleeve crankshaft 158 may revolve synchronously, phase shifting module 160 maintaining a fixed phase shift between the reciprocal motion of first piston 106 (which moves synchronously with second piston 108) and the reciprocal motion of sleeve shuttle 150. According to some embodiments, a fixed, unvaried phase shift is maintained between the rotational motion of engine power shaft 118 and the rotational motion of sleeve crankshaft 158. According to some such embodiments, the rotational motion of engine power shaft 118 is transferred to sleeve crankshaft 158 by a single timing belt or by any other suitable connecting mechanism as known in the art such as gear wheels or a gear train (not exemplified in this Figure). FIGS. 1-17 schematically exemplify the operation of engine 100 with a fixed and unvaried phase shift between engine power shaft 118 and sleeve crankshaft 158. According to other embodiments phase shifting module 160 is used to controllably vary the phase shift between the rotations of engine power shaft 118 and sleeve crankshaft 158 and hence between the reciprocal motions of first piston 106 and sleeve shuttle 150, as is further detailed and explained below.

First cylinder 102 is a piston engine cylinder that houses first piston 106. First cylinder 102 and first piston 106 define chamber A. First cylinder 102 also comprises first port 122 and second port 124. Second cylinder 104 is a piston engine cylinder that houses second piston 108. Second cylinder 104 and second piston 108 define chamber B. Second cylinder 104 also comprises third port 126 and fourth port 128. During operation first piston 106 may move in a reciprocating manner relative to first cylinder 102 in the upward and downward directions, toward its Top Dead Center (TDC) point and Bottom Dead Center (BDC) point, thereby, respectively, decreasing and increasing the volume of chamber A. During operation second piston 108 may move in a reciprocating manner relative to second cylinder 104 in the upward and downward directions, toward its TDC point and BDC point, thereby, respectively, decreasing and increasing the volume of chamber B. First piston 106 and second piston 108 move in phase, that is to say, at any instant of time both move in the same direction and therefore simultaneously reach their respective TDC positions, and their respective BDC positions. First piston 106 and second piston 108 may have or may not have irregular structure or protrusions (not shown in these Figures), to decrease the dead space when the pistons are at their respective TDC point.

Sleeve shuttle 150 comprises a cylindrical sleeve 170 dimensioned and configured to slide inside sleeve cylinder 132, between chamber sealing rings 152 and cylinder sealing rings 154, in a reciprocating motion. It is noted that chamber sealing rings 152 may typically comprise extracting, or expanding, sealing rings, whereas cylinder sealing rings 154 may typically comprise contracting sealing rings. It is further noted that additional or alternative techniques to sealing rings are contemplated within the scope of the invention for sealing high pressure gas leaks between the valve cylinder and the cylindrical sleeve, and between the cylindrical sleeve and the combustion chamber structure during sleeve shuttle motion.

It is noted that assembly of sealing rings in grooves on an internal surface of a cylinder may be less than optimal or practically very difficult. Hence, according to some embodiments the valve cylinder may be composed of cylindrical segments which are configured to be connected together serially, one next to the other, to construct the complete valve cylinder. The valve cylinder is divided into such segments at the locations of the grooves for the sealing rings, and so the valve cylinder may be assembled by sequentially arranging together a cylindrical segment and then a ring positioned in a groove on one end of the segment, and then a second segment positioned on the first segment, thereby closing the ring in the groove, and so on.

It is also noted that the term "cylinder" is used herein a general sense, being directed to cylinders having a circular cross-section and also to cylinders having other suitable cross-section configurations, such as an oval cross-section. It is accordingly noted that the internal surface 192 of valve cylinder (sleeve cylinder) 132 has a circular or an oval or other suitable cross-section. Likewise, the external surface 190 of combustion chamber structure 134 has a circular or an oval or other suitable cross-section. Accordingly, cylindrical sleeve 170 is dimensioned to fit closely to the cross-sectional dimensions of internal surface 192, and to fit closely to the cross-sectional dimensions of external surface 190, thereby enabling the reciprocating motion thereof while maintaining sealing against high pressure gas leaks therebetween.

Cylindrical sleeve 170 comprises a sleeve port 172 positioned and dimensioned to fluidly associate and disassociate, alternatingly, second port 124 with first combustion chamber port 136, and to fluidly associate and disassociate, alternatingly, third port 126 with second combustion chamber port 138. During sleeve shuttle 150 reciprocating motion, chamber E alternates between being fluidly connected and being fluidly disconnected to first chamber A via a passageway defined by second port 124, sleeve port 172, and first combustion chamber port 136. Likewise, during sleeve shuttle 150 reciprocating motion, chamber E alternates between being fluidly connected and being fluidly disconnected to second chamber B via a passageway defined by third port 126, sleeve port 172, and second combustion chamber port 138. In some embodiments (e.g. embodiments having a sleeve port wider or larger than sleeve port 172), during a fraction of sleeve shuttle 150 reciprocating motion, chamber E may simultaneously be fluidly connected to both chamber A and chamber B. In some exemplary embodiments (not exemplified in these Figures), when sleeve shuttle 150 is at its mid-stroke point, and when sleeve port 172 is wide enough to simultaneously fluidly connect second port 124 with first combustion chamber port 136, and third port 126 with second combustion chamber port 138, chamber A may be in fluid communication with chamber B via chamber E. In some exemplary embodiments chamber A is never in fluid communication with chamber B.

During sleeve shuttle 150 reciprocating motion, first port 122 may open or close as sleeve shuttle 150 blocks or unblocks, respectively, first port 122. Thus, sleeve shuttle 150 reciprocating motion fluidly couples or decouples chamber A and chamber C.

During sleeve shuttle 150 reciprocating motion, fourth port 128 may open or close as sleeve shuttle 150 blocks or unblocks, respectively, fourth port 128. Thus, sleeve shuttle 150 reciprocating motion fluidly couples or decouples chamber B and chamber D.

During sleeve shuttle 150 reciprocating motion, chamber E may fluidly couple with, or decouple from, chamber A, via second port 124, sleeve port 172, and first combustion chamber port 136.

During sleeve shuttle 150 reciprocating motion, chamber E may fluidly couple with, or decouple from, chamber B via third port 126, sleeve port 172 and second combustion chamber port 138.

Phase shifting module 160 comprises a phase shifting transmission gear 180 comprising an input axle 182, an output axle (not shown here) revolving synchronously with input axle 182 and a control shaft 184 configured to set a phase shift between the input axle and the output axle. Input axle 182 is coupled to engine power shaft 118 via timing belt 162 and sprocket 186, and the output axle is coupled to sleeve crankshaft 158 via timing belt 164 and sprocket 188. According to some embodiments, the input axle and the output axle may revolve (synchronously) in opposite directions. According to some embodiments phase shifting module 160 may retain a fixed and unvaried phase shift between engine power shaft 118 and sleeve crankshaft 158 during operation of engine 100. According to some embodiments, phase shifting module 160 may be used to controllably vary a phase shift between engine power shaft 118 and sleeve crankshaft 158 during operation of engine 100 as is further detailed and explained below.

An event is said hereinbelow to occur at approximately the same time as another event, or shortly before or shortly after the other event, when in the time interval between their occurrences, first crankshaft 114 may rotate no more than about 10 crankshaft degrees.

The Split-Cycle Engine in Operation

Figure 9:
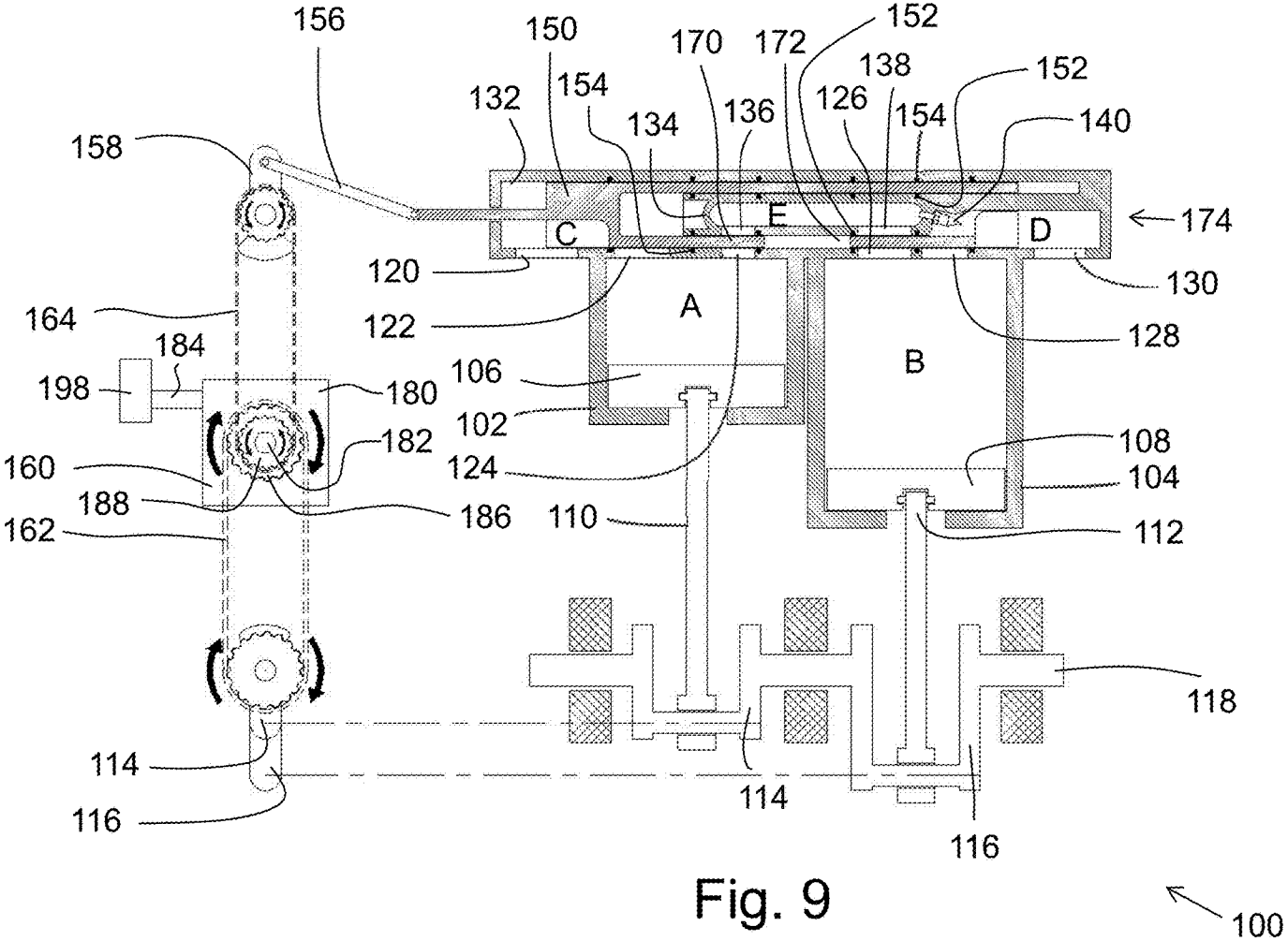
FIG. 9 schematically depicts the engine of FIG. 1 in the first mode of operation. The pistons are illustrated at 180 crankshaft degrees after their respective TDC points, and the sleeve shuttle is illustrated at 90 crankshaft degrees after its TDC point.
Figure 10:
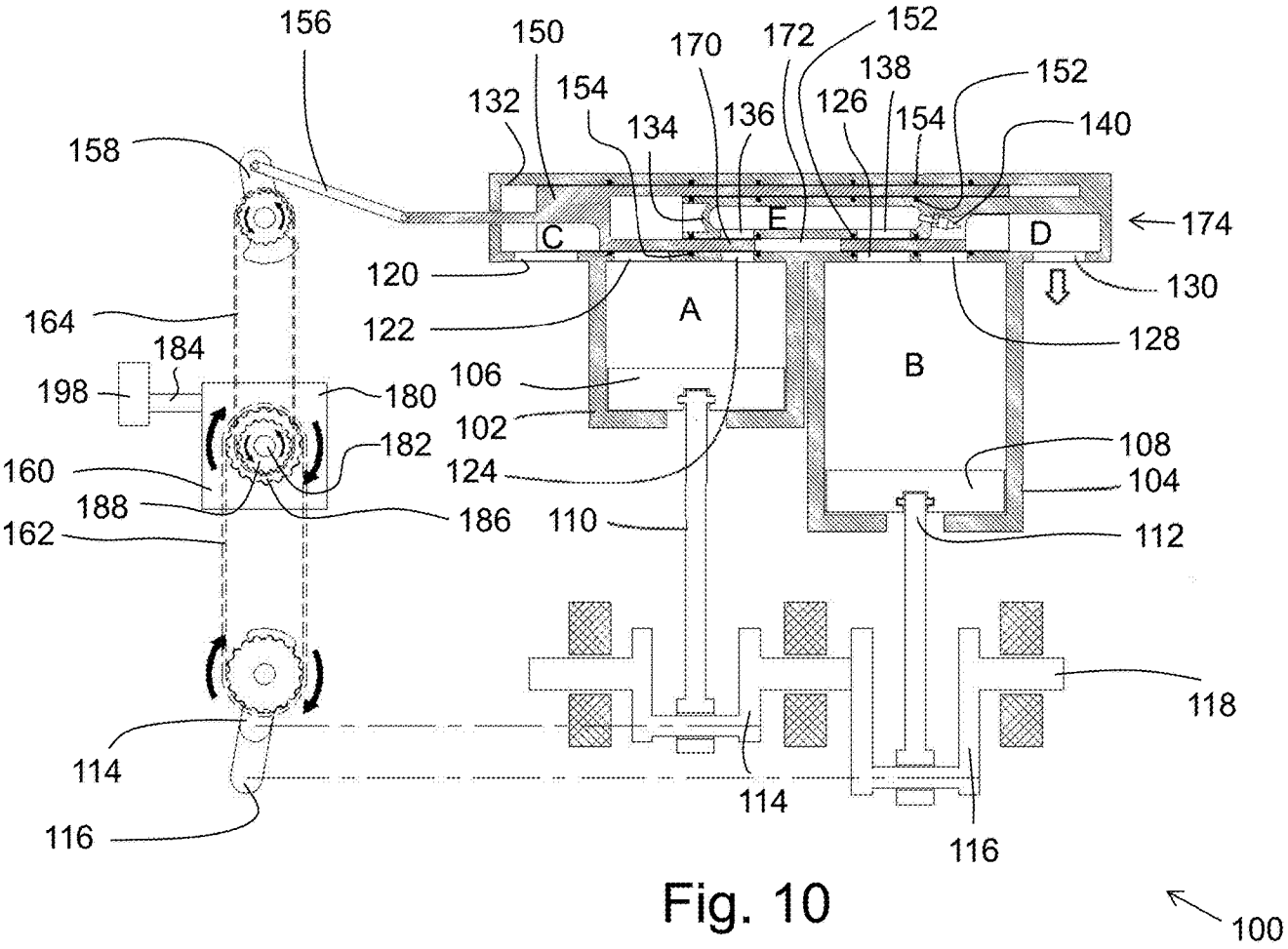
FIG. 10 schematically depicts the engine of FIG. 1 in the first mode of operation. The pistons are illustrated at 190 crankshaft degrees after their respective TDC points, and the sleeve shuttle is illustrated at 100 crankshaft degrees after its TDC point.
Figure 11:
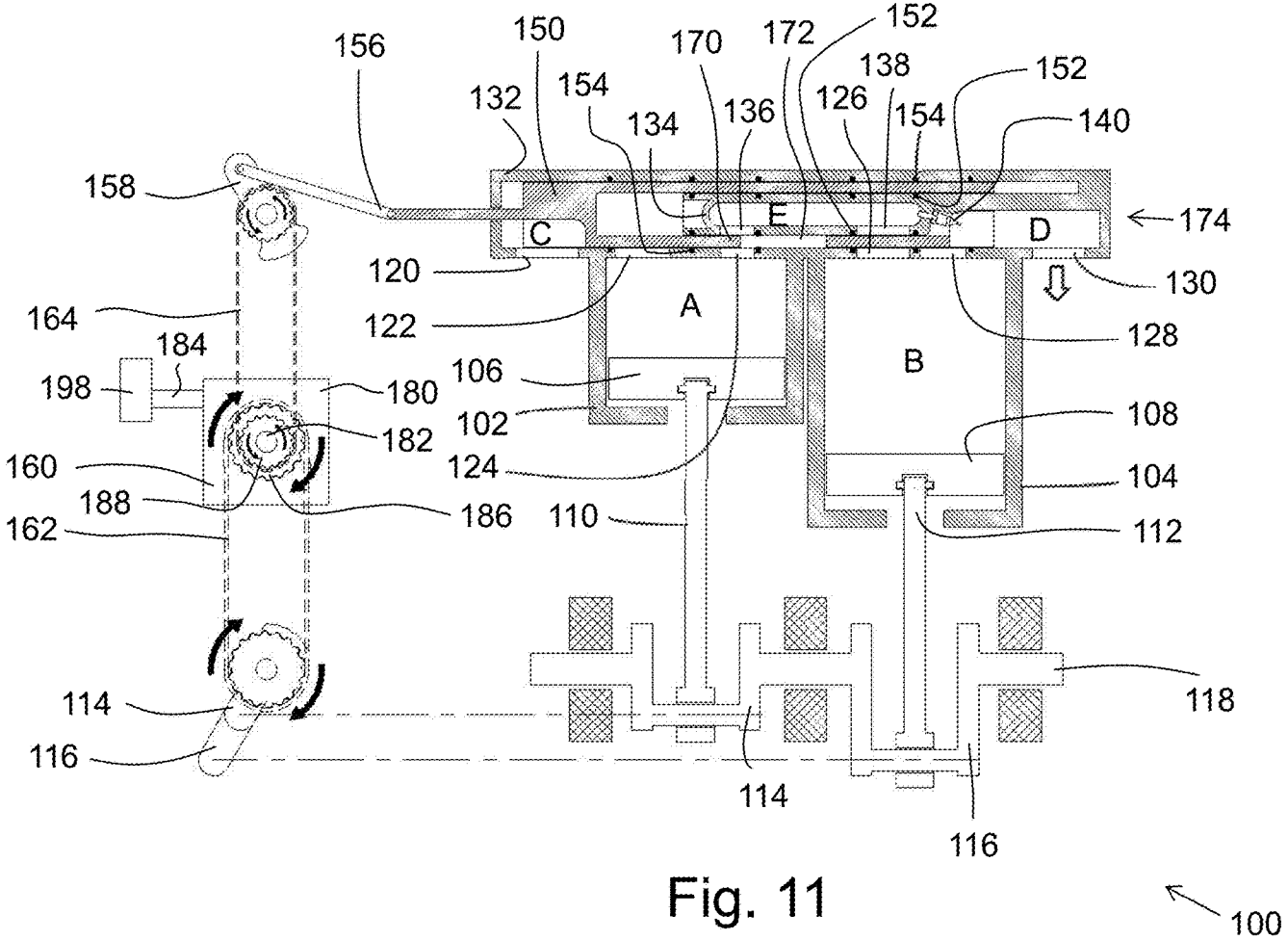
FIG. 11 schematically depicts the engine of FIG. 1 in the first mode of operation. The pistons are illustrated at 210 crankshaft degrees after their respective TDC points, and the sleeve shuttle is illustrated at 120 crankshaft degrees after its TDC point.
Figure 12:
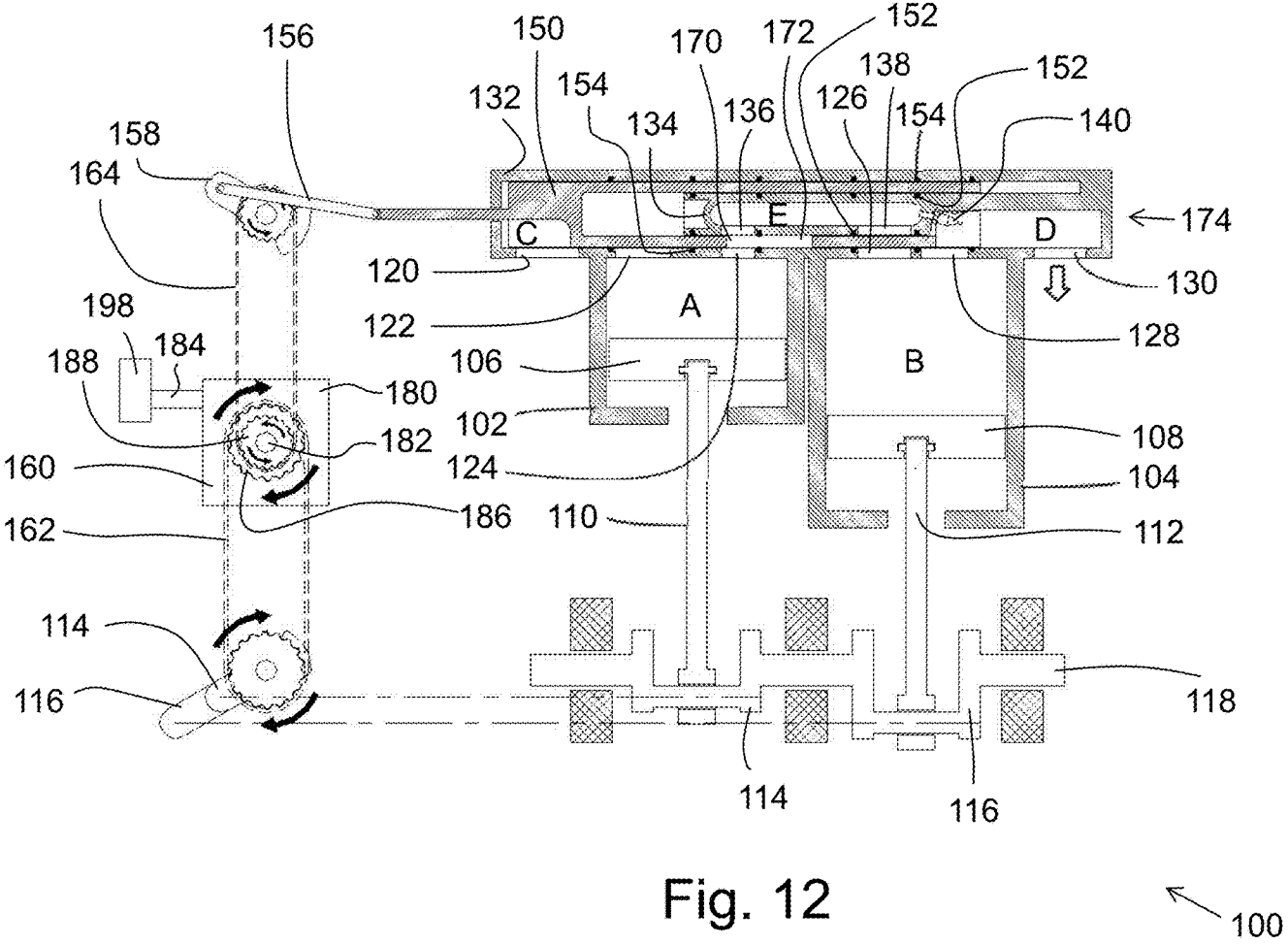
FIG. 12 schematically depicts the engine of FIG. 1 in the first mode of operation. The pistons are illustrated at 240 crankshaft degrees after their respective TDC points, and the sleeve shuttle is illustrated at 150 crankshaft degrees after its TDC point.
Figure 13:
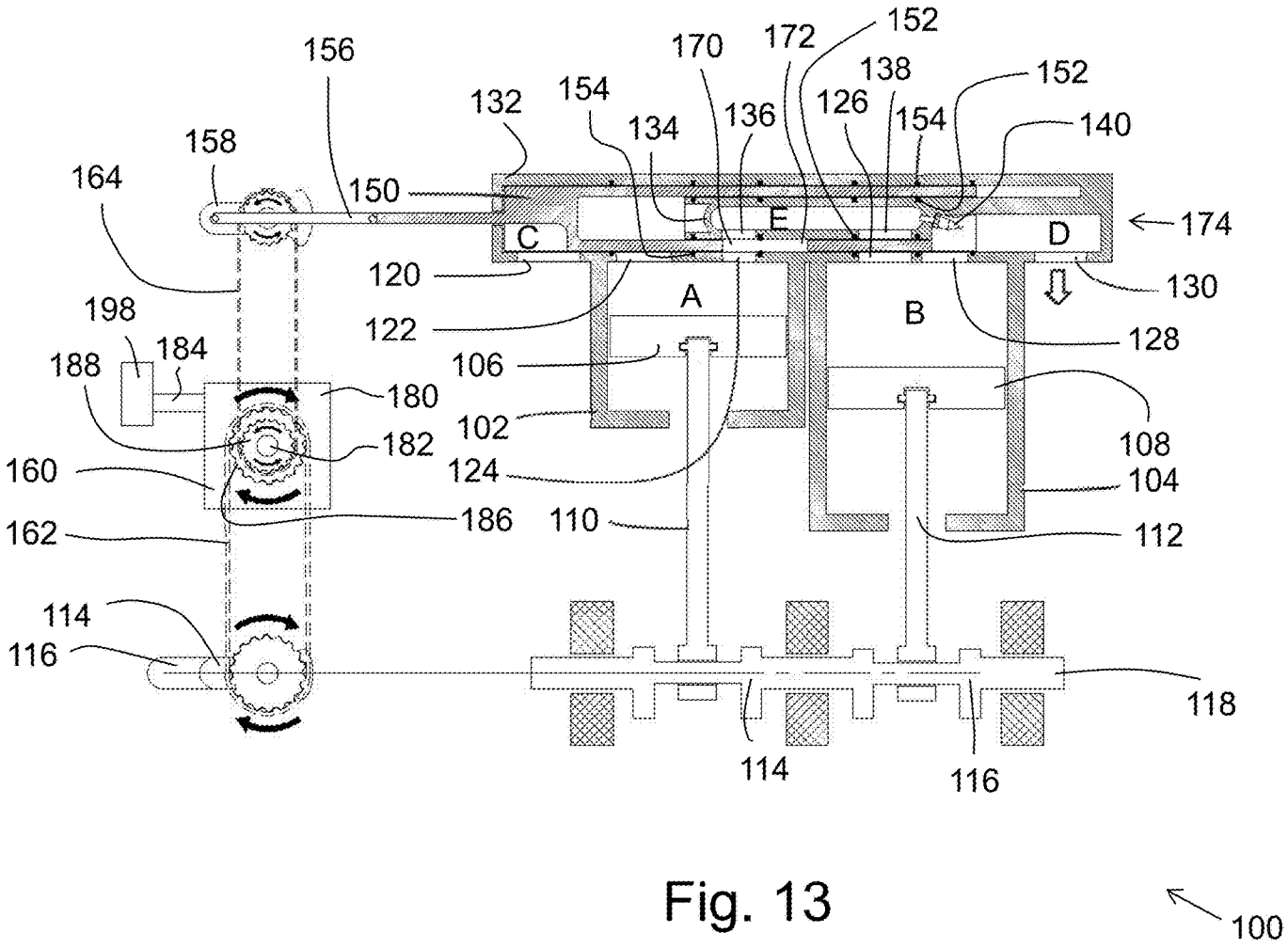
FIG. 13 schematically depicts the engine of FIG. 1 in the first mode of operation. The pistons are illustrated at 270 crankshaft degrees after their respective TDC points, and the sleeve shuttle is illustrated at 180 crankshaft degrees after its TDC point.
Figure 14:
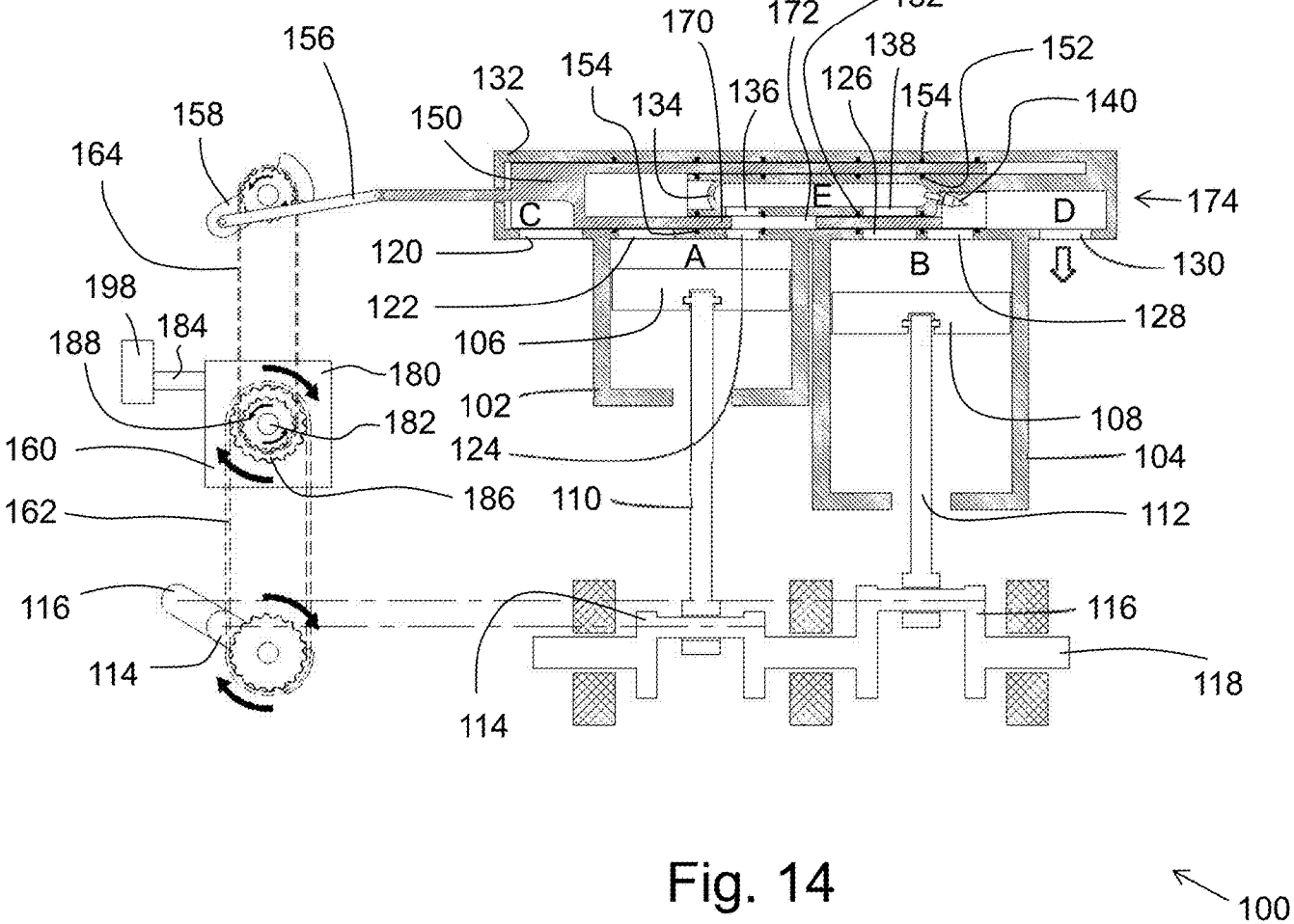
FIG. 14 schematically depicts the engine of FIG. 1 in the first mode of operation. The pistons are illustrated at 300 crankshaft degrees after their respective TDC points, and the sleeve shuttle is illustrated at 210 crankshaft degrees after its TDC point.
Figure 15:
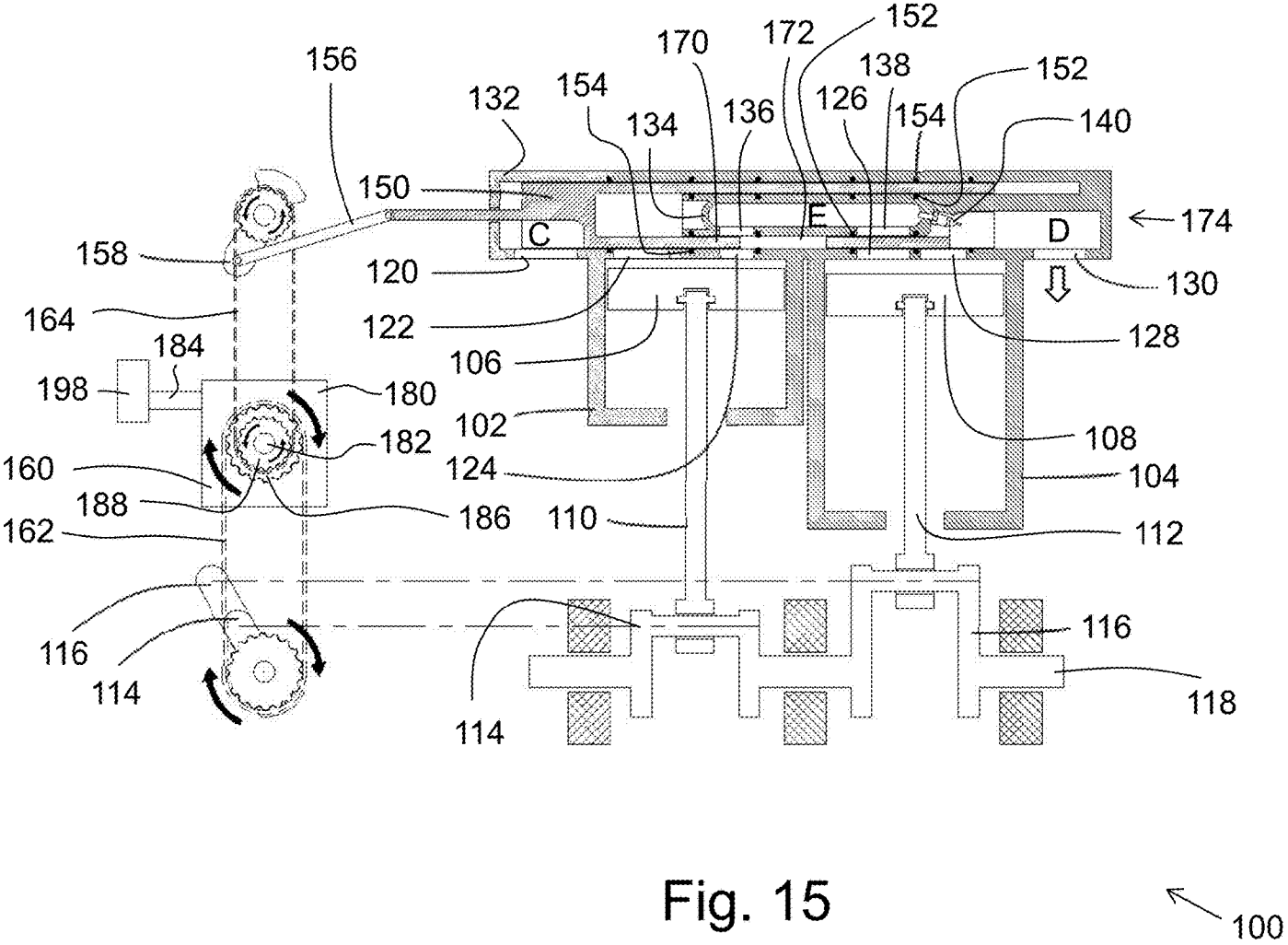
FIG. 15 schematically depicts the engine of FIG. 1 in the first mode of operation. The pistons are illustrated at 330 crankshaft degrees after their respective TDC points, and the sleeve shuttle is illustrated at 240 crankshaft degrees after its TDC point.
Figure 16:
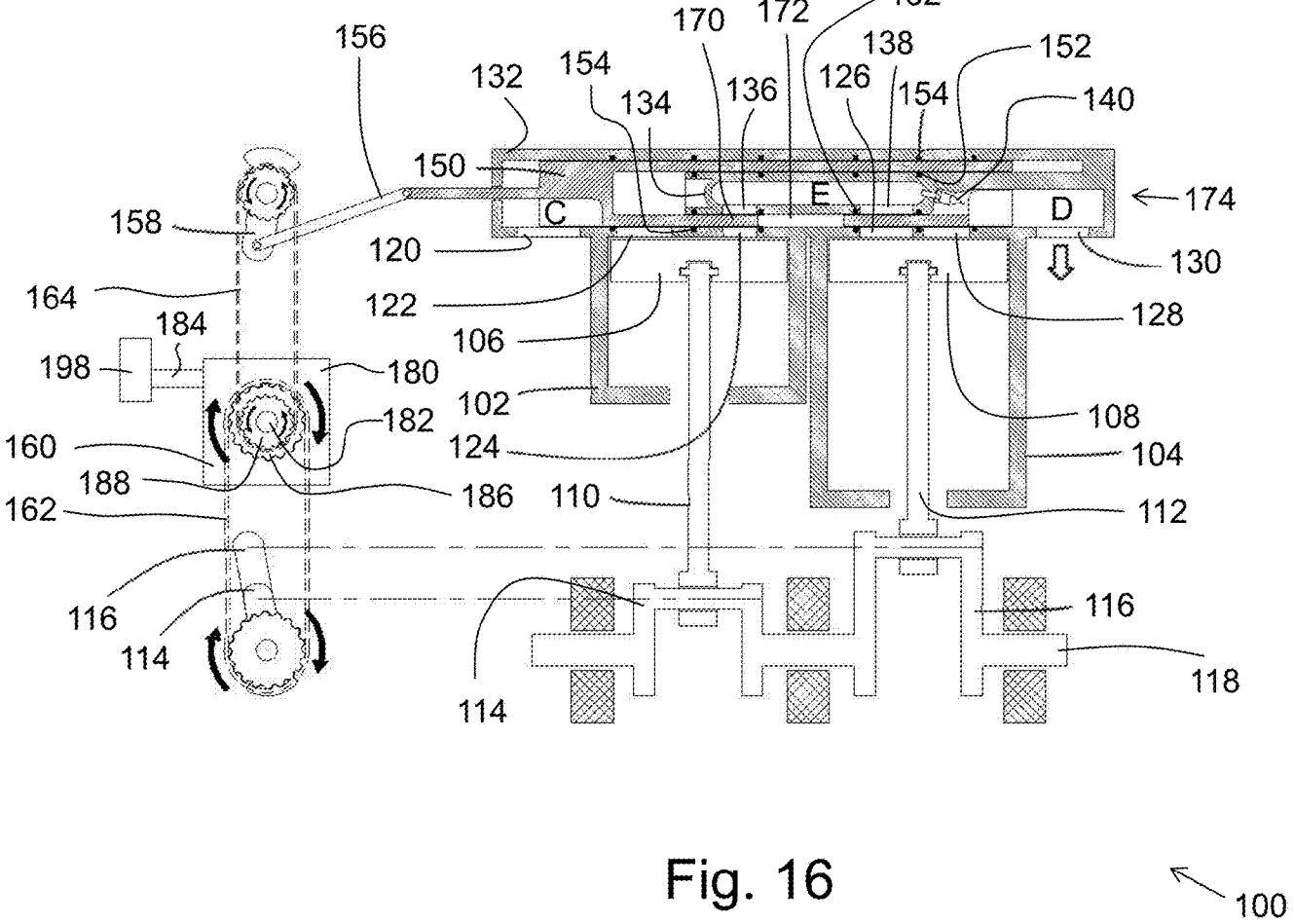
FIG. 16 schematically depicts the engine of FIG. 1 in the first mode of operation. The pistons are illustrated at 350 crankshaft degrees after their respective TDC points, and the sleeve shuttle is illustrated at 260 crankshaft degrees after its TDC point.

In operation (FIGS. 1-17), first piston 106 performs an intake stroke (FIGS. 1-8), followed by a compression stroke (FIGS. 9-17), and second piston 108 performs an expansion stroke (FIGS. 1-8) followed by an exhaust stroke (FIGS. 9-17). During the intake stroke, working fluid (e.g. carbureted naturally aspirated fuel/air charge or forced induced fuel/air charge) flows into chamber C through first manifold 120 and potentially through other apparatus (such as turbo charger, or other apparatus as commonly known to a person skilled in the art), and from chamber C into chamber A through first port 122. During the compression stroke, first piston 106 forces the working fluid into chamber E through the passageway defined by second port 124, sleeve port 172, and first combustion chamber port 136. The working fluid is ignited in chamber E (e.g. in FIG. 1). Second piston 108 performs an expansion stroke (FIGS. 1-8) as burnt fuel gas is released into chamber B, through the passageway defined by second combustion chamber port 138, sleeve port 172, and third port 126. Second piston 108 performs an exhaust stroke (FIGS. 9-17) exhaling the burnt fuel gases into chamber D through fourth port 128, and from chamber D into the ambient air through second manifold 130. First piston 106 does not perform an expansion stroke, or an exhaust stroke, and second piston 108 does not perform an intake stroke or a compression stroke. First piston 106, second piston 108, and sleeve shuttle 150 move in phase. That is to say, first piston 106 and second piston 108 reach their respective TDC positions at the same time, and their respective BDC positions at the same time. Further, when moving to the right, sleeve shuttle 150 reaches its mid-stroke point at the same time that first piston 106 and second piston 108 reach their respective TDC positions (FIG. 1), and when moving to the left, sleeve shuttle 150 reaches its mid-stroke point at the same time that first piston 106 and second piston 108 reach their respective BDC positions (FIG. 9).

In both the intake and expansion strokes and the compression and exhaust strokes, engine power shaft 118 rotational motion is converted via first timing belt 162, phase shifting transmission gear 180, and second timing belt 164, to sleeve crankshaft 158 synchronous rotational motion. Sleeve connecting rod 156 converts sleeve crankshaft 158 rotation to sleeve shuttle 150 reciprocating motion. Sleeve shuttle 150 thus moves synchronously with first piston 106 and second piston 108. During sleeve shuttle 150 reciprocating motion, chamber E alternates between being fluidly connected, via first combustion chamber port 136, sleeve port 172, and second port 124, with chamber A, and via second combustion chamber port 138, sleeve port 172, and third port 126, with chamber B. Also during sleeve shuttle 150 reciprocating motion, first port 122 and fourth port 128 may separately, alternatingly open or close. Also during sleeve shuttle 150 reciprocating motion, second port 124 and third port 126 may separately, alternatingly open or close.

During the intake and expansion strokes (FIGS. 1-8), which occur concurrently, second connecting rod 112 translates second piston 108 reciprocating motion (relative to second cylinder 104) into second crankshaft 116 rotational motion, causing engine power shaft 118, and consequently first crankshaft 114, to rotate synchronously. First crankshaft 114 and second crankshaft 116 thus rotate synchronously. First connecting rod 110 converts first crankshaft 114 rotational motion to first piston 106 reciprocating motion (relative to first cylinder 102). First piston 106 and second piston 108 thus move synchronously. First port 122 governs the flow of the working fluid (i.e. naturally aspirated ambient air or the carbureted air/fuel charge, or forced induction of the charge) into first chamber A, and third port 126 governs the flow of hot, high pressured gas from chamber E into chamber B.

During the intake and expansion strokes (FIGS. 1-8), initially (FIG. 1), all ports are blocked. Specifically, sleeve cylinder 170 (and hence sleeve shuttle 150) is positioned so as to fluidly disconnect chamber E from both chamber A and chamber B, and to fluidly disconnect chamber A from chamber B. The working fluid (naturally aspirated ambient air or the carbureted air/fuel charge, or forced induction of the charge) resides in chamber C between first manifold 120 and first port 122. First piston 106 and second piston 108 are both in their respective TDC positions. Sleeve shuttle 150 is at its mid-stroke point and moving towards its own TDC point at the right hand side of sleeve cylinder 132. First piston 106, second piston 108 and sleeve shuttle 150 are moving synchronously, wherein first piston 106 and second piston 108 are said to be moving in phase, being at a same crankshaft angle (0 degrees) and wherein sleeve shuttle 150 is retarded by 90 degrees relative to the two pistons. Chamber E is filled with high-pressure compressed working fluid and ignition is being initiated (FIG. 1).

Inertia maintains first crankshaft 114 and second crankshaft 116 rotational motions (FIG. 1), which in turn, via engine power shaft 118, phase shifting transmission gear 180 and sleeve crankshaft 158, maintain sleeve shuttle 150 rightward motion. After first piston 106 and second piston 108 start descending (FIG. 2), sleeve shuttle 150 rightward motion opens first port 122 and third port 126, letting new working fluid enter into chamber A through chamber C, and hot, high-pressure burnt fuel gas from chamber E into chamber B. The high-pressure gas in chamber E thrusts down second piston 108 (FIGS. 2-8), thereby increasing chamber B volume. The net torque applied by second piston 108, through connecting rod 112, on second crankshaft 116, causes second crankshaft 116 to rotate, and consequently drives the rotation of first crankshaft 114, thereby increasing chamber A volume.

As sleeve shuttle 150 continues its rightward motion (FIGS. 3 and 4), it increasingly unblocks more of first port 122 and third port 126, possibly allowing for a higher rate of flow of incoming working fluid from chamber C into chamber A, and a higher rate of flow of burnt fuel gas from chamber E into chamber B. When sleeve crankshaft 158 reaches its TDC point, sleeve shuttle 150 reverses direction of motion, (i.e. sleeve shuttle 150 starts moving to the left). As first piston 106 and second piston 108 approach their respective BDC positions, and sleeve shuttle 150 approaches its mid-stroke point from the right (moving to the left), first port 122 closes (FIGS. 8-9), thereby sealing the working fluid inside chamber A, and third port 126 closes, thereby disconnecting chamber B from chamber E.

Throughout the entire intake and expansion strokes, sleeve shuttle 150 position within sleeve cylinder 132 (FIGS. 1-8) prevents high-pressure fluid transfer from chamber B into chamber A. The hot, high-pressure burnt fuel gas of the expansion stroke is being restricted from passing laterally through the gaps between sleeve cylinder 132 and sleeve shuttle 150 (and cylindrical sleeve 170) due to cylinder sealing rings 154, particularly cylinder sealing ring 154 near second port 124 (to its right). Likewise the hot, high-pressure burnt fuel gas of the expansion stroke is restricted from passing laterally through the gaps between cylindrical sleeve 170 and the combustion chamber structure 134 due to chamber sealing rings 152. The high-pressure burnt fuel gas of the expansion stroke is further restricted from escaping through chamber D to ambient air due to chamber sealing rings 152 and cylinder sealing rings 154, particularly contracting ring 154 near fourth port 128 (to its right).

It should be understood that additional or alternative configurations of sealing rings may be employed. For example, extracting rings positioned in grooves (not shown here) on an external surface 194 of cylindrical sleeve 170 may be used instead of cylinder sealing (contracting) rings 154 for sealing and preventing gas leakage between sleeve cylinder 132 and cylindrical sleeve 170. Likewise, contracting rings positioned in grooves (not shown here) on an internal surface 196 of cylindrical sleeve 170 may be used instead of chamber sealing (extracting) rings 152 for sealing and preventing gas leakage between combustion chamber structure 134 and cylindrical sleeve 170.

During the compression and exhaust strokes (FIGS. 9-17), which occur substantially concurrently, engine power shaft 118 rotational motion continues, and consequently, first crankshaft 114 and second crankshaft 116 continue rotating synchronously. First connecting rod 110 translates first crankshaft 114 rotational motion into first piston 106 reciprocating motion (relative to first cylinder 102). Second connecting rod 112 translates second crankshaft 116 rotational motion into second piston 108 reciprocating motion (relative to second cylinder 104). First piston 106 and second piston 108 thus move synchronously. Second port 124 governs the flow (compression) of unexploited working fluid from chamber A into chamber E and fourth port 128 governs the exhalation of burnt fuel gases from chamber C to chamber D.

During the compression and exhaust strokes (FIGS. 9-17), initially (FIG. 9), all ports are blocked. Specifically, sleeve cylinder 170 is positioned so as to fluidly disconnect chamber A from both chamber E and chamber B, and to fluidly disconnect chamber B from both chamber E and chamber D. Unexploited working fluid resides in chamber A and burnt fuel gas resides in both chamber B and the decoupled chamber E. First piston 106 and second piston 108 are both in their respective BDC positions. Sleeve shuttle 150 is at its mid-stroke point and moving to the left. First piston 106 and second piston 108 are moving in phase, and sleeve shuttle 150 is moving synchronously with first piston 106 and second piston 108 retarded by a phase shift of 90 crankshaft degrees as explained above.

Inertia maintains first crankshaft 114 and second crankshaft 116 rotational motions, which in turn, via engine power shaft 118, phase shifting transmission gear 180, and sleeve crankshaft 158, maintain sleeve shuttle 150 leftward motion.

After first piston 106 and second piston 108 start ascending (FIG. 10), sleeve shuttle 150 leftward motion opens second port 124 and fourth port 128, allowing unexploited working fluid to enter (compress into) chamber E from chamber A, and burnt fuel gas to exhale from chamber B through chamber D. As first piston 106 ascent continues, chamber A volume decreases (and hence also the combined volume of chamber A and chamber E). As second piston 108 ascent continues, chamber B volume decreases (FIGS. 10-17). The air-fuel charge in chamber A and chamber E is compressed as an increasingly larger percentage of the air-fuel charge is forced into chamber E.

Figure 17:
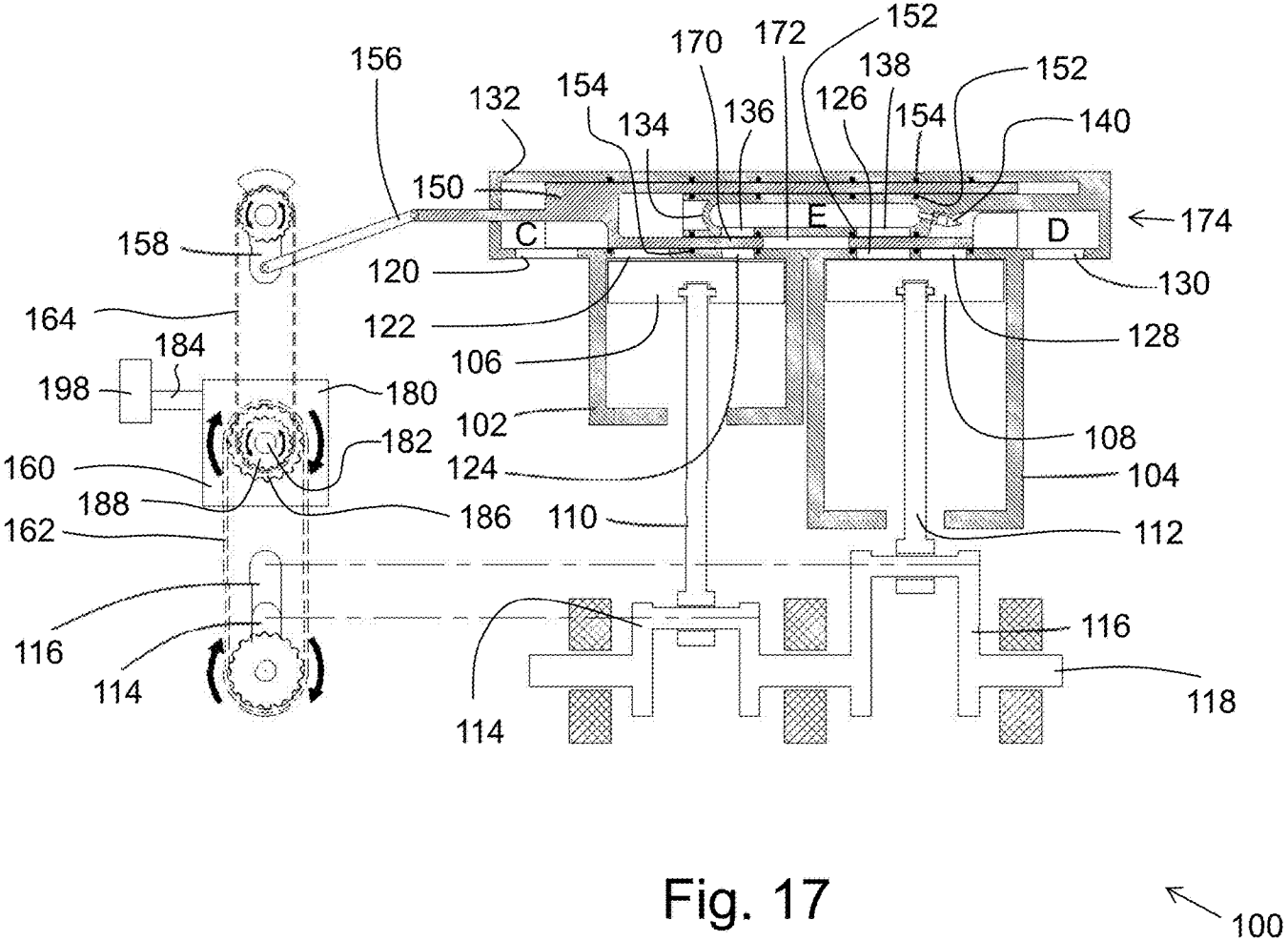
FIG. 17 schematically depicts the engine of FIG. 1 at the end of the first mode of operation and start of a first transition cycle. The pistons are illustrated at their respective TDC points, and the sleeve shuttle is illustrated at 90 crankshaft degrees before its TDC point.

As sleeve shuttle 150 continues its leftward motion (FIGS. 11 and 12), it increasingly opens more of second port 124 and fourth port 128, possibly allowing for a higher transfer rate of unexploited working fluid from chamber A into chamber E, and a higher exhaust rate of burnt fuel gas from chamber B into chamber D. When sleeve crankshaft 158 completes a three quarters of a rotation since the cycle began (FIG. 13), sleeve shuttle 150 reaches it BDC point and sleeve shuttle 150 reverses direction of motion, (i.e. sleeve shuttle 150 starts moving to the right). As first piston 106 and second piston 108 approach their respective TDC positions, and sleeve shuttle 150 approaches its mid-stroke point from the left (moving to the right), second port 124 closes, thereby sealing the compressed working fluid in chamber E, and fourth port 128 closes (FIG. 17).

Throughout the compression and exhaust strokes, sleeve shuttle 150 position within sleeve cylinder 132 (FIGS. 9-17) prevents compressed working fluid transfer from chamber A into chamber B. The working fluid of the compression stroke is being restricted from passing laterally through the gaps between sleeve cylinder 132 and sleeve shuttle 150 (and cylindrical sleeve 170) due to cylinder sealing rings 154, particularly contracting ring 154 near third port 126 (to its left). Likewise the compressed working fluid is restricted from passing laterally through the gaps between cylindrical sleeve 170 and the combustion chamber structure 134 due to chamber sealing rings 152. The compressed working fluid is further restricted from escaping back through chamber A to ambient air due to chamber sealing rings 152 and cylinder sealing rings 154, particularly cylinder sealing ring 154 near first port 122 (to its left).

It is noted that during operation of engine 100 as described above, phase shifting module 160 may be inoperative, that is to say sleeve crankshaft 152 is not retarded nor advanced relative to first crankshaft 114 or to second crankshaft 116.

As mentioned above, at a certain pre-determined point, for example, when first piston 106 and second piston 108 are at their respective TDC positions (FIG. 1), combustion of the air-fuel charge may be initiated via compression ignition. Additionally, or alternatively, at a certain pre-determined point, for example, when first piston 106 and second piston 108 are at their respective TDC positions (FIG. 1), combustion of the air-fuel charge is initiated via an ignition mechanism such as spark plug firing. In compression ignition engine configurations, a high pressure fuel injection system may be incorporated with the timing of fuel injection determining combustion timing.

It is noted that second cylinder 104 is larger than first cylinder 102, resulting in chamber B having a larger volume than chamber A. Thus, split-cycle ICE 100 may utilize an expansion ratio different from a compression ratio, and more specifically an expansion ratio greater than a compression ratio, resulting, potentially, in a higher efficiency of engine 100 cycle as compared to ICE's characterized by an expansion ratio equal to a compression ratio (similar to an Atkinson or a Miller cycle). However, according to some embodiments a split cycle engine of the invention may utilize a compression cylinder equal in size to an expansion cylinder thereof, namely a split cycle engine having a compression chamber A equal in volume to an expansion chamber B. According to some embodiments the compression chamber A may be larger than the expansion chamber C.

According to some embodiments first cylinder 102 and second cylinder 104 may be thermally isolated from one another. According to some embodiments the temperature of chamber A may be regulated or controlled, e.g. by regulating heat dissipation from first cylinder 102. According to some embodiments the temperature of chamber B may be regulated or controlled, e.g. by regulating heat dissipation from the second cylinder 104.

According to some embodiments the temperature of chamber A may be maintained lower than the temperature of chamber B, resulting, potentially, in a higher efficiency as compared to ICEs that utilize the intake stroke and the exhaust stroke in the same cylinder. According to some embodiments heat rejection of first cylinder 102 is larger than heat rejection of second cylinder 104.

In some exemplary embodiments, the components of chamber A and/or of chamber B are temperature controlled using a cooling system, thereby cooling chamber A and/or chamber B structure components (such as the first and second cylinders, 102 and 104 respectively, first and second pistons 106 and 108, and parts of sleeve cylinder 132 and sleeve shuttle 150). In some exemplary embodiments, some or all of the split cycle engine's components may be fabricated out of high-temperature resistant materials such as ceramics or utilizing ceramic coatings, cast iron, titanium, nickel-alloy steel, nano-composites, matrix composites, or stainless steel. In some exemplary embodiments, the split-cycle engine utilizes conventional pressurized cooling and oil lubrication methods and systems (not shown).

In various exemplary embodiments, first crankshaft 114, second crankshaft 116, and sleeve crankshaft 158 structural configurations may vary in accordance with desired engine configurations and designs. For example, possible crankshaft design factors may include: the number of dual cylinders, the relative cylinder positioning, the crankshaft gearing mechanism, and the direction of rotation. In some exemplary embodiments, a single crankshaft actuates both first piston 106 and second piston 108 via first connecting rod 110 and second connecting rod 112. Such a single crankshaft could actuate multiple pairs of first piston 106 and second piston 108. Alternative embodiments for connecting second crankshaft 116 and first crankshaft 114 may include, for example a crankshaft connecting gearwheels mechanism, standard rotational energy connecting elements such as timing belts, multi rod mechanisms gears etc.

In various exemplary embodiments, there could be a single or multiple expanded (extracting) sealing rings mounted in annular grooves on sleeve shuttle 150 between sleeve shuttle 150 and sleeve cylindrical structure 132, instead of the cylinder sealing rings 154. In some embodiments, there could be a single or multiple retracting (contracting) sealing rings mounted in annular grooves on an inner surface of cylindrical sleeve 170, between cylindrical sleeve 170 and combustion chamber structure 134, instead of chamber sealing (extracting) rings 152.

In various exemplary embodiments (not exemplified in these Figures), the opening times and closing times of first port 122 may be different from those described above. According to some embodiments, first port 122 may open within a range between about 15 crankshaft degrees before first piston 106 TDC until about 15 crankshaft degrees after first piston 106 TDC. According to some embodiments, first port 122 may close within a range between about 15 crankshaft degrees before first piston 106 BDC until about 50 crankshaft degrees after first piston 106 BDC.

In various exemplary embodiments (not exemplified in these Figures), the opening times and closing times of second port 124 may be different from those described above. According to some embodiments, second port 124 may open within a range between about 35 crankshaft degrees before first piston 106 BDC until about 25 crankshaft degrees after first piston 106 BDC. According to some embodiments, second port 124 may close within a range between about 10 crankshaft degrees before first piston 106 TDC until about 15 crankshaft degrees after first piston 106 TDC.

In various exemplary embodiments (not exemplified in these Figures), the opening times and closing times of third port 126 may be different from those described above. According to some embodiments, third port 126 may open within a range between about 15 crankshaft degrees before second piston 108 TDC until about 35 crankshaft degrees after second piston 108 TDC. According to some embodiments, third port 126 may close within a range between about 15 crankshaft degrees before second piston 108 BDC until about 15 crankshaft degrees after second piston 108 BDC.

In various exemplary embodiments (not exemplified in these Figures), the opening times and closing times of fourth port 128 may be different from those described above. According to some embodiments, fourth port 128 may open within a range between about 50 crankshaft degrees before second piston 108 BDC until about 20 crankshaft degrees after second piston 108 BDC. According to some embodiments, fourth port 128 may close within a range between about 15 crankshaft degrees before second piston 108 TDC until about 15 crankshaft degrees after second piston 108 TDC.

It should be noted that several factors may affect the timing of opening and closing of first port 122 and second port 124. For example: a phase shift between first piston 106 (and first crankshaft 114) and sleeve crankshaft 158; a location and size of sleeve port 172 and locations and sizes of first port 122 and second port 124 relative the reciprocating movement of cylindrical sleeve 170. Likewise, several factors may affect the timing of opening and closing of third port 126 and fourth port 128, such as a phase shift between second piston 108 (and second crankshaft 116) and sleeve crankshaft 158; a location and size of sleeve port 172 and locations and sizes of third port 126 and fourth port 128 relative the reciprocating movement of cylindrical sleeve 170. A desired combination of these factors may be selected to obtain a desired opening and closing scheme of the ports during operation. It is further emphasized that in embodiments of engine 100 that comprise phase shifting module 160, some of the above-mentioned factors may be varied during operation of the engine as is further described below.

In various exemplary embodiments (not exemplified in these Figures), second piston 108 may reach TDC within a range between about 15 crankshaft degrees before first piston 106 TDC until about 15 crankshaft degrees after first piston 106 TDC, and reach BDC within a range between about 15 crankshaft degrees before first piston 106 BDC until about 15 crankshaft degrees after first piston 106 BDC.

It should be understood that opening and closing times of ports and valves described herein, and phase shifts between the first piston and the second piston, may depend on various factors including the type of the engine (e.g. compression ignition or spark ignition), the configuration of the engine (in-line or opposite), relative sizes of the first and second cylinders, working load and working speed and mode of operation. Accordingly, opening and closing times of ports and valves described herein, and phase shifts between the first piston and the second piston, may be in some embodiments even outside the ranges specified above.

In various exemplary embodiments (not exemplified here), sleeve port 172 is designed, positioned and configured to allow fluid coupling between chamber A and chamber B when sleeve shuttle 150 is at its mid-stroke point. That is to say, chamber E may simultaneously be in fluid contact with both chamber A and chamber B. In various exemplary embodiments, sleeve crankshaft 158 may rotate in the same direction as first crankshaft 114 and second crankshaft 116. In other exemplary embodiments, sleeve crankshaft 158 may rotate in the opposite direction to first crankshaft 114 and second crankshaft 116.

A Split Cycle Engine in a Bi-Directional Mode of Operation

As described above, a split cycle engine generally includes one or more pairs of cylinders. In each pair of cylinders the compression cylinder includes a single piston that performs the intake and compression strokes, and the expansion cylinder includes a single piston that performs the expansion and exhaust strokes. Combustion may be initiated in a third chamber, different from the compression cylinder and the expansion cylinder. A valve mechanism controls the passage of working fluid from the compression cylinder to the expansion cylinder, typically via an intermediate passageway connecting the two cylinders.

The use of a pair of cylinders, instead of a single one, for a complete four strokes cycle, carries with it significant advantages. During intake and compression strokes, efficiency increases as heat rejection increases, whereas during expansion and exhaust strokes, efficiency increases as heat rejection decreases. These conflicting requirements cannot be satisfied in a single cylinder because heat rejection cannot be varied rapidly, and because the piston and cylinder wall temperature cannot readily change from cold to hot and back to cold within each cycle. The split-cycle engine allows for the maintaining of the compression and expansion cylinders at different temperatures, thereby increasing engine efficiency.

Furthermore, split-cycle engines allow for different geometries of the compression and expansion cylinders. A larger expansion ratio than compression ratio may increase engine efficiency in an internal combustion engine. In conventional internal combustion engines, the expansion ratio is typically the same as the compression ratio. Moreover, conventional means may only allow for a limited increase in the expansion ratio via valve timing (Miller and Atkinson cycles, for example), typically having an expansion ratio divided by compression ratio values of 1.5 or less, which limits the efficiency increase. A split-cycle engine can be configured to have an expansion ratio divided by compression ratio values larger than 1.5, which enables a larger efficiency increase compared to conventional internal combustion engines with Miller and Atkinson cycles.

On the other hand, having a smaller expansion ratio than compression ratio may increase the engine's power output (typically, together with a decrease in engines efficiency). Supercharging/turbocharging allows for an increase in power output, by using some of the power output to force more working fluid into the compression chamber during the intake stroke. While in comparison to conventional internal combustion engines, a supercharged/turbocharged engine may allow a significant increase in output power, with turbocharged engines typically being more efficient than supercharged engines, However this comes at the expense of added complexity and greater proneness to failure. Moreover, turbocharged engines suffer from slow throttle response. A split-cycle engine can be configured to have an expansion ratio divided by compression ratio value smaller than 1, thereby achieving supercharged capabilities.

In some of the embodiments disclosed in the publications described above, in order to increase fuel efficiency, the compression cylinder is of smaller internal volume than the expansion cylinder. In other embodiments disclosed in these publications, in order to increase the power output of the engine, the compression cylinder is of greater internal volume than the expansion cylinder. A compression cylinder smaller than the expansion cylinder results in less fuel being consumed per unit work, and hence higher fuel efficiency, but also results in lower power output. According to these publications, an engine may thus be either fuel efficient or it may have high power output, but it cannot provide both.

In view of the foregoing disadvantages inherent in the known types of internal combustion engines now present in the prior art, embodiments described herein include a bi-directional fluid flow split-cycle internal combustion engine which has at least a first cylinder housing a first piston and a second cylinder housing a second piston, the engine affording two modes of operation: a first mode in which working fluid flows from the first cylinder to the second cylinder, and a second mode in which working fluid flows from the second cylinder to the first cylinder. In the first mode the first cylinder serves for the intake and compression strokes and the second cylinder serves for the expansion and exhaust strokes, an in the second mode the second cylinder serves for the intake and compression strokes and the first cylinder serves for the expansion and exhaust strokes. The two modes of operation can be changed from one to the other during operation of the engine. In some embodiments, the first cylinder is smaller than the second cylinder. The engine may then be more fuel efficient in the first mode than in the second mode, and may provide more power in the second mode than in the first mode.

Thus, according to an aspect of some embodiments, there is provided a bi-directional fluid flow split-cycle internal combustion engine (ICE) comprising a first cylinder housing a first piston, defining a first chamber therebetween, and a second cylinder housing a second piston, defining a second chamber therebetween. The engine also comprises at least one movable valve, operating, during the first mode of operation and during the second mode of operation, synchronously with the first and second pistons, thereby regulating fluid flow between the first and second chambers. The split-cycle engine further comprises a phase shifting module controlling the movable valve by controllably setting a phase shift between the movable valve and the first piston and the second piston, such that for a first phase shift value, the engine is in the first mode, and for a second phase shift value, the engine is in the second mode. In some embodiments, the pistons may move out phase relative to one another.

According to some embodiments engine 100 admits two modes of operation: a first mode (schematically described in FIGS. 1-17), associated with a first phase shift value between first piston 106 and sleeve shuttle 150, and a second mode, associated with a second phase shift value between first piston 106 and sleeve shuttle 150. In the first mode of operation, working fluid (such as naturally aspirated air or the carbureted air/fuel charge) is directed from chamber C into chamber A and is then compressed into combustion chamber E where combustion is initiated. Then the burnt gas expands into chamber B, and finally exhales through chamber D to the atmosphere. In engine 100, where first cylinder 102, housing chamber A, is smaller than second cylinder 104, housing chamber B, the first mode of operation is associated with an expansion ratio greater than the compression ratio. It should be commented, and appreciated by a person skilled in the art that FIGS. 1-17 schematically describe a single cycle of engine 100 in the first mode of operation. However engine 100 is configured to work continuously in the first mode, by performing consecutively the cycle described in the FIGS. 1-17—wherein FIG. 17 is substantially identical to FIG. 1).

In the second mode of operation, flow direction of the working fluid is reversed (relative to the flow direction in the first mode of operation). In other words, the working fluid is directed from chamber D into chamber B and is then compressed into combustion chamber E where combustion is initiated. Then the burnt gas expands into chamber A, and finally exhales through chamber C to the atmosphere. It should be appreciated by the person skilled in the art that in engine 100 the second mode of operation is associated with an expansion ratio smaller than the compression ratio. The transition from the first mode of operation to the second mode of operation (and vice versa) may be accomplished by varying the phase shift between first piston 106 and sleeve shuttle 150 as is described in detail below.

Transition from First to Second Mode of Operation

A transition from the first mode to the second mode (referred to herein as the "first transition cycle"), is schematically depicted in FIGS. 17-33. During the first transition cycle, first piston 106 and second piston 108 each complete one cycle (a full rotation of the respective crankshafts), while sleeve shuttle 150 completes one and a half cycles, namely one and a half rotations of sleeve crankshaft 158. Thus, at the end of the first transition cycle, sleeve shuttle 150 is moving synchronously with first piston 106 and second piston 108, and in advance of the two pistons of 90 crankshaft degrees. To effect the phase shift, control shaft 184 is controllably rotated, possibly by an actuator or a motor, e.g. a step motor 198, thereby accelerating (and then decelerating) the output axle (not shown here) relative to input axle 182. Thus, during a first part of the first transition cycle (FIGS. 17-21), phase shifting transmission gear 180 increases sleeve crankshaft 158 rotation speed and during a second part of the first transition cycle (FIGS. 22-24), phase shifting transmission gear 180 decreases back sleeve crankshaft 158 rotation speed. By the end of the second portion of the first transition cycle (FIG. 24) sleeve crankshaft 158 has accumulated a positive 180 crankshaft degrees phase shift (in addition to the crankshaft expected position assuming the transition had not been initiated), thereby advancing from being 90 degrees behind first crankshaft 114 and second crankshaft 116 to reaching a 90 degrees advance over first crankshaft 114 and second crankshaft 116. Throughout a third part of the first transition cycle (FIGS. 25-33) and at the end of the first transition cycle (FIG. 33), sleeve crankshaft 158 resumes synchronous rotation with respect to first crankshaft 114 rotation and second crankshaft 116 rotation.

During the first transition cycle (FIGS. 17-33), initially (FIG. 17), new working fluid resides in chamber C between first manifold 120 and first port 122, compressed working fluid is ignited in chamber E, and all ports are blocked. First piston 106 and second piston 108 are both in their respective TDC positions. Sleeve shuttle 150 is at its mid-stroke point and moving to the right. Thus, first piston 106 and second piston 108 are moving in phase whereas sleeve shuttle 150 is moving with a 90 degrees phase lag behind.

Figure 18:
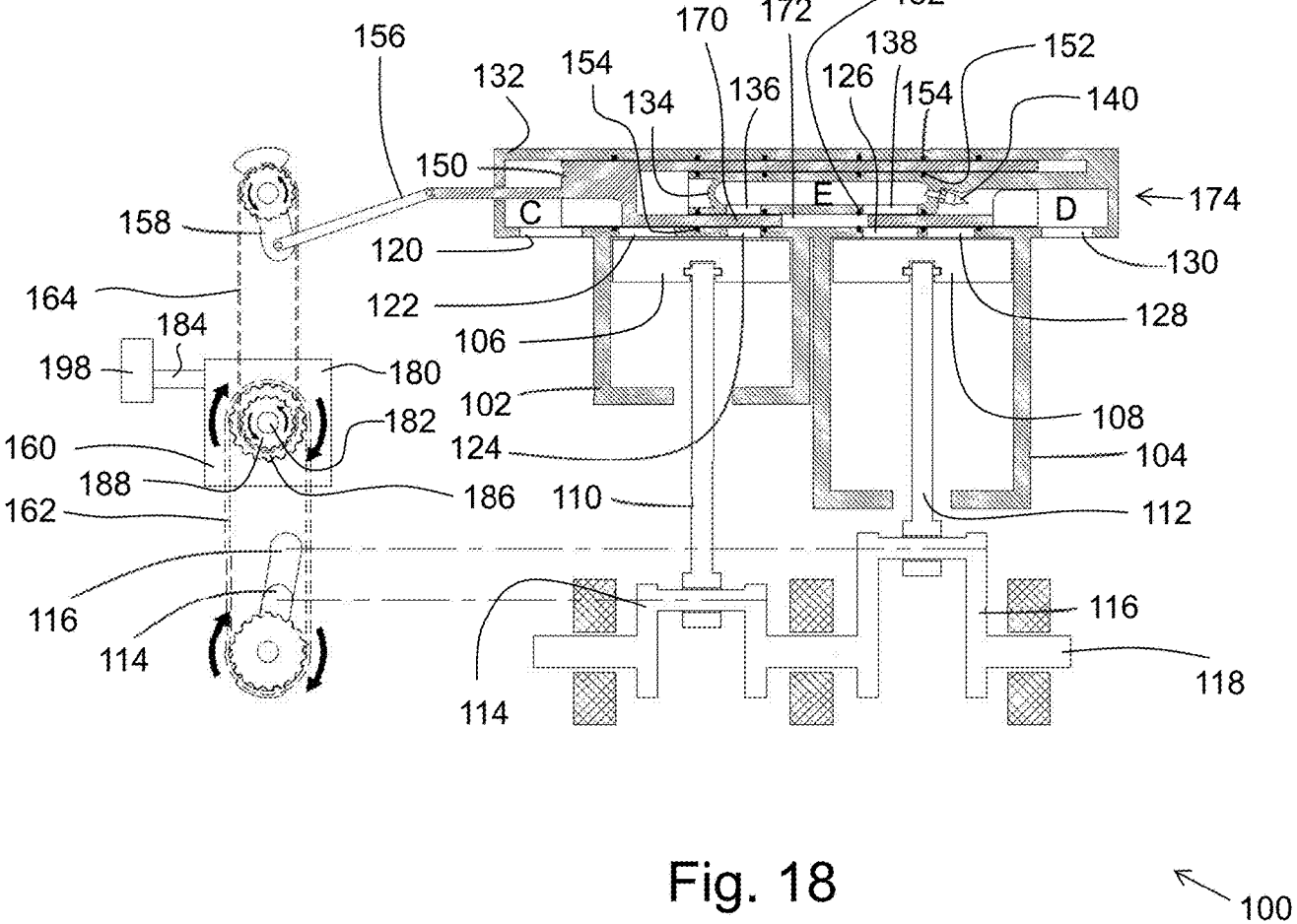
FIG. 18 schematically depicts the engine of FIG. 1 in the first transition cycle. The pistons are illustrated at 10 crankshaft degrees after their respective TDC points, and the sleeve shuttle is illustrated at 78 crankshaft degrees before its TDC point.

As seen in FIGS. 17 and 18, first crankshaft 114 inertia causes, via first connecting rod 110, first piston 106 descent in first cylinder 102. Second crankshaft 116 inertia causes, via second connecting rod 112, second piston 108 descent in second cylinder 104. Phase shifting transmission gear 180, via second timing belt 164, starts increasing sleeve crankshaft 158 rotation speed, which in turn starts accelerating, via sleeve connecting rod 156, sleeve shuttle 150, resulting the accumulation of a positive phase shift between the motion of sleeve shuttle 150 and the motions of first piston 106 and second piston 108.

As seen in FIG. 18, after sleeve shuttle 150 passes through its mid-stroke point (and first piston 106 and second piston 108 start descending), sleeve shuttle 150 opens first port 122 and third port 126, letting new working fluid enter into chamber A from chamber C, and hot, high pressure burnt fuel gas from chamber E into chamber B. The high-pressure burnt fuel gas then pushes down second piston 108 (FIGS. 18-20), thereby increasing chamber B volume. The net torque applied by second piston 108, through second connecting rod 112, on second crankshaft 116, causes second crankshaft 116 rotational motion, and consequently the in-phase rotational motion of the coupled first crankshaft 114, thereby increasing chamber A volume.

Figure 19:
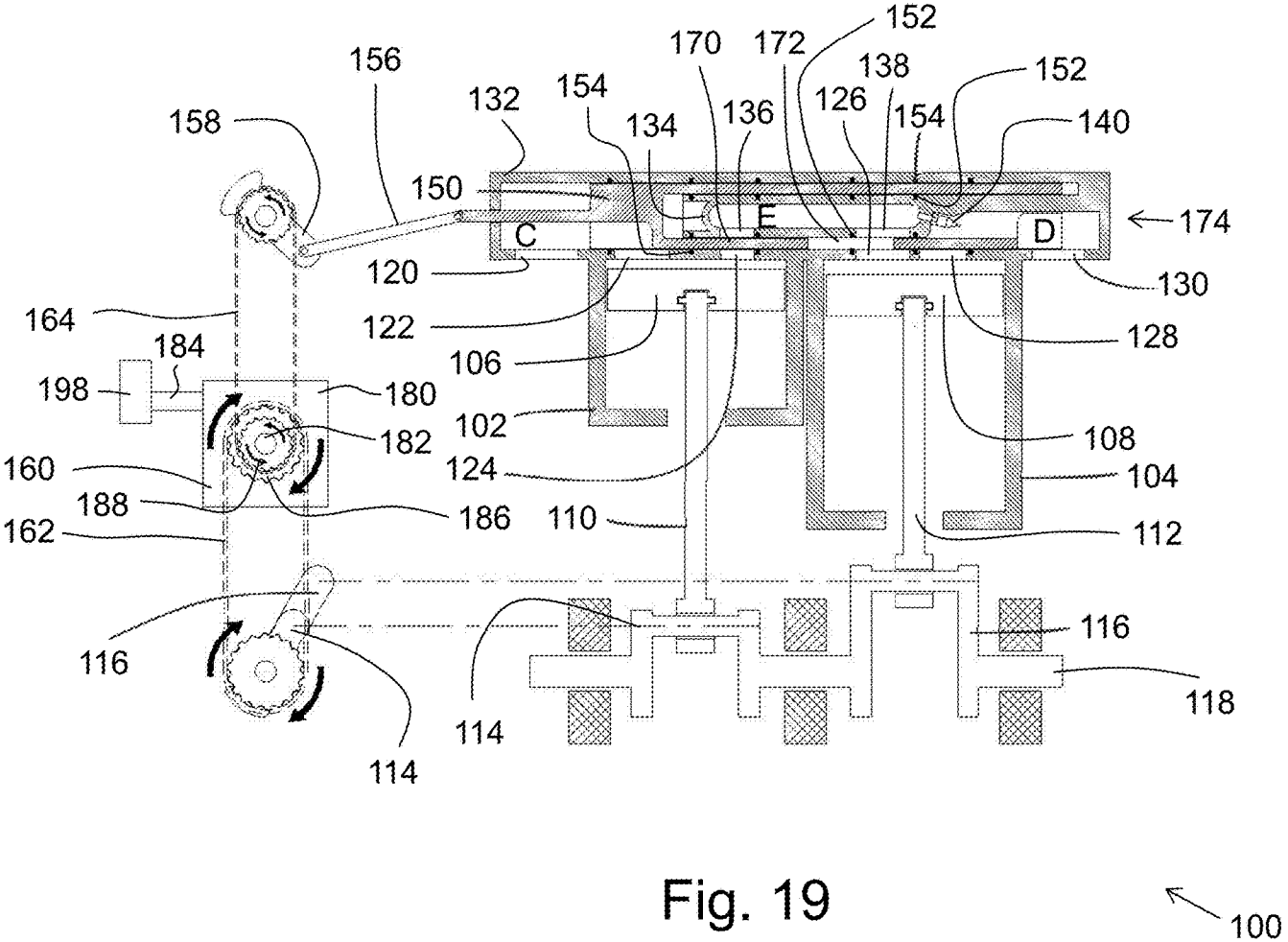
FIG. 19 schematically depicts the engine of FIG. 1 in the first transition cycle. The pistons are illustrated at 30 crankshaft degrees after their respective TDC points, and the sleeve shuttle is illustrated at 42 crankshaft degrees before its TDC point.
Figure 20:
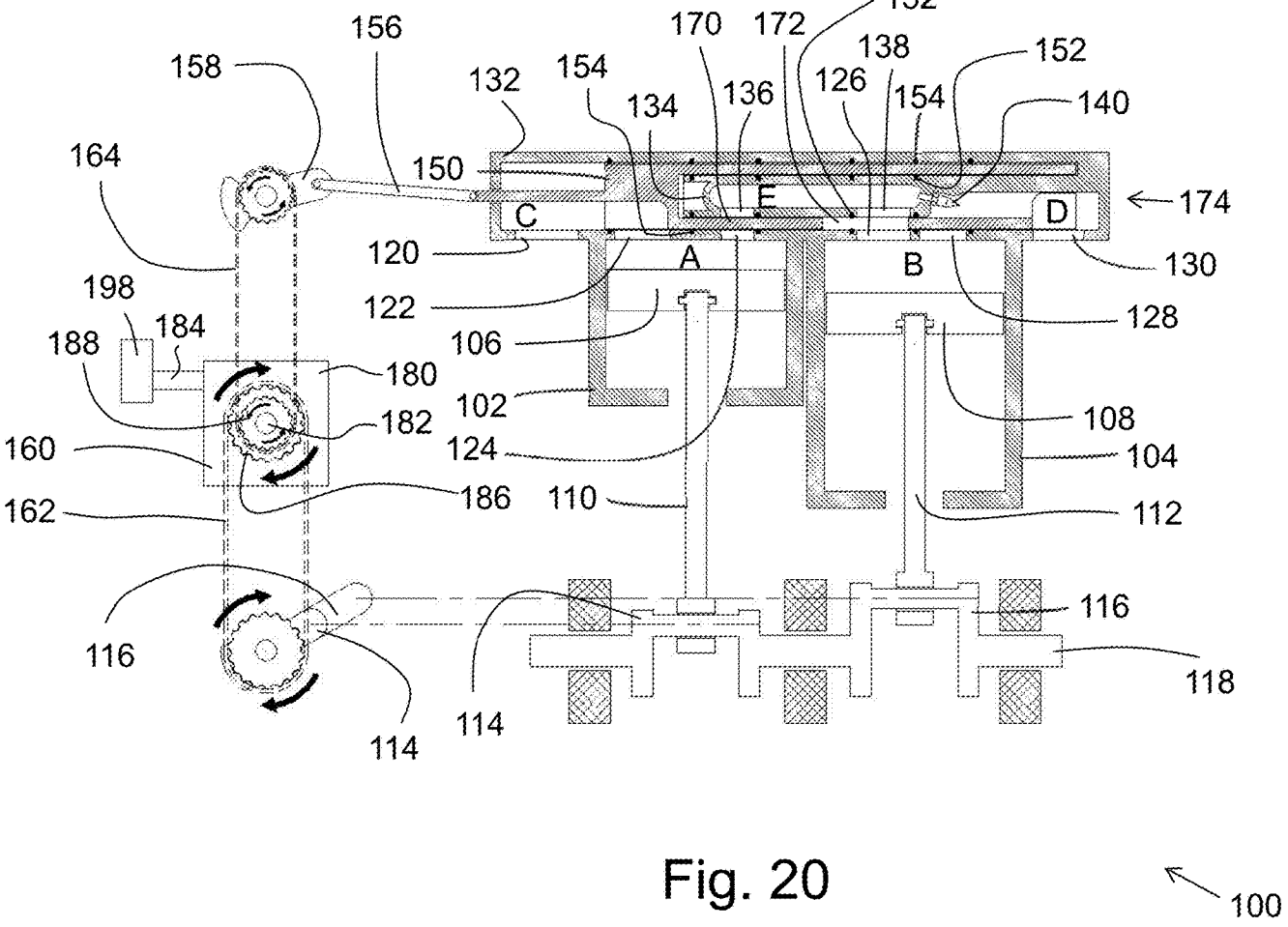
FIG. 20 schematically depicts the engine of FIG. 1 in the first transition cycle. The pistons are illustrated at 60 crankshaft degrees after their respective TDC points, and the sleeve shuttle is illustrated at 13 crankshaft degrees after its TDC point.
Figure 21:
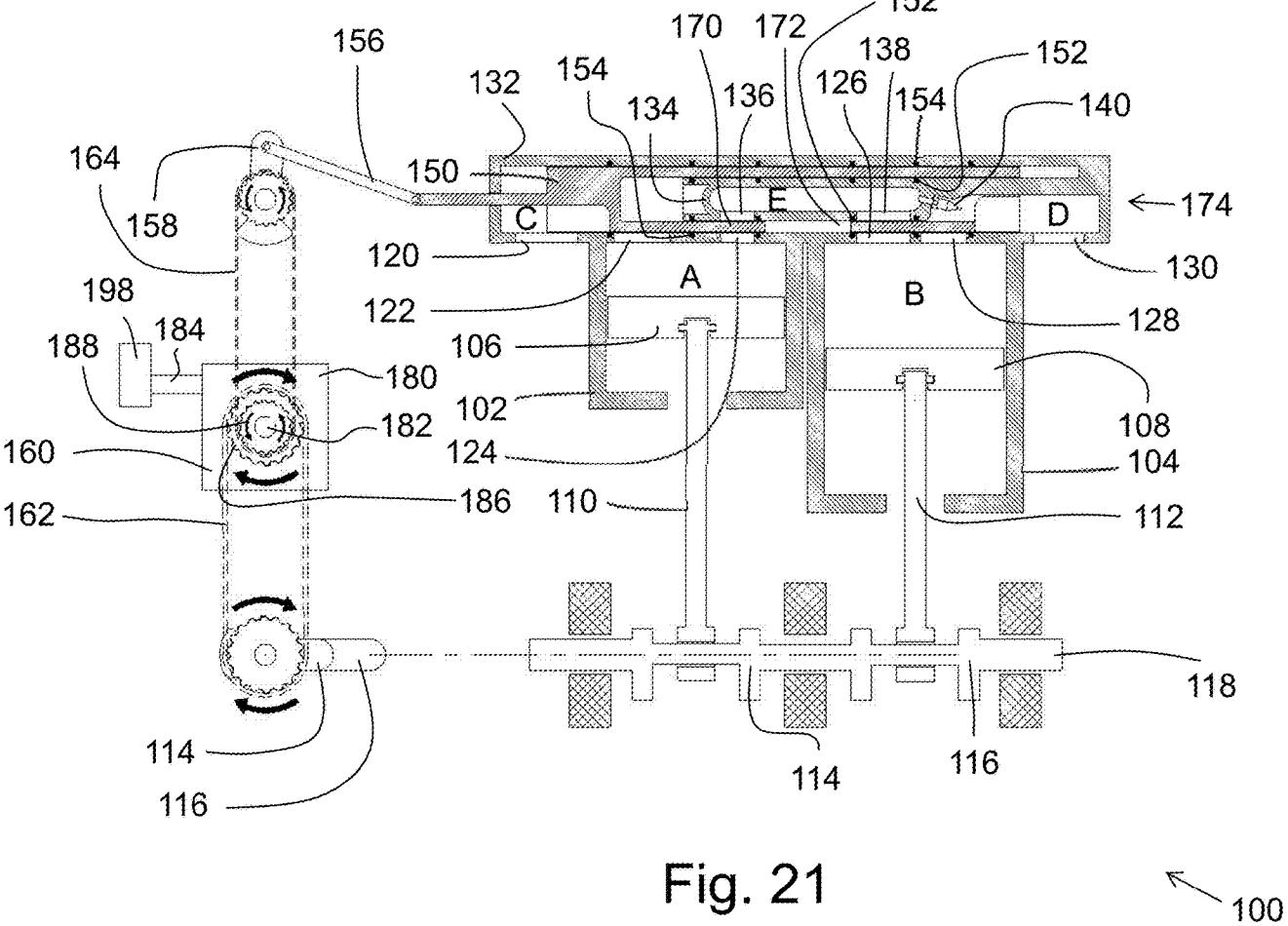
FIG. 21 schematically depicts the engine of FIG. 1 in the first transition cycle. The pistons are illustrated at 90 crankshaft degrees after their respective TDC points, and the sleeve shuttle is illustrated at 88 crankshaft degrees after its TDC point.
Figure 22:
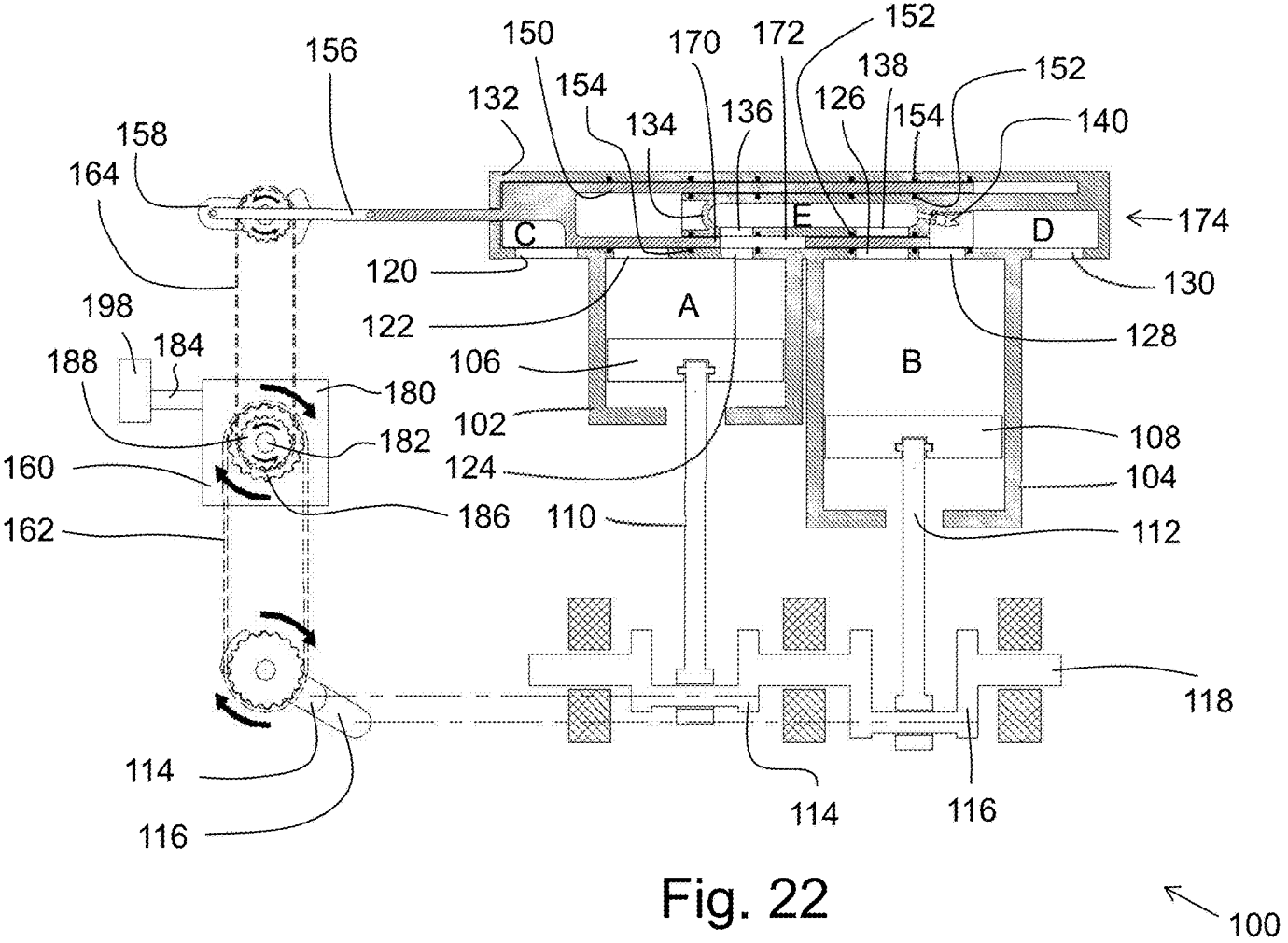
FIG. 22 schematically depicts the engine of FIG. 1 in the first transition cycle. The pistons are illustrated at 120 crankshaft degrees after their respective TDC points, and the sleeve shuttle is illustrated at 178 crankshaft degrees after its TDC point.
Figure 23:
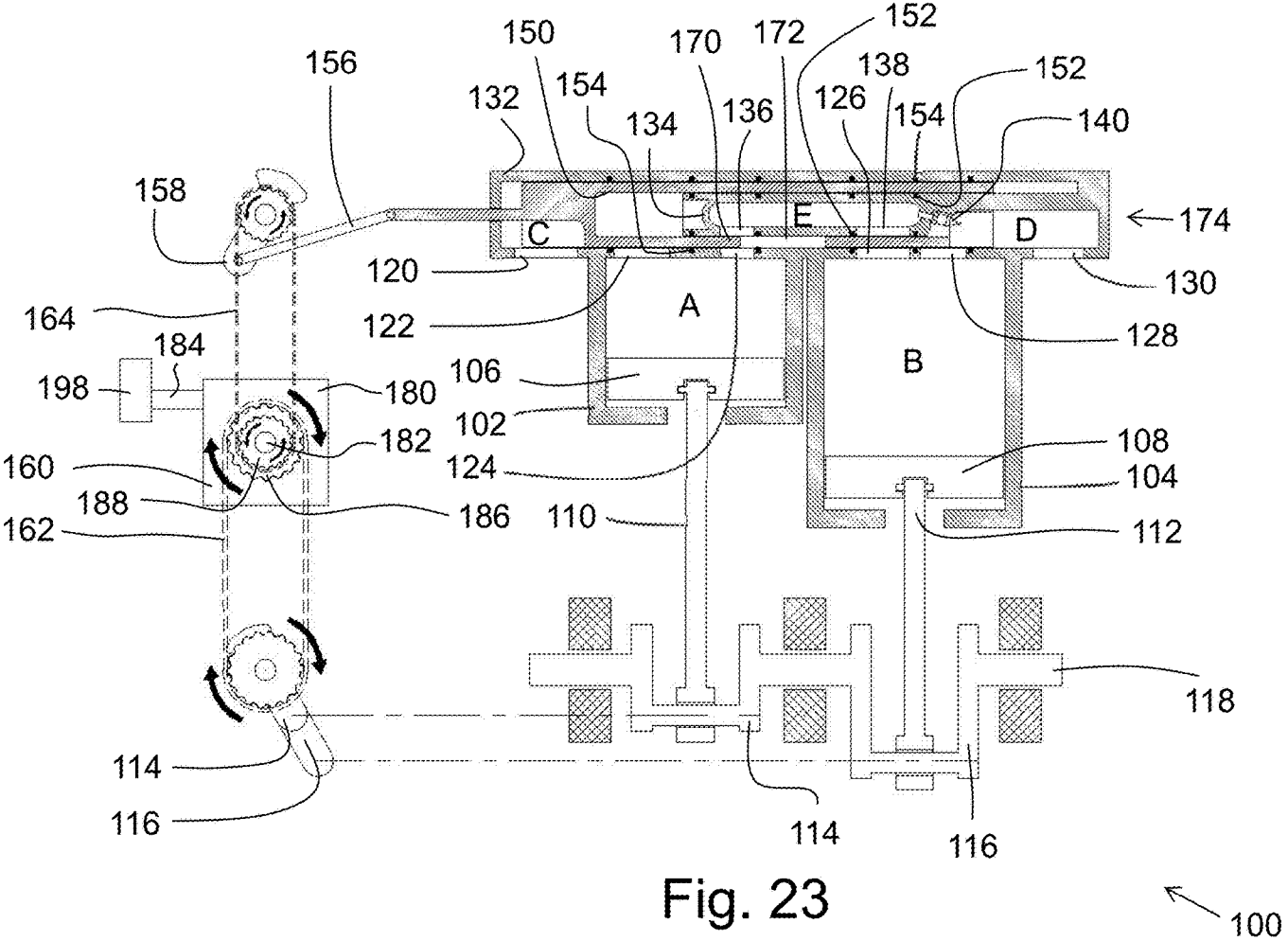
FIG. 23 schematically depicts the engine of FIG. 1 in the first transition cycle. The pistons are illustrated at 150 crankshaft degrees after their respective TDC points, and the sleeve shuttle is illustrated at 240 crankshaft degrees after its TDC point.
Figure 24:
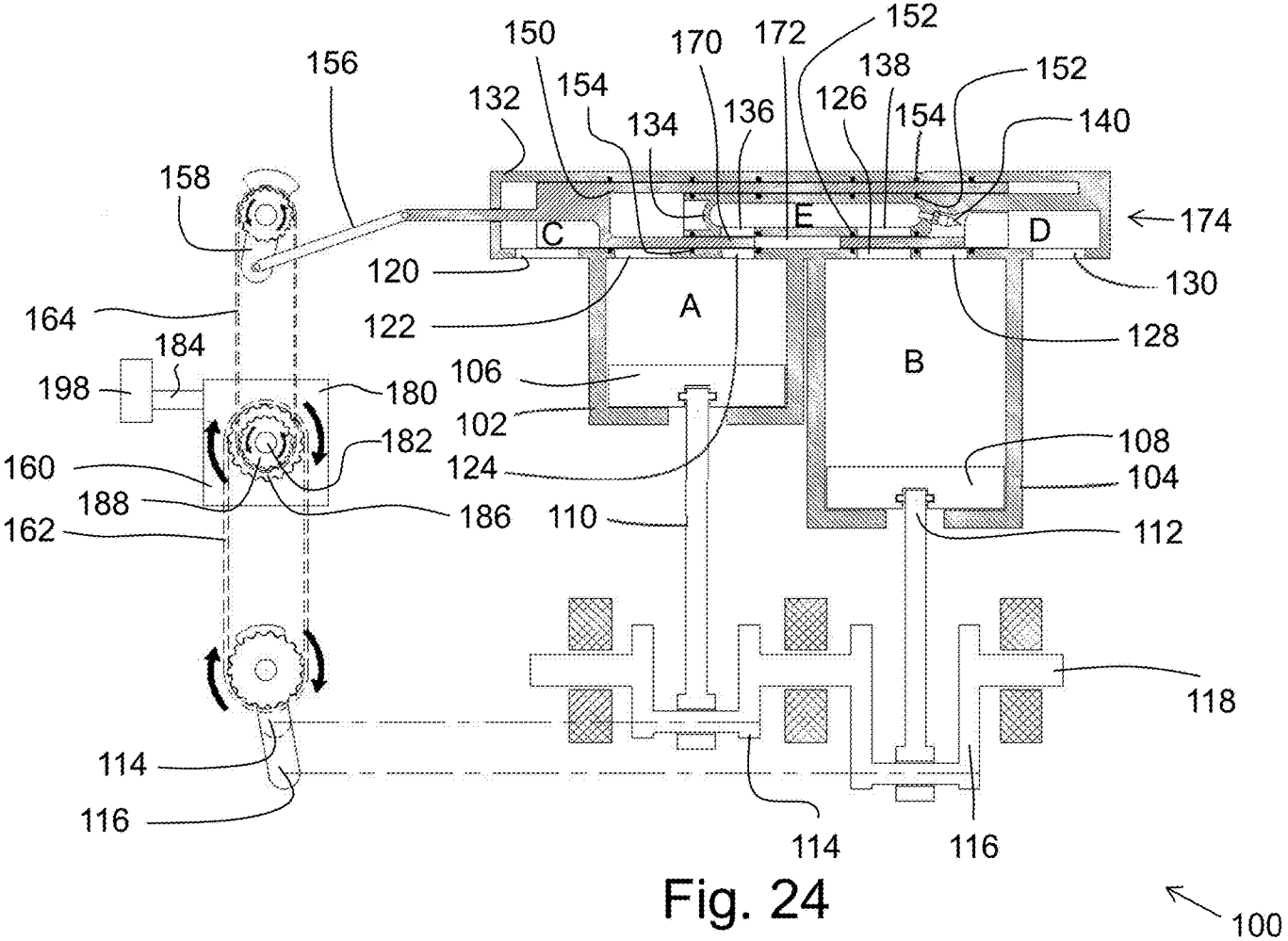
FIG. 24 schematically depicts the engine of FIG. 1 in the first transition cycle. The pistons are illustrated at 170 crankshaft degrees after their respective TDC points, and the sleeve shuttle is illustrated at 260 crankshaft degrees after its TDC point.
Figure 25:
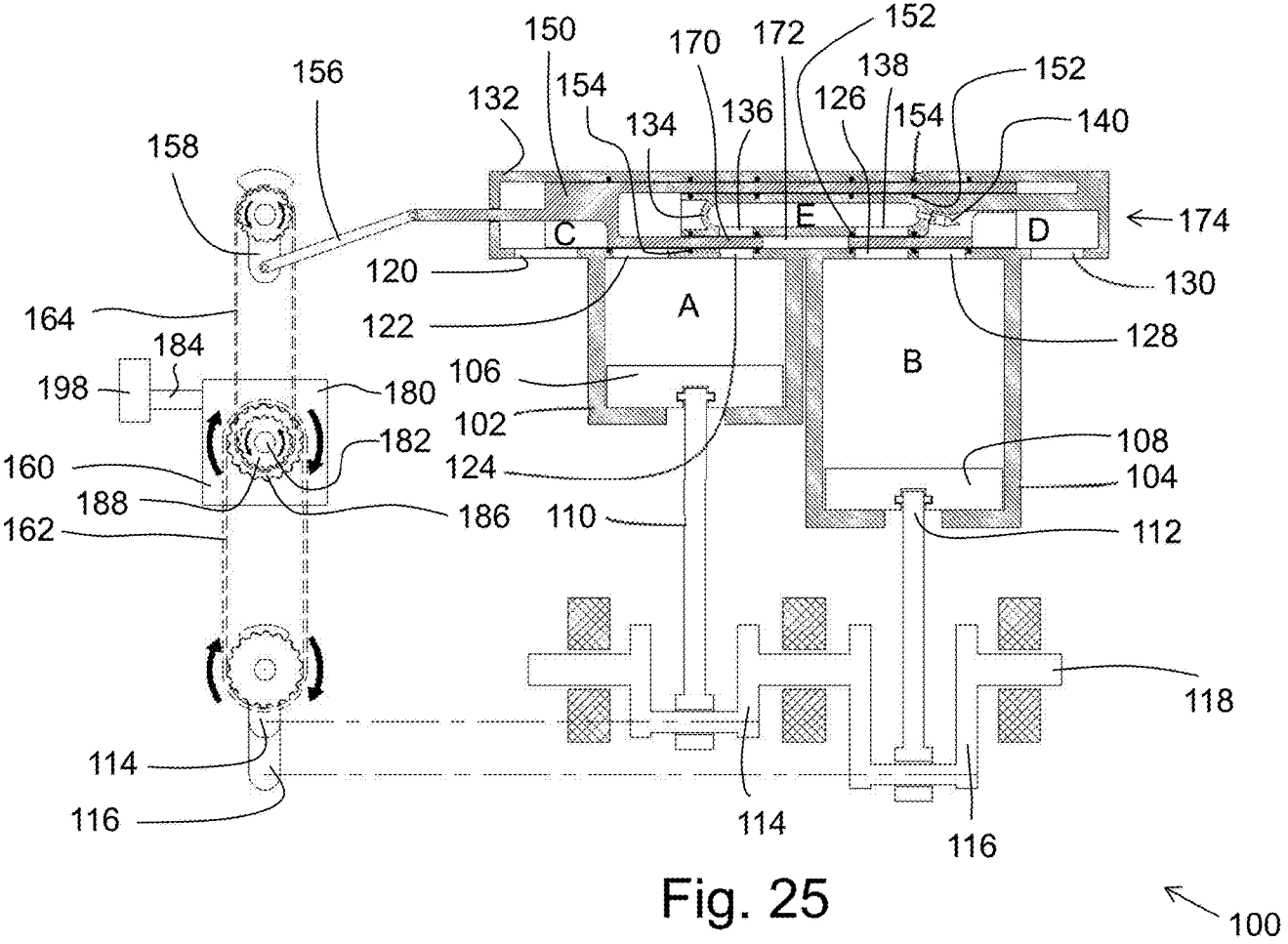
FIG. 25 schematically depicts the engine of FIG. 1 in the first transition cycle. The pistons are illustrated at 180 crankshaft degrees after their respective TDC points, and the sleeve shuttle is illustrated at 270 crankshaft degrees after its TDC point.
Figure 26:
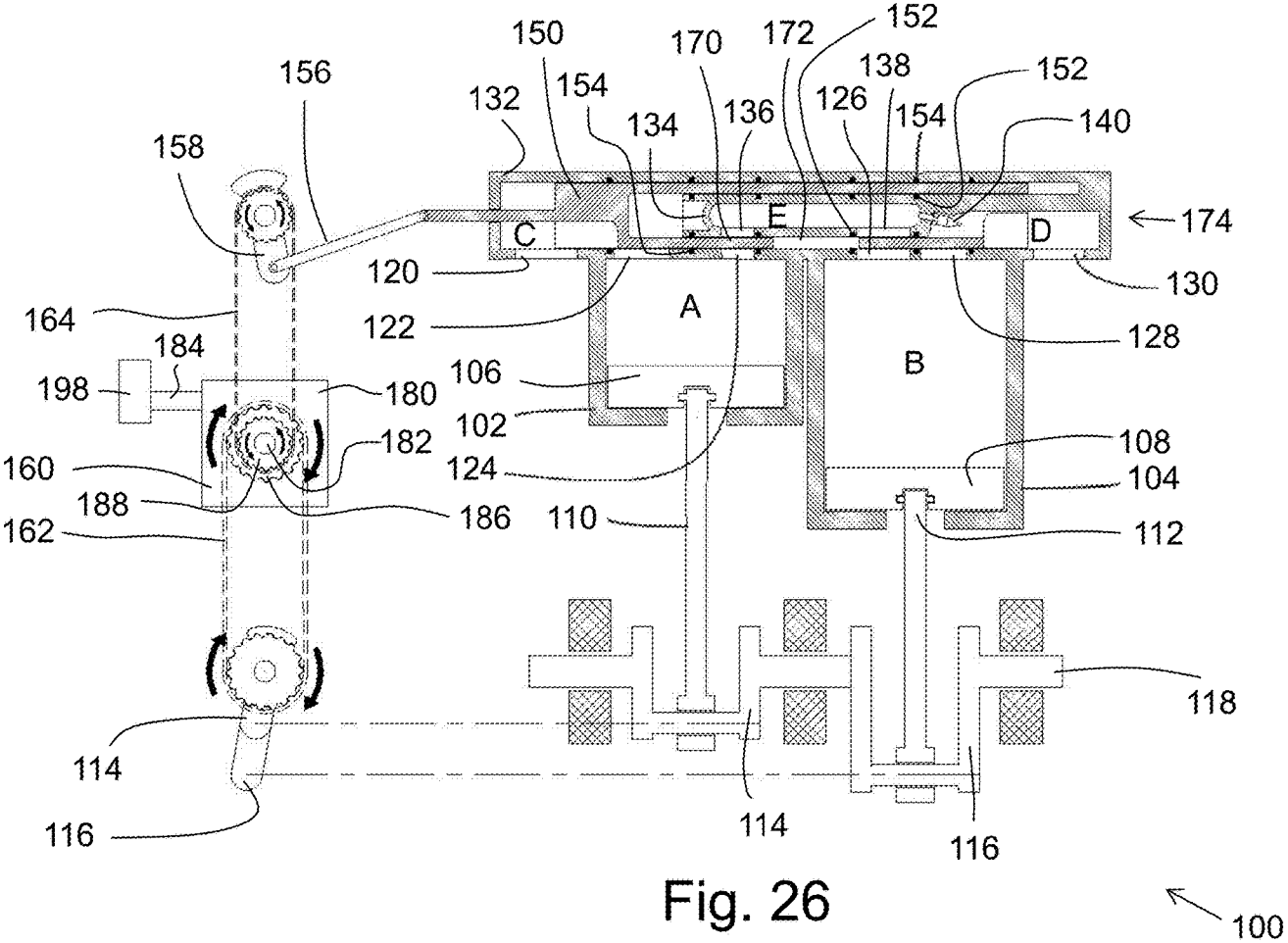
FIG. 26 schematically depicts the engine of FIG. 1 in the a first transition cycle. The pistons are illustrated at 190 crankshaft degrees after their respective TDC points, and the sleeve shuttle is illustrated at 280 crankshaft degrees after its TDC point.
Figure 27:
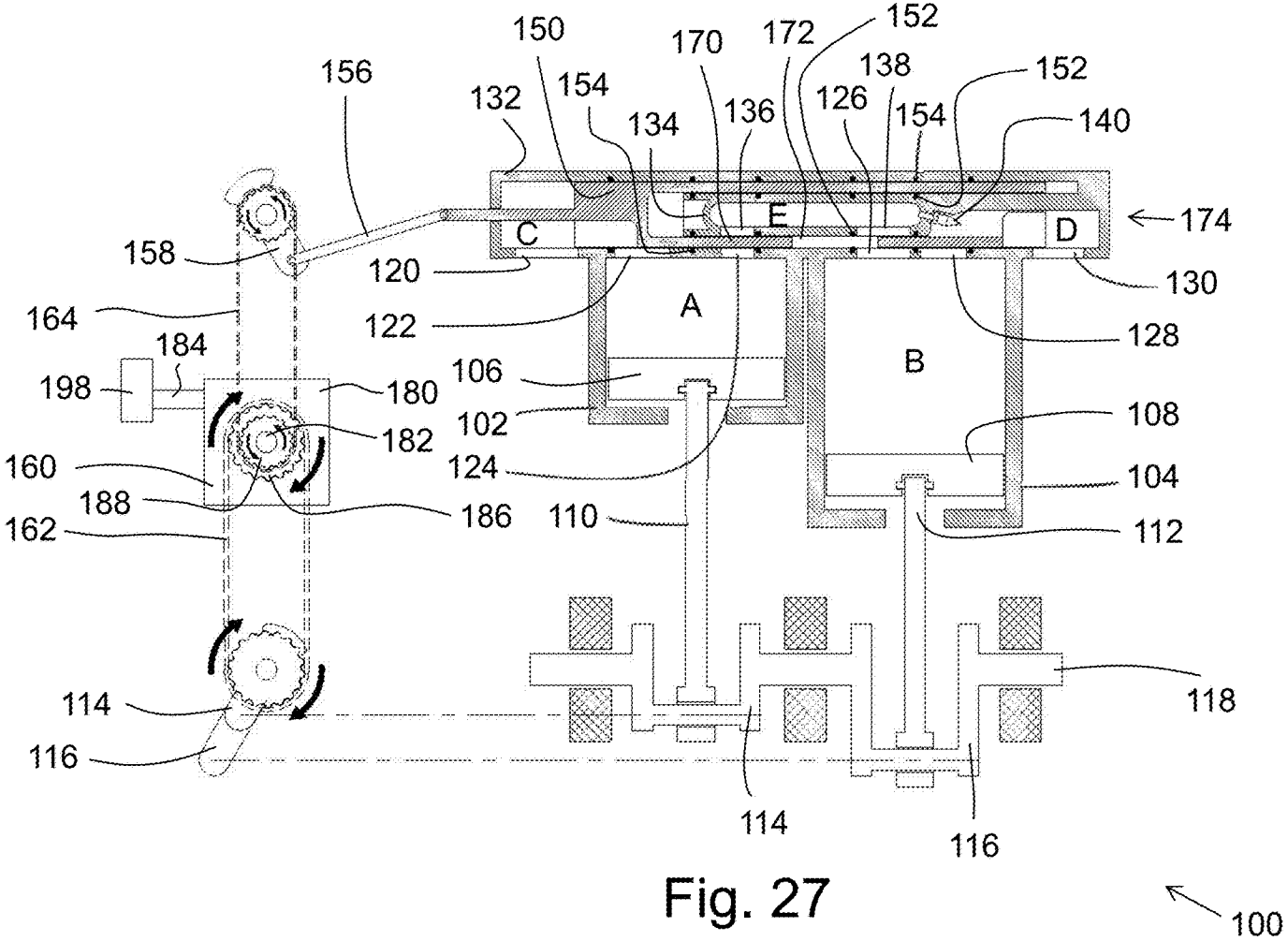
FIG. 27 schematically depicts the engine of FIG. 1 in the first transition cycle. The pistons are illustrated at 210 crankshaft degrees after their respective TDC points, and the sleeve shuttle is illustrated at 300 crankshaft degrees after its TDC point.
Figure 28:
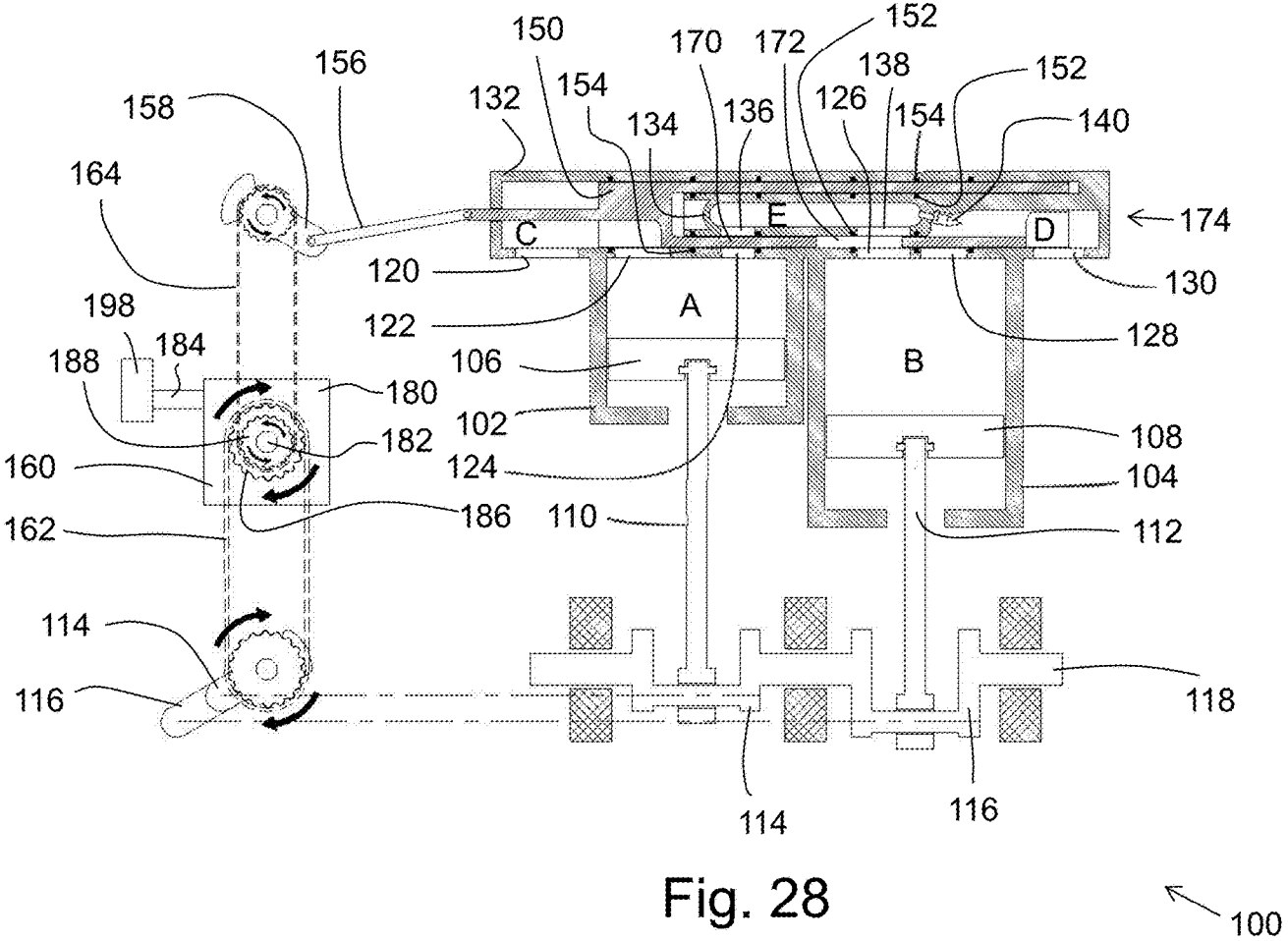
FIG. 28 schematically depicts the engine of FIG. 1 in the first transition cycle. The pistons are illustrated at 240 crankshaft degrees after their respective TDC points, and the sleeve shuttle is illustrated at 330 crankshaft degrees after its TDC point.
Figure 29:
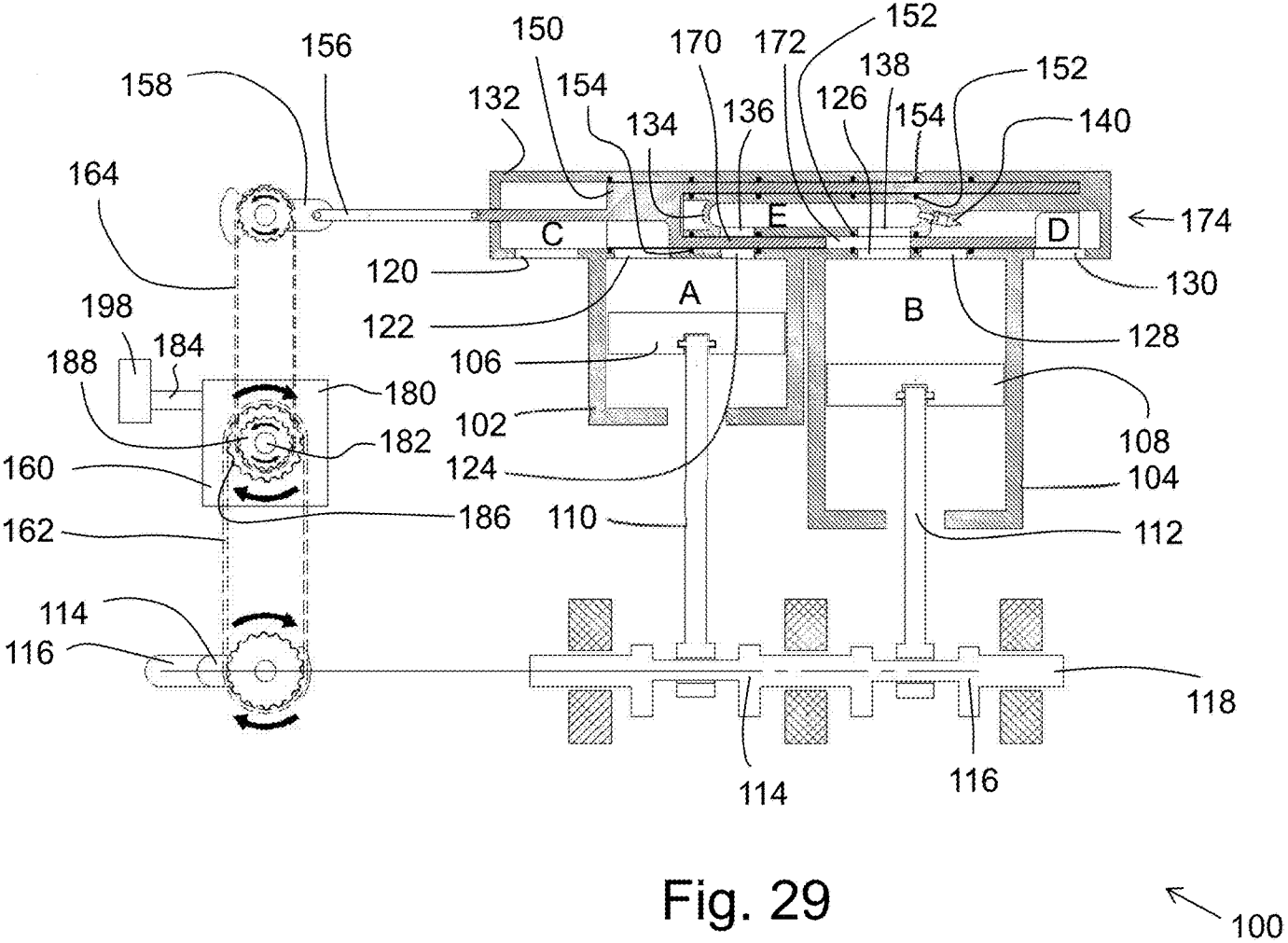
FIG. 29 schematically depicts the engine of FIG. 1 in the first transition cycle. The pistons are illustrated at 270 crankshaft degrees after their respective TDC points, and the sleeve shuttle is illustrated at its TDC point.
Figure 30:
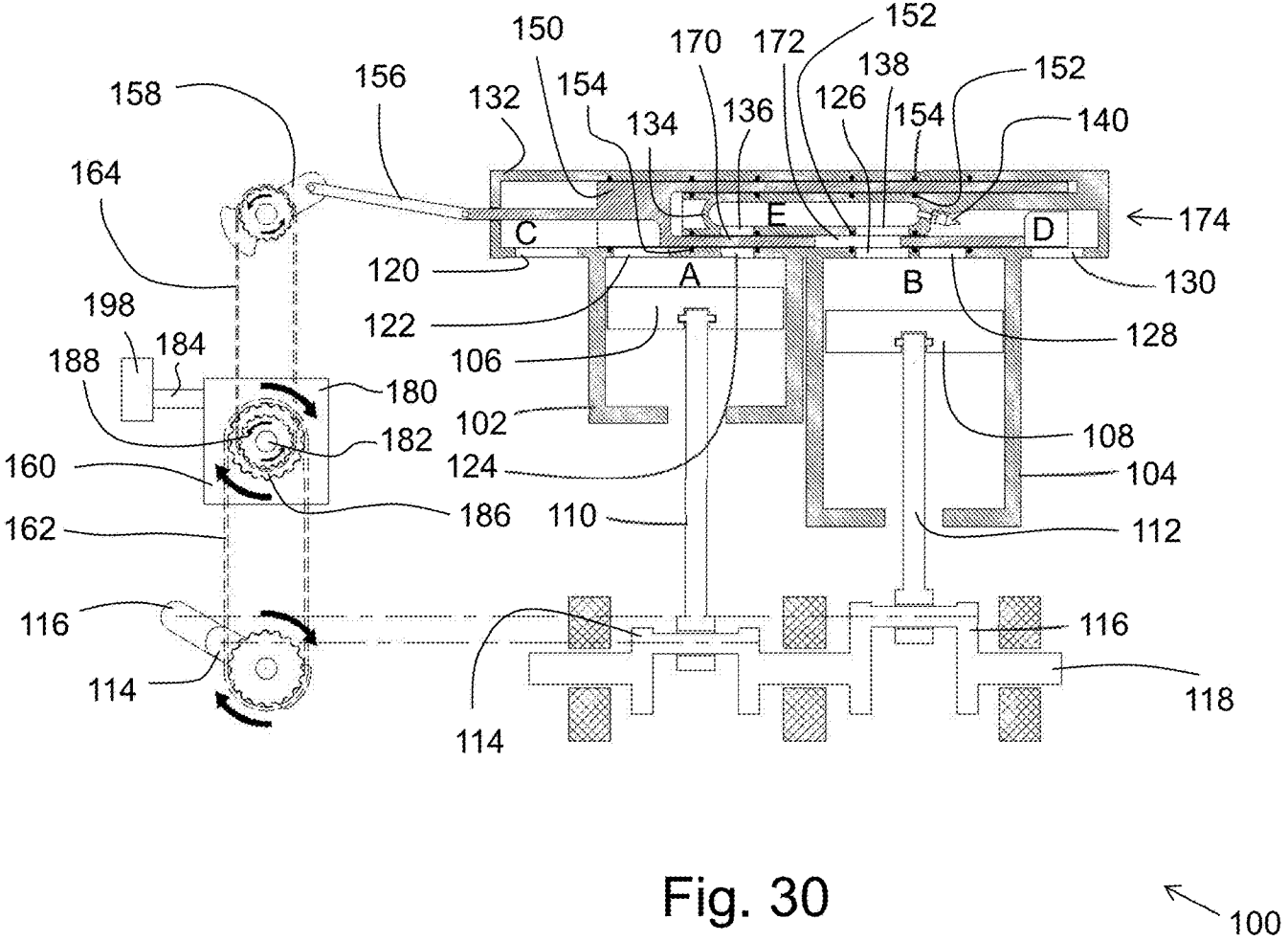
FIG. 30 schematically depicts the engine of FIG. 1 in the first transition cycle. The pistons are illustrated at 300 crankshaft degrees after their respective TDC points, and the sleeve shuttle is illustrated at 30 crankshaft degrees after its TDC point.
Figure 31:
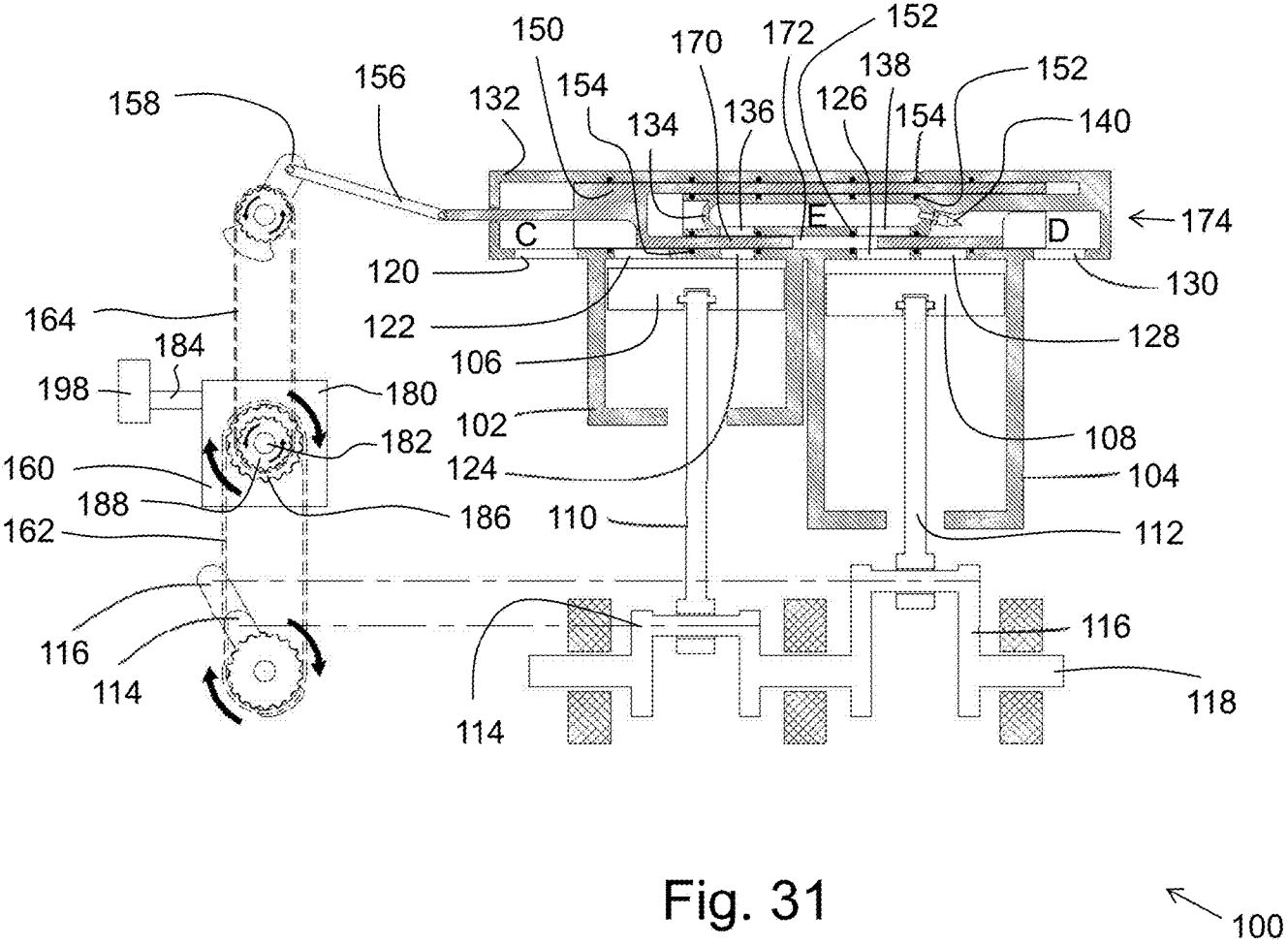
FIG. 31 schematically depicts the engine of FIG. 1 in the first transition cycle. The pistons are illustrated at 330 crankshaft degrees after their respective TDC points, and the sleeve shuttle is illustrated at 60 crankshaft degrees after its TDC point.
Figure 32:
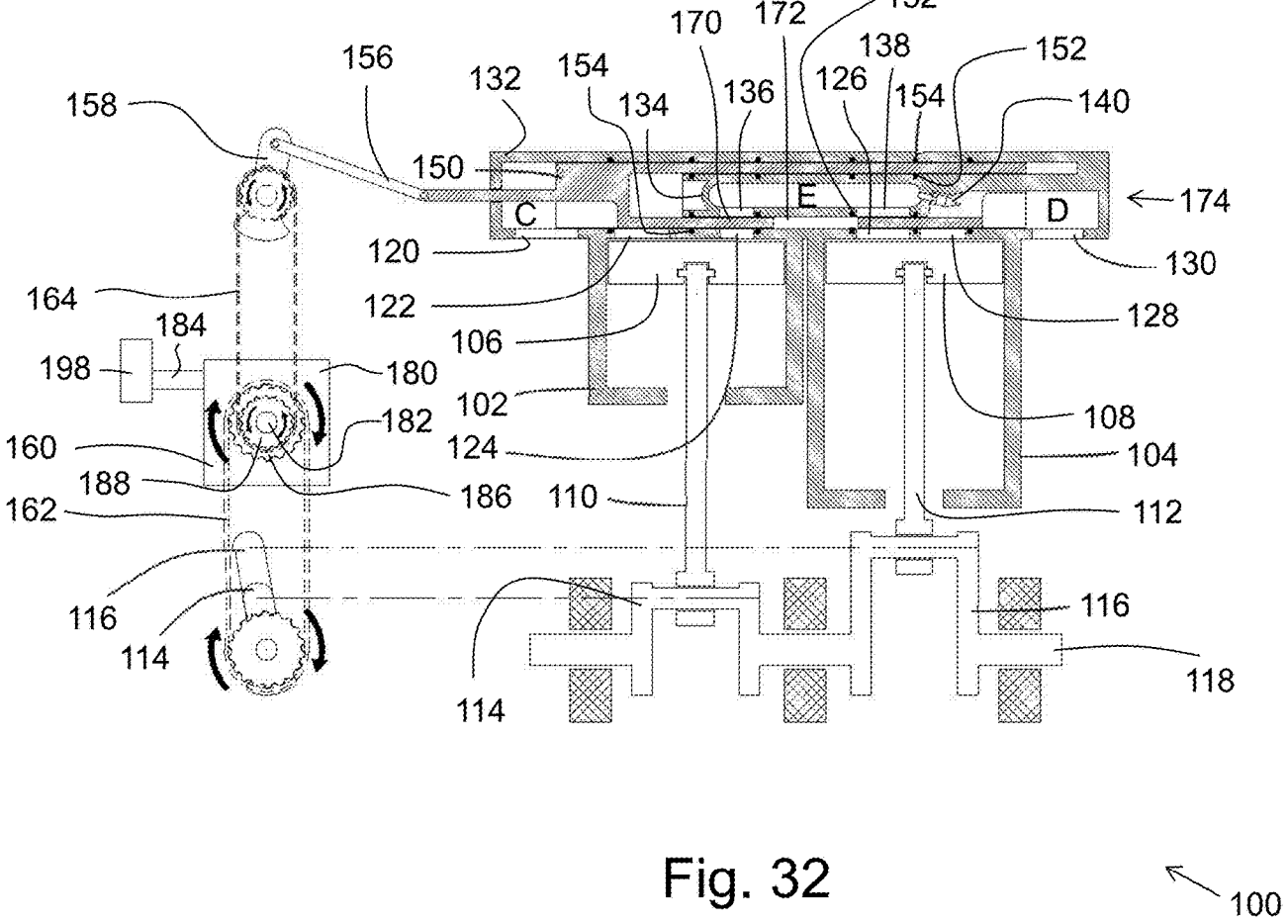
FIG. 32 schematically depicts the engine of FIG. 1 in the first transition cycle. The pistons are illustrated at 350 crankshaft degrees after their respective TDC points, and the sleeve shuttle is illustrated at 80 crankshaft degrees after its TDC point.

As sleeve shuttle 150 rightward motion continues (FIG. 19), sleeve shuttle 150 increasingly opens more of first port 122 and third port 126, possibly allowing for a higher flow rate of incoming working fluid from chamber C into chamber A and a higher flow rate of burnt fuel gas from chamber E into chamber B. As can be seen in FIGS. 19 and 20, the phase shift between the motion of sleeve shuttle 150 and the motions of first piston 106 and second piston 108 continues to vary, as sleeve shuttle 150 reverses its direction of motion and starts moving to the left.

When first piston 106 and second piston 108 are 90 crankshaft degrees after their respective TDC positions, that is to say, midway down first cylinder 102 and second cylinder 104, respectively, sleeve shuttle 150 nears its mid-stroke point from the left (still accumulating the phase shift—FIG. 21) and closes first port 122, thereby sealing the uncompressed working fluid inside chamber A, and also closes third port 126, thereby sealing burnt fuel gas in chamber B, and burnt fuel gas in the now decoupled chamber E. The work performed by the burnt fuel gas in pushing down second piston 108, results in decreasing the gas' pressure, specifically in chamber E.

After first piston 106 and second piston 108 each moves down past the midway point between their respective TDC positions and BDC positions, sleeve shuttle leftward motion opens second port 124 and fourth port 128, thereby allowing for fluid communication between chamber A and chamber E, and between chamber B and chamber D. As first piston 106 and second piston 108 continue their descent (FIG. 22), sleeve shuttle 150 leftward motion increasingly opens more of second port 124 and fourth port 128, and the phase shift continues to vary (continues to grow), reaching a 90 degrees advance over first piston 106 and second piston 108).

As first piston 106 and second piston 108 near their respective BDC positions (FIG. 23), and sleeve shuttle 150 nears its mid-stroke point from the left (having reversed its direction of motion relative to FIG. 22), sleeve shuttle 150 is 90 crankshaft degrees in advance of first piston 106 and second piston 108 and sleeve shuttle 150 moves synchronously with first piston 106 and second piston 108. In other words, the phase shift between sleeve crankshaft 158 and first crankshaft 114 corresponds to the second mode of operation, hence this phase shift remains unchanged during the third part of the first transition cycle.

During the third part of the first transition cycle (FIGS. 25-33) first piston 106 and second piston 108 move in phase, and sleeve shuttle 150 moves synchronously with first piston 106 and second piston 108 at a positive phase shift of 90 crankshaft degrees with respect to the pistons as explained above. Second piston 108 is employed to perform a compression stroke, compressing the gas in chamber B into combustion chamber E via third port 126, sleeve port 172 and second combustion chamber port 138. First piston 106 is employed to perform an exhaust stroke, exhaling the gas from chamber A through first port 122, chamber C and manifold 120 to ambient air. The fluid that resides in chamber B during the compression stroke in the third part of the first transmission cycle may be composed partly or mostly or completely of burnt gas, subsequent the most recent combustion in chamber E. Also, the gas that resides in chamber A during the exhaust stroke in the third part of the first transmission cycle may be composed partly or mostly or completely of unexploited working fluid (fuel composition) which was fed into chamber A during the most recent intake stroke in the first part of the first transition cycle. It is noted however that variations in the fluid contents of the chambers relative to their respective fluidic contents in the compression and exhaust strokes in the second mode of operation (FIGS. 33-49) may occur, and it may take a few further cycles for these variations to disappear as the engine continues operation in the second mode.

It is noted that as first cylinder 102 and second cylinder 104 switch roles (so that intake and compression take place in chamber B and expansion and exhaust take place in chamber A), first manifold 120 and second manifold 130 also switch roles. Second manifold 130 is employed as input for incoming working fluid, whereas first manifold 120 is employed for exhaling burnt gas to ambient air. In some embodiments it may be further required to switch fluid connection between the engine and devices and components such as a carburetor, condenser or compressor, and an exhaust system comprising for example a catalytic converter and a muffler (a silencer) (all not shown in these Figures). For example, a carburetor (not shown here) fluidly associated with first manifold 120 in the first mode of operation, is switched, during the first transition cycle, to be fluidly associated with second manifold 130, and likewise an exhaust system (not shown here) fluidly associated with second manifold 130 in the first mode of operation, is switched, during the first transition cycle, to be fluidly associated with first manifold 120. Such switching is further detailed and explained hereinbelow in FIGS. 66 and 67.

It should be understood that descriptions of possible ranges of opening times and closing times of engine 100 ports, and the phase shifts between various components of engine 100 (such as, for example, first piston 106 and second piston 108, or, for example, second crankshaft 116 and sleeve crankshaft 158, etc.) at first piston TDC and BDC, specifically those appearing at the end of the section describing the first mode of engine 100 cycle, also apply, mutatis mutandis, to the above description of the first transition cycle.

Second Mode of Operation

In the second mode (FIGS. 33-49), second piston 108 performs an intake stroke (FIGS. 33-41), followed by a compression stroke (FIGS. 41-49), and first piston 106 performs an expansion stroke (FIGS. 33-41) followed by an exhaust stroke (FIGS. 41-49). It should be understood that in the second mode of operation, first crankshaft 114, second crankshaft 116, power crankshaft 118 and sleeve crankshaft 158 rotate in the same direction as in the first mode of operation. In other words, transferring from the first mode to the second (or vice versa) does not interfere with the direction of revolution of these shafts and, specifically, does not reverse it.

Figure 33:
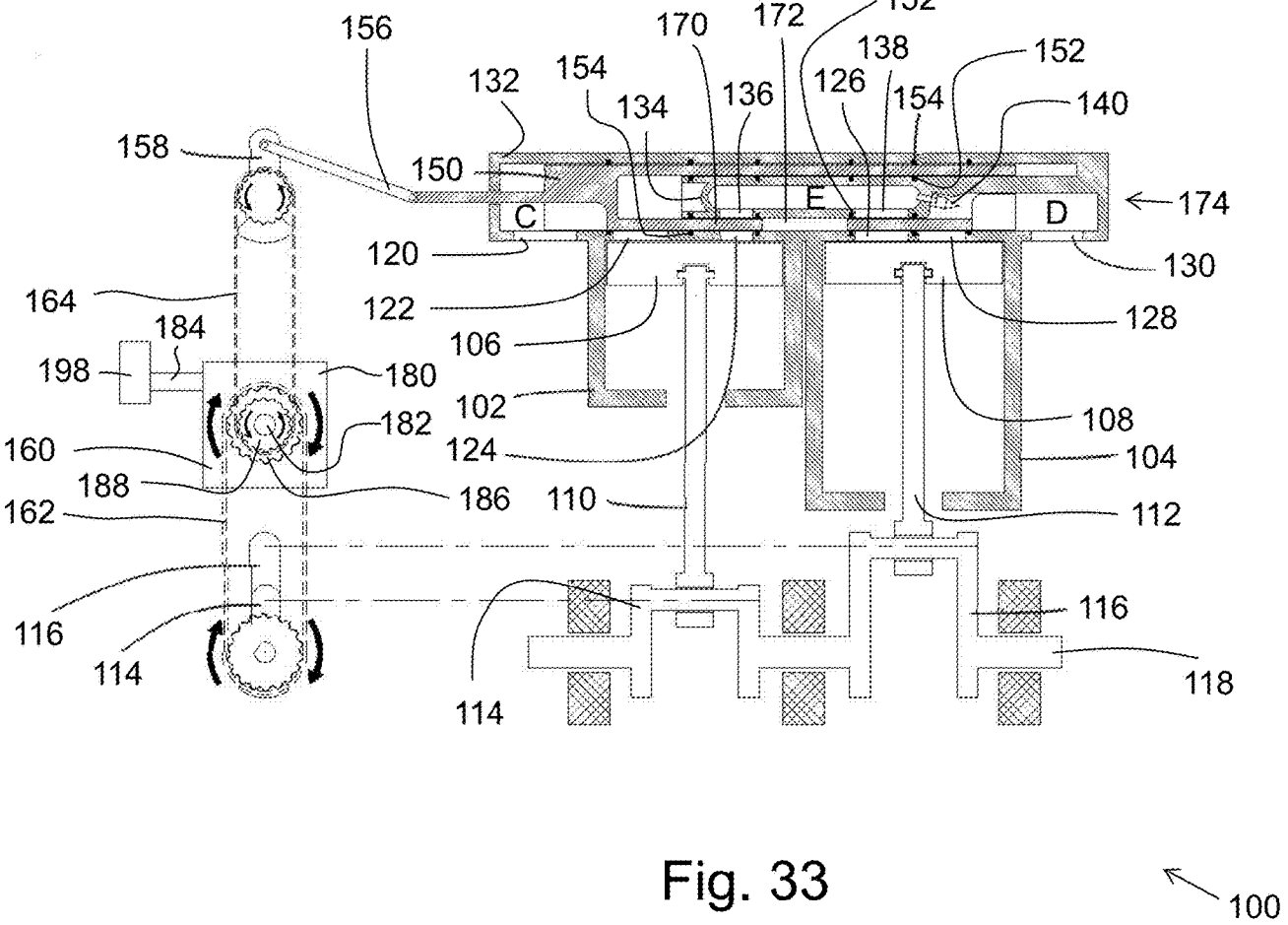
FIG. 33 schematically depicts the engine of FIG. 1 at the end of the first transition cycle and start of a second mode of operation. The pistons are illustrated at their respective TDC points, and the sleeve shuttle is illustrated at 90 crankshaft degrees after its TDC point.
Figure 34:
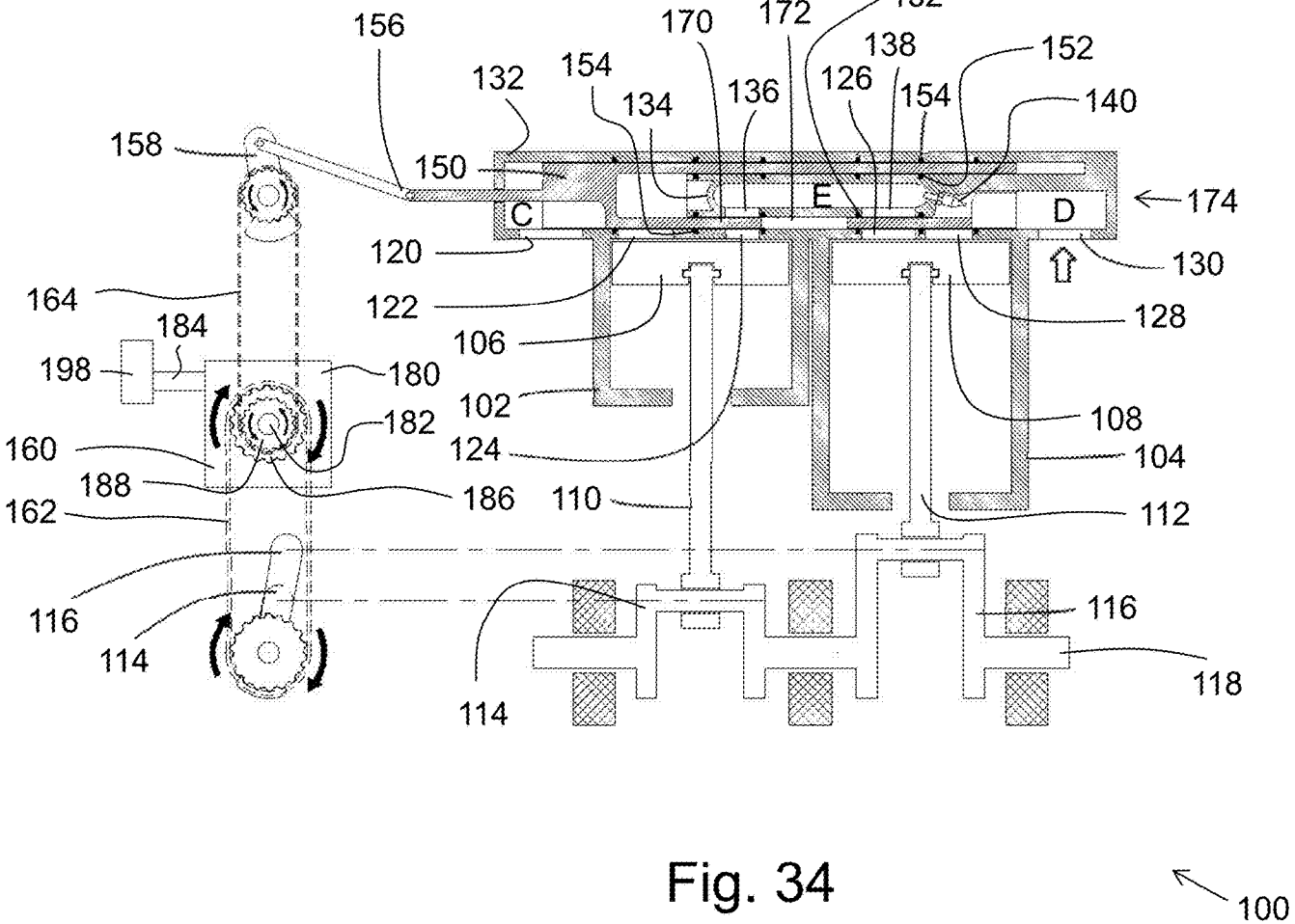
FIG. 34 schematically depicts the engine of FIG. 1 in the second mode of operation. The pistons are illustrated at 10 crankshaft degrees after their respective TDC points, and the sleeve shuttle is illustrated at 100 crankshaft degrees after its TDC point.
Figure 35:
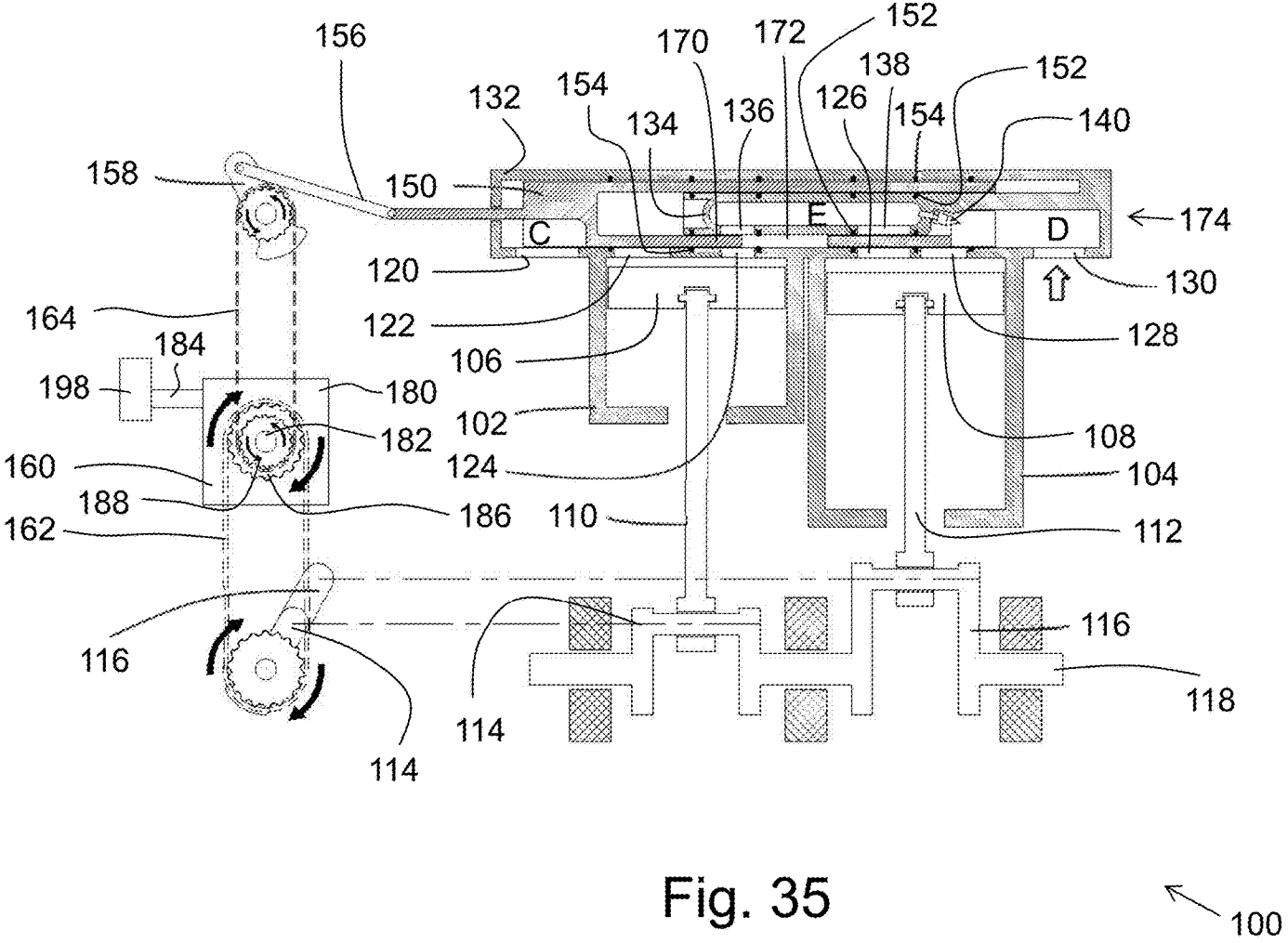
FIG. 35 schematically depicts the engine of FIG. 1 in the second mode of operation. The pistons are illustrated at 30 crankshaft degrees after their respective TDC points, and the sleeve shuttle is illustrated at 120 crankshaft degrees after its TDC point.
Figure 36:
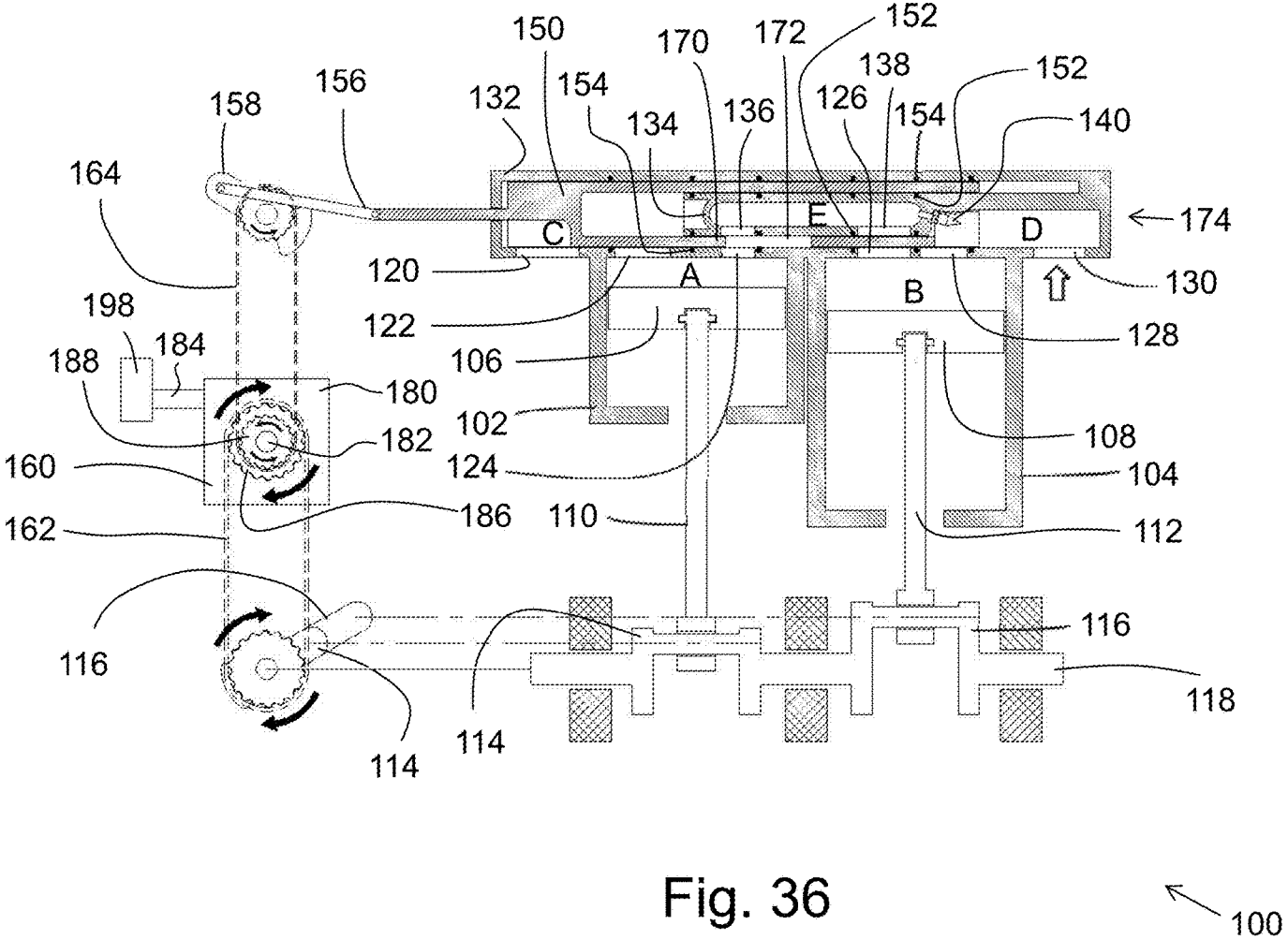
FIG. 36 schematically depicts the engine of FIG. 1 in the second mode of operation. The pistons are illustrated at 60 crankshaft degrees after their respective TDC points, and the sleeve shuttle is illustrated at 150 crankshaft degrees after its TDC point.
Figure 37:
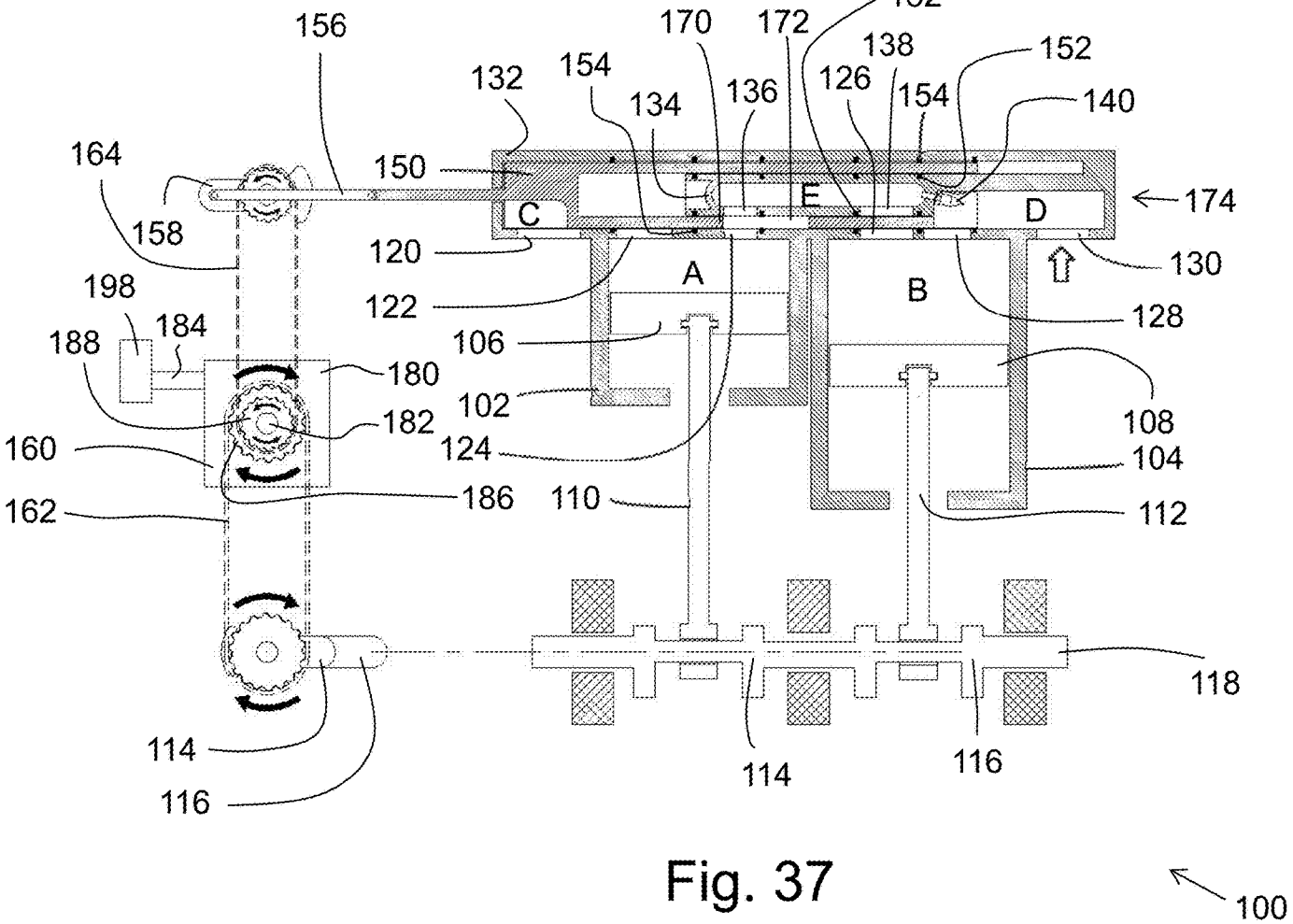
FIG. 37 schematically depicts the engine of FIG. 1 in the second mode of operation. The pistons are illustrated at 90 crankshaft degrees after their respective TDC points, and the sleeve shuttle ill illustrated at 180 crankshaft degrees after its TDC point.
Figure 38:
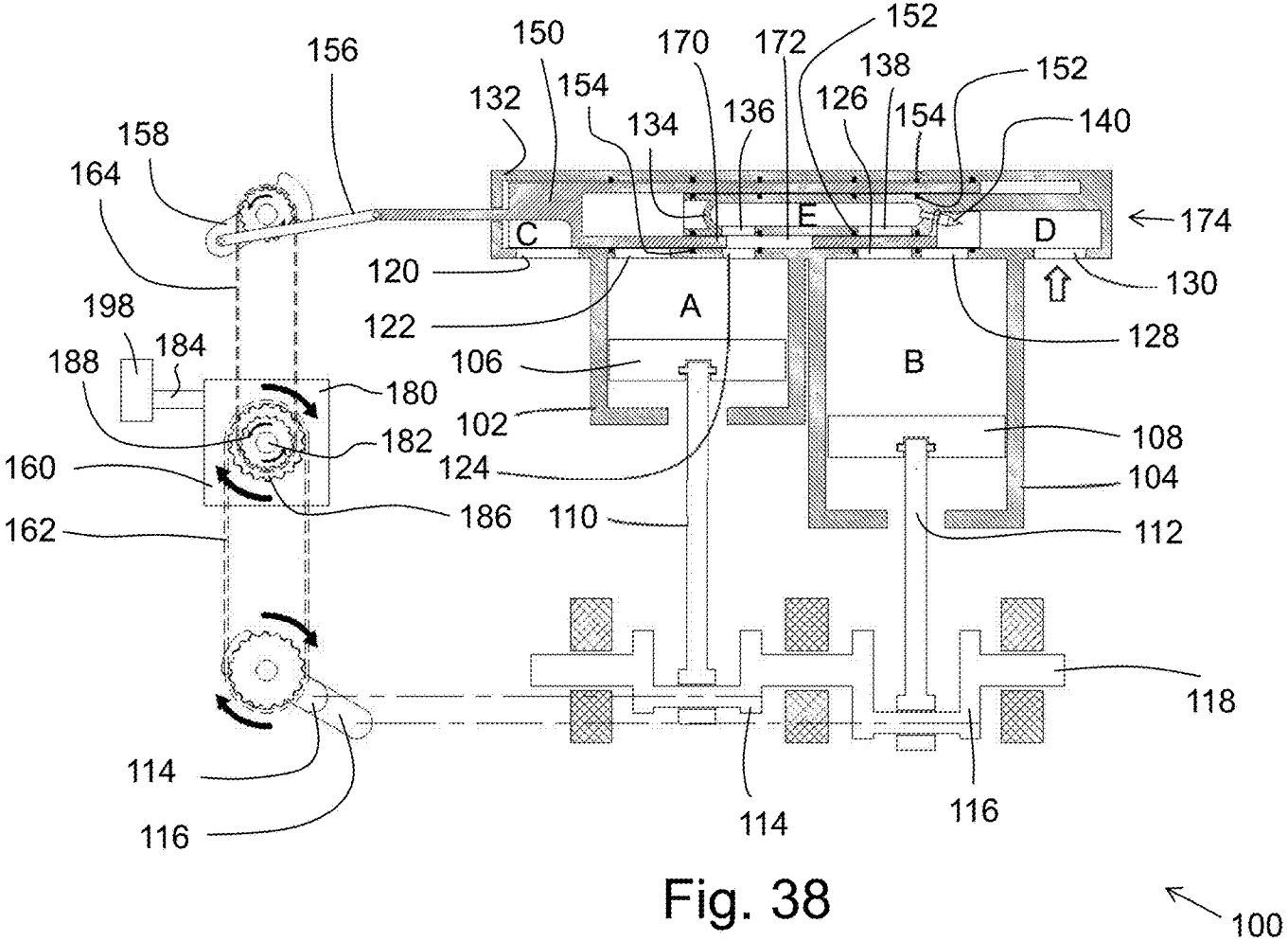
FIG. 38 schematically depicts the engine of FIG. 1 in the second mode of operation. The pistons are illustrated at 120 crankshaft degrees after their respective TDC points, and the sleeve shuttle is illustrated at 210 crankshaft degrees after its TDC point.
Figure 39:
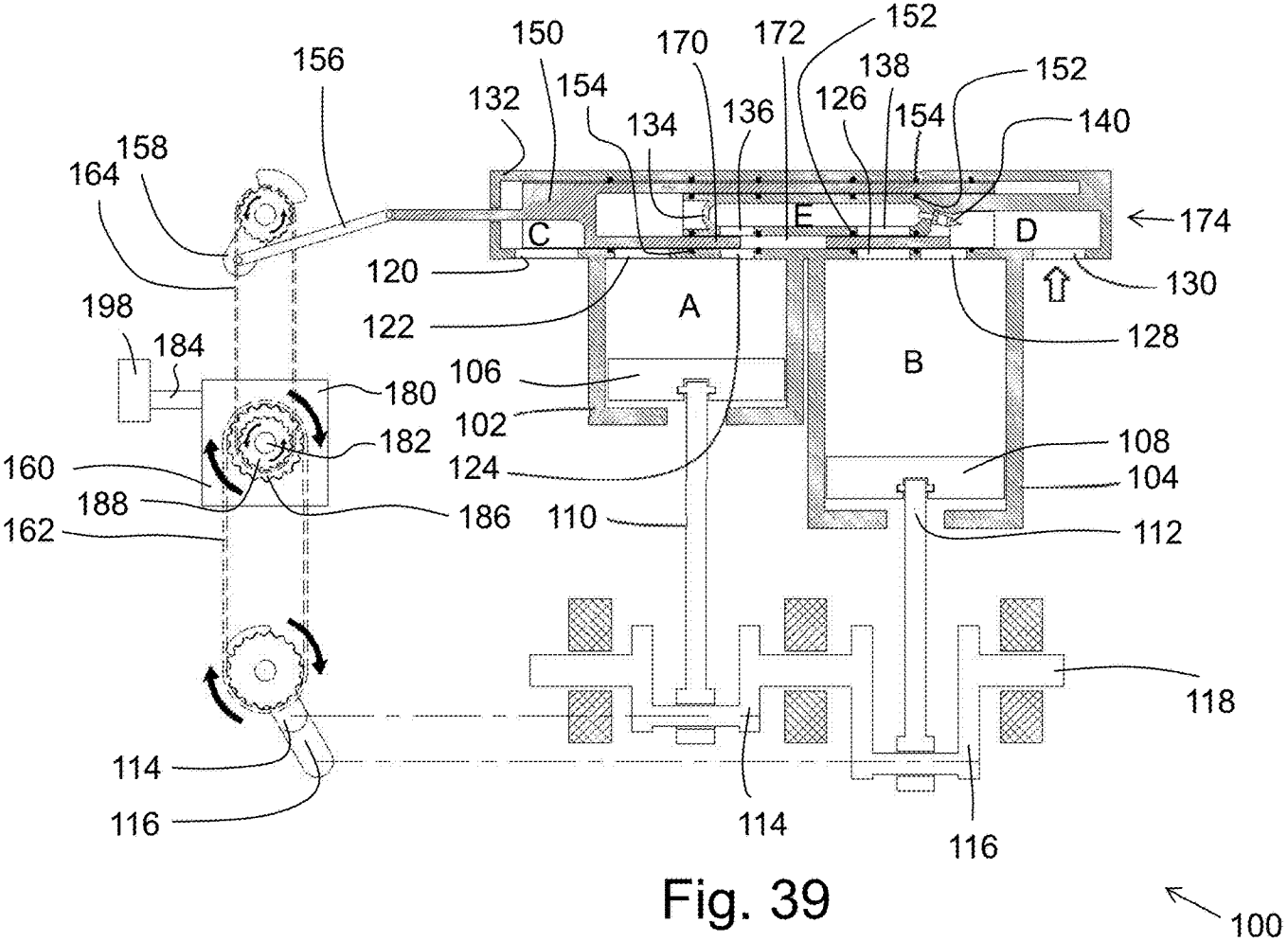
FIG. 39 schematically depicts the engine of FIG. 1 in the second mode of operation. The pistons are illustrated at 150 crankshaft degrees after their respective TDC points, and the sleeve shuttle is illustrated at 240 crankshaft degrees after its TDC point.
Figure 40:
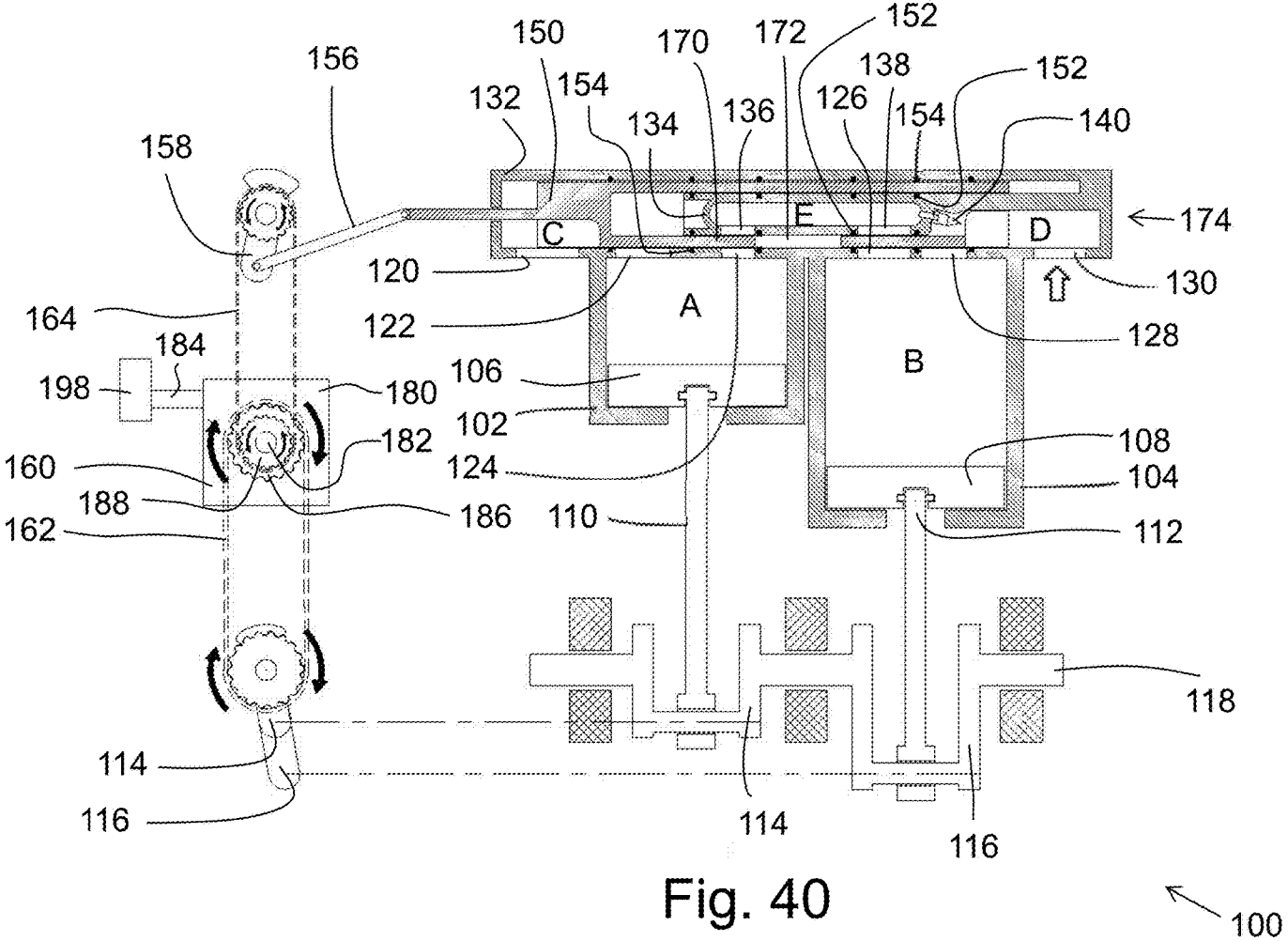
FIG. 40 schematically depicts the engine of FIG. 1 in the second mode of operation. The pistons are illustrated at 170 crankshaft degrees after their respective TDC points, and the sleeve shuttle is illustrated at 260 crankshaft degrees after its TDC point.
Figure 41:
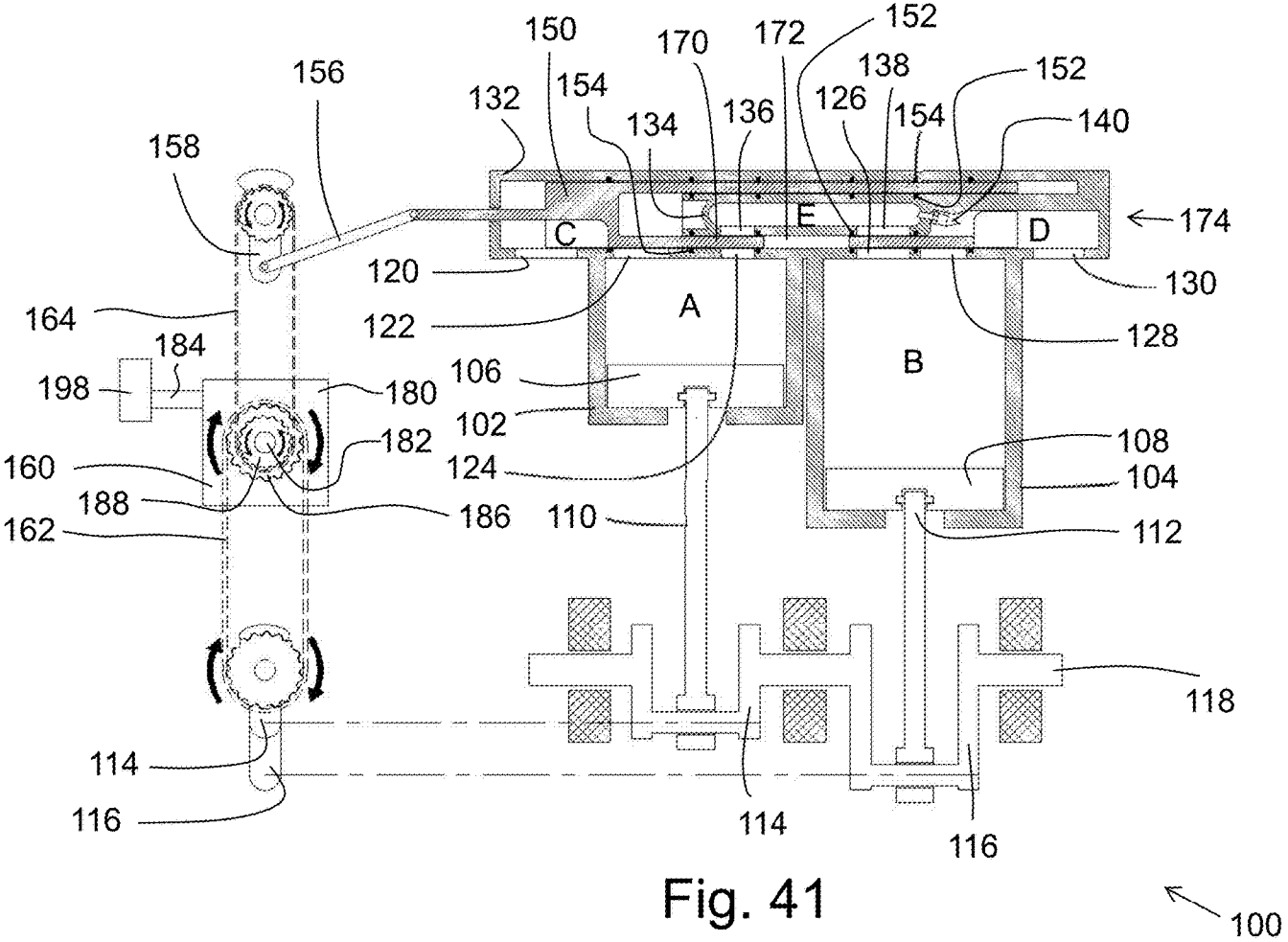
FIG. 41 schematically depicts the engine of FIG. 1 in the second mode of operation. The pistons are illustrated at 180 crankshaft degrees after their respective TDC points, and the sleeve shuttle is illustrated at 270 crankshaft degrees after its TDC point.
Figure 42:
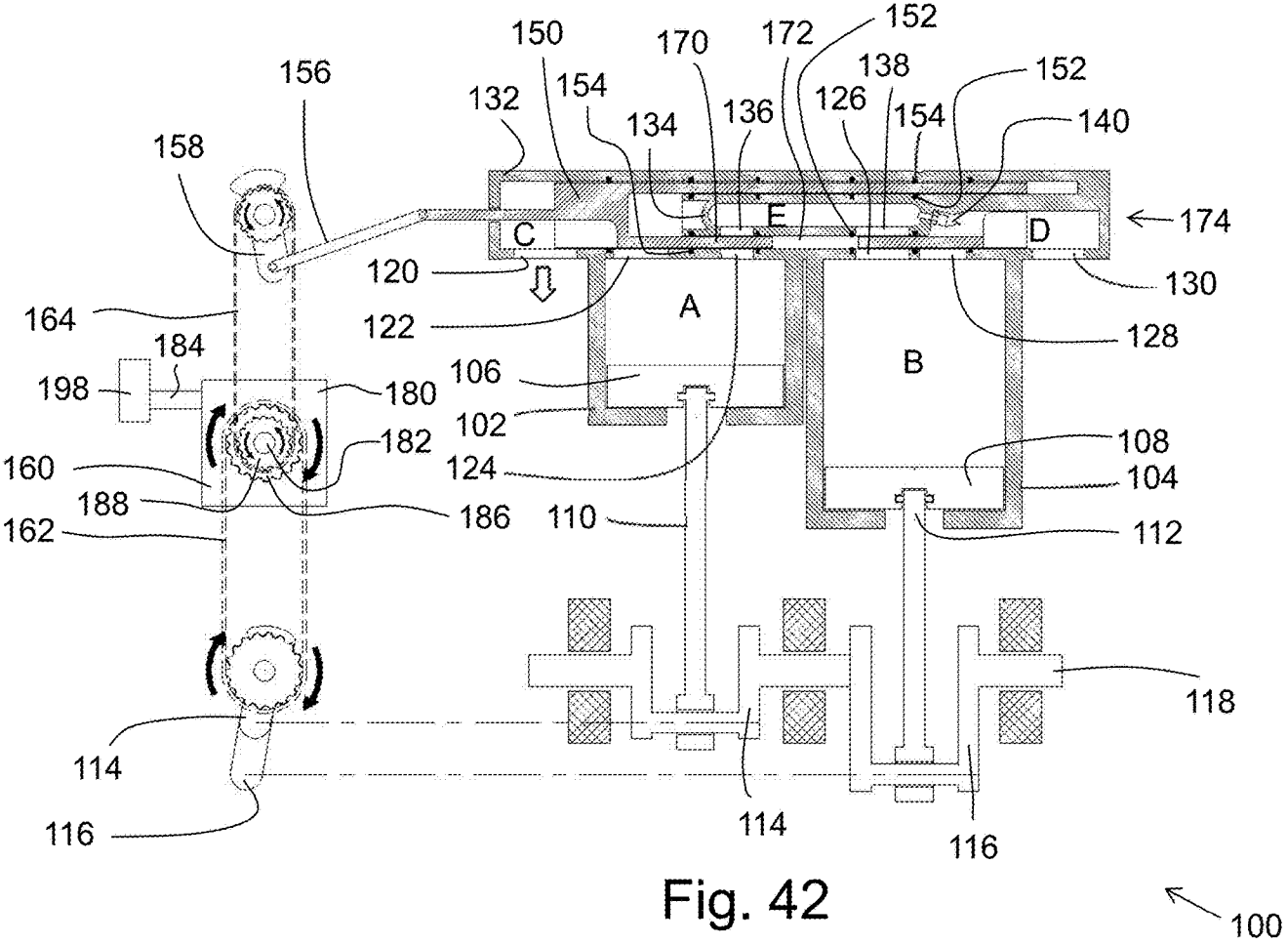
FIG. 42 schematically depicts the engine of FIG. 1 in the second mode of operation. The pistons are illustrated at 190 crankshaft degrees after their respective TDC points, and the sleeve shuttle is illustrated at 280 crankshaft degrees after its TDC point.
Figure 43:
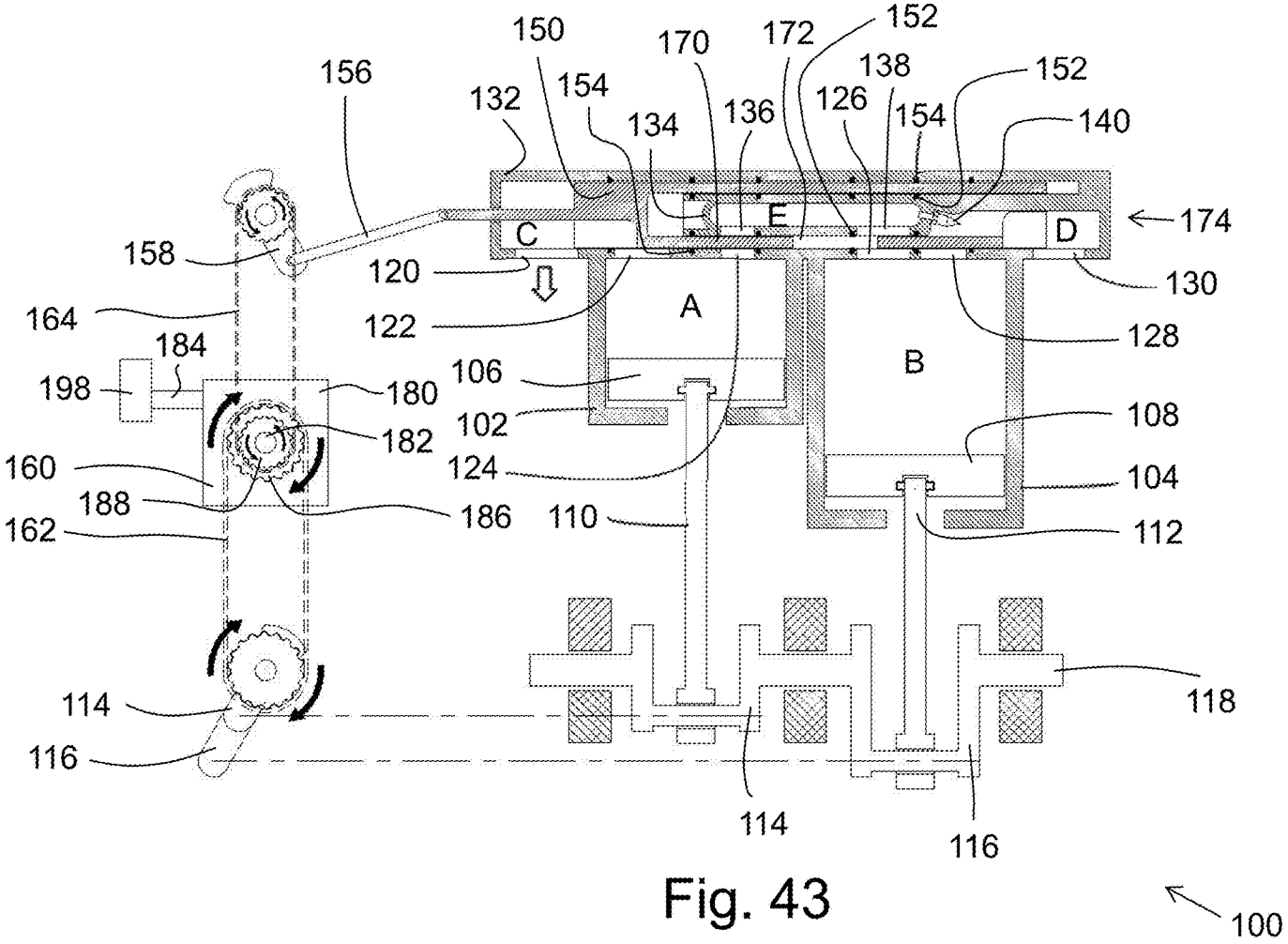
FIG. 43 schematically depicts the engine of FIG. 1 in the second mode of operation. The pistons are illustrated at 210 crankshaft degrees after their respective TDC points, and the sleeve shuttle is illustrated at 300 crankshaft degrees after its TDC point.
Figure 44:
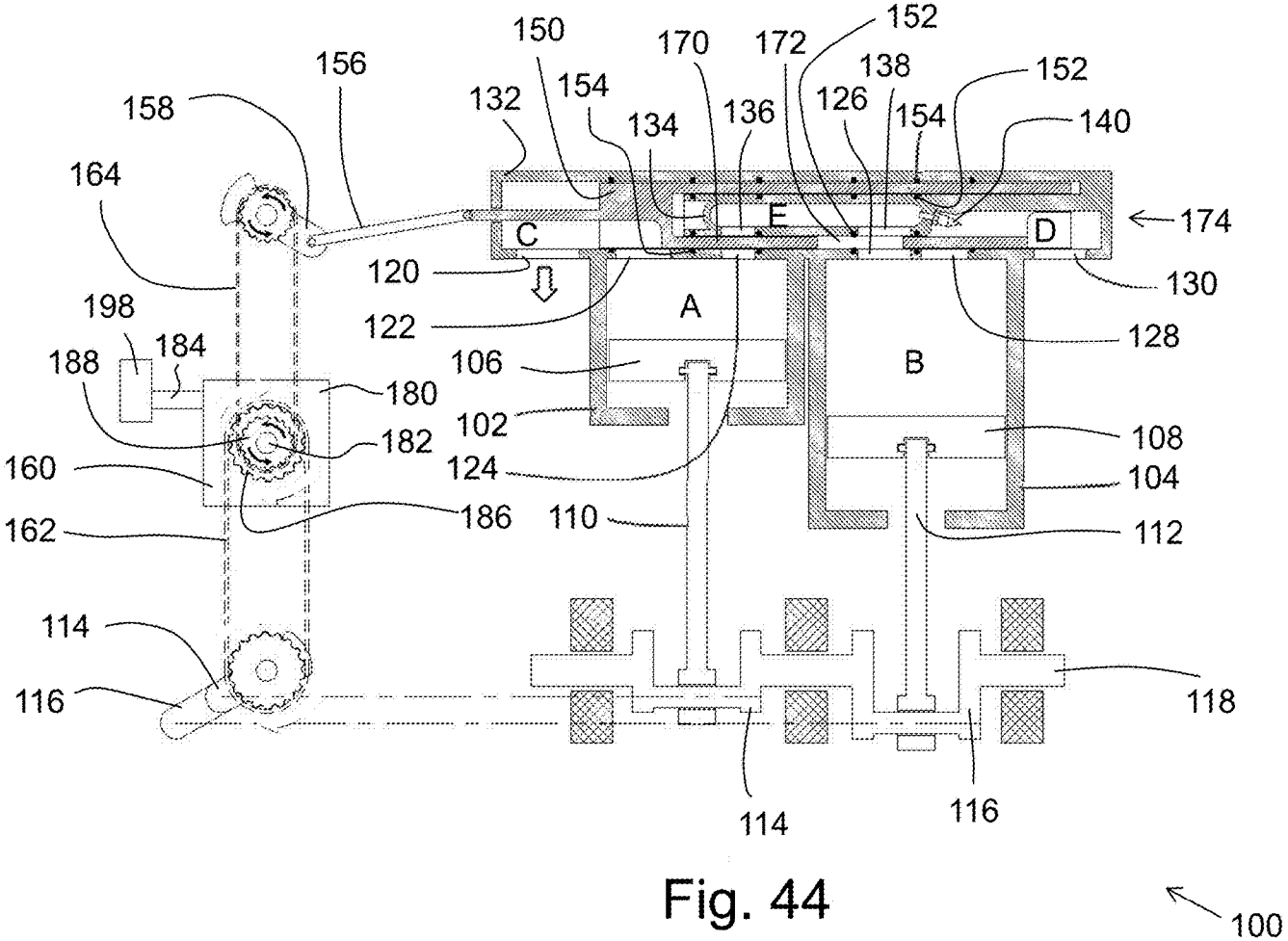
FIG. 44 schematically depicts the engine of FIG. 1 in the second mode of operation. The pistons are illustrated at 240 crankshaft degrees after their respective TDC points, and the sleeve shuttle is illustrated at 330 crankshaft degrees after its TDC point.
Figure 45:
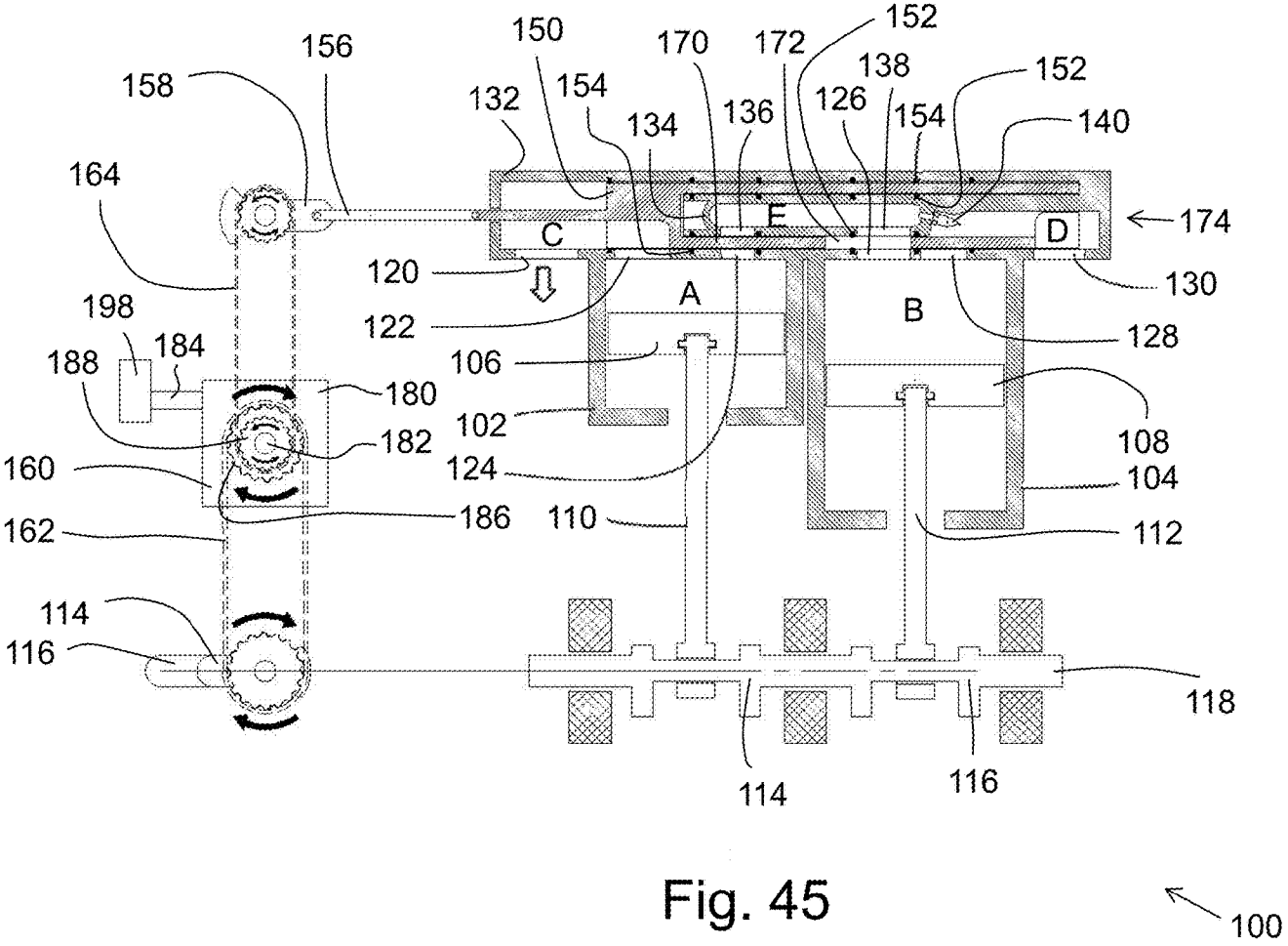
FIG. 45 schematically depicts the engine of FIG. 1 in the second mode of operation. The pistons are illustrated at 270 crankshaft degrees after their respective TDC points, and the sleeve shuttle is illustrated at its TDC point.
Figure 46:
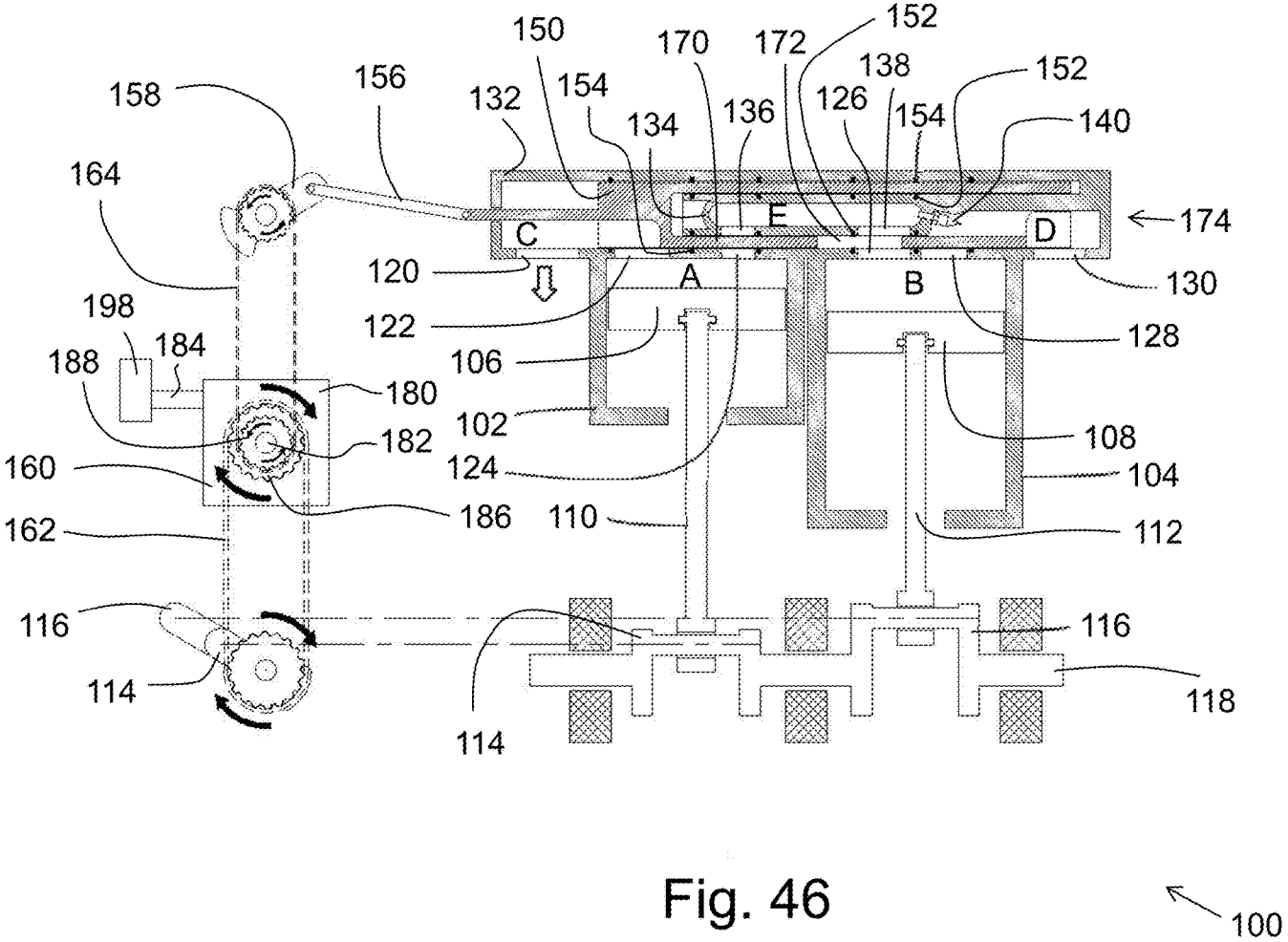
FIG. 46 schematically depicts the engine of FIG. 1 in the second mode of operation. The pistons are illustrated at 300 crankshaft degrees after their respective TDC points, and the sleeve shuttle is illustrated at 30 crankshaft degrees after its TDC point.
Figure 47:
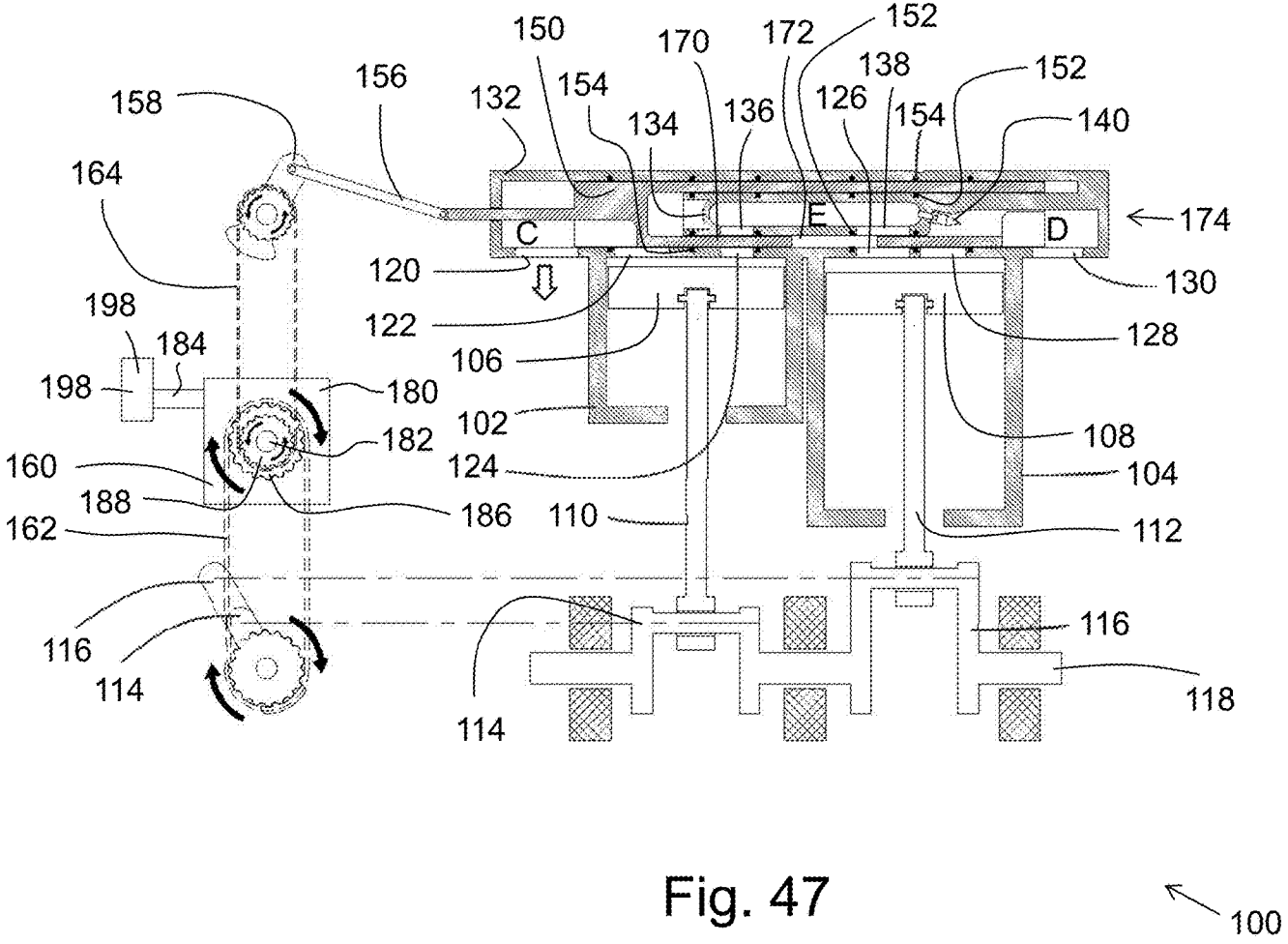
FIG. 47 schematically depicts the engine of FIG. 1 in the second mode of operation. The pistons are illustrated at 330 crankshaft degrees after their respective TDC points, and the sleeve shuttle is illustrated at 60 crankshaft degrees after its TDC point.
Figure 48:
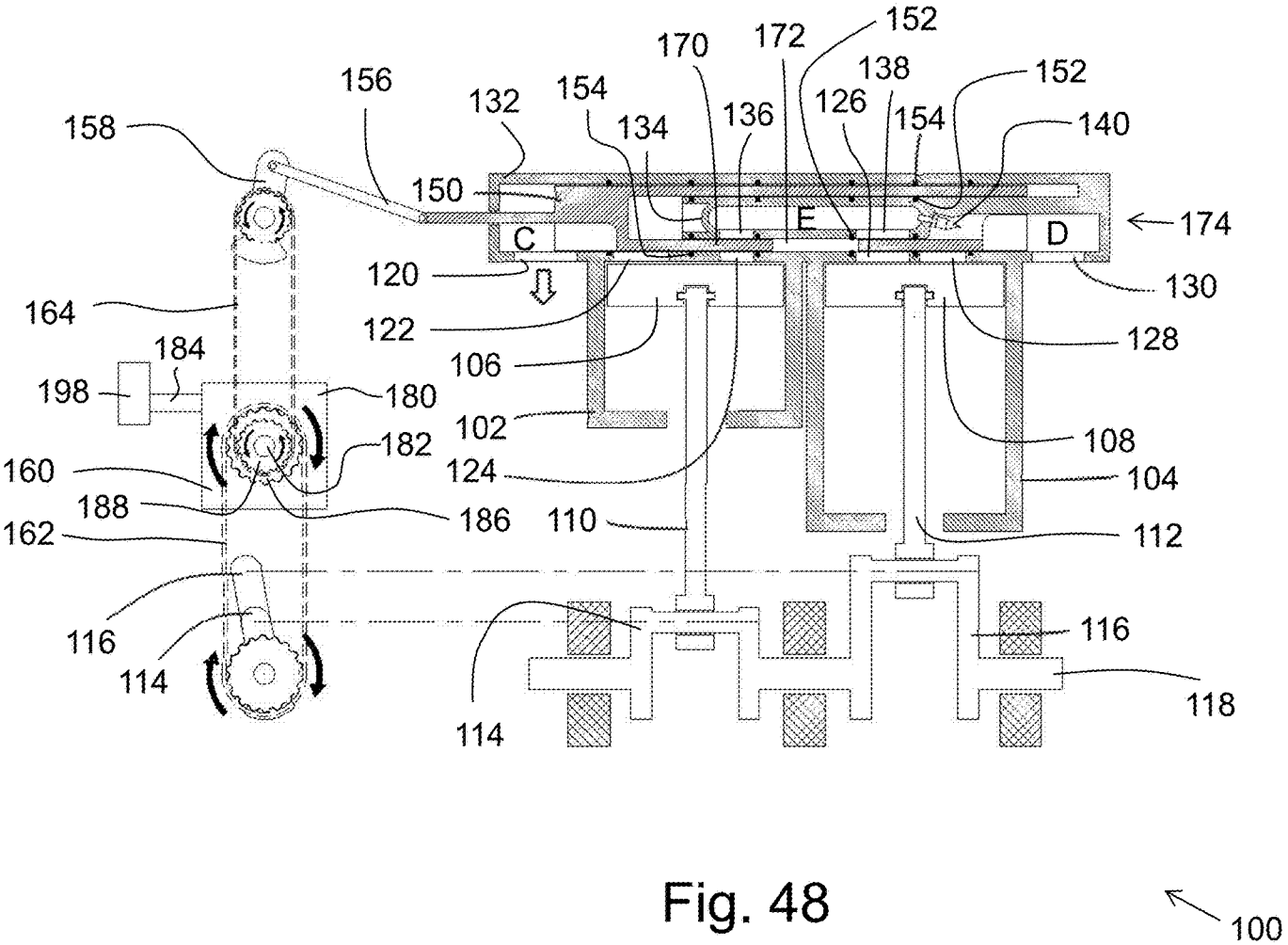
FIG. 48 schematically depicts the engine of FIG. 1 in the second mode of operation. The pistons are illustrated at 350 crankshaft degrees after their respective TDC points, and the sleeve shuttle is illustrated at 80 crankshaft degrees after its TDC point.

During the intake stroke, working fluid (e.g. carbureted naturally aspirated fuel/air charge or forced induced fuel/air charge) flows into chamber D through second manifold 130 and potentially through other apparatus (such as carburetor, turbo charger, fuel injectors or other apparatus as commonly known to a person skilled in the art), and from chamber D into chamber B through fourth port 128. During the compression stroke, second piston 108 forces the working fluid into chamber E through the passageway defined by third port 126, sleeve port 172, and second combustion chamber port 138. The working fluid is ignited in chamber E (FIG. 33). First piston 106 performs an expansion stroke (FIGS. 33-41) as burnt fuel gas is released into chamber A, through the passageway defined by first combustion chamber port 136, sleeve port 172, and second port 124. First piston 106 performs an exhaust stroke (FIGS. 41-49) exhaling the burnt fuel gases into chamber C through first port 122, and from chamber C onto the ambient air through first manifold 120. Second piston 108 does not perform an expansion stroke, or an exhaust stroke, and first piston 106 does not perform an intake stroke or a compression stroke. Second piston 108 and first piston 106 move in phase, and sleeve shuttle 150 moves synchronously with second piston 108 and first piston 106 at a positive (advance) phase shift of 90 crankshaft degrees relative to the pistons. That is to say, second piston 108 and first piston 106 reach their respective TDC positions at the same time, whereas sleeve shuttle 150 reaches its TDC point 90 crankshaft degrees prior to the pistons reaching their TDC points.

In both the intake and expansion strokes and the compression and exhaust strokes, engine power shaft 118 rotational motion is converted via first timing belt 162, phase shifting transmission gear 180, and second timing belt 164, to sleeve crankshaft 158 synchronous rotational motion. Sleeve connecting rod 156 converts sleeve crankshaft 158 rotation to sleeve shuttle 150 reciprocating motion. Sleeve shuttle 150 thus moves synchronously with second piston 108 and first piston 106. During sleeve shuttle 150 reciprocating motion, chamber E alternates between being fluidly connected, via second combustion chamber port 138, sleeve port 172, and third port 126, with chamber B, and via first combustion chamber port 136, sleeve port 172, and second port 124, with chamber A. Also during sleeve shuttle 150 reciprocating motion, fourth port 128 and first port 122 may separately, alternatingly open or close. Also during sleeve shuttle 150 reciprocating motion, third port 126 and second port 124 may separately, alternatingly open or close.

During the intake and expansion strokes (FIGS. 33-41), which occur concurrently, first connecting rod 110 converts first piston 106 reciprocating motion (relative to first cylinder 102) into first crankshaft 114 rotational motion, causing engine power shaft 118, and consequently second crankshaft 116, to rotate synchronously. Second crankshaft 116 and first crankshaft 114 thus rotate synchronously. Second connecting rod 112 converts second crankshaft 116 rotational motion to second piston 108 reciprocating motion (relative to second cylinder 104). Second piston 108 and first piston 106 thus move synchronously. Fourth port 128 governs the flow of the working fluid (i.e. naturally aspirated ambient air or the carbureted air/fuel charge, or forced induction of the charge) into first chamber B, and second port 124 governs the flow of hot, high pressured gas from chamber E into chamber A.

During the intake and expansion strokes (FIGS. 33-41), initially (FIG. 33), all ports are blocked. Specifically, sleeve shuttle 150 (and hence sleeve cylinder 170) is positioned so as to fluidly disconnect chamber E from both chamber B and chamber A, and to fluidly disconnect chamber B from chamber A. The working fluid (naturally aspirated ambient air or the carbureted air/fuel charge, or forced induction of the charge) resides in chamber D between second manifold 130 and fourth port 128. Second piston 108 and first piston 106 are both in their respective TDC positions. Sleeve shuttle 150 is at its mid-stroke point and moving to the left. Second piston 108, first piston 106, and sleeve shuttle 150 are moving synchronously. Chamber E is filled with high-pressure compressed working fluid and ignition is initiated (FIG. 33).

Inertia maintains second crankshaft 116 and first crankshaft 114 rotational motions (FIG. 33), which in turn, via engine power shaft 118, phase shifting transmission gear 180, and sleeve crankshaft 158, maintain sleeve shuttle 150 leftward motion. After second piston 108 and first piston 106 start descending (FIG. 34), sleeve shuttle 150 leftward motion opens fourth port 128 and second port 124, letting new working fluid enter into chamber B through chamber D, and letting hot, high-pressure burnt fuel gas from chamber E into chamber A. The high-pressure gas in chamber E thrusts down first piston 106 (FIGS. 34-40), thereby increasing chamber A volume. The net torque applied by first piston 106, through connecting rod 112, on first crankshaft 114, causes first crankshaft 114 to rotate, and consequently the rotation of the coupled second crankshaft 116, thereby increasing chamber B volume.

As sleeve shuttle 150 continues its leftward motion (FIGS. 35 and 36), it increasingly opens more of fourth port 128 and second port 124, possibly allowing for a higher rate of flow of incoming working fluid from chamber D into chamber B, and a higher rate of flow of burnt fuel gas from chamber E into chamber A. After sleeve crankshaft 158 reaches its BDC point (FIG. 37), sleeve shuttle 150 reverses direction of motion, (i.e. sleeve shuttle 150 starts moving to the right). As second piston 108 and first piston 106 approach their respective BDC positions, and sleeve shuttle 150 approaches its mid-stroke point from the left (moving to the right), fourth port 128 closes (FIGS. 40-41), thereby sealing the working fluid inside chamber B, and second port 124 closes, thereby sealing burnt fuel gas in chamber A.

Throughout the intake and expansion strokes, sleeve shuttle 150 position within sleeve cylinder 132 (FIGS. 33-41) prevents high-pressure fluid transfer from chamber A into chamber B as the hot, high-pressure burnt fuel gas of the expansion stroke is being restricted from passing laterally through the gaps between sleeve cylinder 132 and sleeve shuttle 150 due to cylinder sealing rings 154, particularly cylinder sealing ring 154 near third port 126 (to its left). Likewise the hot, high-pressure burnt fuel gas of the expansion stroke is restricted from passing laterally through the gaps between cylindrical sleeve 170 and the combustion chamber structure 134 due to chamber sealing rings 152. The compressed working fluid is further restricted from escaping back through chamber B to ambient air due to chamber sealing rings 152 and cylinder sealing rings 154, particularly contracting ring 154 near fourth port 128 (to its right). The high-pressure burnt fuel gas of the expansion stroke is further restricted from escaping through chamber C to ambient air due to chamber sealing rings 152 and cylinder sealing rings 154, particularly contracting ring 154 near first port 128 (to its left).

During the compression and exhaust strokes (FIGS. 41-49), which occur concurrently, engine power shaft 118 rotational motion continues, and consequently, second crankshaft 116 and first crankshaft 114 continue rotating synchronously. Second connecting rod 112 translates second crankshaft 116 rotational motion into second piston 108 reciprocating motion (relative to second cylinder 104). First connecting rod 110 translates first crankshaft 114 rotational motion into first piston 106 reciprocating motion (relative to first cylinder 102). Second piston 108 and first piston 106 thus move synchronously. Third port 126 governs the flow of unexploited working fluid from chamber B into chamber E and first port 122 governs the exhalation of burnt fuel gases.

During the compression and exhaust strokes (FIGS. 41-49), initially (FIG. 41), all ports are blocked. Specifically, sleeve cylinder 170 is positioned so as to fluidly disconnect chamber B from both chamber E and chamber D, and to fluidly disconnect chamber A from both chamber E and chamber C. Unexploited working fluid resides in chamber B and burnt fuel gas resides in chamber A and the decoupled chamber E. Second piston 108 and first piston 106 are both in their respective BDC positions. Sleeve shuttle 150 is at its mid-stroke point and moving to the right. Second piston 108 and first piston 106 are moving in phase, and sleeve shuttle 150 is moving synchronously with second piston 108 and first piston 106 at a positive phase shift (advance) of 90 crankshaft degrees.

Inertia maintains second crankshaft 116 and first crankshaft 114 rotational motions, which in turn, via engine power shaft 118, phase shifting transmission gear 180, and sleeve crankshaft 158, maintain sleeve shuttle 150 rightward motion. Shortly after second piston 108 and first piston 106 start ascending (FIG. 42), sleeve shuttle 150 rightward motion opens third port 126 and first port 122, letting unexploited working fluid to enter chamber E from chamber B and burnt fuel gas to exhale from chamber A through chamber C. As second piston 108 ascent continues, chamber B volume decreases (and hence also the combined volume of chamber B and chamber E). The air-fuel charge in chamber B is compressed as an increasingly larger amount of the air-fuel charge is forced into chamber E. As first piston 106 ascent continues, chamber A volume decreases (FIGS. 42-48).

As sleeve shuttle 150 continues its rightward motion (FIGS. 43 and 44), it increasingly opens more of third port 126 and first port 122, possibly allowing for a higher transfer rate of unexploited working fluid from chamber B into chamber E, and a higher exhaust rate of burnt fuel gas from chamber A into chamber C. After sleeve crankshaft 158 reaches its TDC point (FIG. 45), sleeve shuttle 150 reverses direction of motion, (i.e. sleeve shuttle 150 starts moving to the left). As second piston 108 and first piston 106 approach their respective TDC positions, and sleeve shuttle 150 approaches its mid-stroke point from the right, (FIG. 49) third port 126 closes, thereby sealing the compressed working fluid in chamber E, and fourth port 128 closes.

Throughout the entire compression and exhaust strokes, sleeve shuttle 150 position within sleeve cylinder 132 (FIGS. 41-49) prevents compressed working fluid transfer from chamber B into chamber A as the working fluid of the compression stroke is being restricted from passing laterally through the gaps between sleeve cylinder 132 and sleeve shuttle 150 due to cylinder sealing rings 154, particularly contracting ring 154 near second port 124 (to its right). Likewise the compressed working fluid is restricted from passing laterally through the gaps between cylindrical sleeve 170 and the combustion chamber structure 134 due to chamber sealing rings 152. The compressed working fluid is further restricted from escaping back through chamber B to ambient air due to chamber sealing rings 152 and cylinder sealing rings 154, particularly cylinder sealing ring 154 near fourth port 128 (to its right).

As mentioned above, at a certain pre-determined point, for example, when first piston 106 and second piston 108 are at their respective TDC positions (FIGS. 33 and 49), combustion of the air-fuel charge may be initiated via compression ignition. Additionally, or alternatively, at a certain pre-determined point, for example, when first piston 106 and second piston 108 are at their respective TDC positions (FIGS. 33 and 49), combustion of the air-fuel charge is initiated via an ignition mechanism such as spark plug firing. In compression ignition engine configurations, a high pressure fuel injection system is incorporated with the timing of fuel injection determining combustion timing.

It is noted that second cylinder 104 is larger than first cylinder 102, resulting in chamber B having a larger volume than chamber A. Thus, split-cycle ICE 100 may utilize an expansion ratio different from a compression ratio, and more specifically an expansion ratio smaller than a compression ratio, resulting, potentially, in a higher power output in the second mode compared to the power output in the first mode.

According to some embodiments first cylinder 102 and second cylinder 104 may be thermally isolated from one another. According to some embodiments the temperature of chamber A may be regulated or controlled, e.g. by regulating heat dissipation from first cylinder 102. According to some embodiments the temperature of chamber B may be regulated or controlled, e.g. by regulating heat dissipation from the second cylinder 104. According to some embodiments the temperature of chamber A may be maintained higher than the temperature of chamber B during the second mode of engine 100.

In some exemplary embodiments, the components of chamber B are temperature controlled using a cooling system (not shown here), thereby cooling chamber B structure components (such as the second cylinder 104 and second piston 108) and optionally cooling combustion chamber structure 132 and/or sleeve shuttle 150. It is emphasized that when engine 100 is utilized as a bi-directional engine (that is to say an engine that may be switched between the first mode and the second mode), temperature regime of various components of the engine may vary or switch together with switching the mode of operation, and temperature regulation of such components may vary or switch correspondingly. In other words, a temperature regulation scheme may be employed during the first mode to cool first cylinder 102 and first piston 104 to a lower temperature than the temperature of second cylinder 104 and second piston 108. And vice versa—a temperature regulation scheme may be employed during the second mode to cool second cylinder 104 and second piston 108 to a lower temperature than the temperature of first cylinder 102 and first piston 104.

It is to be understood that descriptions of possible ranges of opening times and closing times of engine 100 ports, and the phase shifts between various engine 100 components (such as, for example, first piston 106 and second piston 108, or, for example, second crankshaft 116 and sleeve crankshaft 158, etc.) at first piston TDC and BDC, specifically those appearing at the end of the section describing the first mode of engine 100 cycle, also apply, mutatis mutandis, to the above description of the second mode. It is to be further understood that FIGS. 33-49 schematically describe a single cycle of engine 100 in the second mode of operation. However engine 100 is configured to work continuously in the second mode, by performing consecutively the described cycle, as should be appreciated by a person skilled in the art.

Transition from Second Mode to First Mode of Operation

A transition from the second mode to the first mode (referred to herein as the "second transition cycle") is schematically depicted in FIGS. 49-64 and 1. During the second transition cycle, second piston 108 and first piston 106 each complete one cycle, (a full rotation of the respective crankshafts), while sleeve shuttle 150 completes one and half cycles, namely one and a half rotations of sleeve crankshaft 158. Thus, at the end of the second transition cycle, sleeve shuttle 150 is moving synchronously with first piston 106 and second piston 108, and at 90 crankshaft degrees behind the two pistons. To effect the phase shift, control shaft 184 is controllably rotated, by e.g. step motor 198, thereby accelerating (and then decelerating) the output axle (not shown here) relative to input axle 182. Thus, during a first part of the second transition cycle (FIGS. 49-53), phase shifting transmission gear 180 increases sleeve crankshaft 158 rotation speed and during a second part of the second transition cycle (FIGS. 54-55) phase shifting transmission gear 180 decreases back sleeve crankshaft 158 rotation speed. By the end of the second portion of the second transition cycle (FIG. 55) sleeve crankshaft 158 has accumulated a positive 180 crankshaft degrees phase shift (relative to the phase sleeve crankshaft 158 would have had if the transition was not affected), thereby advancing from being 90 degrees in advance of first crankshaft 114 and second crankshaft 116 to being 270 degrees in advance of first crankshaft 114, (which is equivalent to being 90 degrees behind first crankshaft 114 and second crankshaft 116). Throughout a third part of the second transition cycle (FIGS. 56-64 and FIG. 1) and at the end of the second transition cycle (FIG. 1), sleeve crankshaft 158 resumes synchronous rotation with respect to first crankshaft 114 rotation and second crankshaft 116 rotation.

During the second transition cycle (FIGS. 49-64 and 1), initially (FIG. 49), new working fluid resides in chamber D between second manifold 130 and fourth port 128, compressed working fluid is ignited in chamber E, and all ports are blocked. Second piston 108 and first piston 106 are both in their respective TDC positions. Sleeve shuttle 150 is at its mid-stroke point and moving to the left. Second piston 108, first piston 106, are thus moving in phase and sleeve shuttle 150 is moving synchronously with second piston 108 and first piston 106 at a 180 crankshaft degrees phase shift with respect to them.

Figure 49:
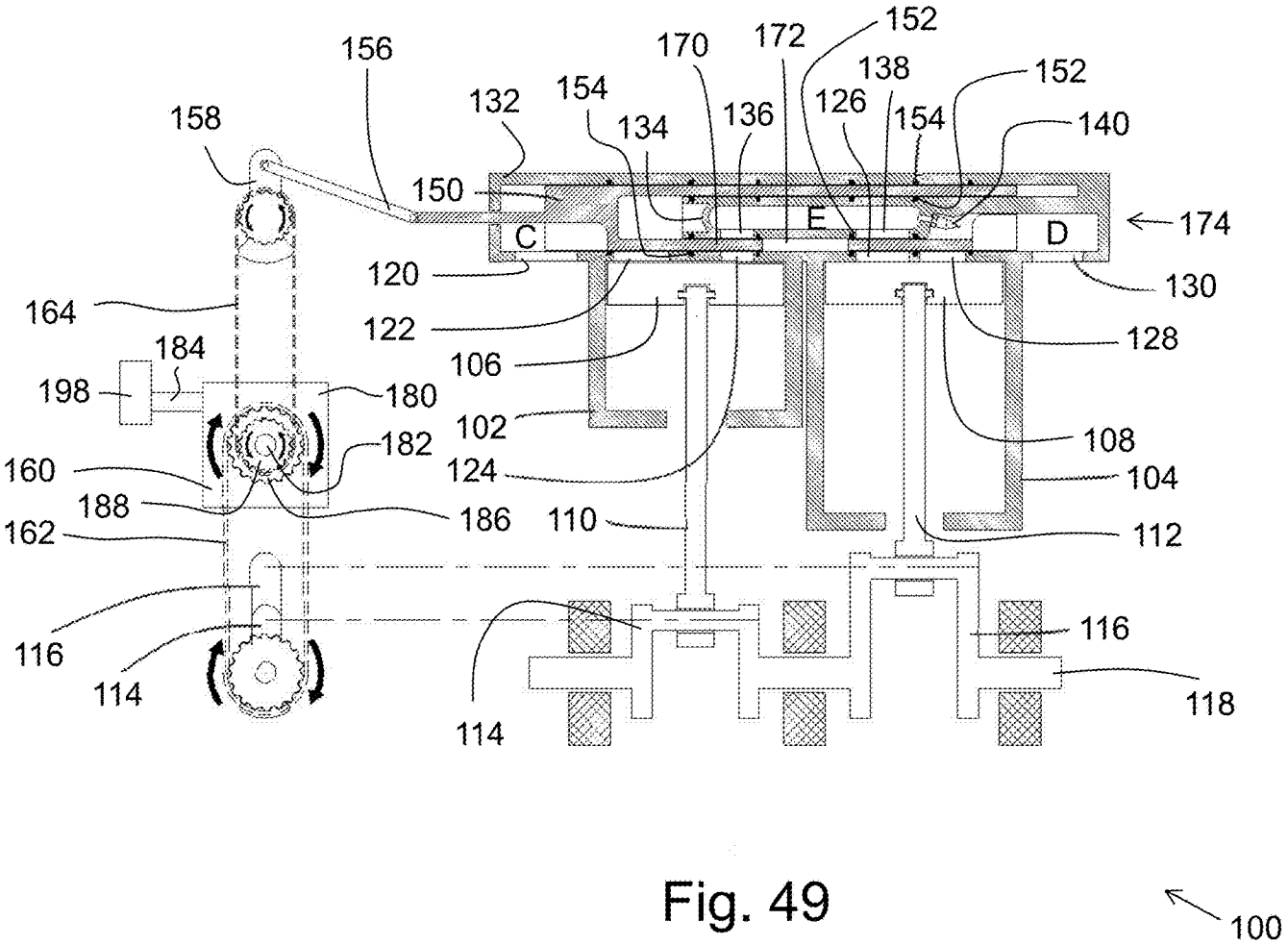
FIG. 49 schematically depicts the engine of FIG. 1 at the end of the second mode of operation and start of a second transition cycle. The pistons are illustrated at their respective TDC points, and the sleeve shuttle is illustrated at 90 crankshaft degrees after its TDC point.
Figure 50:
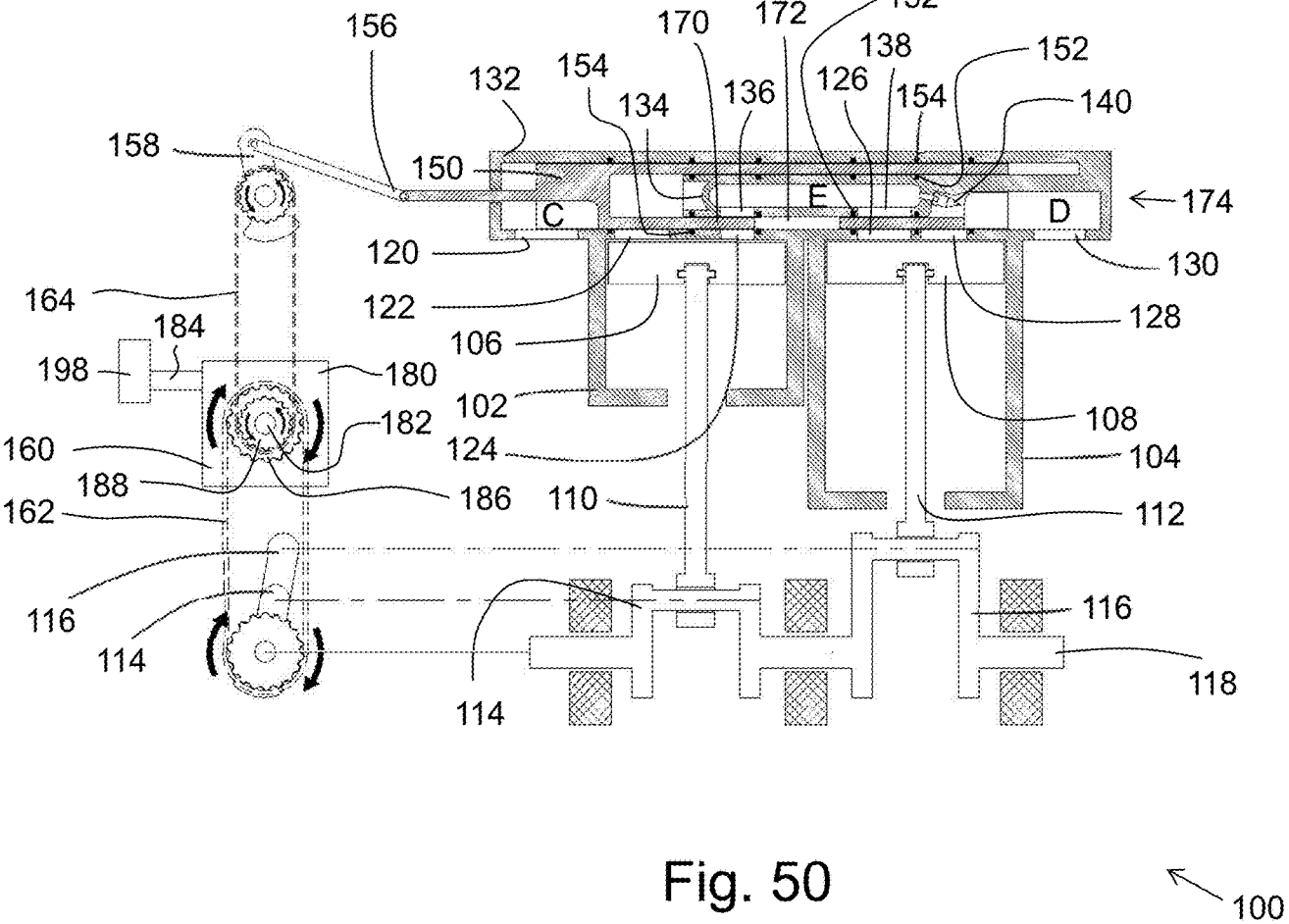
FIG. 50 schematically depicts the engine of FIG. 1 in the second transition cycle. The pistons are illustrated at 10 crankshaft degrees after their respective TDC points, and the sleeve shuttle is illustrated at 102 crankshaft degrees after its TDC point.

As seen in FIGS. 49 and 50, second crankshaft 116 inertia causes, via second connecting rod 112, second piston 108 descent in second cylinder 104. First crankshaft 114 inertia causes, via first connecting rod 110, first piston 106 descent in first cylinder 102. Phase shifting transmission gear 180, via second timing belt 164, starts increasing sleeve crankshaft 158 rotation speed, which in turn starts accelerating, via sleeve connecting rod 156, the reciprocating motion of sleeve shuttle 150, resulting in the increase of the phase shift between the motion of sleeve shuttle 150 and the motions of second piston 108 and first piston 106.

As seen in FIG. 50, after sleeve shuttle 150 passes through its mid-stroke point (and second piston 108 and first piston 106 start descending), sleeve shuttle 150 opens fourth port 128 and second port 124, letting new working fluid enter into chamber B from chamber D, and hot, high pressure burnt fuel gas from chamber E into chamber A. The high-pressure burnt fuel gas pushes down first piston 106 (FIGS. 50-56), thereby increasing chamber A volume. The net torque applied by first piston 106, through first connecting rod 110, on first crankshaft 114, causes first crankshaft 114 rotational motion, and consequently the in-phase rotational motion of the coupled second crankshaft 116, thereby increasing chamber B volume.

Figure 51:
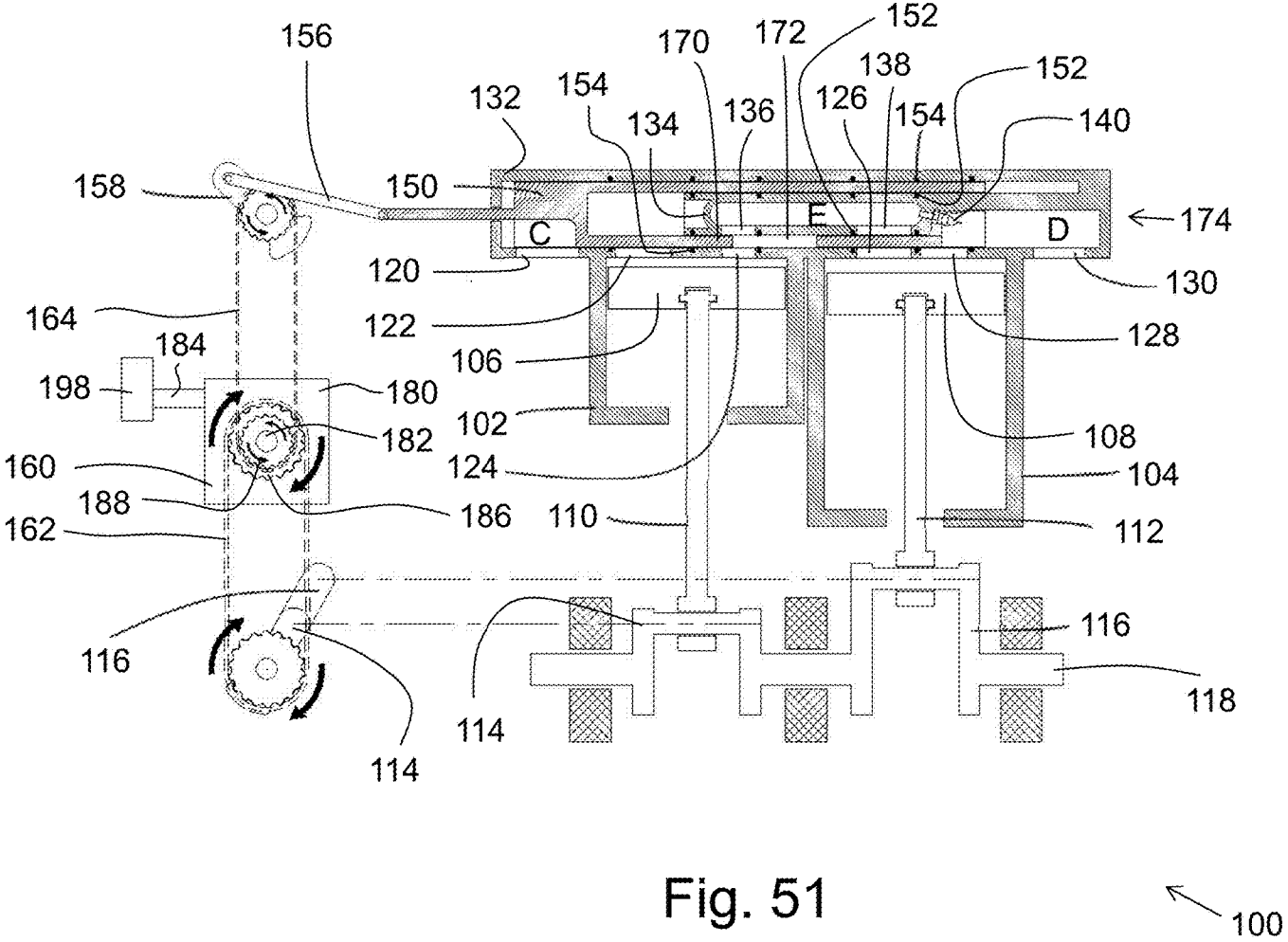
FIG. 51 schematically depicts the engine of FIG. 1 in the second transition cycle. The pistons are illustrated at 30 crankshaft degrees after their respective TDC points, and the sleeve shuttle is illustrated at 137 crankshaft degrees after its TDC point.
Figure 52:
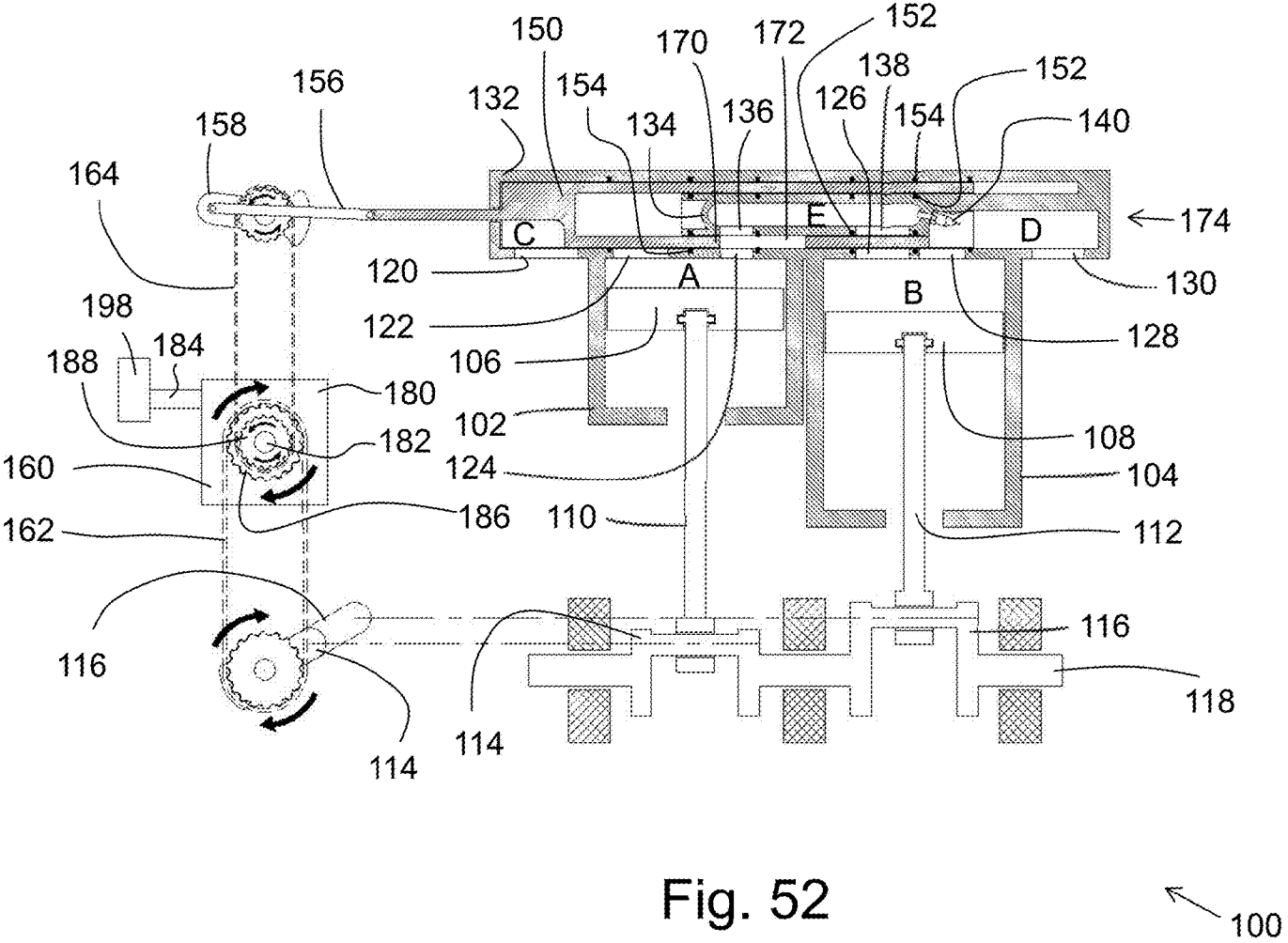
FIG. 52 schematically depicts the engine of FIG. 1 in the second transition cycle. The pistons are illustrated at 60 crankshaft degrees after their respective TDC points, and the sleeve shuttle is illustrated at 173 crankshaft degrees after its TDC point.
Figure 53:
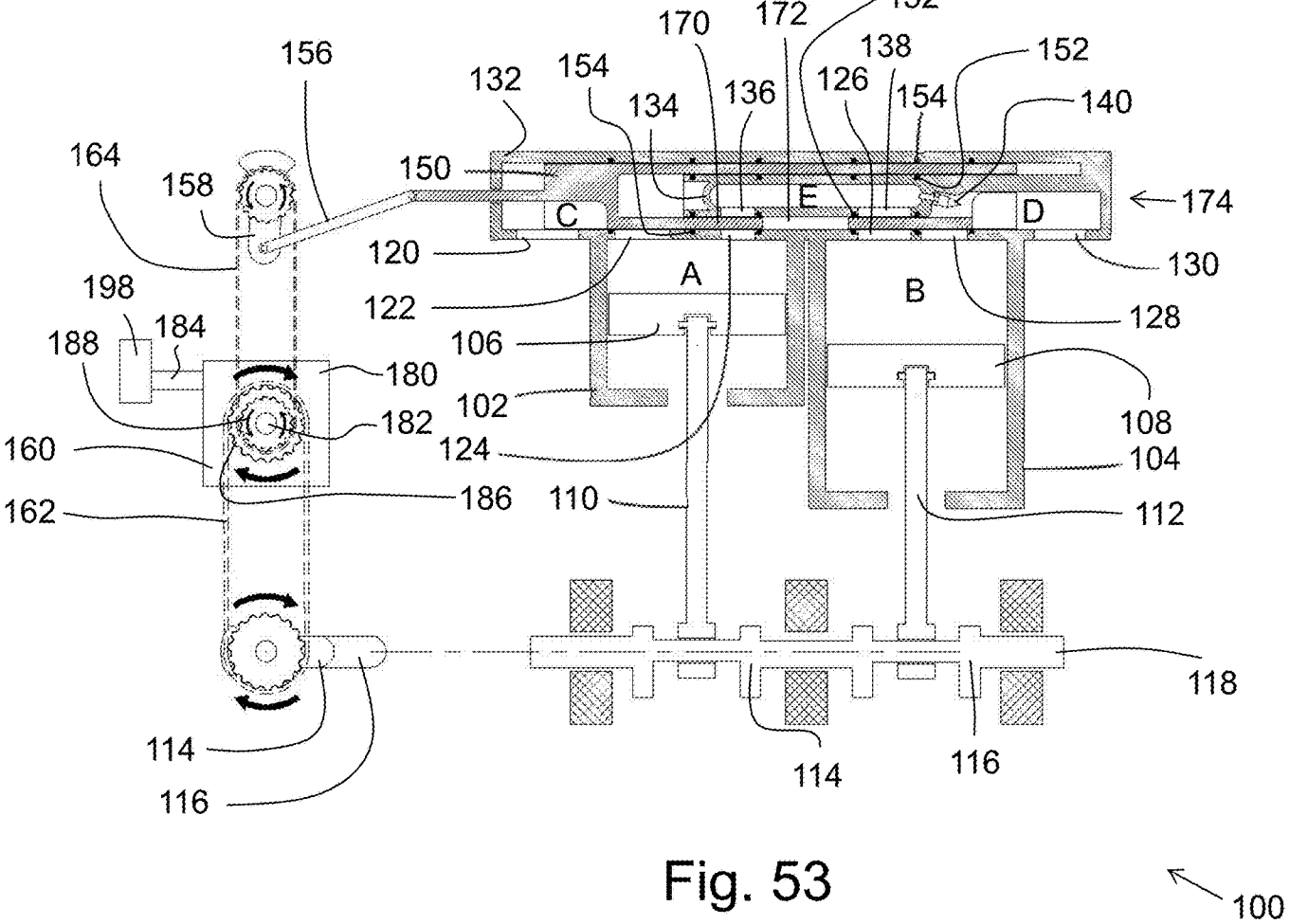
FIG. 53 schematically depicts the engine of FIG. 1 in the second transition cycle. The pistons are illustrated at 90 crankshaft degrees after their respective TDC points, and the sleeve shuttle is illustrated at 268 crankshaft degrees after its TDC point.
Figure 54:
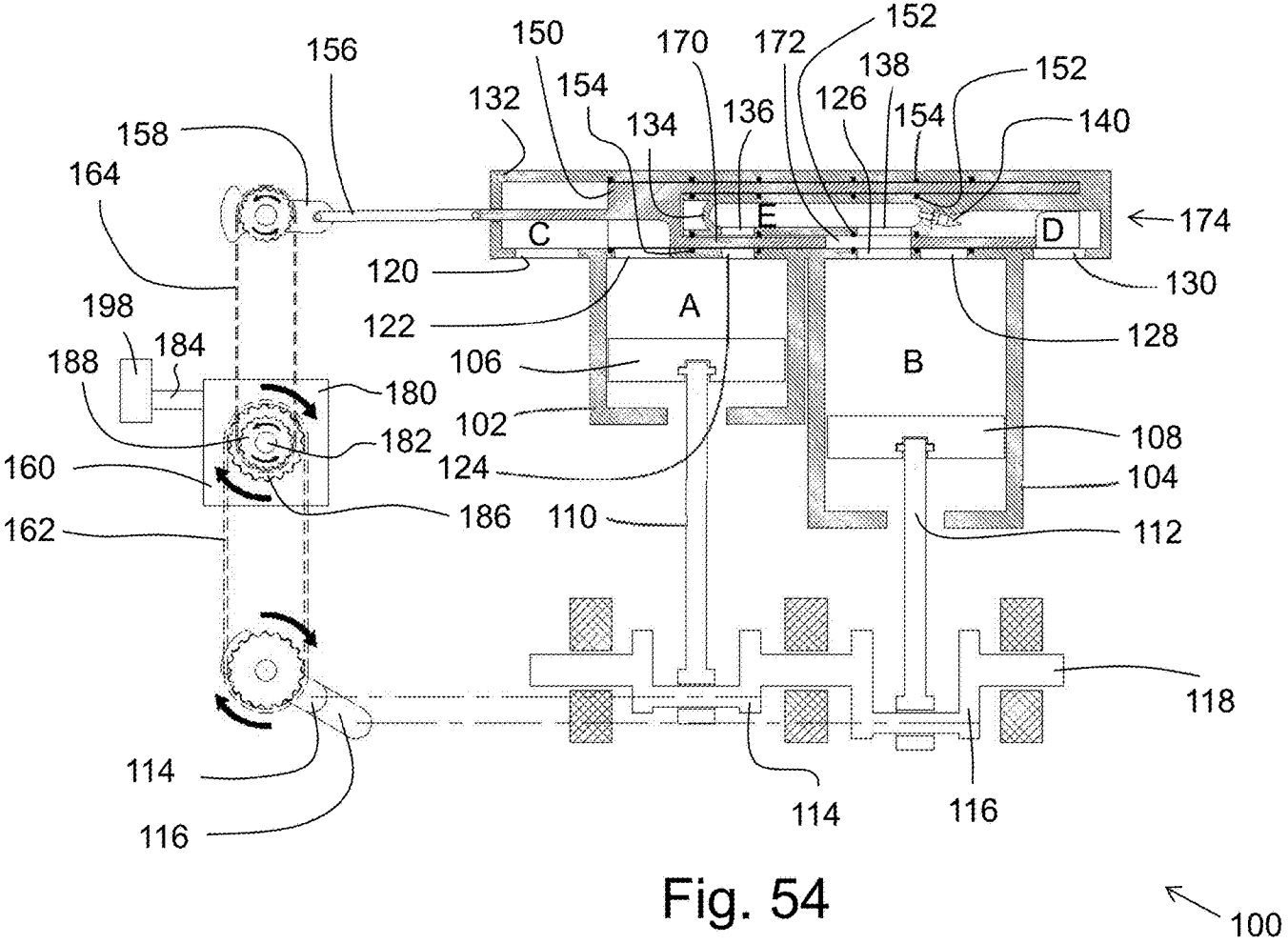
FIG. 54 schematically depicts the engine of FIG. 1 in the second transition cycle. The pistons are illustrated at 120 crankshaft degrees after their respective TDC points, and the sleeve shuttle is illustrated at 358 crankshaft degrees after its TDC point.
Figure 55:
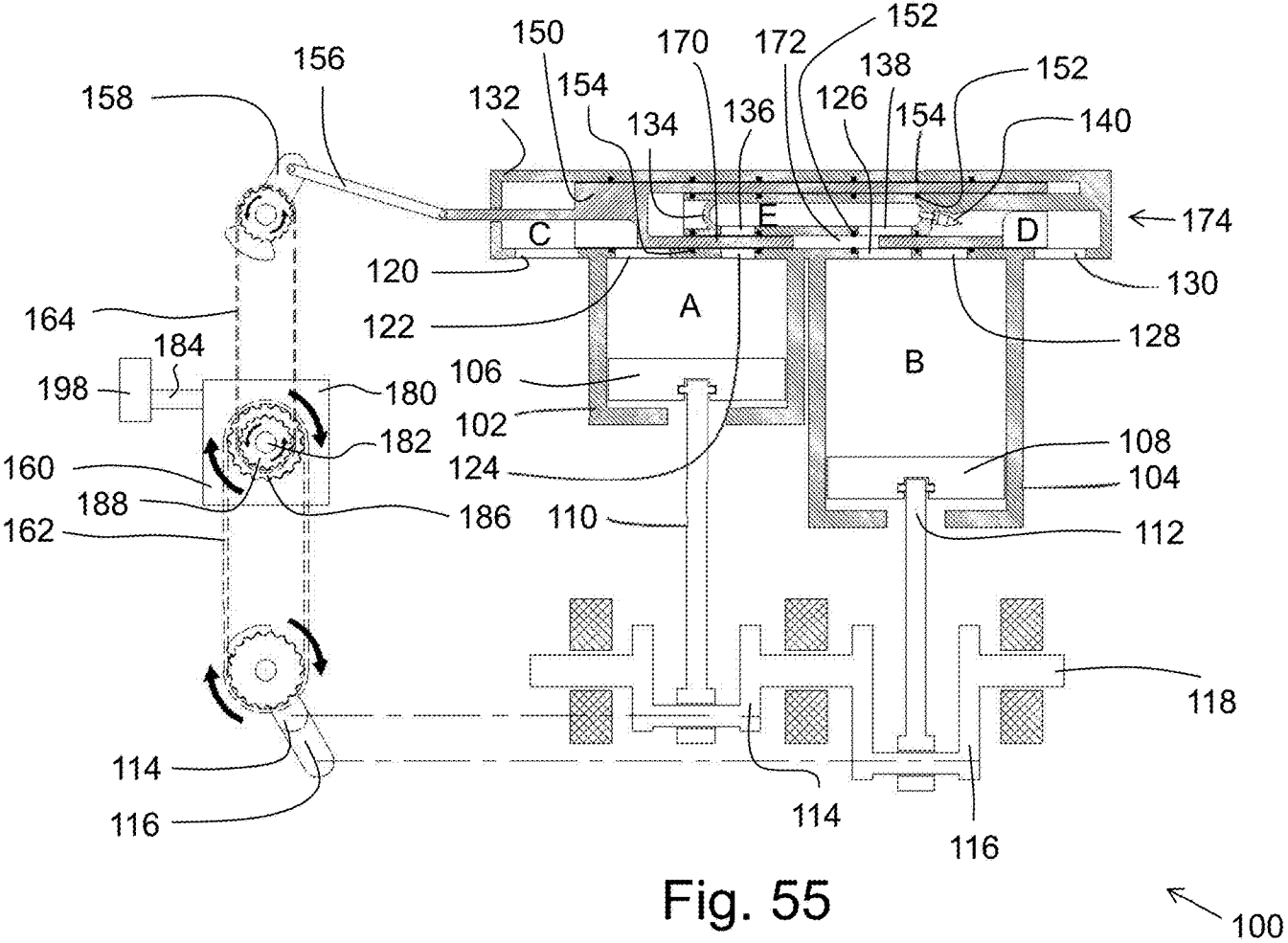
FIG. 55 schematically depicts the engine of FIG. 1 in the second transition cycle. The pistons are illustrated at 150 crankshaft degrees after their respective TDC points, and the sleeve shuttle is illustrated at 60 crankshaft degrees after its TDC point.
Figure 56:
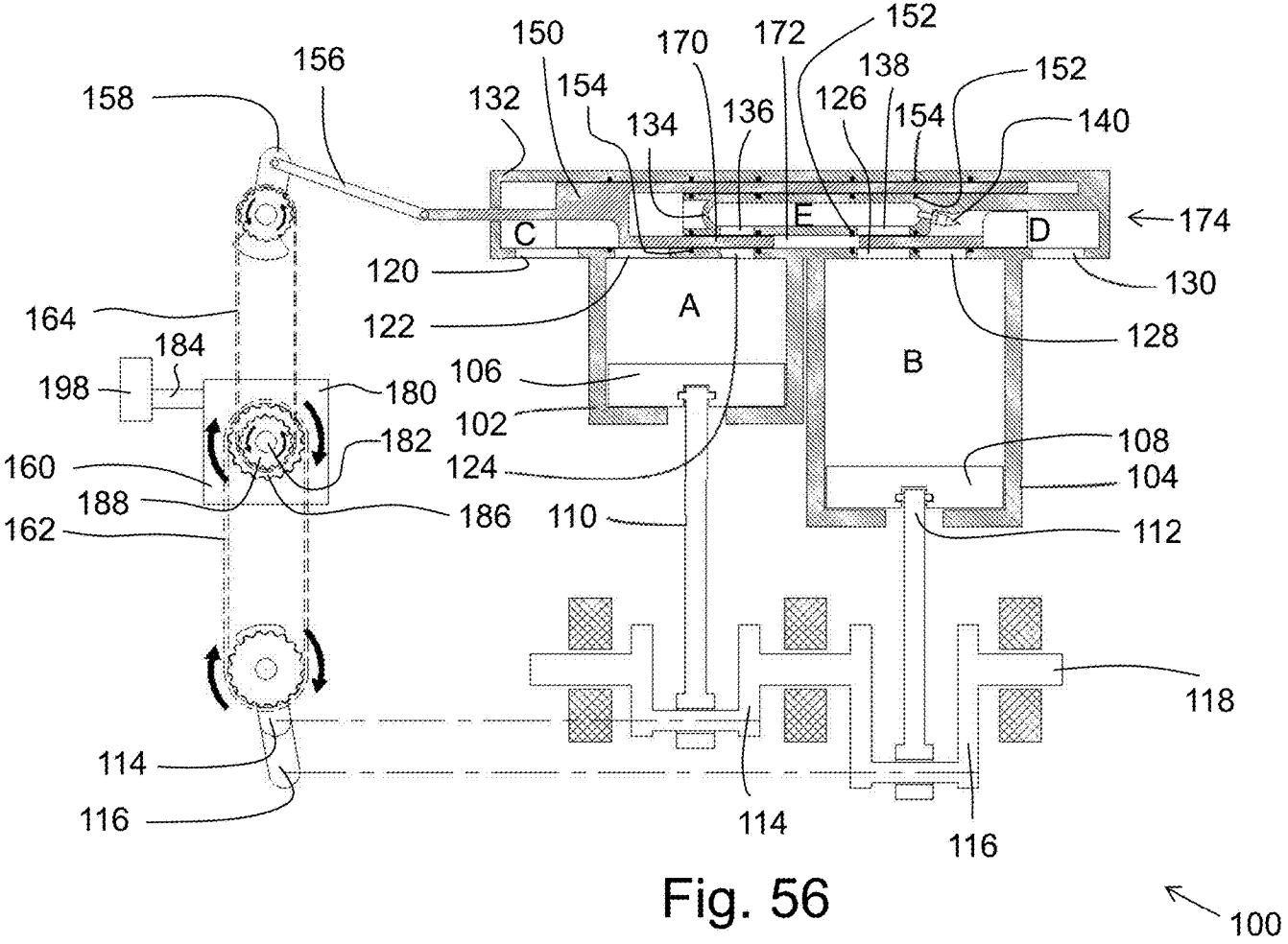
FIG. 56 schematically depicts the engine of FIG. 1 in the second transition cycle. The pistons are illustrated at 170 crankshaft degrees after their respective TDC points, and the sleeve shuttle is illustrated at 80 crankshaft degrees after its TDC point.
Figure 57:
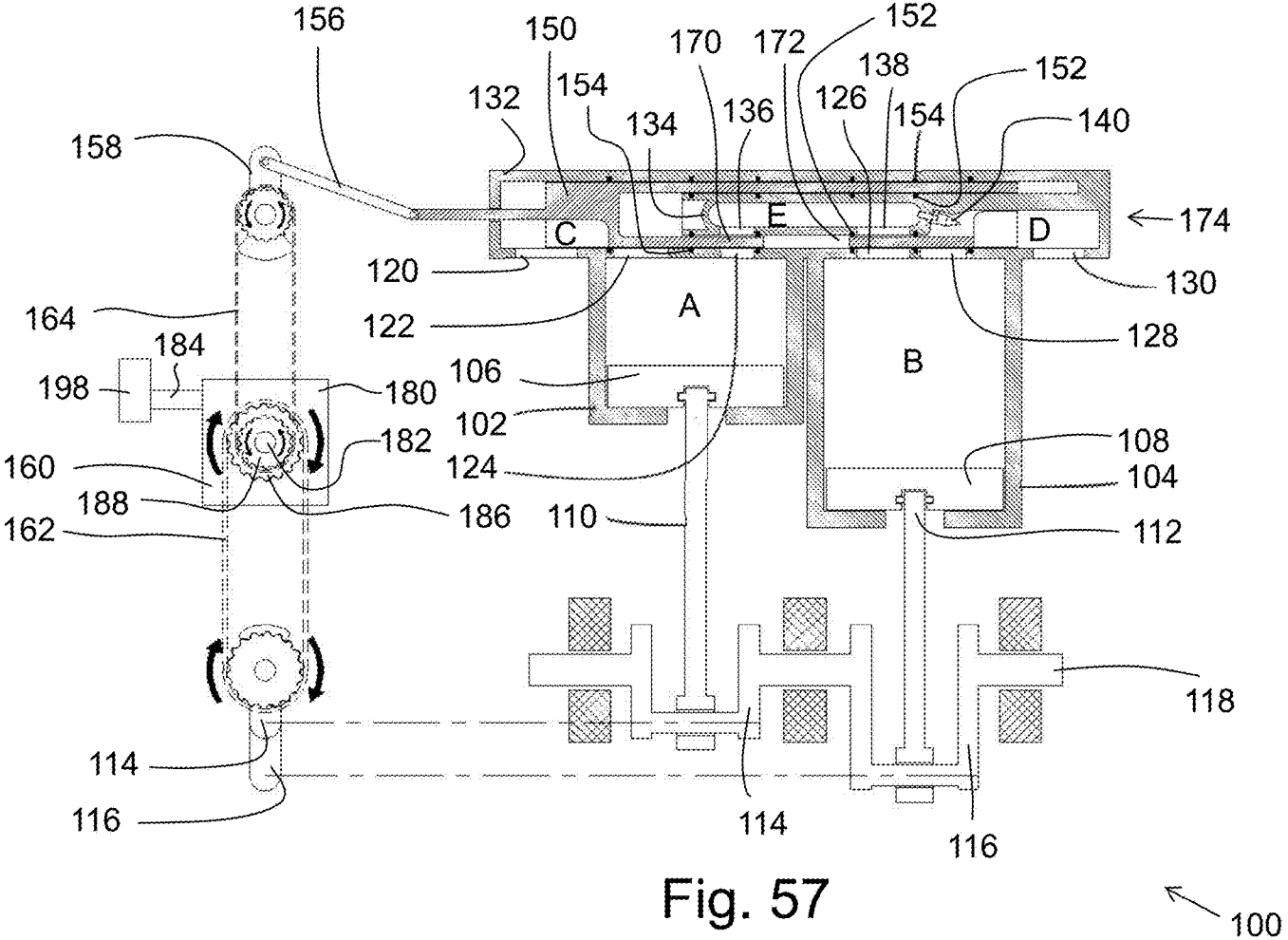
FIG. 57 schematically depicts the engine of FIG. 1 in the second transition cycle. The pistons are illustrated at 180 crankshaft degrees after their respective TDC points, and the sleeve shuttle is illustrated at 90 crankshaft degrees after its TDC point.
Figure 58:
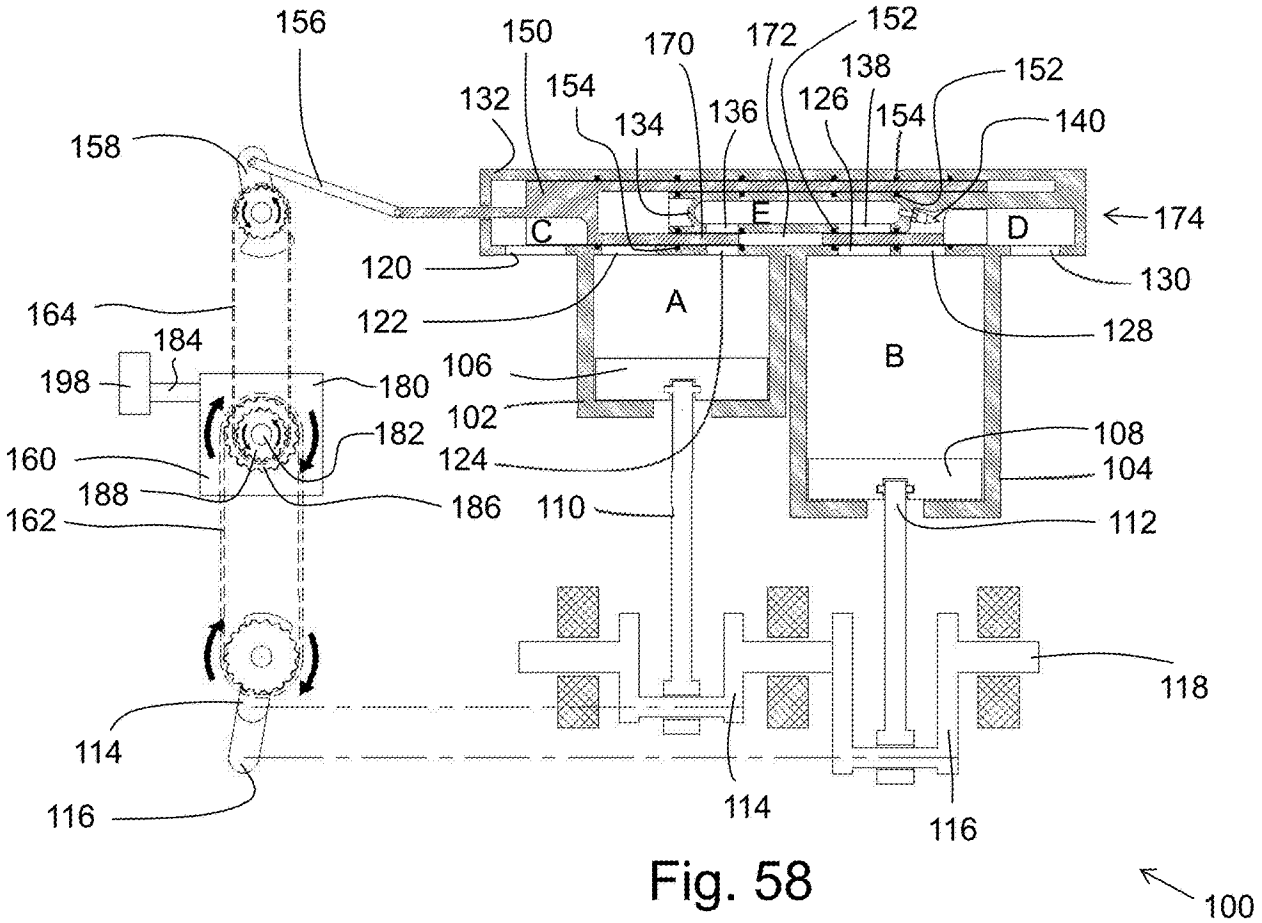
FIG. 58 schematically depicts the engine of FIG. 1 in the second transition cycle. The pistons are illustrated at 190 crankshaft degrees after their respective TDC points, and the sleeve shuttle is illustrated at 100 crankshaft degrees after its TDC point.
Figure 59:
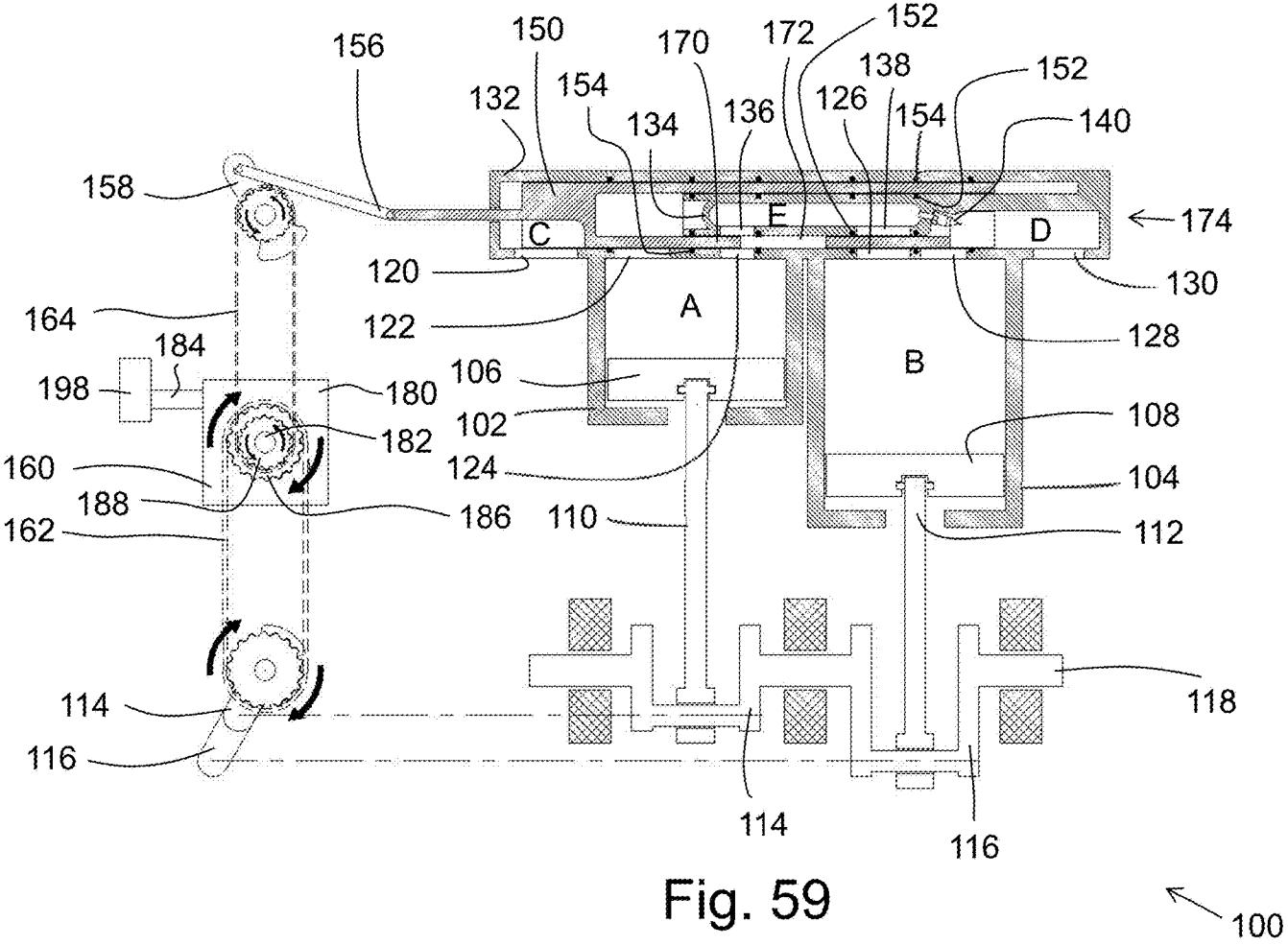
FIG. 59 schematically depicts the engine of FIG. 1 in the second transition cycle. The pistons are illustrated at 210 crankshaft degrees after their respective TDC points, and the sleeve shuttle is illustrated at 120 crankshaft degrees after its TDC point.
Figure 60:
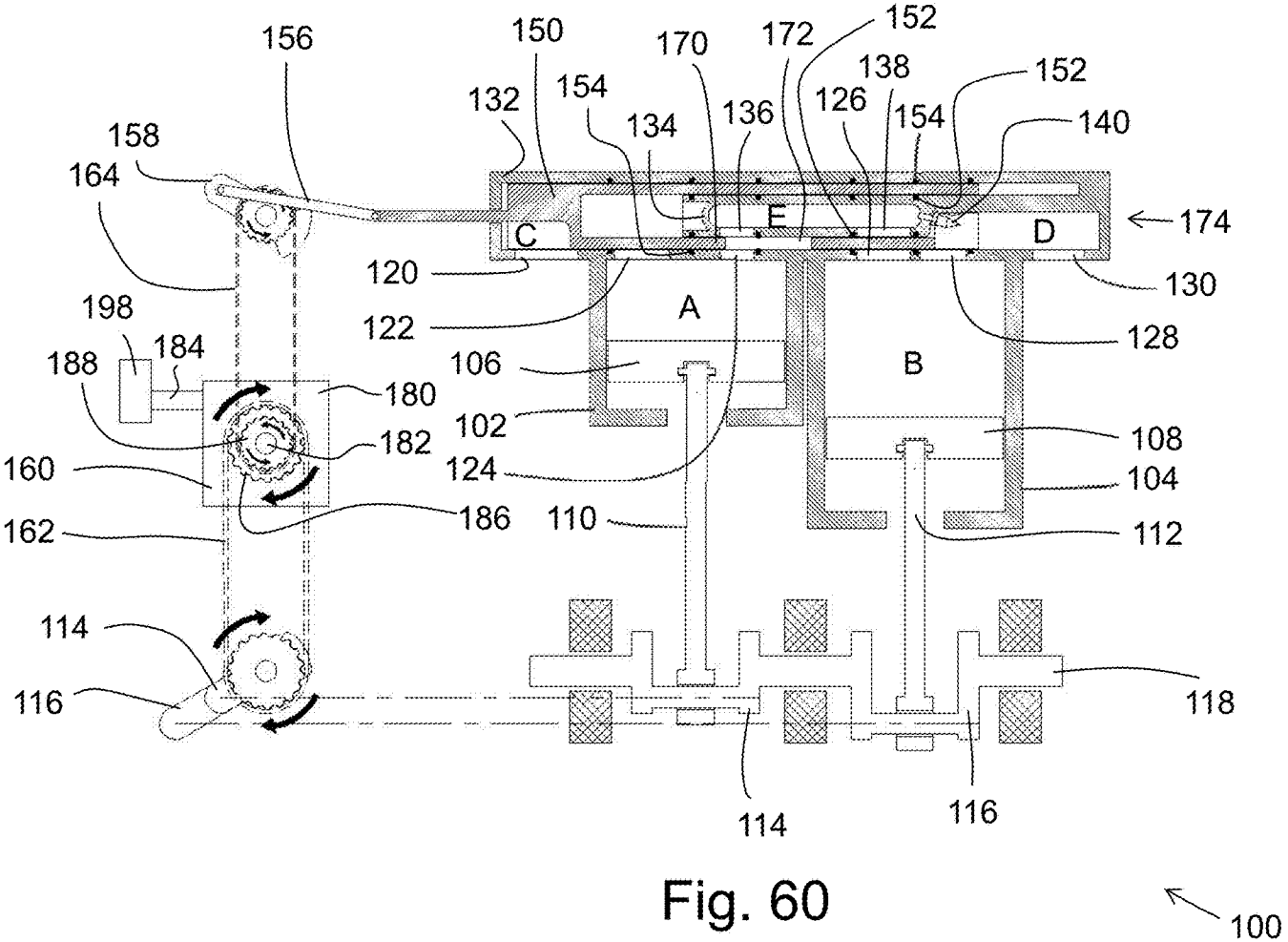
FIG. 60 schematically depicts the engine of FIG. 1 in the second transition cycle. The pistons are illustrated at 240 crankshaft degrees after their respective TDC points, and the sleeve shuttle is illustrated at 150 crankshaft degrees after its TDC point.
Figure 61:
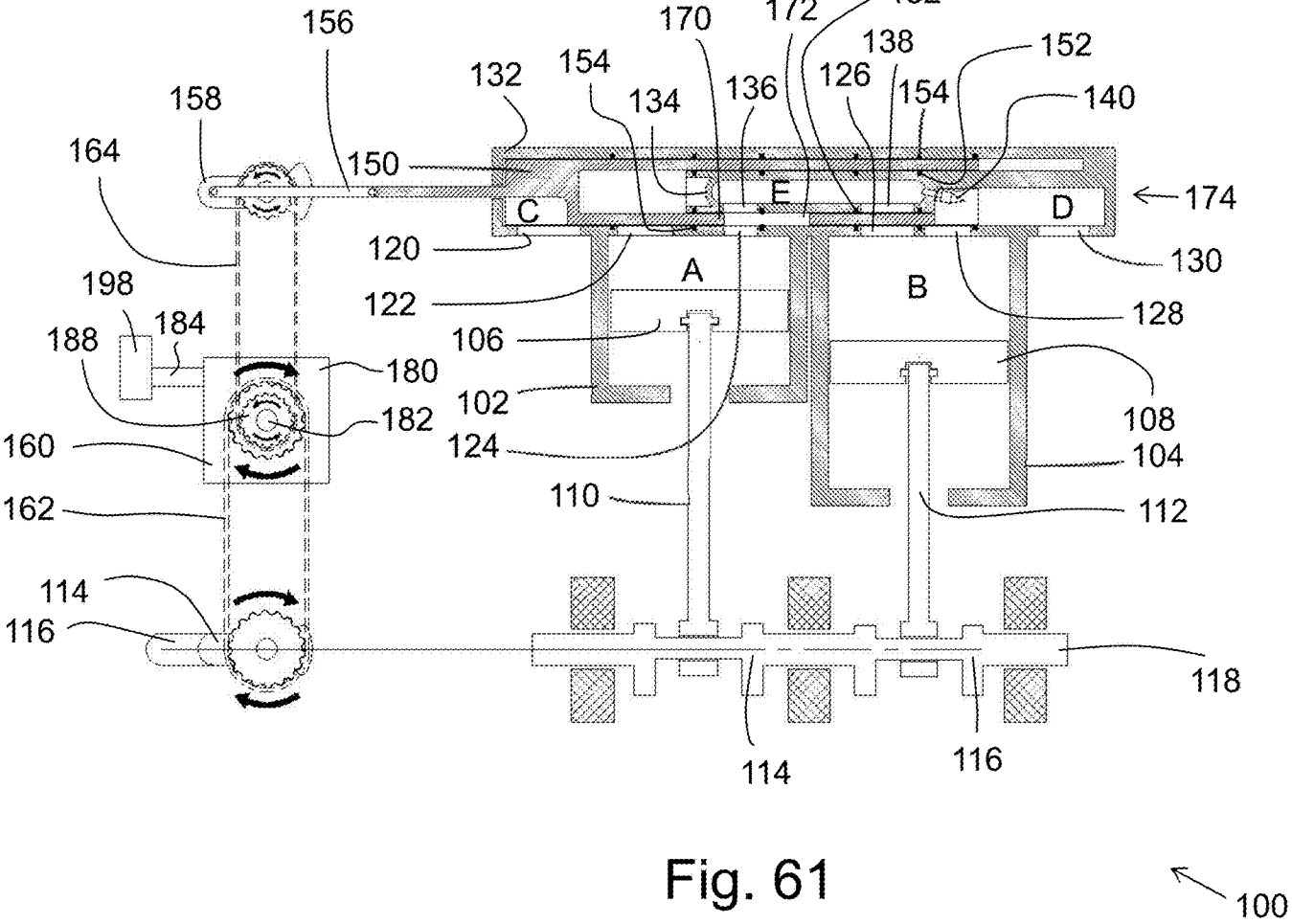
FIG. 61 schematically depicts the engine of FIG. 1 in the second transition cycle. The pistons are illustrated at 270 crankshaft degrees after their respective TDC points, and the sleeve shuttle is illustrated at its BDC (Bottom Dead Center) point.
Figure 62:
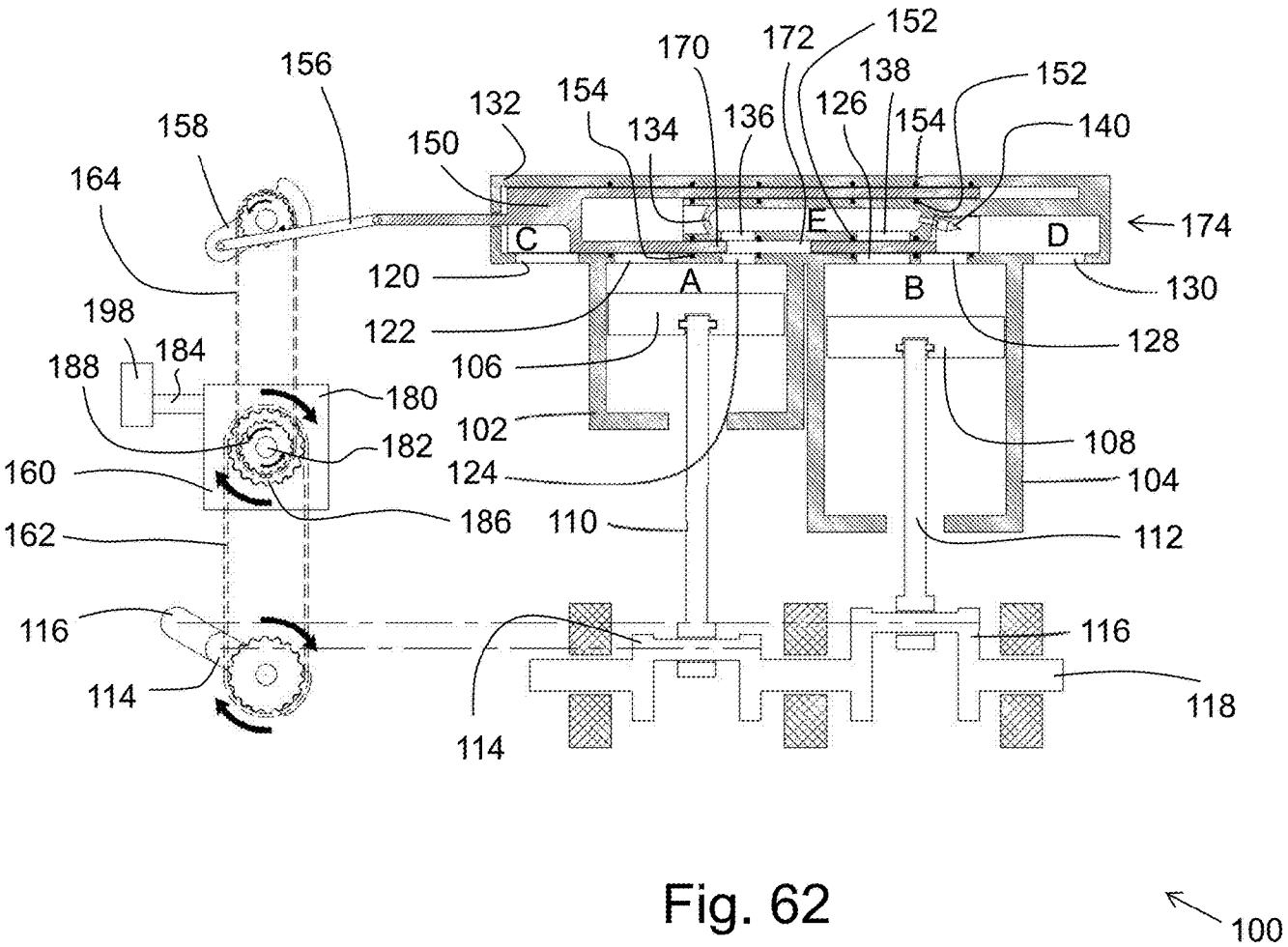
FIG. 62 schematically depicts the engine of FIG. 1 in the second transition cycle. The pistons are illustrated at 300 crankshaft degrees after their respective TDC points, and the sleeve shuttle is illustrated at 210 crankshaft degrees after its TDC point.
Figure 63:
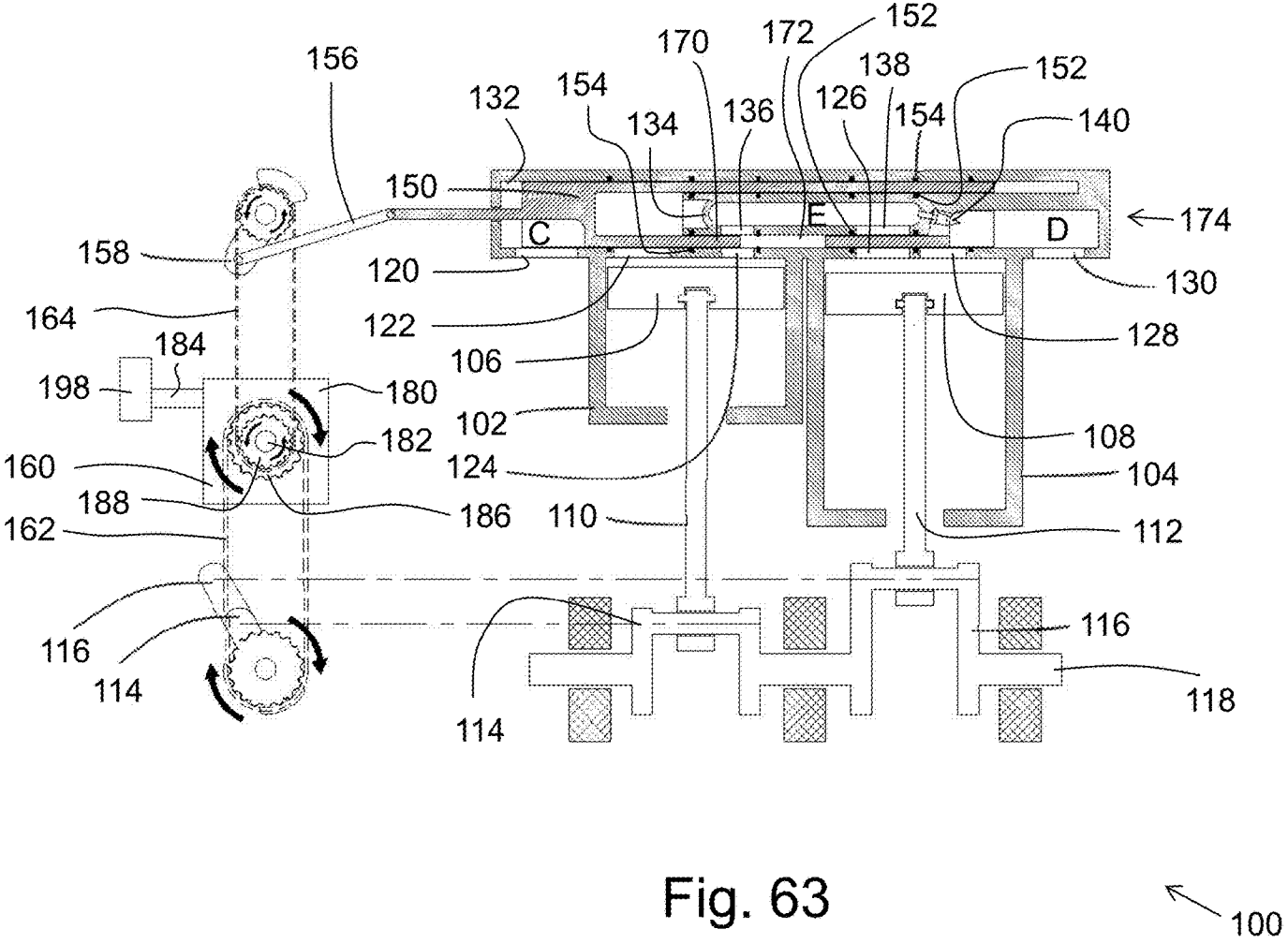
FIG. 63 schematically depicts the engine of FIG. 1 in the second transition cycle. The pistons are illustrated at 330 crankshaft degrees after their respective TDC points, and the sleeve shuttle is illustrated at 240 crankshaft degrees after its TDC point.
Figure 64:
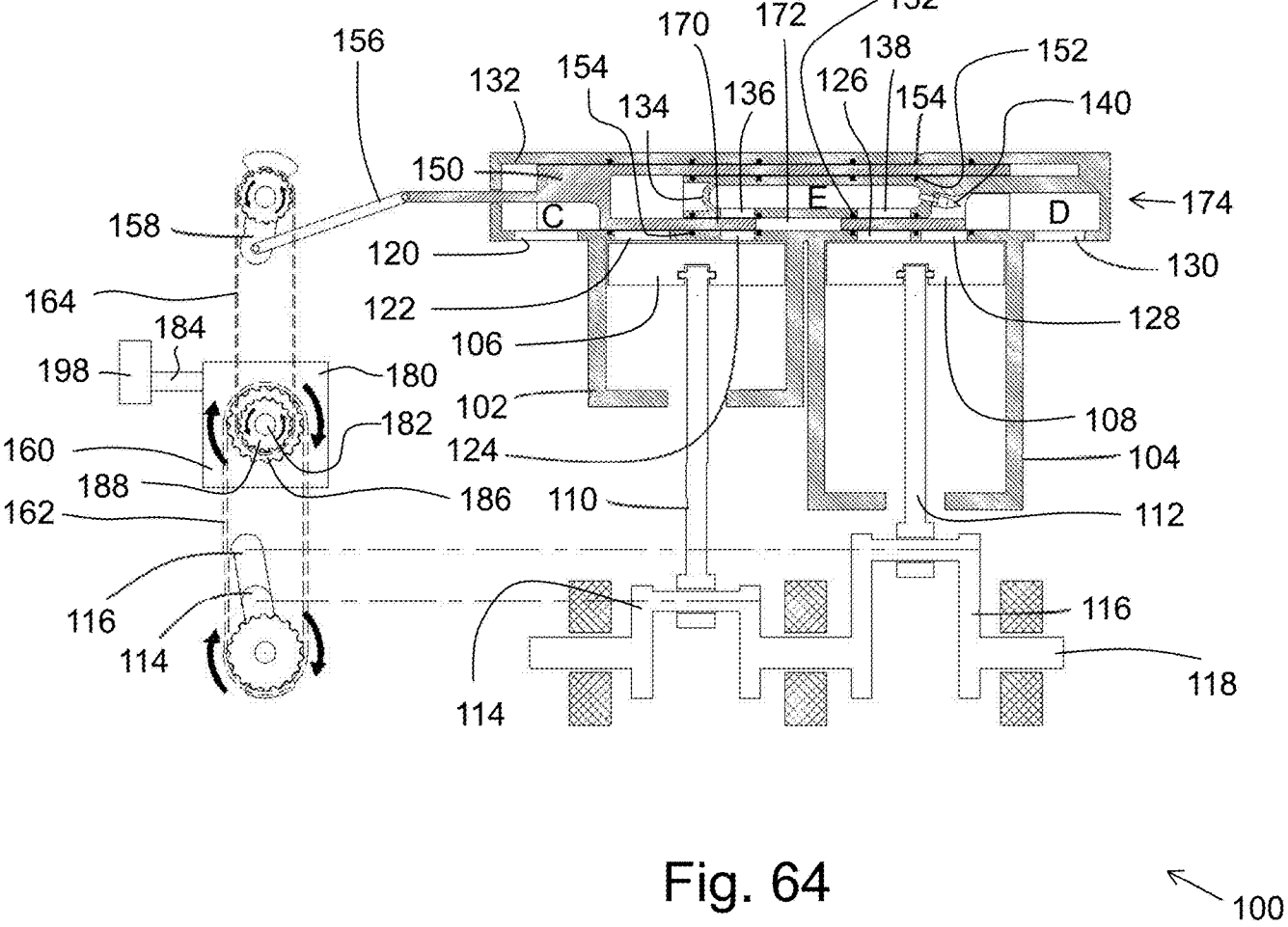
FIG. 64 schematically depicts the engine of FIG. 1 in the second transition cycle. The pistons are illustrated at 350 crankshaft degrees after their respective TDC points, and the sleeve shuttle is illustrated at 260 crankshaft degrees after its TDC point.

As sleeve shuttle 150 leftward motion continues (FIG. 51), sleeve shuttle 150 increasingly opens more of fourth port 128 and second port 124, possibly allowing for a higher flow rate of incoming working fluid from chamber D into chamber B and a higher flow rate of burnt fuel gas from chamber E into chamber A. As can be seen in FIG. 51, the phase shift between the motion of sleeve shuttle 150 and the motions of second piston 108 and first piston 106, continues to increase. The increase in the phase shift continues as sleeve shuttle 150 reverses its direction of motion and starts moving to the right (FIG. 52).

When second piston 108 and first piston 106 are 90 crankshaft degrees after their respective TDC positions, that is to say, midway down second cylinder 104 and first cylinder 102, respectively, sleeve shuttle 150 nears its mid-stroke point from the right (still increasing the phase shift—FIG. 53) and closes fourth port 128, thereby sealing the uncompressed working fluid inside chamber B, and also blocks second port 124, thereby sealing burnt fuel gas in chamber A, and burnt fuel gas in the now decoupled chamber E. The work performed by the burnt fuel gas in pushing down first piston 106, has commensurately decreased the gas' pressure, particularly in chamber E.

After second piston 108 and first piston 106 each move down past the midway point between its respective TDC positions and BDC positions, sleeve shuttle rightward motion opens third port 126 and first port 122, thereby allowing for fluid communication between chamber B and chamber E, and between chamber A and chamber C. As second piston 108 and first piston 106 continue their descent (FIG. 54), sleeve shuttle 150 rightward motion increasingly unblocks more of third port 126 and first port 122, and the phase shift relative to the pistons continues increasing.

As second piston 108 and first piston 106 near their respective BDC positions (FIG. 55), and sleeve shuttle 150 nears its mid-stroke point from the right (having reversed its direction of motion relative to FIG. 54), sleeve shuttle 150 is advanced by 270 degrees (equivalent to being retarded by 90 degrees) relative to second piston 108 and to first piston 106, and it resumes moving synchronously with second piston 108 and first piston 106.

During the third part of the first transition cycle (FIGS. 56-64 and FIG. 1) first piston 106 and second piston 108 move in phase, and sleeve shuttle 150 moves synchronously with first piston 106 and second piston 108 at a negative phase shift of 90 crankshaft degrees with respect to the pistons as explained above. First piston 106 is employed to perform a compression stroke, compressing the gas in chamber A into combustion chamber E via first port 122, sleeve port 172 and first combustion chamber port 136. Second piston 108 is employed to perform an exhaust stroke, exhaling the gas from chamber B through fourth port 128, chamber D and manifold 130 to ambient air. The fluid that resides in chamber A during the compression stroke in the third part of the second transmission cycle may be composed partly or mostly or completely of burnt gas, subsequent the most recent combustion in chamber E. Also, the gas that resides in chamber B during the exhaust stroke in the third part of the second transmission cycle may be composed partly or mostly or completely of unexploited working fluid (fuel/air charge) which was fed into chamber B during the most recent intake stroke in the first part of the second transition cycle. It is noted however that variations in the fluid contents and compositions of the chambers relative to their respective fluidic contents in the compression and exhaust strokes in the first mode of operation (FIGS. 1-17) may occur, and it may take a few further cycles for these variations to disappear as the engine continues operation in the first mode.

It is noted that as first cylinder 102 and second cylinder 104 switch roles (so that intake and compression take place in chamber A and expansion and exhaust take place in chamber B), first manifold 120 and second manifold 130 also switch roles as is further detailed and explained hereinbelow in FIGS. 66 and 67.

It is to be understood that descriptions of possible ranges of opening times and closing times of engine 100 ports, and the phase shifts between various engine 100 components (such as, for example, first piston 106 and second piston 108, or, for example, second crankshaft 116 and sleeve crankshaft 158, etc.) at first piston TDC and BDC, specifically those appearing at the end of the section describing the first mode of engine 100 cycle, also apply, mutatis mutandis, to the above description of the second transition cycle.

It is noted that a transition from the first mode to the second mode, and a transition from the second mode to the first mode, may also be affected by retarding sleeve crankshaft 158 relative to first crankshaft 114 (rather than advancing sleeve crankshaft 158 relative to first crankshaft 114, as described herein above). Retarding sleeve crankshaft 158 relative to first crankshaft 114 may be carried out, for example, by rotating control shaft 184 so as to decelerate crankshaft 158 relative to first crankshaft 114 during a first part of a transition cycle, and then to accelerate crankshaft 158 relative to first crankshaft 114 during a subsequent part of the transition cycle. It is further noted however, that by affecting a transition cycle using advancing sleeve crankshaft 158 rather than retarding sleeve crankshaft 158 (relative to first crankshaft 114), a transition cycle may be completed over a shorter time period and hence over a smaller number of engine cycles (or a smaller portion of a single cycle). An engine cycle is referred to herein as a complete revolution of first crankshaft 114.

Completing a transition cycle over a shorter period may be advantageous in some embodiments, due to shortening the time of undefined direction of fluid flow in the engine. Yet, it is emphasized that a transition from first mode to second mode or vice versa may, according to some embodiments, extend over several cycles of the engine. For example, in an engine that runs at 3000 RPM such a transition may be conducted over a time period of e.g. 20 msec, thereby completing the transition during a single cycle. According to some embodiments with more relaxed performance, a transition may be conducted within 100 msec, so that the transition is accomplished within 5 cycles of the engine. During the transition the engine may not nominally produce torque, however inertia maintains the engine running for a few cycles during the transition even if fuel utilization during this time is substantially null.

It is noted that, according to some embodiments, shifting the phase of the sleeve shuttle relative to the pistons, and/or shifting the phase of the expansion piston relative to the compression piston, may be used to decelerate forcefully the engine. Such deceleration may be achieved by causing the engine to compress gas without utilizing the compressed gas for obtaining work. This may be obtained for example by shifting the phase of the sleeve shuttle, e.g. by 180 degrees, as is described above in FIGS. 17-33 and then in FIGS. 33-49, without switching the source of the working fluid. By shifting the phase of the sleeve shuttle, e.g. by 180 degrees, the engine is effected to intake gas through an exhaust system (not shown here) and the second manifold 130 and through fourth port 128 into the second cylinder 104, and then compress the gas into the combustion chamber. The gas may then be released through first cylinder 102 (and through first port 122 and first manifold 120) to ambient air without performing any work, thereby decelerating the engine. Other configurations of relative phase shifting the sleeve shuttle and/or the pistons for decelerating the engine are contemplated.

Phase Shifting Transmission Gear

Figure 65:
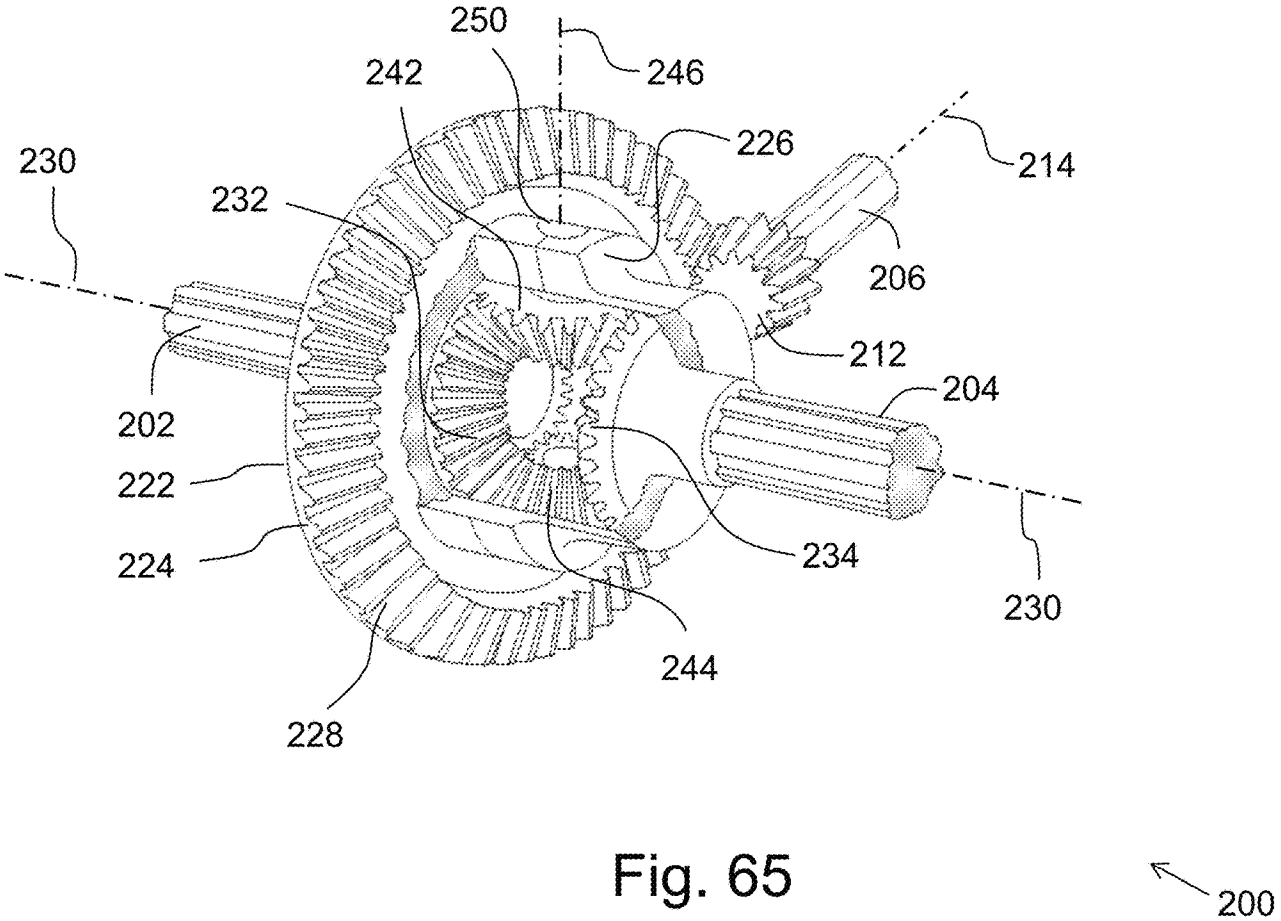
FIG. 65 is a perspective depiction of a phase shifting transmission gear comprising an open differential, in accordance with exemplary embodiments.

FIG. 65 schematically depicts an exemplary embodiment of phase shifting transmission gear 180, comprising an open differential 200. Open differential 200 comprises an input axle 202, an output axle 204 and a control shaft 206. During operation, if control shaft 206 is stationary, output axle 204 is configured to revolve synchronously with input axle 202 and in opposite direction to input axle 202. A rotation of control shaft 206 by a rotation angle θ—whether input axle 202 and output axle 204 are concurrently revolving or not—sets a phase shift—namely an angular difference—between input axle 202 and output axle 204.

Open differential 200 further comprises a control gear 212, a crown gear 222, a first sun gear 232, a second sun gear 234, a first planetary gear 242, and a second planetary gear 244. Control gear 212 is mounted on the end of control shaft 206, such that control shaft 206 and control gear 212 have a same rotation axis 214. Crown gear 222 comprises an annulus 224 being flat on one side thereof and having a circular band of cogs 228 on the other side thereof. A hollow cylindrical structure 226 is fixed to annulus 224. Crown gear 222 may rotate about a rotation axis 230 coinciding with a symmetry axis of the annulus and circular band of cogs 228. Crown gear 222 and control gear 212 constitute a bevel-gear system. That is to say, control gear 212 is engaged with circular band of cogs 228 such that rotation axis 230 of crown gear 222 is perpendicular to the rotation axis 214 of control gear 212, and a rotation of one of crown gear 222 and control gear 212 may induce a rotation in the other.

First sun gear 232 is fixedly mounted on the end of input axle 202, and disposed inside hollow cylindrical structure 226, being freely rotatable relative to hollow cylindrical structure 226 around rotation axis 230. Second sun gear 234 is fixedly mounted on the end of output axle 204, and disposed inside hollow cylindrical structure 226 opposite first sun gear 232, being freely rotatable relative to hollow cylindrical structure 226 around rotation axis 230. A first planetary gear 242 is mounted on a first pinion 250 inside hollow cylindrical structure 226, being freely rotatable relative to hollow cylindrical structure 226 around a rotation axis 246, rotation axis 246 being perpendicular to rotation axis 230 and to rotation axis 214. A second planetary gear 244, which may be identical to first planetary gear 242, is mounted on a second pinion (not shown here) opposite to first planetary gear 242 inside hollow cylindrical structure 226, being freely rotatable relative to hollow cylindrical structure 226 around rotation axis 246. First sun gear 232 is engaged with first planetary gear 242 and with second planetary gear 244, and second sun gear 234 is engaged with first planetary gear 242 and with second planetary gear 244 so that a rotation of one of first sun gear 232 or second sun gear 234 in one direction relative to hollow cylindrical structure 226, compels a rotation of the other one of first sun gear 232 and second sun gear 234 in the opposite direction.

A rotation of output axle 204 at a rotation angle $\phi$ is a function of the rotation angle $\psi$ of input axle 202 and the rotation angle $\theta$ of control shaft 206: $\phi=\psi+c\cdot\theta$ where c is a constant. Thus, as input axle 202 rotates and control shaft 206 is stationary, output axle 204 rotates synchronously with input axle 202 in the opposite direction to input axle 202. Further, a rotation of control shaft 206 by an angle $\theta$—whether input axle 202 and output axle 204 are concurrently rotating or not—may introduce a phase shift proportional to B between the rotations of input axle 202 and output axle 204.

In exemplary embodiments, in the first mode (e.g. FIGS. 1-17) and in the second mode (e.g. FIGS. 33-49), control shaft 206, control gear 212 and crown gear 222 are stationary and do not rotate about their respective axes. Engine power shaft 118 may induce, via first timing belt 162, a rotation of first sun gear 232, which in turn induces a rotation of first planetary gear 242 and a rotation of second planetary gear 244 in opposite directions to one another. The rotations of first planetary gear 242 and second planetary gear 244 cause second sun gear 234 to rotate at the same speed as first sun gear 232, and in opposite direction to it.

During the first and second parts of the first transition cycle (FIGS. 17-23) and the first and second parts of the second transition cycle (FIGS. 49-55), control shaft 206 may be rotated to effect a phase shift between input axle 202 and output axle 204. Control shaft 206 rotation by an angle $\theta$ causes, via control gear 212, a rotation of crown gear 222 and hence a net rotation of output axle 204 relative to input axle 202 of $c\cdot\theta$ as explained above.

Switching Between Gas Supply and Gas Exhale

Figure 66:
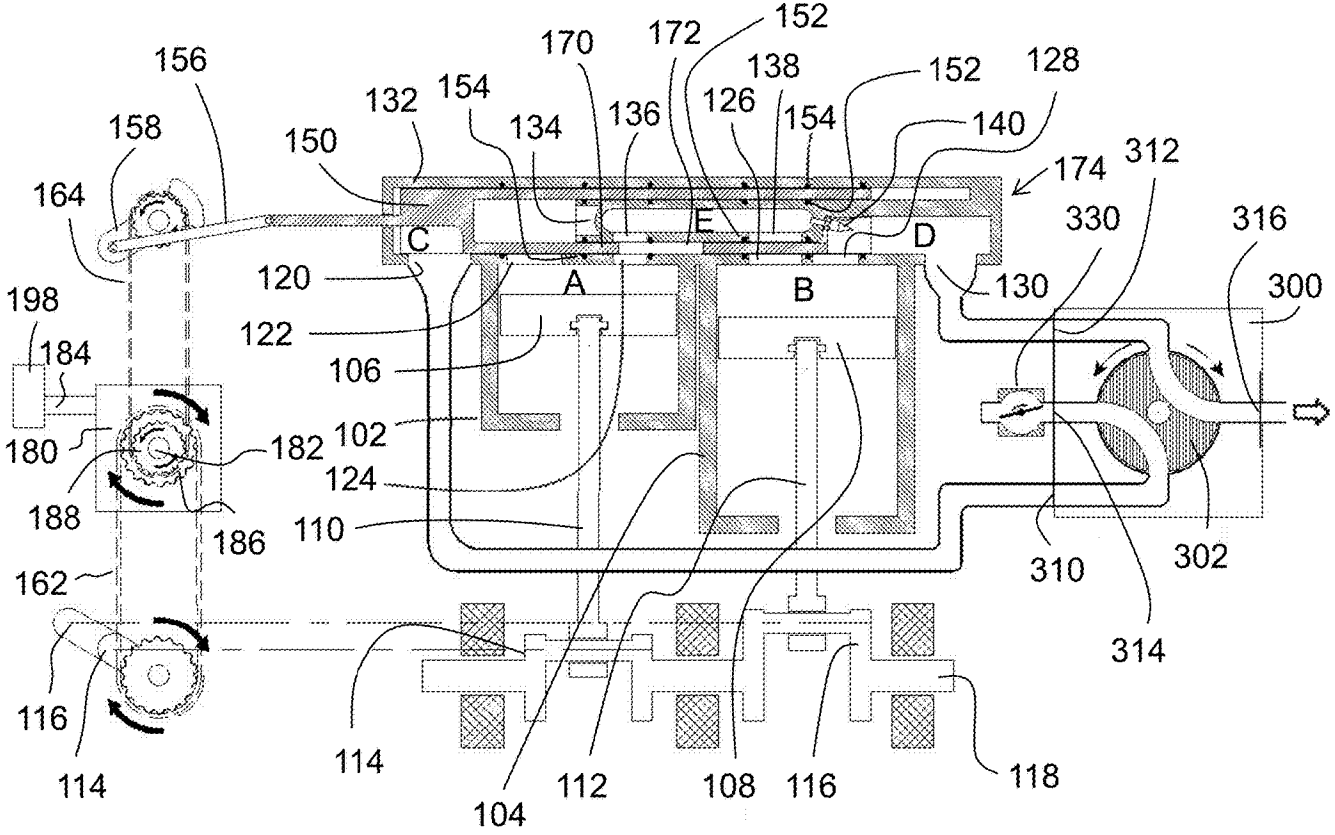
FIG. 66 schematically depicts a cross-sectional side view of a switching valve, in accordance with exemplary embodiments, in a first valve state, coupled to the engine of FIG. 1, which is in a first mode of operation.
Figure 67:
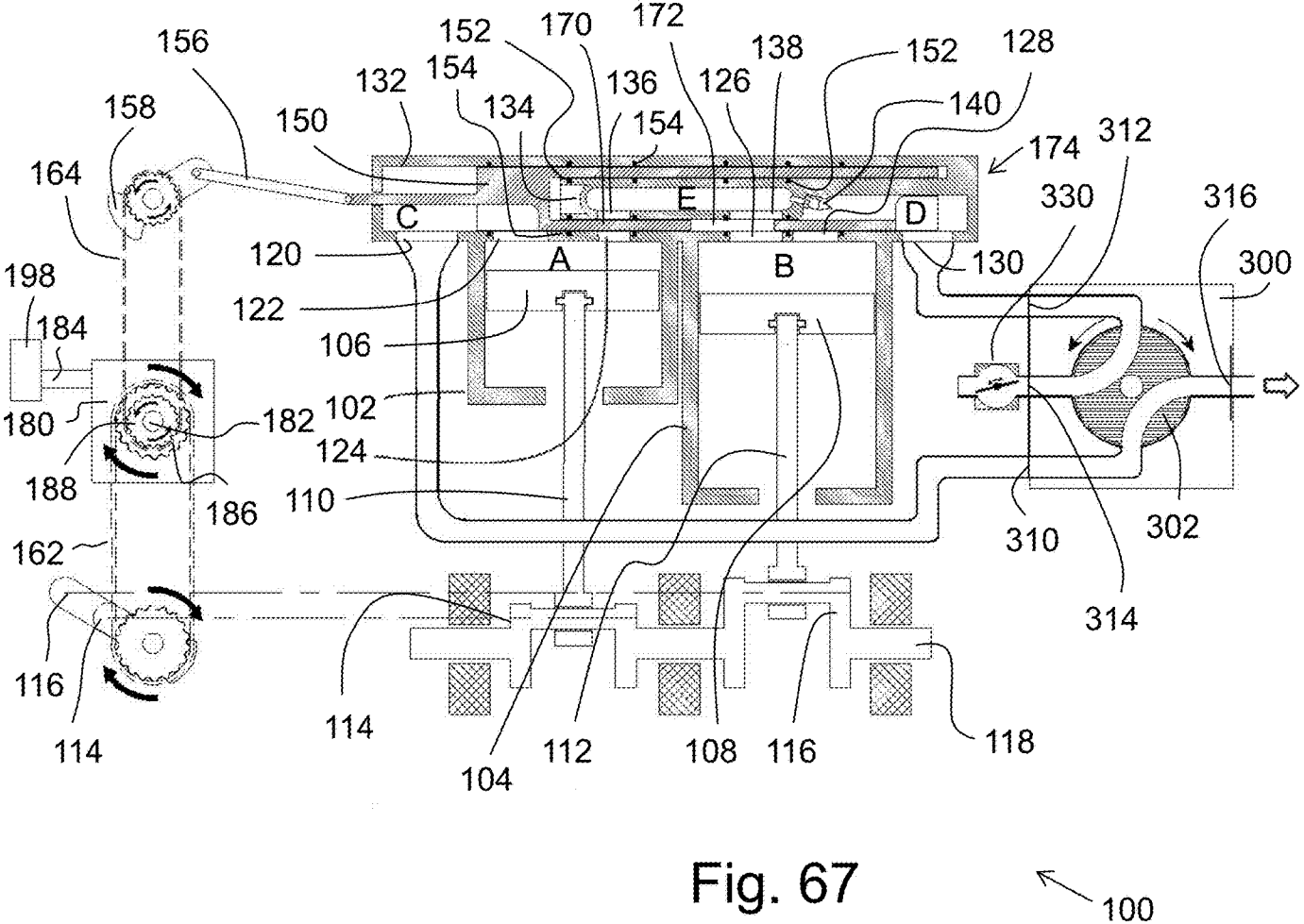
FIG. 67 schematically depicts the switching valve and the engine of FIG. 66 in a second valve state and in a second mode of operation, respectively.

FIGS. 66 and 67 depict an exemplary embodiment of a switching valve 300 in a first state and in a second state, respectively, the switching valve being coupled to engine 100. The first state and the second state of the switching valve are associated with the first mode and second mode of operation, respectively of engine 100, as is further explained below. Switching valve 300 comprises a rotary valve 302, a first valve port 310, a second valve port 312, a third valve port 314 and a fourth valve port 316. First valve port 310 is fluidly coupled to first manifold 120 to allow fluid communication between first valve port 310 and first manifold 120. Second valve port 312 is fluidly coupled to second manifold 130 to allow fluid communication between second valve port 312 and second manifold 130. Third valve port 314 is fluidly coupled to a throttle valve 330 to allow fluid communication between third valve port 310 and throttle valve 330. And fourth valve port 316 is fluidly open to ambient air, or alternatively fluidly coupled to an exhaust system (not shown here).

In the first state of switching valve 300, schematically depicted in FIG. 66, rotary valve 302 fluidly couples first valve port 310 with third valve port 314 and fluidly couples second valve port 312 with fourth valve port 316. In the second state of switching valve 300, schematically depicted in FIG. 67, rotary valve 302 fluidly couples first valve port 310 with fourth valve port 316 and fluidly couples second valve port 312 with third valve port 314.

During the first mode of operation (FIG. 66), switching valve 300 is in the first state. In the second mode of operation (FIG. 67), switch valve 300 is in the second state. Thus in the first mode, when switching valve 300 is in the first state, fuel—air charge flows from throttle valve 330, via third valve port 314 and first valve port 310 into first manifold 120 and into chamber C. Also in the first mode burnt fuel gas exhausts from chamber D and second manifold 130, via second valve port 312 and fourth valve port 316, to ambient air. During the second mode switching valve 300 is in the second state, air-fuel charge flows from throttle valve 330, via third valve port 314 and second valve port 312 into second manifold 130 and into chamber D, and burnt fuel gas exhausts from chamber C and first manifold 120, via first valve port 310 and fourth valve port 316, to ambient air.

Switching valve 300 switches from the first state to the second state during the first transition cycle (FIGS. 17-33), preferably after the first part of the first transition cycle, preferably during the third part of the first transition cycle.

Likewise, switching valve 300 switches from the second state to the first state during the second transition cycle (FIGS. 49-64 and through FIG. 1), preferably after the first part of the second transition cycle, preferably during the third part of the second transition cycle. For switching between states rotary valve 300 may be mechanically powered by an actuator or a motor such as a step motor (not shown in these Figures).

Phase Shifting the Pistons

Figure 68:
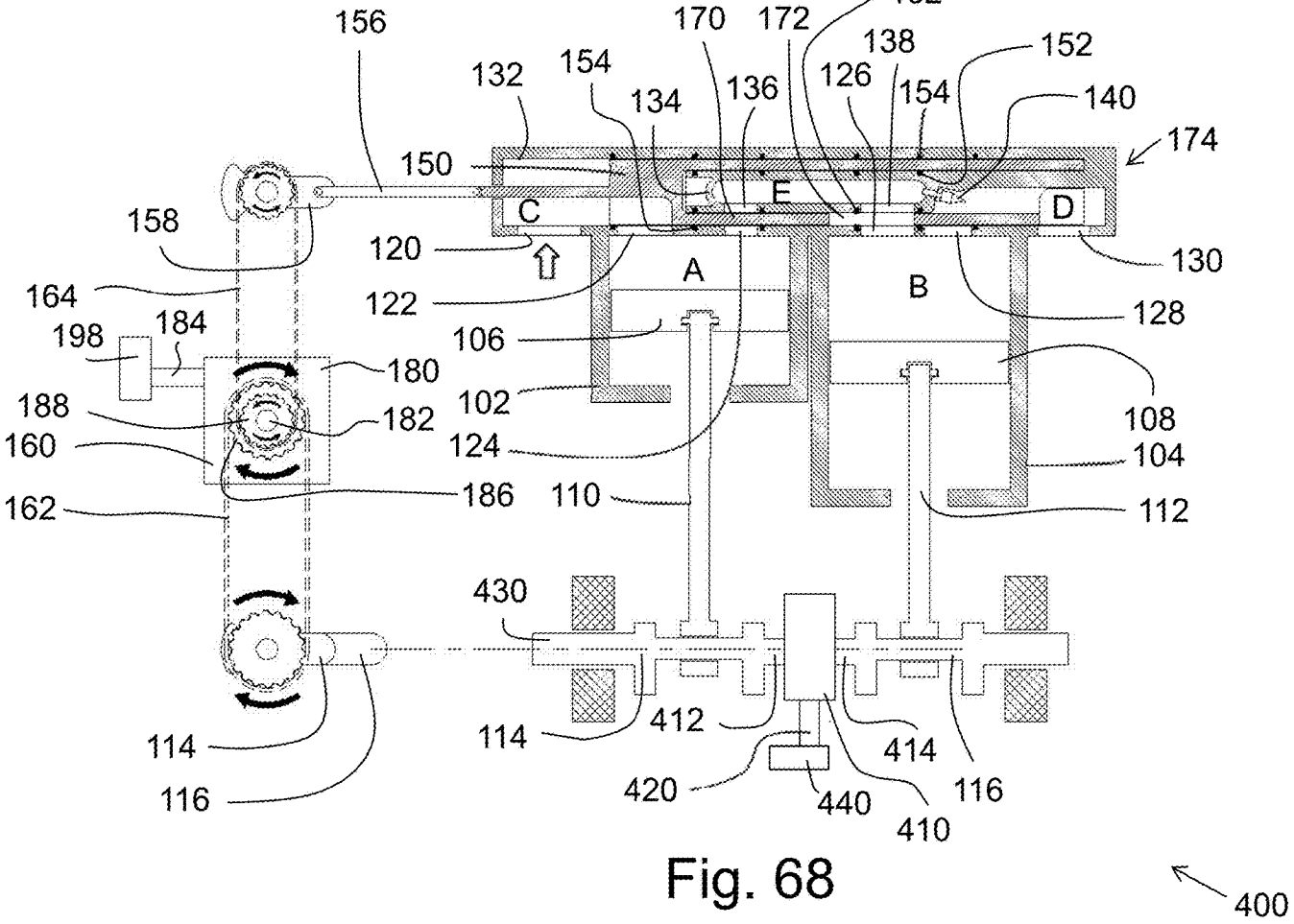
FIG. 68 schematically depicts a cross-sectional side view of a bi-directional fluid flow split-cycle engine comprising a piston phase transmission gear. The engine is in the first mode of operation and the pistons are in phase.

FIG. 68 schematically depicts an exemplary embodiment of a split-cycle engine 400. Engine 400 differs from engine 100 in having a piston phase transmission gear 410, allowing for controllably setting a phase difference between first piston 106 and second piston 108. Piston phase transmission gear 410 comprises a first piston axle 412, a second piston axle 414 revolving synchronously with first piston axle 412, and a phase control shaft 420 configured to set a phase shift between first piston axle 412 and second piston axle 414. Phase control shaft 420 may be rotated to vary or to set a phase shift between the pistons by an actuator 440, such as a motor or a step motor. First piston axle 412 is fixedly coupled with first crankshaft 114 thereby first piston axle 412 and first crankshaft 114 revolve together about a first common rotation axis. Likewise, second piston axle 414 is fixedly coupled with second crankshaft 116 thereby second piston axle 414 and second crankshaft 116 revolve together about a second common rotation axis, possibly being identical with the first common rotation axis. An engine power shaft 430 fixedly coupled to first crankshaft 114 is used to drive phase shifting transmission gear 180 via timing belt 162 as is explained and detailed above in FIGS. 1-64. According to some embodiments, engine power shaft 430 may be fixedly coupled to second crankshaft 116 rather than to first crankshaft 114. According to some embodiments engine power shaft 430 may be used to output engine power. According to some embodiments the first piston axle and the second piston axle rotate synchronously in the same direction. According to some embodiments, the first piston axle and the second piston axle rotate (synchronously) in opposite directions. According to some embodiments, piston phase transmission gear 410 comprises an open differential as described in FIG. 65.

Piston phase transmission gear 410 may be employed to controllably vary and to controllably set a phase difference $\gamma$ between first piston 106 and second piston 108, e.g. by rotating phase control shaft 420 by an angle $\theta$ so that $\gamma=c\cdot\theta$ where c is a constant. According to some embodiments piston phase transmission gear 410 may be employed to set a zero phase shift between the pistons during the first mode of operation, as described for example in FIGS. 1-16 above, and to set a non-zero phase shift between the pistons during the second mode of operation. In some embodiments piston phase transmission gear 410 may be employed to retard second piston 108 relative to first piston 106, e.g. by 10 or 20 or 30 or even by 40 degrees. In embodiments comprising a sleeve cylinder having a sleeve port large enough to simultaneously fluidly couple both chamber A and chamber B to chamber E, piston phase transmission gear 410 may be employed to retard second piston 108 such that combustion is initiated when second piston 108 nears TDC and first piston 106 is past TDC, thereby effectively increasing the volume in which combustion occurs and allowing the intake and exploitation of a greater amount of air-fuel charge. In some embodiments combustion may be initiated when the ascent velocity of second piston 108, while effecting a compression stroke, is equal to the descent velocity of first piston 106, while effecting an expansion stroke, thereby maintaining the compression ratio below a suitable value.

In some exemplary embodiments, phase shifting transmission gear 180 and piston phase transmission gear 410 may also change the phase differences between second piston 108 and sleeve shuttle 150, and first piston 106 and second piston 108, respectively, during the first mode of operation, and/or during the second mode of operation, and not just in the first and second transition cycles. Particularly, phase shifting transmission gear 180 and second phase shifting transmission gear 410 may switch between more than two values of phase differences, for example, 3, 5, or even 10 values of phase differences, and fine tune the phase differences with respect to various engine parameters, such as the speed and fuel consumption, in order to optimize, for example, fuel efficiency or to maximize engine power etc. According to some embodiments, phase shifts set by phase shifting transmission gear 180 and by piston phase transmission gear 410 may admit continuous phase shift values rather than discrete values.

Double Combustion Chamber

Figure 69:
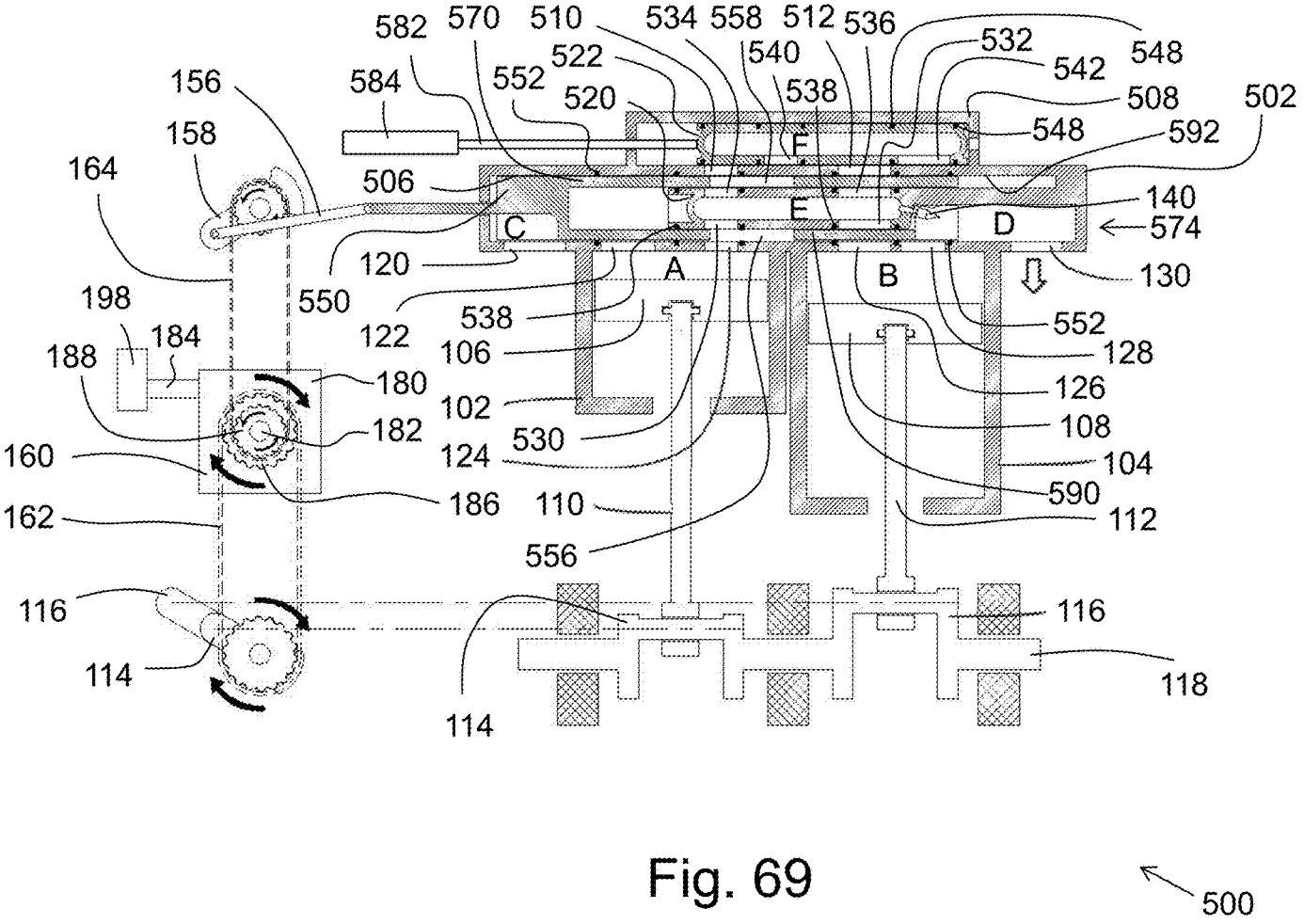
FIG. 69 schematically depicts a cross-sectional side view of a bi-directional fluid flow split-cycle engine comprising a first combustion chamber and a second, auxiliary combustion chamber wherein the engine is in a first mode of operation, and the auxiliary combustion chamber is fluidly decoupled from the first combustion chamber, and combustion may occur only in the first combustion chamber.
Figure 70:
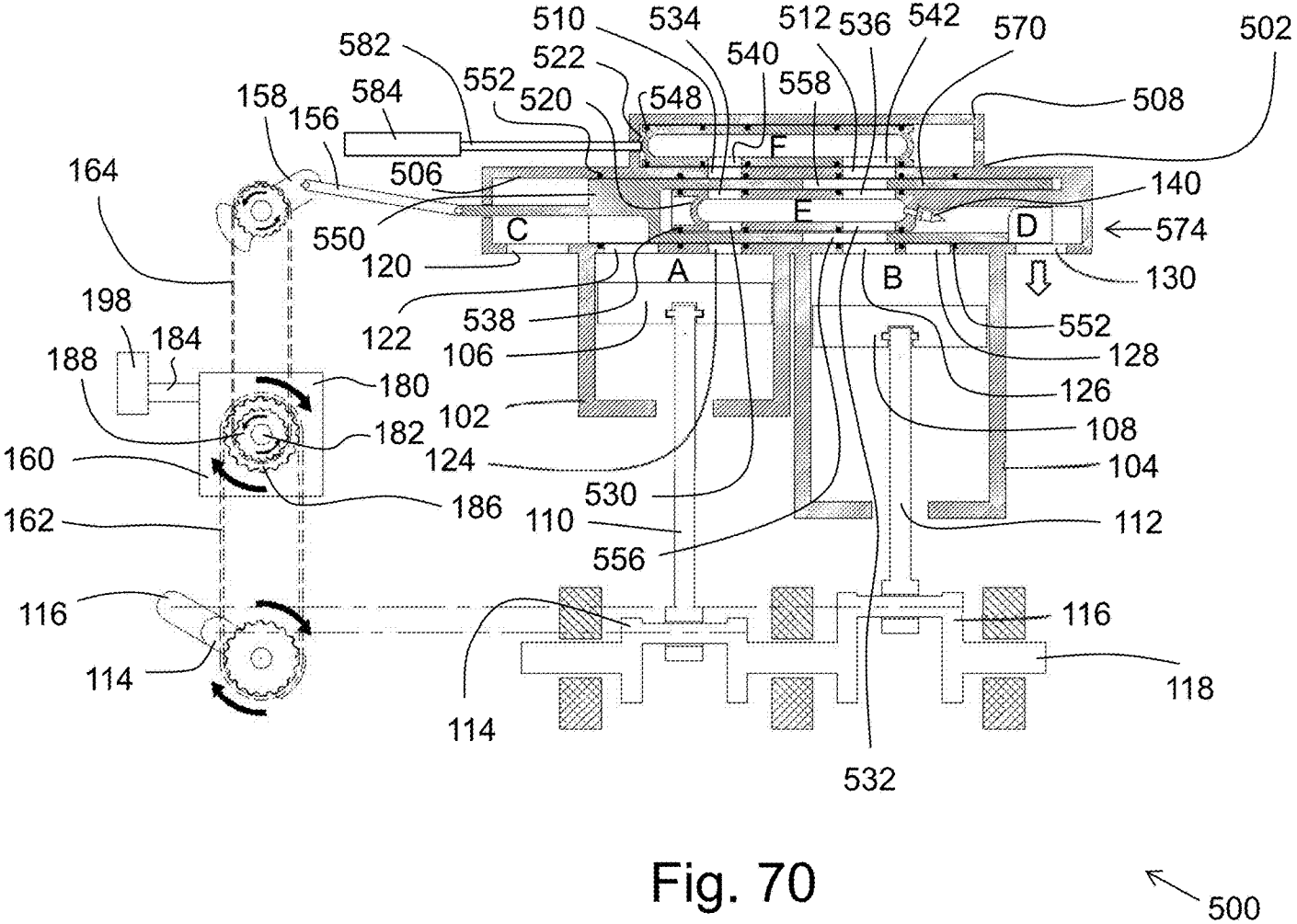
FIG. 70 schematically depicts the engine of FIG. 69 in a second mode of operation, wherein the auxiliary combustion chamber is fluidly coupled to the first combustion chamber and combustion may occur simultaneously in both combustion chambers.

FIGS. 69 and 70 depict an embodiment of a bi-directional flow split-cycle engine 500, having the combustion chamber E and also an auxiliary combustion chamber F. Auxiliary combustion chamber F may be controllably fluidly coupled to combustion chamber E, thereby increasing the volume in which combustion occurs. According to some embodiments, auxiliary combustion chamber F is decoupled from combustion chamber E and is not in use when engine 500 is employed in the first mode of operation (FIG. 69), wherein compression occurs in a first, smaller cylinder and expansion occurs in a second larger cylinder, substantially as described above in FIGS. 1-16. Auxiliary combustion chamber F may be coupled to combustion chamber E when engine 500 is employed in the second mode of operation (FIG. 70), wherein compression occurs in the second, larger cylinder and expansion occurs in the first, smaller cylinder, thereby effectively increasing the volume in which combustion occurs and thereby allowing for t exploitation of a greater amount of fuel-air charge, while maintaining the compression ratio below a suitable value.

Engine 500 differs from engine 100 by having a double cylinder structure 502 in place of sleeve cylinder structure 132. Double cylinder structure 502 comprises a sleeve cylinder (valve cylinder) 506 and an upper cylinder 508. Sleeve cylinder 506 is placed on top of, and perpendicularly to, first cylinder 102 and second cylinder 104. Upper cylinder 508 is placed on top of, and in parallel to, sleeve cylinder 506.

Sleeve cylinder 506 comprises a combustion chamber structure 520 fixed within sleeve cylinder 506, defining chamber E therein, and comprising a first combustion chamber port 530, a second combustion chamber port 532, a third combustion chamber port 534 and a fourth combustion chamber port 536. In some embodiments, spark plug 140 is positioned in combustion chamber structure 520 and configured to ignite a spark within chamber E. Sleeve cylinder 506 further comprises a sleeve shuttle 550, extracting (sealing) rings 538 mounted in annular grooves on an external surface of combustion chamber structure 520 and contracting (sealing) rings 552 mounted in annular grooves of sleeve cylinder 506.

Upper cylinder 508 comprises a first inter-cylinder port 510 and a second inter-cylinder port 512. Upper cylinder 508 houses an upper combustion chamber structure 522, defining an auxiliary combustion chamber F there within. Upper combustion chamber structure 522 is dimensioned and configured to slide inside upper cylinder 508. Upper combustion chamber structure 522 comprises a first upper combustion chamber port 540, a second upper combustion chamber port 542, and upper extracting rings 548, mounted in annular grooves on an external surface of upper combustion chamber structure 522. Upper combustion chamber structure 522 may be controllably slid inside upper cylinder 508 from a first position to a second position and vice-versa by means of a positioning shaft 582. In the first position (FIG. 69), first upper combustion chamber port 540 and second upper combustion chamber port 542 are blocked, and auxiliary combustion chamber F is fluidly decoupled from combustion chamber E; extracting rings 548 prevent fluid passage between first upper combustion chamber port 540 and first inter-cylinder port 510 and/or second inter-cylinder port 512, and between second upper combustion chamber port 542 and first inter-cylinder port 510 and/or second inter-cylinder port 512, through gaps between an internal surface of upper cylinder 508 and the external surface of upper combustion chamber structure 522.

In the second position (FIG. 70), auxiliary combustion chamber F is fluidly coupled to first inter-cylinder port 510 via first upper combustion chamber port 540 and is fluidly coupled to second inter-cylinder port 512 via second upper combustion chamber port 542.

Sleeve shuttle 550 comprises a cylindrical sleeve 570 dimensioned and configured to slide inside sleeve cylinder 506, between extracting rings 538 and contracting rings 552, in a reciprocating motion. Cylindrical sleeve 570 comprises a first sleeve port 556, positioned and dimensioned to fluidly associate and disassociate, alternatingly, second port 124 with first combustion chamber port 530, and to fluidly associate and disassociate, alternatingly, third port 126 with second combustion chamber port 532. Cylindrical sleeve 570 further comprises a second sleeve port 558, positioned and dimensioned to fluidly associate and disassociate, alternatingly, first inter-cylinder port 510 with third combustion chamber port 534, and to fluidly associate and disassociate, alternatingly, second inter-cylinder port 512 with fourth combustion chamber port 536. During engine 500 operation, fluid association periods and disassociation periods of first inter-cylinder port 510 with third combustion chamber port 534, respectively coincide with fluid association periods and disassociation periods of second port 124 with first combustion chamber port 530. That is to say, when second port 124 is fluidly coupled to first combustion chamber port 530, first inter-cylinder port 510 is fluidly coupled to third combustion chamber port 534, and when second port 124 is fluidly decoupled from first combustion chamber port 530, first inter-cylinder port 510 is fluidly decoupled from third combustion chamber port 534. Likewise, fluid association and disassociation periods of second inter-cylinder port 512 with fourth combustion chamber port 536, coincide with fluid association and disassociation periods, respectively, of third port 126 and second combustion chamber port 532.

Fluid association and disassociation herein mean fluid coupling and fluid decoupling, respectively.

Sleeve connecting rod 156 connects sleeve shuttle 550 to sleeve crankshaft 158, and thereby translates sleeve crankshaft 158 rotational motion into sleeve shuttle reciprocating motion in sleeve cylinder 506. During sleeve shuttle 550 reciprocating motion, chamber E alternates between being fluidly connected and being fluidly disconnected to first chamber A via a passageway defined by second port 124, first sleeve port 556, and first combustion chamber port 530. Likewise, during sleeve shuttle 550 reciprocating motion, chamber E alternates between being fluidly connected and being fluidly disconnected to second chamber B via a passageway defined by third port 126, first sleeve port 556, and second combustion chamber port 532.

During engine 500 operation, leakage, flow or penetration of fluids through gaps between sleeve cylinder 506 and sleeve shuttle 550 is prevented or at least reduced due to contracting rings 552. Likewise, leakage flow or penetration of fluids through gaps between cylindrical sleeve 570 and combustion chamber structure 520 is prevented or at least reduced due to extracting rings 538.

During the first mode of operation (FIG. 69), upper combustion chamber structure 522 is stationary in the first position at the right-hand side of upper cylinder 508. First upper combustion chamber port 540 and second upper combustion chamber port 542 are blocked, and Chamber F is fluidly decoupled from chamber E. First piston 106 and second piston 108 simultaneously perform an intake stroke and an expansion stroke, respectively, followed by the simultaneous performance of a compression stroke and an exhaust stroke, respectively, substantially as described in FIGS. 1-17 and 33-49 above. During the intake stroke, working fluid flows into chamber C through first manifold 120 and from chamber C into chamber A through first port 122. During the compression stroke, first piston 106 forces the working fluid into chamber E through the passageway defined by second port 124, first sleeve port 556, and first combustion chamber port 530. The working fluid is ignited in chamber E. During the expansion stroke, burnt fuel gas expands from chamber E into chamber B, through the passageway defined by second combustion chamber port 532, first sleeve port 556, and third port 126, thrusting second piston 108 downward. In the exhaust stroke second piston 108 expels the burnt fuel gases to the ambient air through chamber D, fourth port 128 and through second manifold 130.

In the second mode (FIG. 70), upper combustion chamber structure 522 is stationary in the second position at the left-hand side of upper cylinder 508, and auxiliary combustion chamber F is in fluid communication with first inter-cylinder port 510 and with second inter-cylinder port 512 via first upper combustion chamber port 540 and via second upper combustion chamber port 542, respectively. During sleeve shuttle 550 reciprocating motion, combustion chamber E is intermittently fluidly coupled with first inter-cylinder port 510 through third combustion chamber port 534 and through second sleeve cylinder port 558. Likewise, during sleeve shuttle 550 reciprocating motion, combustion chamber E is intermittently fluidly coupled with second inter-cylinder port 512 through fourth combustion chamber port 536 and through second sleeve cylinder port 558. Thus, during sleeve shuttle 550 reciprocating motion, auxiliary combustion chamber F is fluidly coupled with combustion chamber E via a passageway defined by first upper combustion chamber port 540, first inter-cylinder port 510, second sleeve cylinder port 558 and third combustion chamber port 534.

Cylindrical sleeve 570 comprises a first sleeve port 556, positioned and dimensioned to fluidly associate and disassociate, alternatingly, second port 124 with first combustion chamber port 530, and to fluidly associate and disassociate, alternatingly, third port 126 with second combustion chamber port 532.

Fluidic coupling and decoupling events of first inter-cylinder port 510 with combustion chamber E via second sleeve cylinder port 558, coincide with the fluidic coupling and decoupling events of combustion chamber E with chamber A via second port 124, first combustion chamber port 530, and first sleeve port 556. Also, Fluidic coupling and decoupling events of second inter-cylinder port 512 with combustion chamber E via second sleeve cylinder port 558, coincide with the fluidic coupling and decoupling events of combustion chamber E with chamber B via third port 126, second combustion chamber port 533, and first sleeve port 556. Consequently, during the expansion stroke (in the second mode), chamber A is fluidly coupled with combustion chamber E via second port 124, first sleeve port 556, and first combustion chamber port 530, and, as described above, is therefor also fluidly coupled with auxiliary combustion chamber F via combustion chamber E. During the expansion stroke, chamber B is fluidly decoupled from combustion chamber E. Likewise, during a compression stroke (in the second mode), chamber B is fluidly coupled with combustion chamber E via third port 126, first sleeve port 556, and second combustion chamber port 532 and, as described above, is therefor also fluidly coupled with auxiliary combustion chamber F via combustion chamber E. During the compression stroke, chamber A is fluidly decoupled from combustion chamber E.

During the second mode, second piston 108 and second piston 106 simultaneously perform an intake stroke and an expansion stroke, respectively, followed by the simultaneous execution of a compression stroke and an exhaust stroke, respectively. During the intake stroke, working fluid flows into chamber D through first manifold 130 and from chamber D into chamber B through fourth port 128. During the compression stroke, second piston 108 forces the working fluid into chamber E, and into fluidly coupled chamber F, through the passageway defined by third port 126, first sleeve port 556, and second combustion chamber port 532. The working fluid is ignited in chamber E and the fluidly coupled chamber F. During the expansion stroke, burnt fuel gas is released from chamber E and from the fluidly coupled chamber F, into chamber A, through the passageway defined by first combustion chamber port 530, first sleeve port 556, and second port 124, thrusting first piston 106 downward. In the exhaust stroke first piston 106 expels the burnt fuel gases into ambient air through first port 122, chamber C and first manifold 120. Thus, in the second mode, engine 500 operation substantially employs auxiliary combustion chamber F, in fluid association with chamber E, thereby increasing the volume in which combustion occurs and allowing for increased working fluid intake and exploitation (as compared to the first mode).

Upper combustion chamber structure 522 switches from the first position to the second position during engine 500 first transition cycle (not shown here, but substantially corresponding to engine 100 first transition cycle, FIGS. 17-33), preferably after the first part of the first transition cycle, preferably during the third part of the first transition cycle. Likewise, upper combustion chamber structure 522 switches from the second position to the first position during the engine 500 second transition cycle (not shown here, but substantially corresponding to engine 100 second transition cycle, FIGS. 49-64 and through FIG. 1), preferably after the first part of the second transition cycle, preferably during the third part of the second transition cycle. To switch between the first position and the second position, positioning shaft 582 may push or pull upper combustion chamber structure 522, causing it to slide inside upper cylinder 508. The positioning shaft may be mechanically powered by an actuator or a motor 584.

A Split-Cycle Engine in an Opposed Configuration

Figure 71:
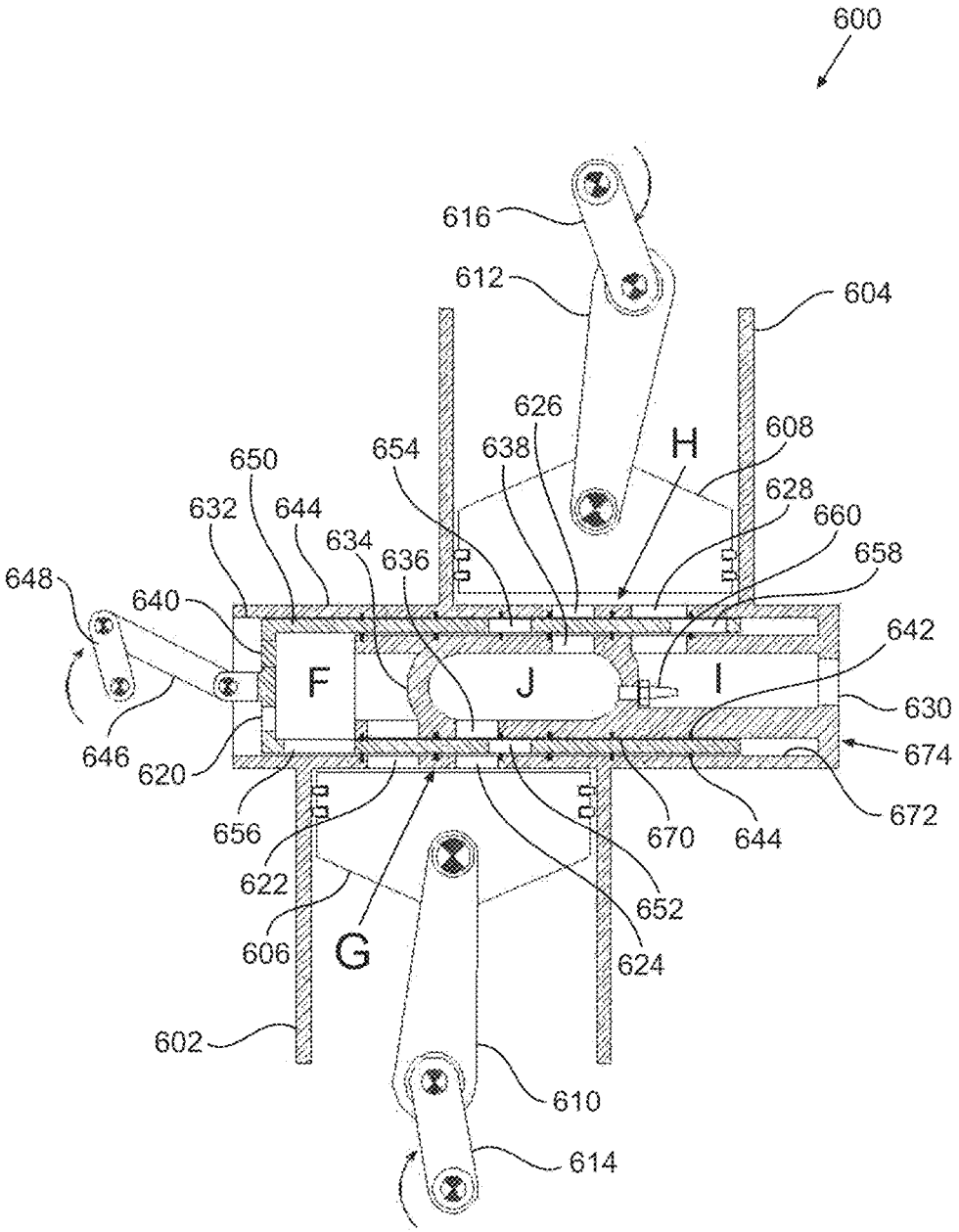
FIG. 71 schematically depicts an embodiment of cross-sectional side view of a split-cycle engine in an opposed configuration, wherein the compression crankshaft angle is illustrated at 350 degrees after the compression piston point of TDC, and the power crankshaft angle is illustrated at 340 degrees after the power piston point of TDC.
Figure 72:
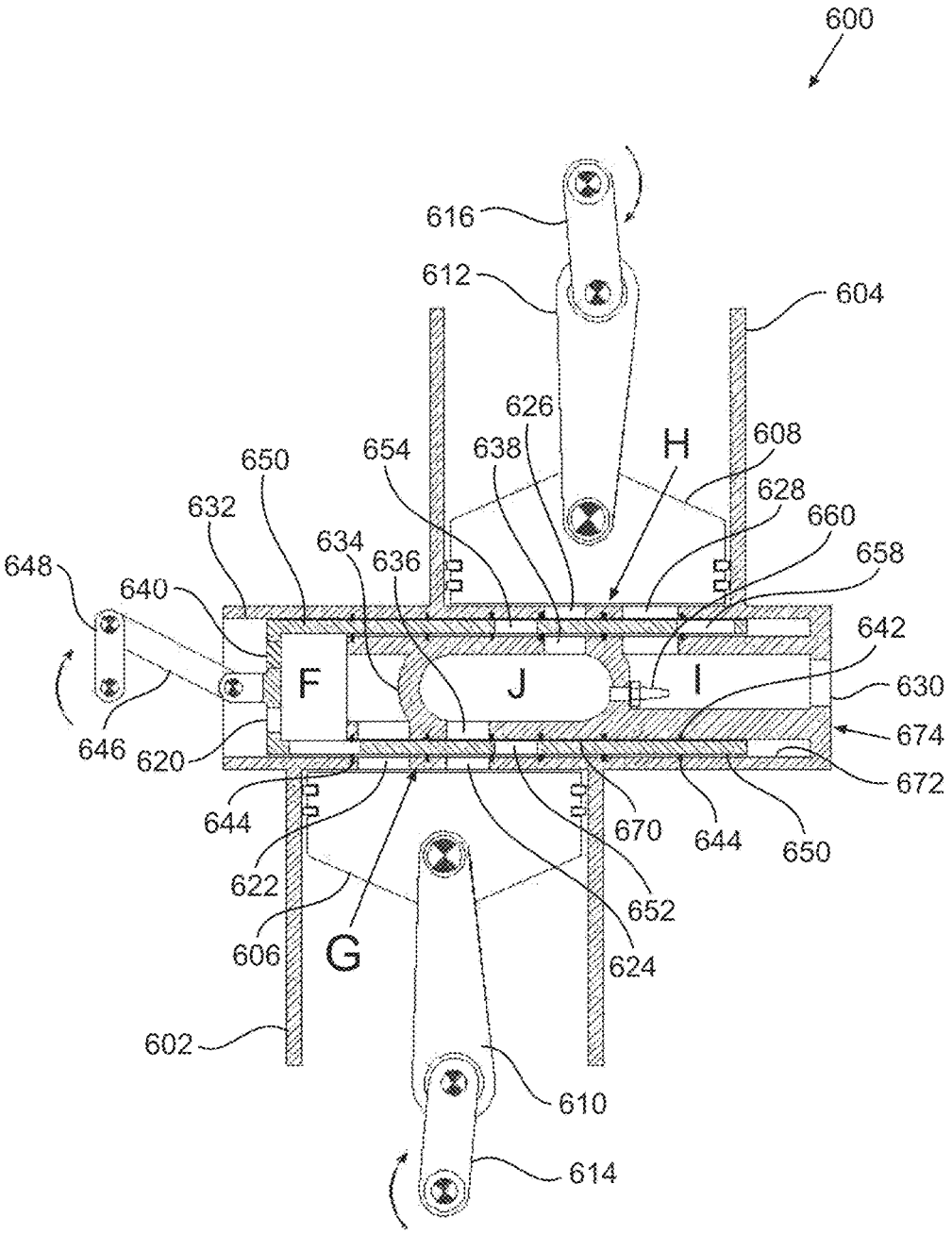
FIG. 72 schematically depicts the engine of FIG. 71, wherein the compression crankshaft angle is illustrated at 5 degrees after the compression piston point of TDC, and the power crankshaft angle is illustrated at 355 degrees after the power piston point of TDC.
Figure 73:
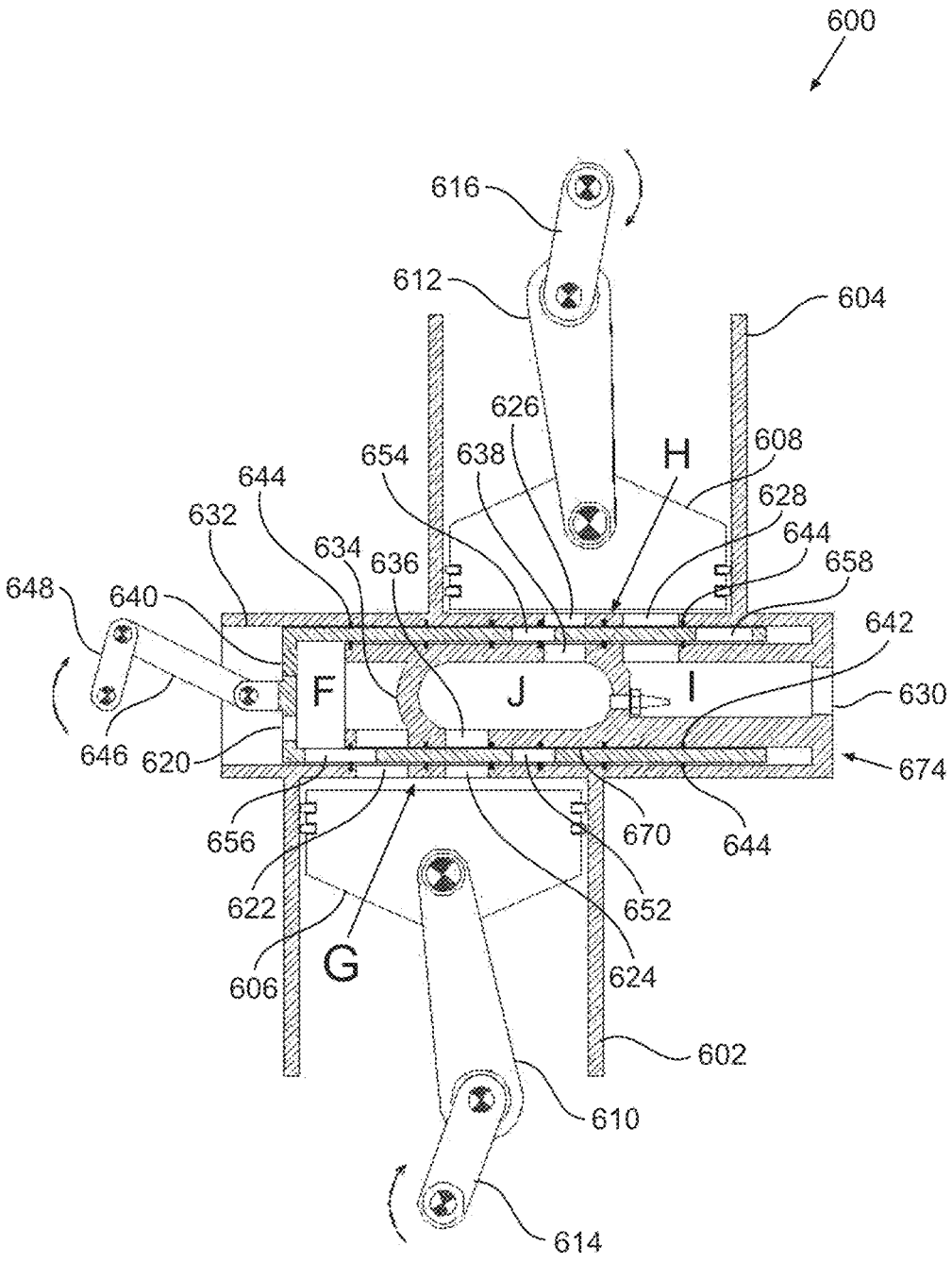
FIG. 73 schematically depicts the engine of FIG. 71, wherein the compression crankshaft angle is illustrated at 20 degrees after the compression piston point of TDC, and the power crankshaft angle is illustrated at 10 degrees after the power piston point of TDC.

FIGS. 71-73 depict an embodiment of a split-cycle ICE 600, in which a compression cylinder and an expansion cylinder are arranged in an opposed configuration, unlike the engine of FIGS. 1-16 in which the compression cylinder and the expansion cylinder are arranged in an in-line configuration. The split-cycle engine includes: a compression cylinder 602, a power cylinder 604, a compression piston 606 and a power piston 608. An intake/compression chamber G and an expansion/exhaust chamber H are defined between the compression cylinder 602, and the compression piston 606, and between the power cylinder 604 and the power piston 608, respectively. It is noted that the expressions herein "expansion piston", "expansion cylinder" "expansion chamber" and "expansion stroke" refer to what is also known in the art as "power piston", "power cylinder" "power chamber" and "power stroke", respectively. The split-cycle engine also includes a compression piston connecting rod 610 and a power piston connecting rod 612, a compression crankshaft 614 and a power crankshaft 616 that may be mechanically associated with an engine power shaft (not shown in this Figure). The compression crankshaft 614 and the power crankshaft 616 are mechanically associated by a crankshaft connecting mechanism not shown in FIGS. 71-73 that may comprise, for example, a gear based mechanism or any other mechanical linkage mechanism, such as belts, connecting rods and chains.

The split-cycle engine also includes an intake manifold 620, chamber F, an intake port 622, a compression port 624, an expansion port 626, chamber I, an exhaust port 628 and an exhaust manifold 630. The split-cycle engine also includes a sleeve cylinder 632 (also called valve cylinder 632), a combustion chamber structure 634 fixed within sleeve cylinder 632 and defining combustion chamber J therein, a first combustion chamber port 636 and a second combustion chamber port 638. The split-cycle engine also includes a sleeve shuttle 640, chamber sealing rings (expanding) 642 mounted in annular grooves on an external surface 670 of combustion chamber structure 634, cylinder sealing (contracting) rings 644 mounted in annular grooves on an internal surface 672 of sleeve cylinder 632, a sleeve connecting rod 646 and a sleeve crankshaft 648.

Split-cycle ICE 600 is different from split-cycle engine 100 in having compression cylinder 602 and expansion cylinder 604 arranged opposed to each other whereas sleeve cylinder 632 is arranged between compression cylinder 602 and expansion cylinder 604.

Sleeve cylinder 632 houses the sleeve shuttle 640 and both are arranged perpendicular to both compression cylinder 602 and power cylinder 604 and between them. Sleeve connecting rod 646 connects sleeve shuttle 640 to sleeve crankshaft 648. Sleeve crankshaft 648 converts rotational motion into sleeve shuttle 640 reciprocating motion. Sleeve crankshaft 648 is mechanically connected to the compression crankshaft 614 and to the power crankshaft 616 by a sleeve crankshaft connecting mechanism (not shown in these Figures). The sleeve crankshaft connecting mechanism may comprise, for example, a gear based mechanism or any other mechanical linkage mechanism, such as belts, connecting rods and chains. During operation of engine 600, compression crankshaft 614, power crankshaft 616 and sleeve crankshaft 648 revolve synchronously with each other.

Sleeve shuttle 640 comprises a cylindrical sleeve 650 dimensioned and configured to slide inside sleeve cylinder 632, between chamber sealing rings 642 and cylinder sealing rings 644, in a reciprocating motion. Split-cycle ICE 600 is further different from split-cycle engine 100 in that cylindrical sleeve 650 comprises a sleeve compression port 652 and a sleeve expansion port 654. Sleeve compression port 652 is positioned and dimensioned to fluidly associate and disassociate, alternatingly, compression port 624 with first combustion chamber port 636 during reciprocating motion of sleeve shuttle 640. Likewise, sleeve expansion port 654 is positioned and dimensioned to fluidly associate and disassociate, alternatingly, second combustion chamber port 638 with expansion port 626 during reciprocating motion of sleeve shuttle 640. During sleeve shuttle 640 reciprocating motion, combustion chamber J alternates between being fluidly connected and being fluidly disconnected to compression chamber G through compression port 624, sleeve compression port 652 and first combustion chamber port 636. During sleeve shuttle 640 reciprocating motion, combustion chamber G also alternates between being fluidly connected and being fluidly disconnected to expansion chamber H through expansion port 626, sleeve expansion port 654 and second combustion chamber port 638. In some embodiments, during a fraction of sleeve shuttle 640 reciprocating motion, combustion chamber G could be fluidly connected to both compression chamber G and expansion chamber H. According to some exemplary embodiments cylindrical sleeve 650 further comprises a sleeve intake port 656 and a sleeve exhaust port 658. Accordingly, during an intake stroke, chamber F is fluidly connected with chamber G for incoming flow of working fluid via sleeve intake port 656 and via intake port 622. Likewise, during an exhaust stroke, chamber H is fluidly connected with chamber I for exhaling burnt gas via exhaust port 628 and via sleeve exhaust port 658. It is noted that according to some embodiments, for example utilizing extracting sealing rings (not shown here) on cylindrical sleeve 650 instead of contracting sealing rings 644, cylindrical sleeve 650 may be shortened, (possibly also combustion chamber structure 634 may be shortened) thereby rendering sleeve intake port 656 and sleeve exhaust port 658 redundant. During sleeve shuttle 640 reciprocating motion, intake port 622 may open or close as sleeve shuttle 640 blocks or unblocks intake port 622. Thus, sleeve shuttle 640 reciprocating motion fluidly couples or decouples chamber F and chamber G.

During sleeve shuttle 640 reciprocating motion, exhaust port 628 may open or close as sleeve shuttle 640 blocks or unblocks exhaust port 628. Thus, sleeve shuttle 640 reciprocating motion fluidly couples or decouples chamber H and chamber I.

During sleeve shuttle 640 reciprocating motion, chamber J may fluidly couple with or decouple from chamber G, via compression port 624, sleeve compression port 652 and first combustion chamber port 636.

During sleeve shuttle 640 reciprocating motion, chamber J may fluidly couple with or decouple from chamber H, via expansion port 626, sleeve expansion port 654 and second combustion chamber port 638.

Engine 600 exemplifies a split cycle engine according to the teachings herein wherein the compression piston and the expansion piston are not in phase. Compression piston 606 and expansion piston 608 move synchronously with one another whereas compression piston 606 is advanced relative to expansion piston 608 by 10 crankshaft degrees. Accordingly, compression piston 606 reaches its TDC point 10 crankshaft degrees before expansion piston 608 reaches its own TDC point. Accordingly, in FIG. 71, compression piston 606 is 10 crankshaft degrees prior to its TDC point whereas expansion piston 608 is 20 crankshaft degrees prior to its own TDC point; in FIG. 72, compression piston 606 is illustrated 5 crankshaft degrees after its TDC point whereas expansion piston 608 is illustrated 5 crankshaft degrees prior to its own TDC point; and in FIG. 73, compression piston 606 is 20 crankshaft degrees after its TDC point whereas expansion piston 608 is 10 crankshaft degrees after its own TDC point.

According to some embodiments the engine's cycle may comprise:

An intake stroke, wherein a working fluid such as air-fuel charge, flows, or is forced into, the compression cylinder (chamber G), optionally through chamber F and through open intake port 622 of the compression cylinder, as is schematically depicted in FIG. 73.

A compression stroke, wherein the intake port 622 is closed and the compression piston 606 compresses the working fluid into the combustion chamber J as is schematically depicted in FIG. 71. Compression port 624, sleeve compression port 652 and first combustion chamber port 636 fluidly couple the compression cylinder (chamber G) and the combustion chamber J.

Combustion of the working fluid in the combustion chamber J. The engine may be configured and operated so as to activate the combustion when the combustion chamber J is fluidly sealed, as is schematically depicted in FIG. 72. Alternatively, according to some embodiments, the combustion chamber J may be coupled to either one of the compression cylinder (chamber G) and the expansion cylinder (Chamber H), or to both cylinders. Combustion may be timed and initiated by e.g. a spark plug 660, or, (for example in embodiments wherein combustion is initiated when the combustion chamber is fluidly coupled with the compression chamber G) combustion may be initiated by compression ignition (e.g. as in Diesel engines).

An expansion stroke, wherein cylindrical sleeve 650 is positioned so that sleeve expansion port 654 fluidly couples the combustion chamber J with the expansion cylinder (chamber H) via second combustion chamber port 638 and expansion port 626, as is schematically depicted in FIG. 73. Fluidly coupling the combustion chamber with the expansion chamber enables high-pressure combusted fluid from combustion chamber to thrust the expansion piston 608.

An exhaust stroke, exemplified in FIG. 71, wherein cylindrical sleeve 650 is positioned in sleeve cylinder 632 so that expansion port 626 is closed thereby decoupling the combustion chamber J from the expansion cylinder (chamber H). Further, exhaust port 628 is open, enabling burnt gases to be exhaled through open exhaust port 628 of the expansion cylinder 604 to the ambient.

According to some embodiments, engine 600 provides better thermal isolation between compression cylinder 602 and expansion cylinder 604, compared to engine 100, due to the opposed configuration of the cylinders. Better thermal isolation may enable less energy waste through heat dissipation resulting in a higher thermal (energy) efficiency of the engine. The opposed configuration of the cylinders of engine 600 may further allow a shorter sleeve cylinder compared to the sleeve cylinder of engine 100, allowing shorter strokes of sleeve shuttle 640 compared to the strokes of sleeve shuttle 150. The opposed configuration of the cylinders of engine 600 may yet further allow the combustion chamber J have a less elongated shape, e.g. a more spherical shape, thereby enabling improving combustion characteristics, compared to engine 100.

Fluidly Connected Compression Chamber and Expansion Chamber

Figure 74A:
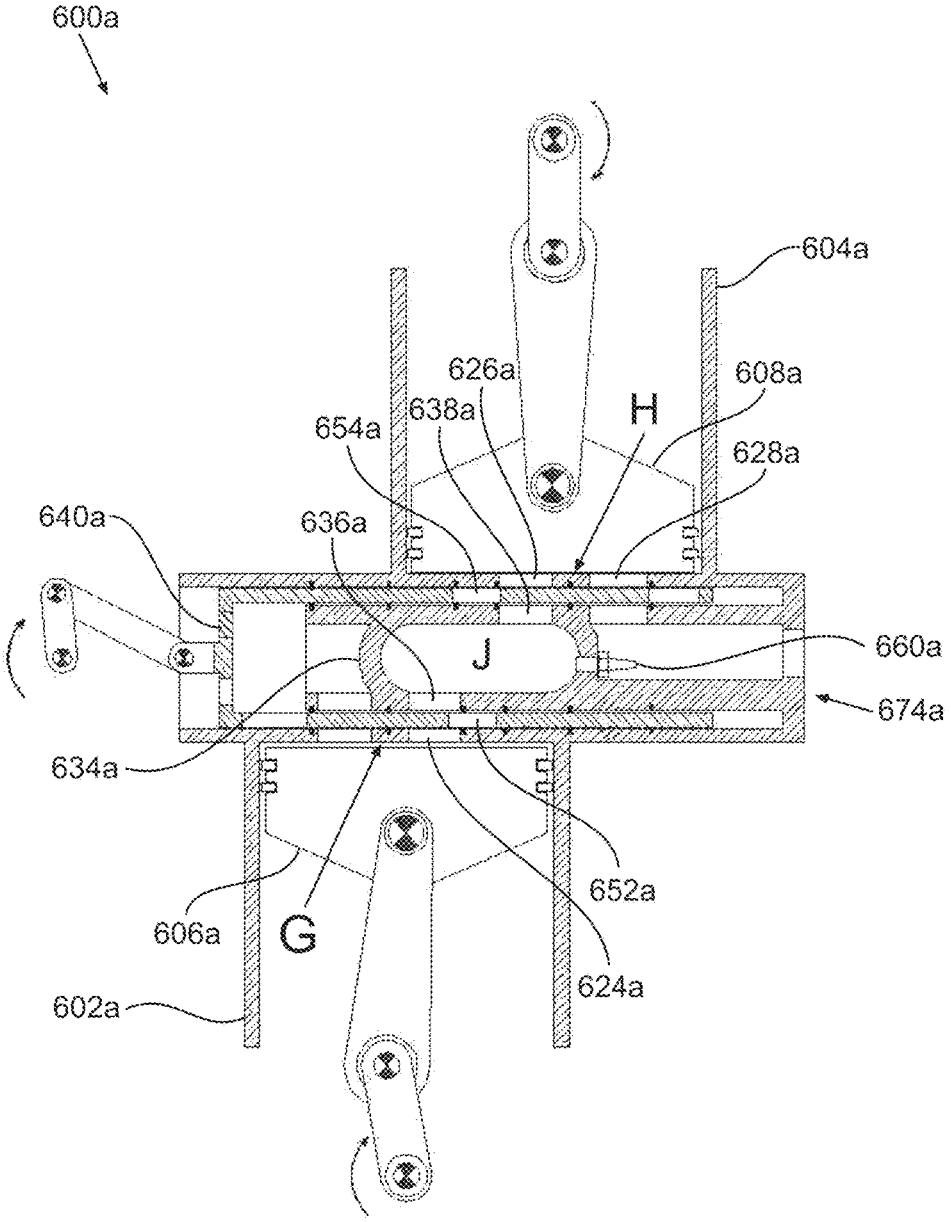
FIG. 74A schematically depicts an embodiment of cross-sectional side view of a split-cycle engine in an opposed configuration, wherein the compression crankshaft angle is illustrated at 350 degrees after the compression piston point of TDC, and the power crankshaft angle is illustrated exactly at the power piston point of TDC.
Figure 74B:
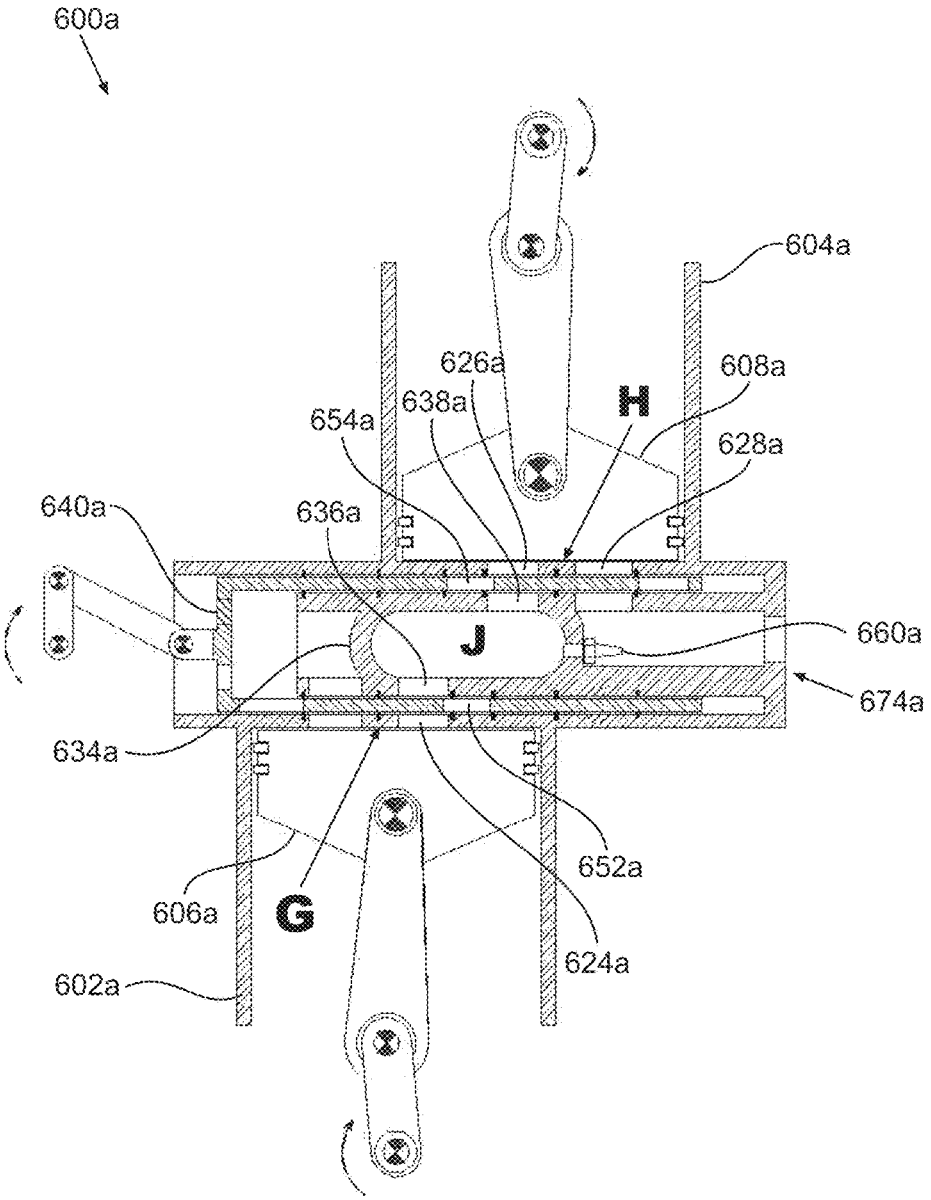
FIG. 74B schematically depicts the engine of FIG. 74A, wherein the compression crankshaft angle is illustrated at 5 degrees prior the compression piston point of TDC, and the power crankshaft angle is illustrated at 5 degrees after the power piston point of TDC, whereas the compression cylinder the combustion chamber and the expansion cylinder are fluidly connected.
Figure 74C:
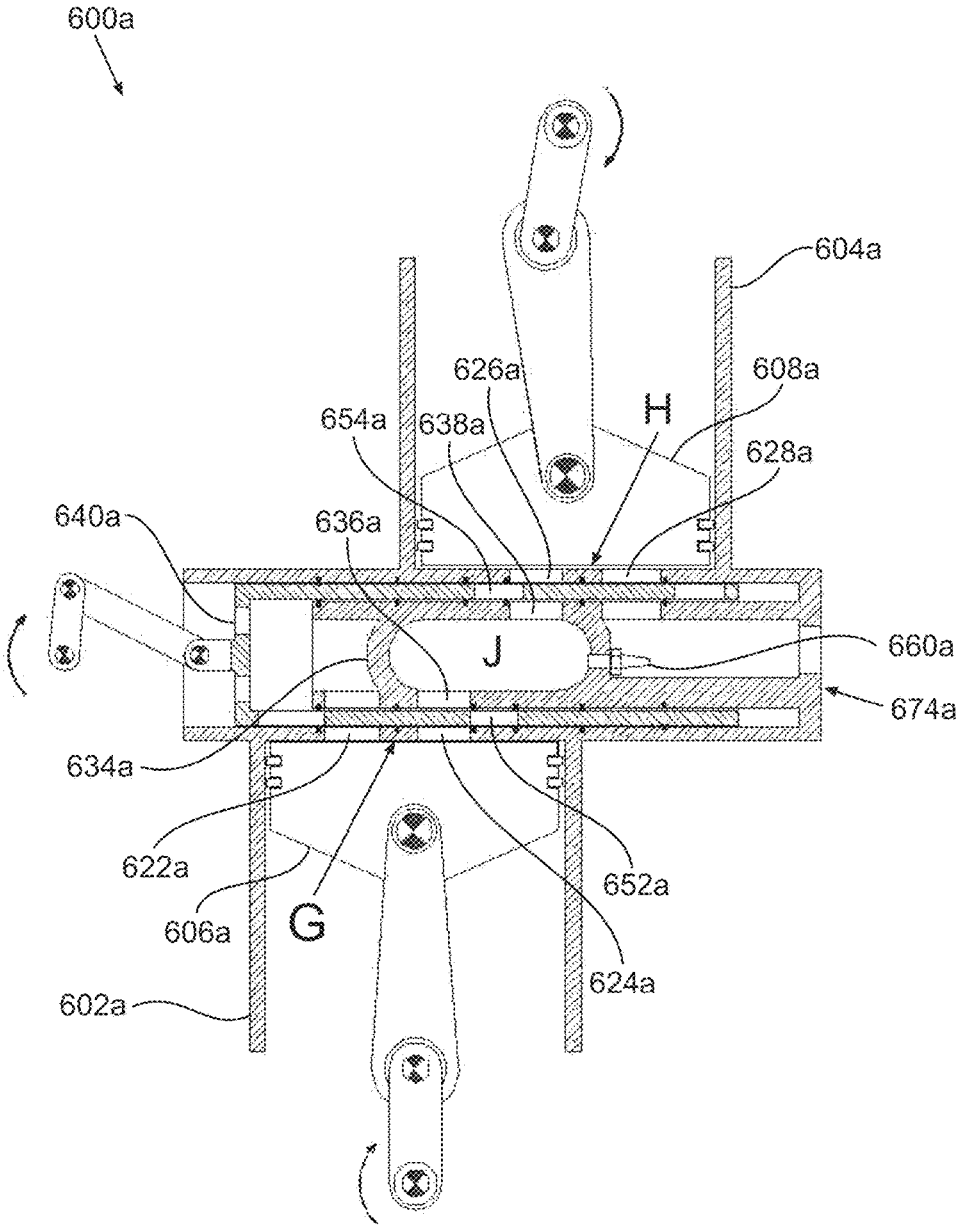
FIG. 74C schematically depicts the engine of FIG. 74A, wherein the compression crankshaft angle is illustrated exactly at the compression piston point of TDC, and the power crankshaft angle is illustrated at 10 degrees after the power piston point of TDC.

FIGS. 74A-74C schematically depict an embodiment of a split-cycle ICE 600*a*, in which a compression cylinder and an expansion cylinder are arranged in an opposed configuration. Engine 600*a* is different from engine 600 described above in FIGS. 71-73 in that during a portion of the engine's cycle, the compression chamber, the combustion chamber and the expansion chamber are fluidly connected simultaneously. For the simplicity and clarity of the description and drawings, all components of engine 600*a* are enumerated herein with the same numbers as the equivalent components of engine 600 with the suffix "a". For example the compression chamber G is defined between compression cylinder 602*a* and compression piston 606*a*, the expansion chamber H is defined between expansion cylinder 604*a* and expansion piston 608*a*, and combustion chamber J is defined by combustion chamber structure 634*a* which is fixed inside sleeve cylinder 632*a*. As explained above regarding engine 600, cylindrical sleeve 650*a* is configured to slide in a reciprocating motion between sleeve cylinder 632*a* and combustion chamber structure 634*a*.

Engine 600*a* is different from engine 600 in that first sleeve port 652*a* and second sleeve port 654*a* are larger than first sleeve port 652 and second sleeve port 654, in engine 600, respectively. Consequently, during a portion of the engine's cycle, the compression chamber G, the combustion chamber J and the expansion chamber are fluidly connected simultaneously. It should be understood by the person skilled in the art that according to some embodiments, a similar simultaneous fluid connection between the chambers may be achieved for example by changing relative location and/or size of first combustion chamber port 638*a* and/or compression port 624*a*, and/or the location and/or size of second combustion chamber port 638*a* and/or expansion port 616*a*, and/or any combination thereof.

According to some embodiments, a preferred timing of the pistons is obtained in engine 600*a* if the compression piston is retarded relative to the expansion piston. In other words, in some embodiments of a split cycle engine according to the teachings herein, wherein the compression chamber and the expansion chamber are simultaneously fluidly connected with the combustion chamber, a more efficient operation may be achieved by tuning the compression piston to retard behind the expansion piston. Thus, engine 600*a* is also different from engine 600 in that compression piston 606*a* is retarded relative to expansion piston 608*a*, rather than being relatively advanced, as in engine 600. Engine 600*a* exemplifies a split cycle engine according to the teachings herein wherein compression piston 606*a* and expansion piston 608*a* move synchronously with one another whereas compression piston 606*a* is retarded relative to expansion piston 608*a* by 10 crankshaft degrees, and sleeve crankshaft 648*a* (and hence sleeve shuttle 640) is 85 degrees retarded relative to compression piston 606*a*.

Accordingly, compression piston 606*a* reaches its TDC point 10 crankshaft degrees after expansion piston 608*a* reaches its own TDC point.

In FIG. 74A, compression piston 606*a* is 10 crankshaft degrees prior to its TDC point, expansion piston 608*a* is exactly at its own TDC point, and sleeve shuttle 640*a* is 95 degrees prior its own TDC point; In FIG. 74B, compression piston 606*a* is 5 crankshaft degrees prior to its TDC point, expansion piston 608*a* is 5 crankshaft degrees after its TDC point, and sleeve shuttle 640*a* is 90 degrees prior its own TDC point; and in FIG. 74C, compression piston 606*a* is exactly at its TDC point, expansion piston 608*a* is 10 crankshaft degrees after its TDC point, and sleeve shuttle 640*a* is 85 degrees prior its own TDC point.

According to some embodiments the engine's cycle may comprise:

- An intake stroke, wherein a working fluid such as air-fuel charge, flows, or is forced into, the compression cylinder, optionally through chamber F and through open intake port 622*a* of the compression cylinder. FIG. 74C illustrates engine 606*a* at the instant of beginning of the intake stroke.
- A compression stroke, wherein the intake port 622*a* is closed and the compression piston 606 compresses the working fluid into the combustion chamber J as is schematically depicted in FIG. 74A. Compression port 624*a*, sleeve compression port 652*a* and first combustion chamber port 636*a* fluidly couple the compression cylinder (chamber G) and the combustion chamber J.
- Combustion of the working fluid in the combustion chamber J as illustrated in FIG. 74B. The combustion chamber J is fluidly coupled to the compression cylinder (chamber G) via compression port 624*a*, sleeve compression port 652*a* and first combustion chamber port 636*a*. The combustion chamber J is also fluidly coupled to the expansion cylinder (Chamber H) via expansion port 626*a*, sleeve expansion port 654*a* and second combustion chamber port 638*a*. Combustion may be timed and initiated by e.g. a spark plug 660*a*, or combustion may be initiated by compression ignition (e.g. as in Diesel engines). It should be appreciated by the person skilled in the art that the effective volume available for combusted gas at the combustion may be defined by tuning the phase shift between the compression piston and the expansion piston (the larger the phase shift, the larger the available volume becomes).
- An expansion stroke, wherein combustion chamber J is fluidly coupled with the expansion cylinder (chamber H) via sleeve expansion port 654*a* second combustion chamber port 638*a* and expansion port 626*a*, as is schematically depicted in FIG. 74C. Fluidly coupling the combustion chamber with the expansion chamber enables high-pressure combusted fluid from combustion chamber J to thrust the expansion piston 608*a*.
- An exhaust stroke, wherein cylindrical sleeve 650*a* is positioned in sleeve cylinder 632*a* so that expansion port 626*a* is closed thereby decoupling the combustion chamber J from the expansion cylinder (chamber H). Further, exhaust port 628*a* is open, enabling burnt gases to be exhaled through open exhaust port 628*a* of the expansion cylinder 604*a* to the ambient. FIG. 74A illustrates engine 600*a* at the instant of end of an exhaust stroke.

It is noted that two conditions are fulfilled concurrently, thereby obtaining an efficient operation of the engine 600*a*: (a) at the combustion event (FIG. 74B) the combustion chamber is fluidly connected with the expansion chamber. Therefore—without wishing to be bound by theory or mechanism of action—ill effects of possible "dead space" associated with having a cross-over valve between the combustion chamber and the expansion chamber are eliminated or at least greatly reduced. In other words, the combusted gas is allowed to expand into an already available open space (namely the expansion chamber) rather than burst thereto, after the combustion, through an opening valve. And (b) combustion occurs when the compression piston (first crankshaft 114) and the expansion piston (second crankshaft 116) are distanced by the same (absolute) angular distance for their respective TDC points (5 crankshaft degrees before and after their respective TDC points, respectively, in the example of FIG. 74B). Consequently—again, without being bound by theory or mechanism of action—the enlargement of the space available for gas expansion immediately following the combustion is infinitesimal, and therefore adiabatic cooling of the gas following the combustion is prevented or at least greatly reduced. It should be understood that simultaneous fluid connection of the compression chamber, the combustion chamber and the expansion chamber is not limited only to a split cycle engine having an opposed configuration like engine 600*a*. In other words, simultaneous fluid connection of the compression chamber, the combustion chamber and the expansion chamber may be practiced in engines configured as appropriate modifications, according to the teachings herein, of any of the engines described here, e.g. engine 100 and engine 700, engine 1000 and engine 1100 described in detail below.

A Split-Cycle Engine in an Opposed Configuration with Poppet Valves

Figure 75:
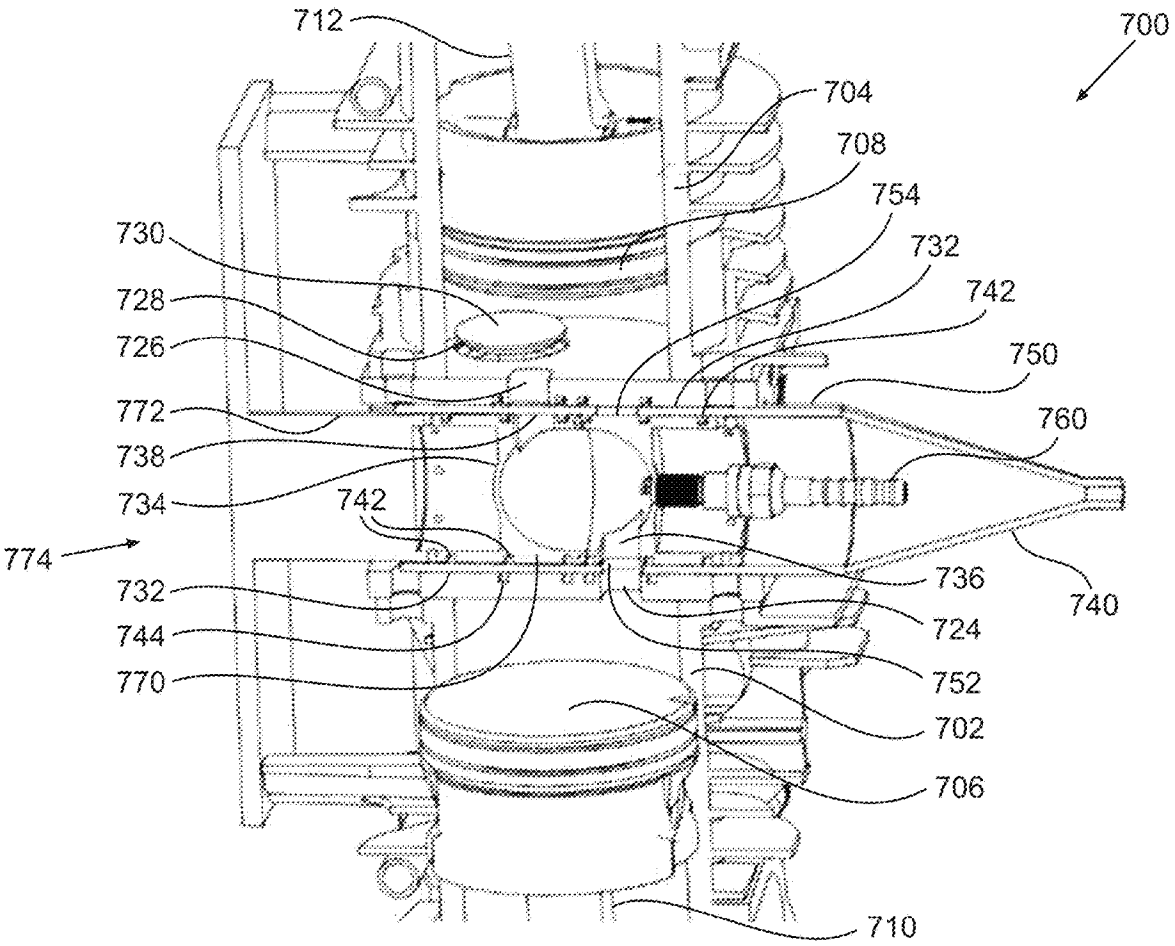
FIG. 75 schematically depicts a 3-dimensional, semi cross-sectional view of an embodiment of a split-cycle engine in an opposed configuration, comprising an intake port and an exhaust port regulated by an intake poppet valve and an exhaust poppet valve, respectively.

FIG. 75 schematically depicts an embodiment of a split-cycle ICE 700, in a perspective, cross-sectional view. Engine 700 has an opposed cylinder configuration similar to the opposed cylinder configuration of engine 600. Engine 700 is different from engine 600 in having poppet valves for regulating the intake and the exhaust.

Engine 700 includes a compression cylinder 702, a power cylinder 704, a compression piston 706 and a power piston 708. An intake/compression chamber G and an expansion/exhaust chamber H are defined between the compression cylinder 702, and the compression piston 706, and between the power cylinder 704 and the power piston 708, respectively. The split-cycle engine also includes a compression piston connecting rod 710 and a power piston connecting rod 712 connected to a compression crankshaft and to a power crankshaft, respectively (both crankshafts are not shown in this Figure) similarly to engine 600. The compression crankshaft and the power crankshaft may be mechanically associated with an engine power shaft (not shown in this Figure) and to each other by a crankshaft connecting mechanism, substantially as described above regarding engine 600.

Engine 700 also includes an intake port (not shown here), a compression port 724, an expansion port 726, and an exhaust port 728. The intake port is regulated (that is to say opened and closed) by an intake poppet valve (not shown in this Figure) and exhaust port 728 is regulated by an exhaust poppet valve 730, the intake poppet valve and the exhaust poppet valve 730 being actuated using e.g. a cam and a camshaft (not shown here) similarly to the operation of a poppet valve in a conventional ICE.

Engine 700 also includes a sleeve cylinder 732 (also called valve cylinder 732), a combustion chamber structure 734 fixed within sleeve cylinder 732 and defining combustion chamber J therein, a first combustion chamber port 736 and a second combustion chamber port 738. The split-cycle engine also includes a sleeve shuttle 740, chamber sealing rings 742 mounted in annular grooves on an external surface of combustion chamber structure 734, cylinder sealing rings 744 mounted in annular grooves of sleeve cylinder 732, a sleeve connecting rod and a sleeve crankshaft (both not shown here).

Sleeve cylinder 732 houses the sleeve shuttle 740 and both are arranged perpendicular to both compression cylinder 702 and power cylinder 704 (namely perpendicular to the direction of travel of compression piston 706 and expansion piston 708, respectively, therein) and between them. During operation of engine 700, the compression crankshaft, the power crankshaft and the sleeve crankshaft revolve synchronously with each other.

Sleeve shuttle 740 comprises a cylindrical sleeve 750 dimensioned and configured to slide inside sleeve cylinder 732, between chamber sealing rings 742 and cylinder sealing rings 744, in a reciprocating motion. Split-cycle ICE 700 comprises a sleeve compression port 752 and a sleeve expansion port 754. Sleeve compression port 752 is positioned and dimensioned to fluidly associate and disassociate, intermittently, compression port 724 with first combustion chamber port 736 during reciprocating motion of sleeve shuttle 740. Likewise, sleeve expansion port 754 is positioned and dimensioned to fluidly associate and disassociate, intermittently, second combustion chamber port 738 with expansion port 726 during reciprocating motion of sleeve shuttle 740. During sleeve shuttle 740 reciprocating motion, combustion chamber J alternates between being fluidly connected and being fluidly disconnected to compression chamber G through compression port 724, sleeve compression port 752 and first combustion chamber port 736. During sleeve shuttle 740 reciprocating motion, combustion chamber G also alternates between being fluidly connected and being fluidly disconnected to expansion chamber H through expansion port 726, sleeve expansion port 754 and second combustion chamber port 738. In some embodiments, during a fraction of sleeve shuttle 740 reciprocating motion, combustion chamber G could be fluidly connected to both compression chamber G and expansion chamber H. A spark plug 770 may be used to initiate combustion in combustion chamber J, substantially as explained above regarding engine 600 and engine 100.

The operation of engine 700 differs from the operation of engine 600 in that intake flow of working fluid into compression cylinder 702 is regulated by the intake poppet valve (not shown here) and not by the cylindrical sleeve. Likewise, the exhale of burnt gas from expansion cylinder 704 during exhaust stroke, is regulated by the exhaust poppet valve 730 and not by the cylindrical sleeve 750. Consequently, operation parameters of the engine, such as timing, within the engine cycle, of opening and closing of the intake port and the exhaust port, may be tuned in engine 700 independently of the timing of opening and closing compression port 724 and expansion port 726 (being regulated by cylindrical sleeve 750).

A 3-Cylinders Split-Cycle Engine

When considering engine power to weight ratio and compact packaging of the engine, utilizing an engine in which a single compression cylinder feeds (that is to say, compresses working fluid into) more than one power piston is beneficial as understood by those skilled in the art. US patent application publication 2014/0338646 to Tour et al, incorporated herein as reference in its entirety, discloses a split cycle engine with a single compression cylinder that is used to charge two power cylinders in a consecutive manner. The compression piston crankshaft rate of rotation is double the rate of the power piston crankshafts and the two power cylinders are phased by 180 crankshaft degrees. Each of the power cylinders is coupled to the compression cylinder by its own interstage valve. According to an aspect of some embodiments, there is thus provided herein a 3-cylinders split cycle engine with a single cylindrical sleeve crossover valve.

Figure 76A:
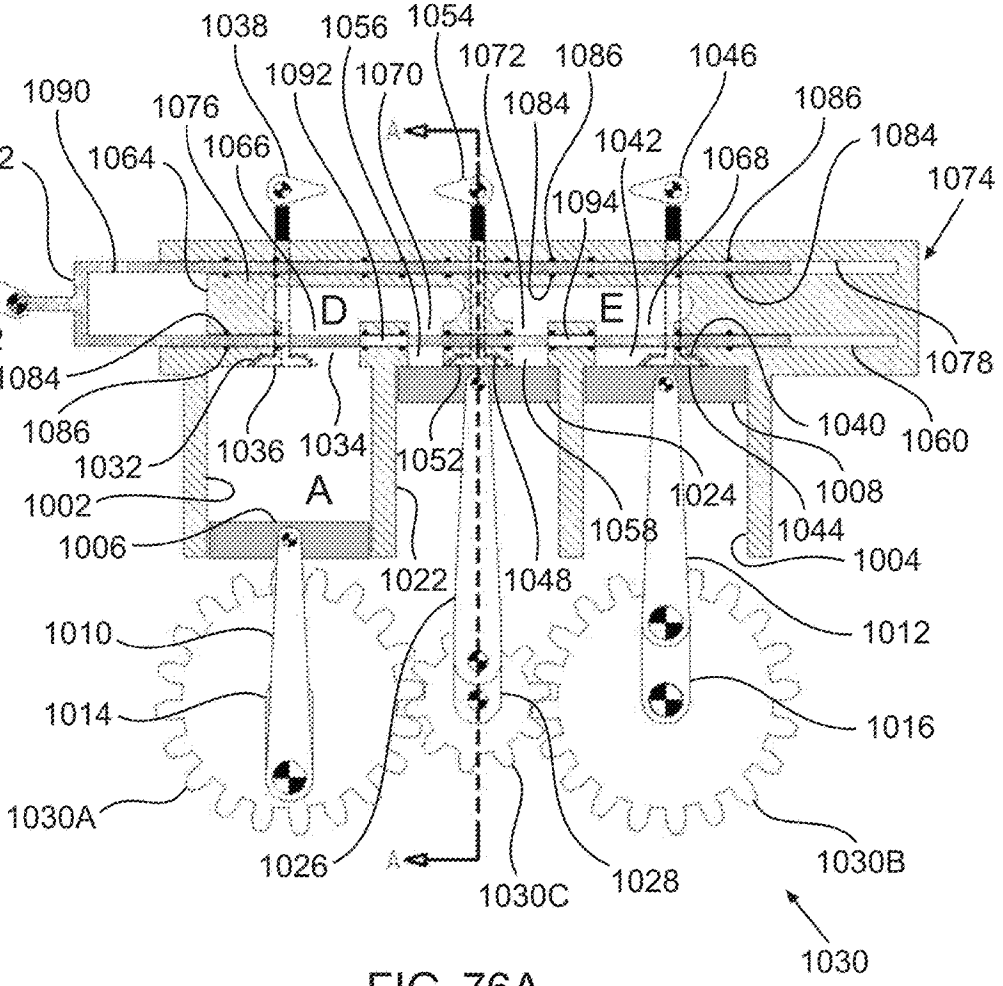
FIG. 76A schematically depicts an embodiment of a cross-sectional side view of a 3-cylinders split-cycle engine, having one compression cylinder, two expansion cylinders, a fixed chamber structure defining two combustion chambers and a movable valve comprising a sleeve shuttle, according to the teachings herein.
Figure 76B:
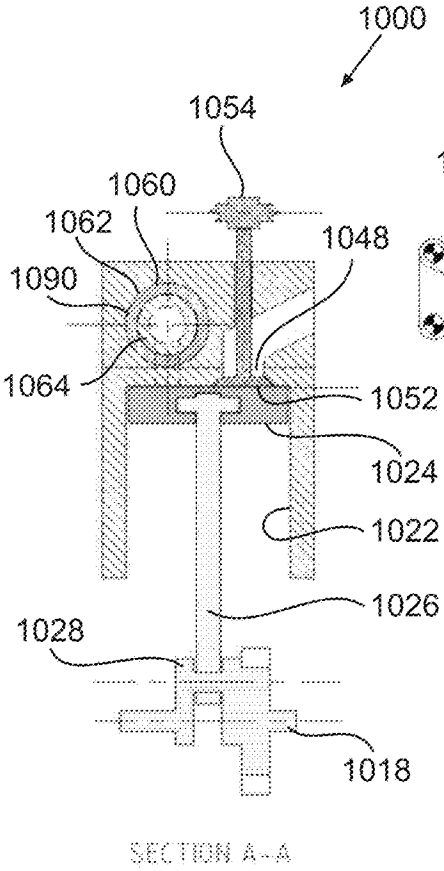
FIG. 76B schematically depicts the engine of FIG. 75A in a cross-sectional view along cross-section A-A designated in FIG. 75A.

Referring to FIGS. 76A and 76B, an in-line configuration of a 3 cylinder split-cycle internal combustion engine 1000 includes: a first expansion cylinder 1002, a second expansion cylinder 1004, a first expansion piston 1006, a second expansion piston 1008, a first expansion chamber A defined between first cylinder 1002 and first piston 1006, and a second expansion chamber B (shown clearly in FIGS. 79-87) defined between second expansion cylinder 1004 and second expansion piston 1008. The split-cycle engine also includes a first piston connecting rod 1010, a second piston connecting rod 1012, a first crankshaft 1014, a second crankshaft 1016, and an engine power shaft 1018.

First connecting rod 1010 connects first crankshaft 1014 with first expansion piston 1006, and is configured to convert first crankshaft 1014 rotation to first expansion piston 1006 reciprocating motion in first expansion cylinder 1002 and to convert first expansion piston 1006 reciprocating motion to first crankshaft 1014 rotation. Second connecting rod 1012 connects second crankshaft 1016 with second expansion piston 1008, and is configured to convert second crankshaft 1016 rotation to second expansion piston 1008 reciprocating motion in second expansion cylinder 1004, and to convert second expansion piston 1008 reciprocating motion to second crankshaft 1016 rotation.

The 3-cylinder engine 1000 further includes a compression cylinder 1022, a compression piston 1024 and a compression chamber C (shown clearly in FIGS. 79-81 and 85-87), defined between compression cylinder 1022 and compression piston 1024. The split-cycle engine also includes a compression piston connecting rod 1026, and a compression crankshaft 1028. Compression piston connecting rod 1026 connects compression crankshaft 1028 with compression piston 1024, and is configured to convert compression crankshaft 1028 rotation to compression piston 1024 reciprocating motion in compression cylinder 1022 and to convert compression piston 1024 reciprocating motion to rotation of compression crankshaft 1028. In an exemplary embodiment, first expansion cylinder 1002, second expansion cylinder 1004 and compression cylinder 1022 are arranged in an in-line configuration, that is to say arranged side by side, compression cylinder 1022 positioned between first expansion cylinder 1002 and second expansion cylinder 2004.

The 3-cylinder engine 1000 further includes a crankshaft connecting gearwheels mechanism 1030. Crankshaft connecting gearwheels mechanism 1030 includes a first expansion gearwheel 1030A fixedly associated with first crankshaft 1014, a second expansion gearwheel 1030B fixedly associated with second crankshaft 1016 and a compression gearwheel 1030C fixedly associated with compression crankshaft 1028. Compression gearwheel 1030C connects first expansion gearwheel 1030A to second expansion gearwheel 1030B.

Gearwheels mechanism 1030 is configured to impose mutual and related rotations of first expansion gearwheel 1030A, second expansion gearwheel 1030B and compression gearwheel 1030C, whereas compression gearwheel 1030C revolves in an opposite direction to the rotation direction of first expansion gearwheel 1030A and second expansion gearwheel 1030B, and at twice the rate thereof.

Consequently, compression piston 1024 completes two cycles of reciprocating motion in compression cylinder 1022 during each single cycle of reciprocating motion of first expansion piston 1006 and second expansion piston 1008 in the respective cylinders. Further, connecting gearwheels mechanism 1030 is aligned and configured so that first expansion piston 1006 and second expansion piston 1008 move in anti-phase relative to each other, that is to say that first expansion piston 1006 reciprocating motion is shifted by 180 crankshaft degrees relative to second expansion piston 1008 reciprocating motion. Thus, when first expansion piston 1006 is at its Top Dead Center (TDC) point, compression piston 1024 is also at its own Top Dead Center (TDC) point and second expansion piston 1008 is at its Bottom Dead Center (BDC) point. Further, when second expansion piston 1008 is at its TDC point, compression piston 1024 is also at its TDC point and first expansion piston 1006 is at its BDC point. Compression piston 1024 is at its BDC point when first expansion piston 1006 and second expansion piston 1008 are half way between their respective TDC and BDC points. Engine power shaft 1018 is associated with first crankshaft 1014, with second crankshaft 1016 and with compression crankshaft 1028, so that engine power shaft 1018 rotates when the crankshafts rotate. In some embodiments engine power shaft 1018 is fixedly associated with one of first crankshaft 1014, second crankshaft 1016 and compression crankshaft 1028 (for example, with compression crankshaft 1028), being thereby rotationally associated with the other crankshafts via gearwheel mechanism 1030.

The 3-cylinder engine 1000 also includes a first exhaust port 1032 and a first expansion cylinder port 1034 in first cylinder 1002. First exhaust port 1032 is regulated (that is to say opened and closed) by a first exhaust poppet valve 1036 operated by a first exhaust camshaft 1038. 3-cylinder engine 1000 further includes a second exhaust port 1040 and a second expansion cylinder port 1042 in second cylinder 1004. Second exhaust port 1040 is regulated by a second exhaust poppet valve 1044 operated by a second exhaust camshaft 1046. 3-cylinder engine 1000 further includes an inlet port 1048 first compression port 1056 regulated by an inlet poppet valve 1052, whereas inlet poppet valve 1052 is operated by an inlet camshaft 1054. The 3-cylinder engine 1000 further comprises a first compression port 1056 and a second compression port 1058 in compression cylinder 1022.

First exhaust camshaft 1038, second exhaust camshaft 1046 and inlet camshaft 1054 are engaged to gearwheels mechanism 1030 via a mechanical linkage mechanism (not shown here), configured to impose mutual rotations of the crankshafts and the camshafts.

Specifically, during operation of engine 1000, first exhaust camshaft 1038, second exhaust camshaft 1046 and inlet camshaft 1054 rotate synchronously with first crankshaft 1014, with second crankshaft 1016 and with compression crankshaft 1028, respectively. Consequently, inlet camshaft 1054 completes two revolutions during every single revolution of first exhaust camshaft 1038 and second exhaust camshaft 1046.

In exemplary embodiments, first expansion piston 1006, second expansion piston 1008 and compression piston 1024 have protrusions (not shown here) corresponding to first expansion cylinder port 1034 in first cylinder 1002, to second expansion cylinder port 1042 in second cylinder 1004, and to first compression port 1056 and second compression port 1058 in compression cylinder 1022, respectively. The protrusions are arranged on pistons 1006, 1008 and 1024 so that when each piston reaches its TDC point, each protrusion on the piston protrudes at least partially into a corresponding port in the cylinder of the piston, thereby reducing dead volume in the corresponding chamber.

The split-cycle engine 1000 also includes a sleeve cylinder 1060, housing a sleeve shuttle 1062 therein, sleeve shuttle 1062 being configured for a reciprocating motion inside sleeve cylinder 1060. Split-cycle engine 1000 further comprises a combustion chamber structure 1064 fixed within sleeve cylinder 1060 defining a first combustion chamber D and a second combustion chamber E therein.

It is noted that FIG. 76A schematically depicts a cross-sectional side view of engine 1000; first exhaust port 1032 and first exhaust poppet valve 1036, second exhaust port 1040 and second exhaust poppet valve 1044, and inlet port 1048 and inlet poppet valve 1052 are not in the plane of the cross-section of FIG. 76A, and are therefore illustrated in FIG. 76A (and in FIGS. 77-88 discussed below) using dashed lines. FIG. 76B schematically depicts engine 1000 in a cross-sectional view along cross-section designated A-A in FIG. 76A which crosses through inlet port 1048 and inlet poppet valve 1052. FIG. 76B illustrates the mutual arrangement of inlet port 1048 and inlet poppet valve 1052 relative to sleeve cylinder 1060. Accordingly, inlet port 1048 and inlet poppet valve 1052 are arranged to the right of sleeve cylinder 1060 in FIG. 76B, behind sleeve cylinder 1060 in FIG. 76A. First exhaust port 1032, first exhaust poppet valve 1036, second exhaust port 1040 and second exhaust poppet valve 1044 are arranged in the same plane of inlet port 1048 and inlet poppet valve 1052 parallel to the cross-sectional plane of FIG. 76A.

Combustion chamber structure 1064 comprises a first combustion chamber expansion port 1066 fluidly associated with first combustion chamber D, and a second combustion chamber expansion port 1068 fluidly associated with second combustion chamber E. Combustion chamber structure 1064 further comprises a first combustion chamber compression port 1070 fluidly associated with first combustion chamber D, and a second combustion chamber compression port 1072 fluidly associated with second combustion chamber E. In some embodiments engine 1000 comprises spark plugs (not shown here) in combustion chamber D and in combustion chamber E, respectively, configured to ignite a spark within chambers D and E respectively.

The split-cycle engine 1000 further comprises a sleeve connecting rod 1080, a sleeve crankshaft 1082, chamber (expanding) sealing rings 1084 mounted in annular grooves on an external surface of combustion chamber structure 1064 and cylinder (contracting) sealing rings 1086 mounted in annular grooves of sleeve cylinder 1060.

In an exemplary embodiment, the sleeve cylinder 1060 houses the sleeve shuttle 1062 and both are placed on top and perpendicular to first expansion cylinder 1002, second expansion cylinder 1004 and compression cylinder 1022 which are arranged side by side, compression cylinder 1022 between first expansion cylinder 1002 and second expansion cylinder 1004. First combustion chamber D and second combustion chamber E are arranged inside combustion chamber structure 1064 side by side, along a longitudinal axis of sleeve cylinder 1060.

Sleeve connecting rod 1080 connects sleeve shuttle 1062 to sleeve crankshaft 1082. Sleeve crankshaft 1082 converts rotational motion into sleeve shuttle 1062 reciprocating motion. Sleeve crankshaft 1082 is mechanically engaged via a mechanical linkage mechanism (not shown here) to gearwheels mechanism 1030, thus gearwheels mechanism 1030 drives sleeve crankshaft 1082 rotational motion. In another exemplary embodiment, a swash plate mechanism or a camshaft mechanism could be used to drive sleeve shuttle 1062.

During operation of engine 1000, sleeve shuttle 1062 reciprocating motion is synchronized, via the mechanical linkage mechanism (not shown here) to gearwheels mechanism 1030, with the reciprocating motion of first expansion piston 1006 and second expansion piston 1008. Thus, during operation, sleeve shuttle 1062 completes a full single cycle of reciprocating motion in sleeve cylinder 1060, during a full single cycle of reciprocating motion of first expansion piston 1006 and second expansion piston 1008, and during two full cycles of reciprocating motion of compression piston 1024.

Sleeve shuttle 1062 comprises a cylindrical sleeve 1090 housed inside sleeve cylinder 1060, between chamber sealing rings 1084 and cylinder sealing rings 1086, and dimensioned and configured to slide therein in a reciprocating motion. Cylindrical sleeve 1090 comprises a first sleeve port 1092 positioned and dimensioned to fluidly associate and disassociate, alternatingly during the reciprocating motion, first expansion cylinder port 1034 with first combustion chamber expansion port 1066, and to fluidly associate and disassociate, alternatingly, first compression port 1056 with first combustion chamber compression port 1070. During sleeve shuttle 1062 reciprocating motion, chamber D alternates between being fluidly connected and being fluidly disconnected to first expansion chamber A via a passageway defined by first expansion cylinder port 1034, first sleeve port 1092, and first combustion chamber expansion port 1066. Likewise, during sleeve shuttle 1062 reciprocating motion, chamber D alternates between being fluidly connected and being fluidly disconnected to compression chamber C via a passageway defined by first compression port 1056, first sleeve port 1092, and first combustion chamber compression port 1070.

Cylindrical sleeve 1090 further comprises a second sleeve port 1094 positioned and dimensioned to fluidly associate and disassociate, alternatingly during the reciprocating motion, second expansion cylinder port 1042 with second combustion chamber expansion port 1068, and to fluidly associate and disassociate, alternatingly, second compression port 1058 with second combustion chamber compression port 1072. During sleeve shuttle 1062 reciprocating motion, chamber E thus alternates between being fluidly connected and being fluidly disconnected to second expansion chamber B via a passageway defined by second expansion cylinder port 1042, second sleeve port 1094, and second combustion chamber expansion port 1068. Likewise, during sleeve shuttle 1062 reciprocating motion, chamber E alternates between being fluidly connected and being fluidly disconnected to compression chamber C via a passageway defined by second compression port 1058, second sleeve port 1094, and second combustion chamber compression port 1072.

In some embodiments (e.g. embodiments having a first sleeve port and a second sleeve port wider or larger than first sleeve port 1092 and second sleeve port 1094), during a fraction of sleeve shuttle 1062 reciprocating motion, chamber D may simultaneously be fluidly connected to both chamber A and chamber C, and chamber E may simultaneously be fluidly connected to both chamber C and chamber B. In some exemplary embodiments (not exemplified in the Figures), e.g. when sleeve shuttle 1062 is departing its mid-stroke point, while traveling to the left, and when first sleeve port 1092 is wide enough to simultaneously fluidly connect first expansion cylinder port 1034 with first combustion chamber expansion port 1066, and first compression port 1056 with first combustion chamber compression port 1070, first expansion chamber A may be in fluid communication with compression chamber C via chamber D. Likewise, when, e.g., sleeve shuttle 1062 is departing its mid-stroke point, while traveling to the right, and when second sleeve port 1094 is wide enough to simultaneously fluidly connect second expansion cylinder port 1042 with second combustion chamber expansion port 1068, and second compression port 1058 with second combustion chamber compression port 1072, second expansion chamber B may be in fluid communication with compression chamber C via chamber E.

In some exemplary embodiments chambers A and B are never in fluid communication with chamber C. During sleeve shuttle 1062 reciprocating motion, first combustion chamber D alternates between being fluidly connected to compression chamber C via first combustion chamber compression port 1070, first sleeve port 1092 and first compression port 1056, and to first expansion chamber A via first combustion chamber expansion port 1066, first sleeve port 1092 and first expansion cylinder port 1034. Further, during sleeve shuttle 1062 reciprocating motion, second combustion chamber E alternates between being fluidly connected to compression chamber C via second combustion chamber compression port 1072, second sleeve port 1094 and second compression port 1058, and to second expansion chamber B via second combustion chamber expansion port 1068, second sleeve port 1094 and second expansion cylinder port 1042.

FIGS. 77-88 illustrate schematically engine 1000 during a single cycle of operation. During one cycle of operation of engine 1000, first expansion piston 1006 and second expansion piston 1008 perform one cycle of reciprocating motion, such one cycle comprising an expansion stroke and an exhaust stroke (not necessarily in this order, as is described below). During one cycle of operation of engine 1000, compression piston 1024 completes two cycles of reciprocating motion, a first cycle comprising a first intake stroke and a first compression stroke, and a second cycle comprising a second intake stroke and a second compression stroke. The first cycle of compression piston 1024 is configured to provide the compressed working fluid which is to be expanded after ignition in first expansion cylinder 1002, whereas the second cycle of compression piston 1024 is configured to provide the compressed working fluid which is to be expanded after ignition in second expansion cylinder 1004.

Figure 78:
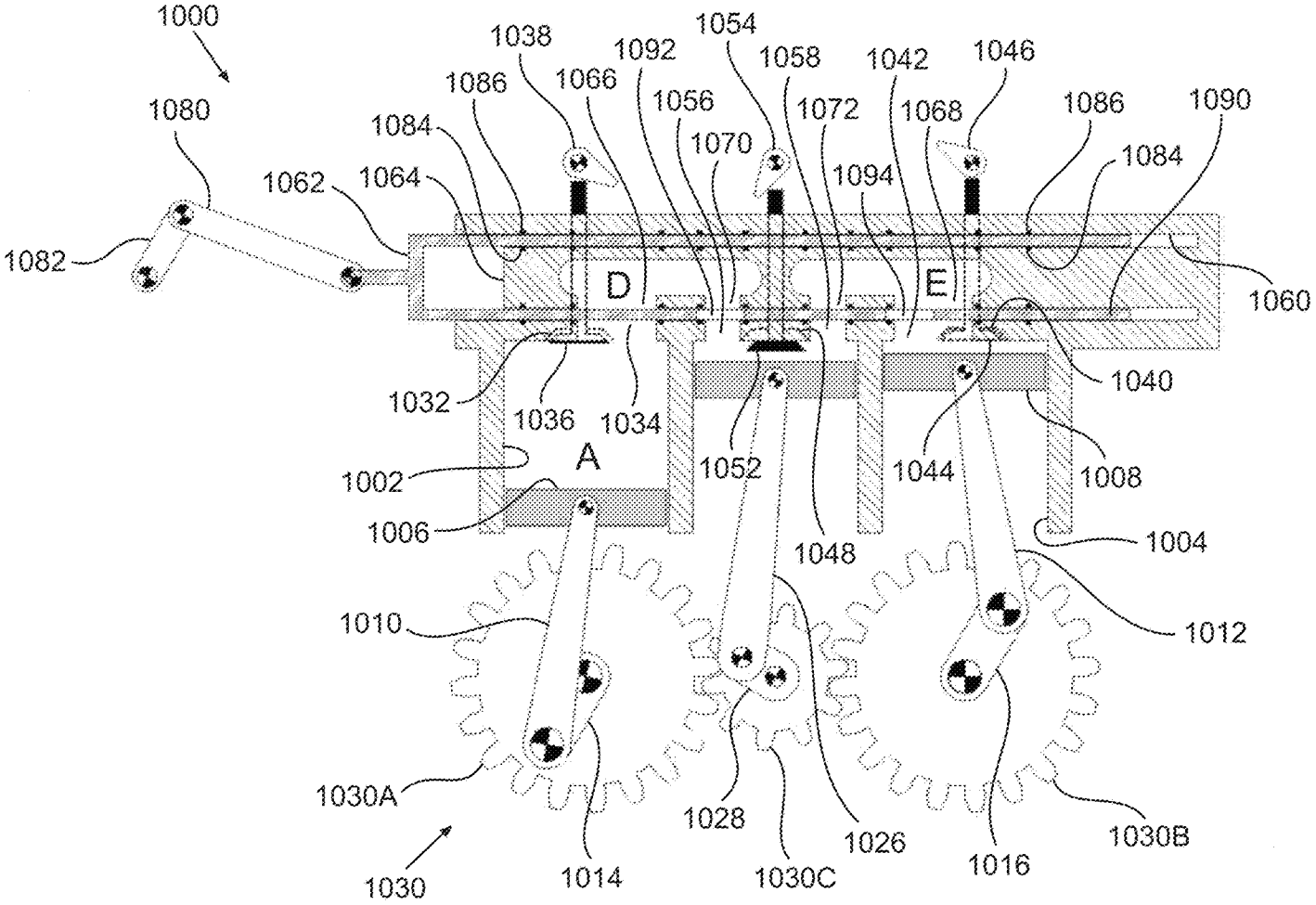
FIG. 78 schematically depicts the engine of FIG. 76A wherein the first expansion piston is illustrated at 210 degrees, the second expansion piston is illustrated at 30 degrees, and the compression piston is illustrated at −60 degrees, from their respective TDC points.
Figure 79:
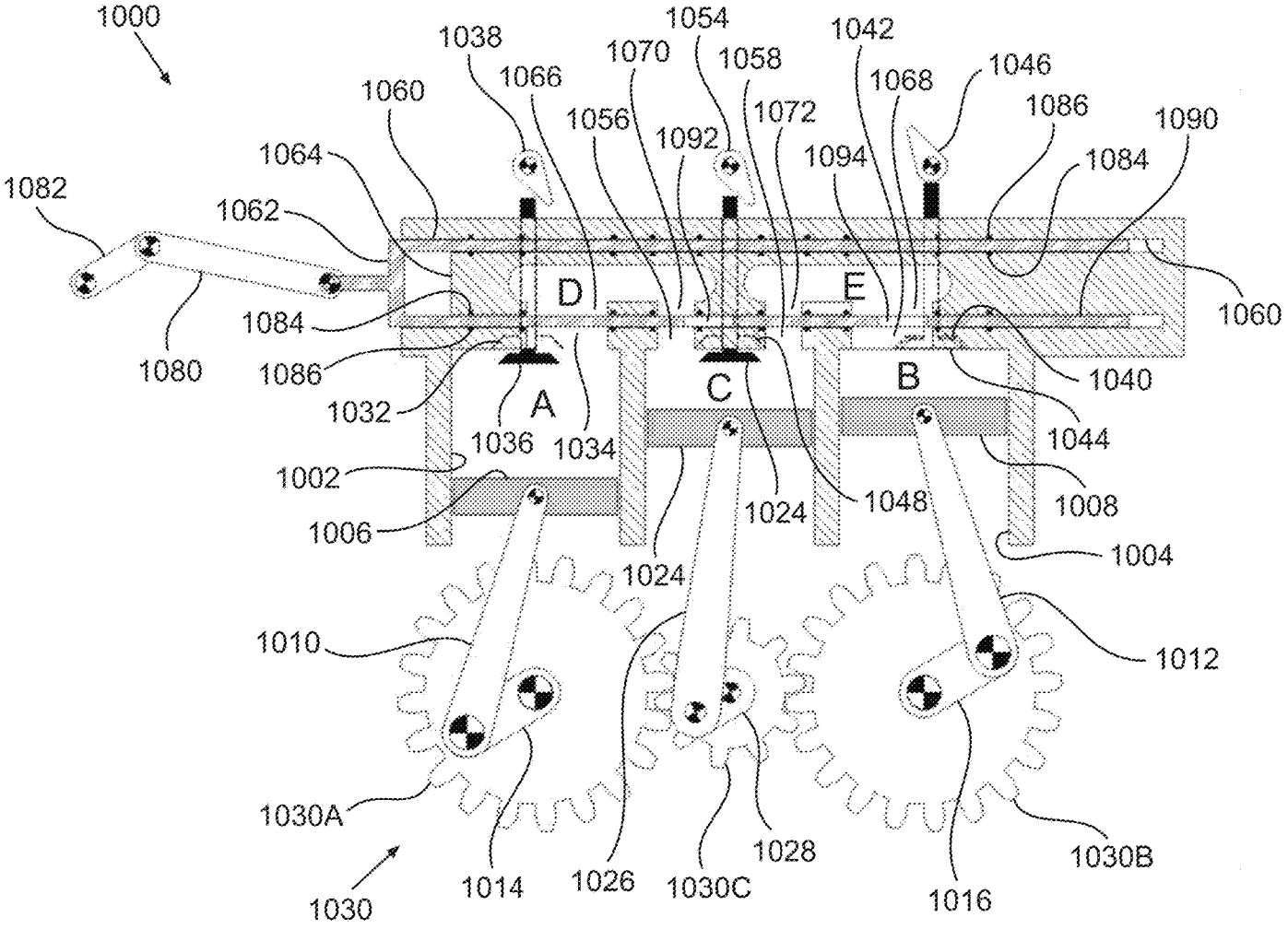
FIG. 79 schematically depicts the engine of FIG. 76A wherein the first expansion piston is illustrated at 240 degrees, the second expansion piston is illustrated at 60 degrees, and the compression piston is illustrated at −120 degrees, from their respective TDC points.
Figure 80:
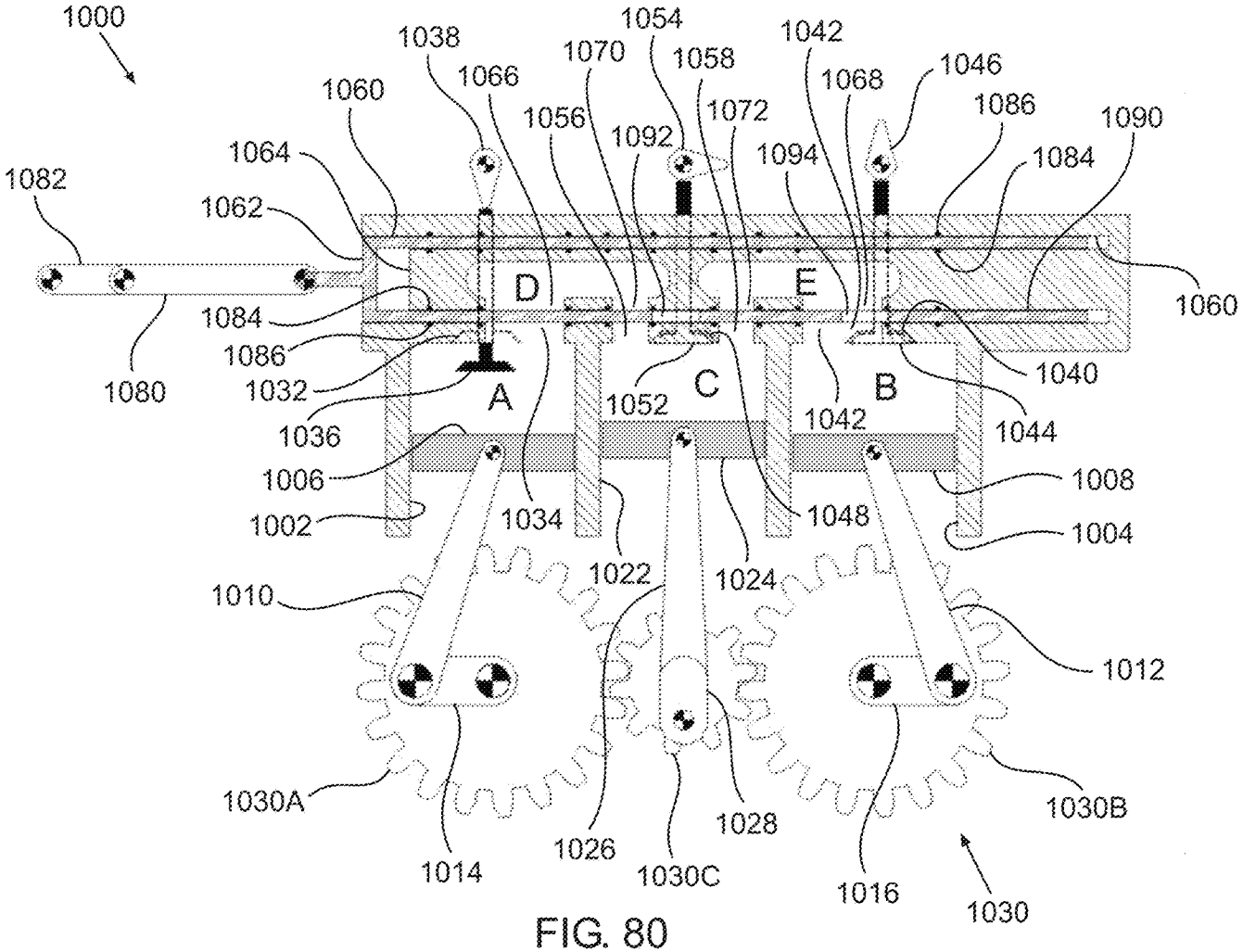
FIG. 80 schematically depicts the engine of FIG. 76A wherein the first expansion piston is illustrated at 270 degrees and the second expansion piston is illustrated at 90 degrees from their respective TDC points, and the compression piston is illustrated at −180 degrees from its respective TDC points namely at its respective BDC point.

A first intake stroke is depicted schematically in FIGS. 78-80. During a portion of the first intake stroke, depicted schematically in FIGS. 78-79, inlet camshaft 1054 operates inlet poppet valve 1052 to open inlet port 1048, and a working fluid (e.g. carbureted/injected naturally aspirated fuel/air charge or forced induced fuel/air charge) flows into chamber C through inlet port 1048 and possibly through other apparatus (such as turbo charger, or other apparatus as commonly known to a person skilled in the art—such apparatus not shown here), as the compression piston 1024 approaches its BDC point. Also during the first intake stroke, sleeve shuttle 1062 travels to the right from a center position in sleeve cylinder 1060, thereby fluidly connecting first combustion chamber D to compression chamber C via first combustion chamber compression port 1070, first sleeve port 1092 and first compression port 1056 (and fluidly connecting second combustion chamber E to second expansion chamber B via second combustion chamber expansion port 1068, second sleeve port 1094 and second expansion cylinder port 1042).

Figure 81:
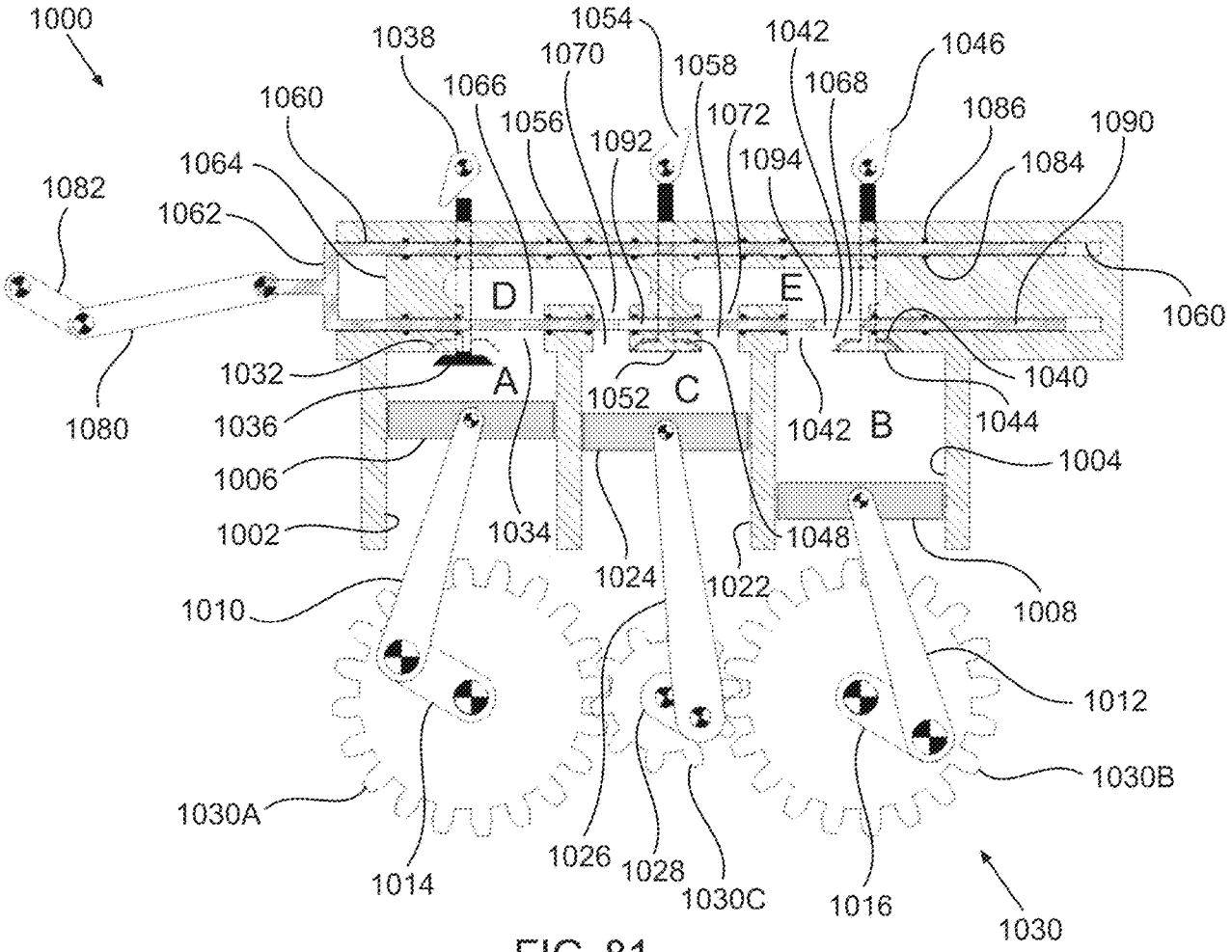
FIG. 81 schematically depicts the engine of FIG. 76A wherein the first expansion piston is illustrated at 300 degrees, the second expansion piston is illustrated at 120 degrees, and the compression piston is illustrated at −240 degrees, from their respective TDC points.
Figure 82:
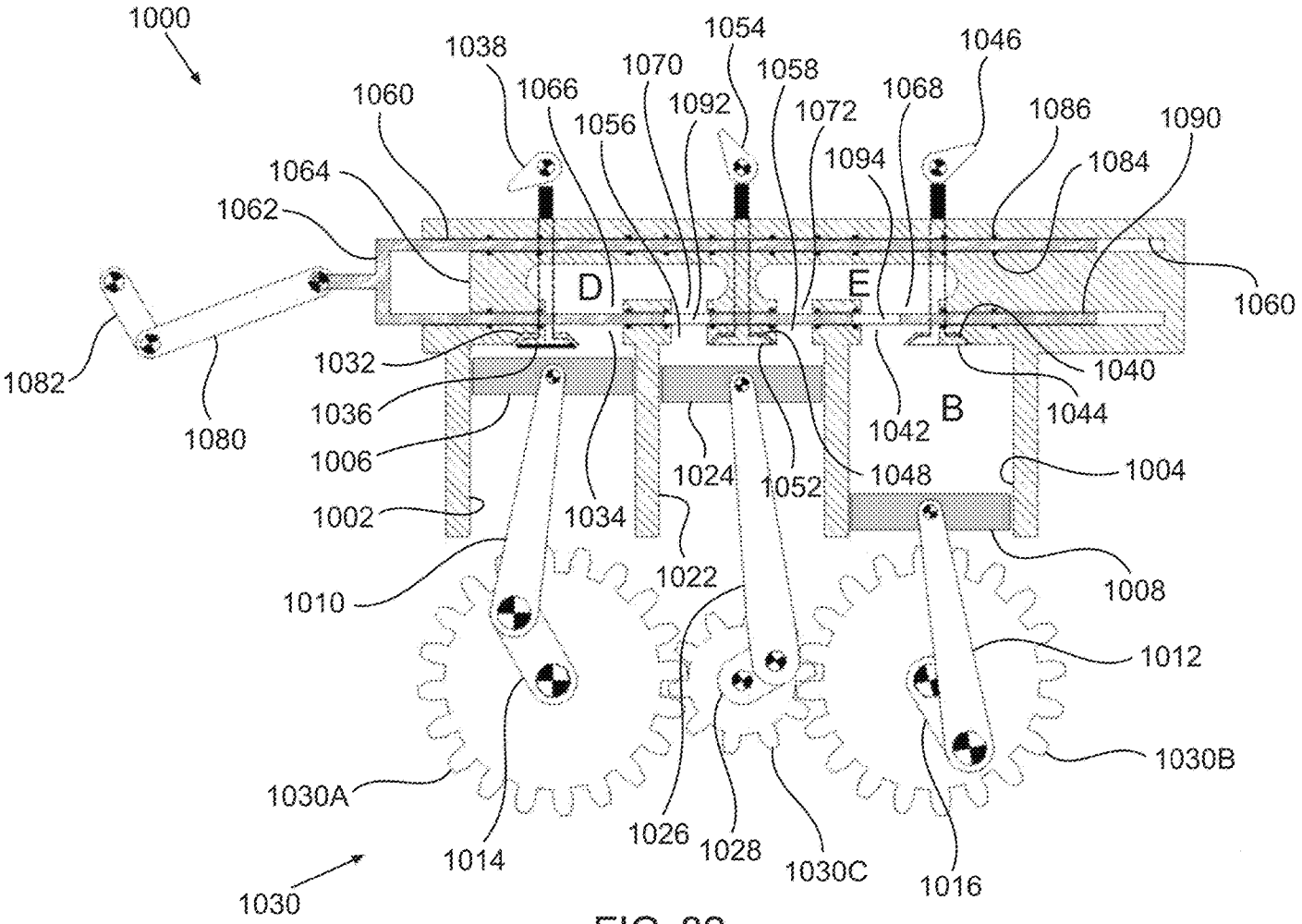
FIG. 82 schematically depicts the engine of FIG. 76A wherein the first expansion piston is illustrated at 330 degrees, the second expansion piston is illustrated at 150 degrees, and the compression piston is illustrated at −300 degrees, from their respective TDC points.
Figure 83:
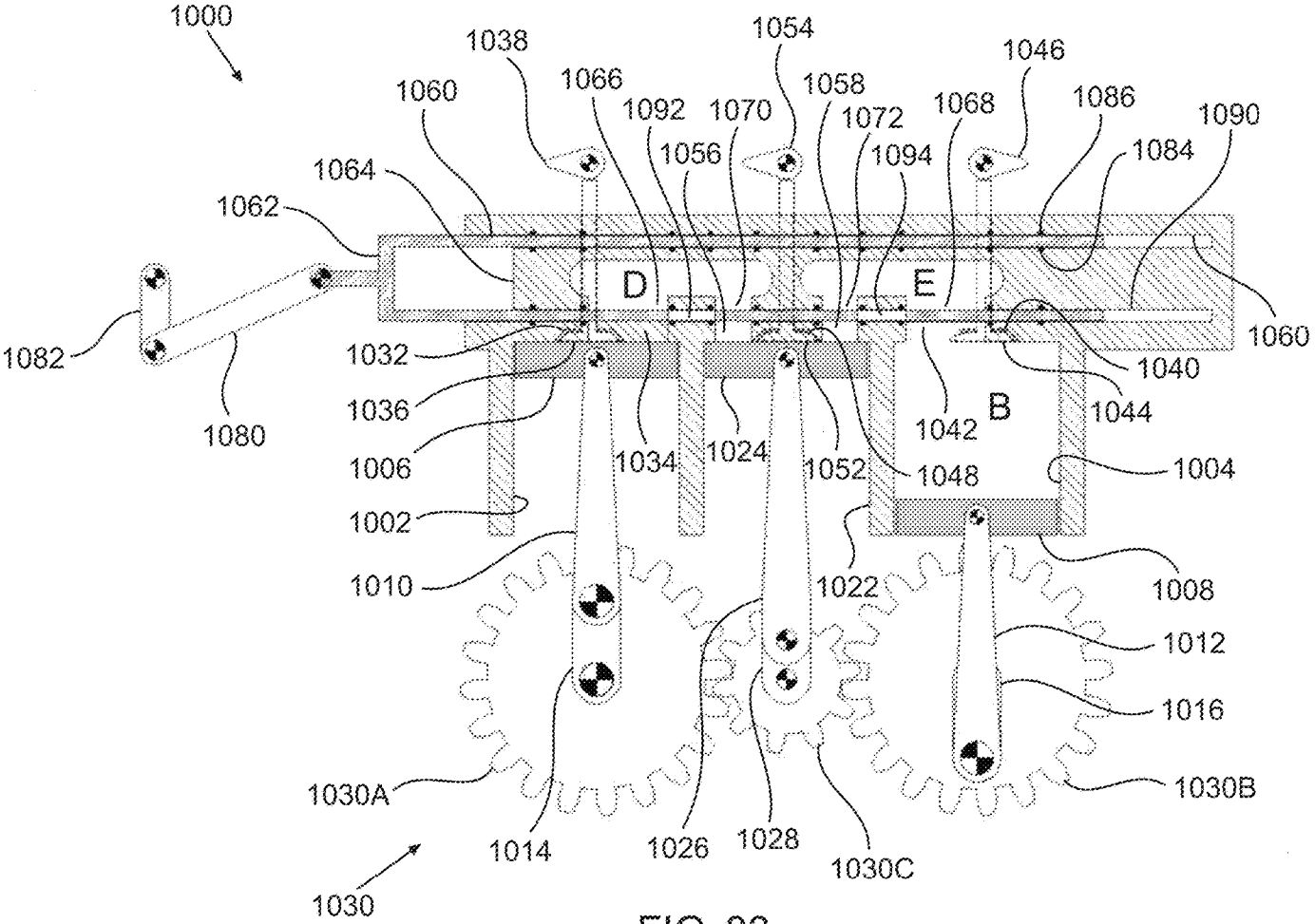
FIG. 83 schematically depicts the engine of FIG. 76A wherein the first expansion piston and the compression piston are illustrated at their respective TDC points, and the second expansion piston is illustrated at 180 degrees from its TDC point, that is to say at its respective BDC point.

When compression piston 1024 passes through its BDC point, the intake stroke ends, and compression stroke begins. During the first compression stroke, depicted schematically in FIGS. 81-83, inlet camshaft 1054 operates inlet poppet valve 1052 to close inlet port 1048, whereas compression piston 1024 approaches its TDC point. Also during the first compression stroke, sleeve shuttle 1062 travels to the left towards the center position in sleeve cylinder 1060 whereas first combustion chamber D remains fluidly connected to compression chamber C via first combustion chamber compression port 1070, first sleeve port 1092 and first compression port 1056 (and whereas second combustion chamber E remains fluidly connected to second expansion chamber B via second combustion chamber expansion port 1068, second sleeve port 1094 and second expansion cylinder port 1042). FIGS. 81 and 82 illustrate schematically an open passageway defined by first compression port 1056, first sleeve port 1092 and first combustion chamber compression port 1070, enabling compression piston 1024 to force the working fluid from chamber C into first combustion chamber D there through. The working fluid is ignited in combustion chamber D when the passageway closes (e.g. in FIG. 83), as sleeve shuttle 1062 approaches or reaches the center position.

An expansion stroke of first expansion piston 1006 is illustrated schematically in FIGS. 83-88. During the expansion stroke, sleeve shuttle 1062 travels to the left from the center position in sleeve cylinder 1060, and then back to the right towards the center position, thereby fluidly connecting first combustion chamber D to first expansion chamber A via first combustion chamber expansion port 1066, first sleeve port 1092 and first expansion cylinder port 1034 (and fluidly connecting second combustion chamber E to compression chamber C via second combustion chamber compression port 1072, second sleeve port 1094 and second compression port 1058). Accordingly, FIGS. 84-88 illustrate schematically an open passageway defined by first combustion chamber expansion port 1066, first sleeve port 1092 and first expansion cylinder port 1034, enabling expansion of the ignited working fluid in combustion chamber D into first expansion chamber A, thereby forcing first expansion piston 1006 towards its BDC point.

An exhaust stroke of first expansion piston 1006 is illustrated schematically in FIGS. 77-82. An exhaust stroke of first expansion piston 1006 begins when the expansion stroke ends, as first expansion piston 1006 departs from its BDC point and approaches its TDC point. During the exhaust stroke, sleeve shuttle 1062 travels to the right from the center position in sleeve cylinder 1060, and then back to the left towards the center position. During a portion of the exhaust stroke of first expansion piston 1006, depicted schematically in FIGS. 78-85, first exhaust camshaft 1038 operates first exhaust poppet valve 1036 to open first exhaust port 1032, thereby fluidly connecting first expansion chamber A to the ambient through first exhaust port 1032. The travel of first expansion piston 1006 towards its TDC point, possibly combined with relatively high pressure of the burnt fluid, thus forces the burnt gas out from first expansion chamber A to the ambient through the open exhaust port 1032.

Figure 84:
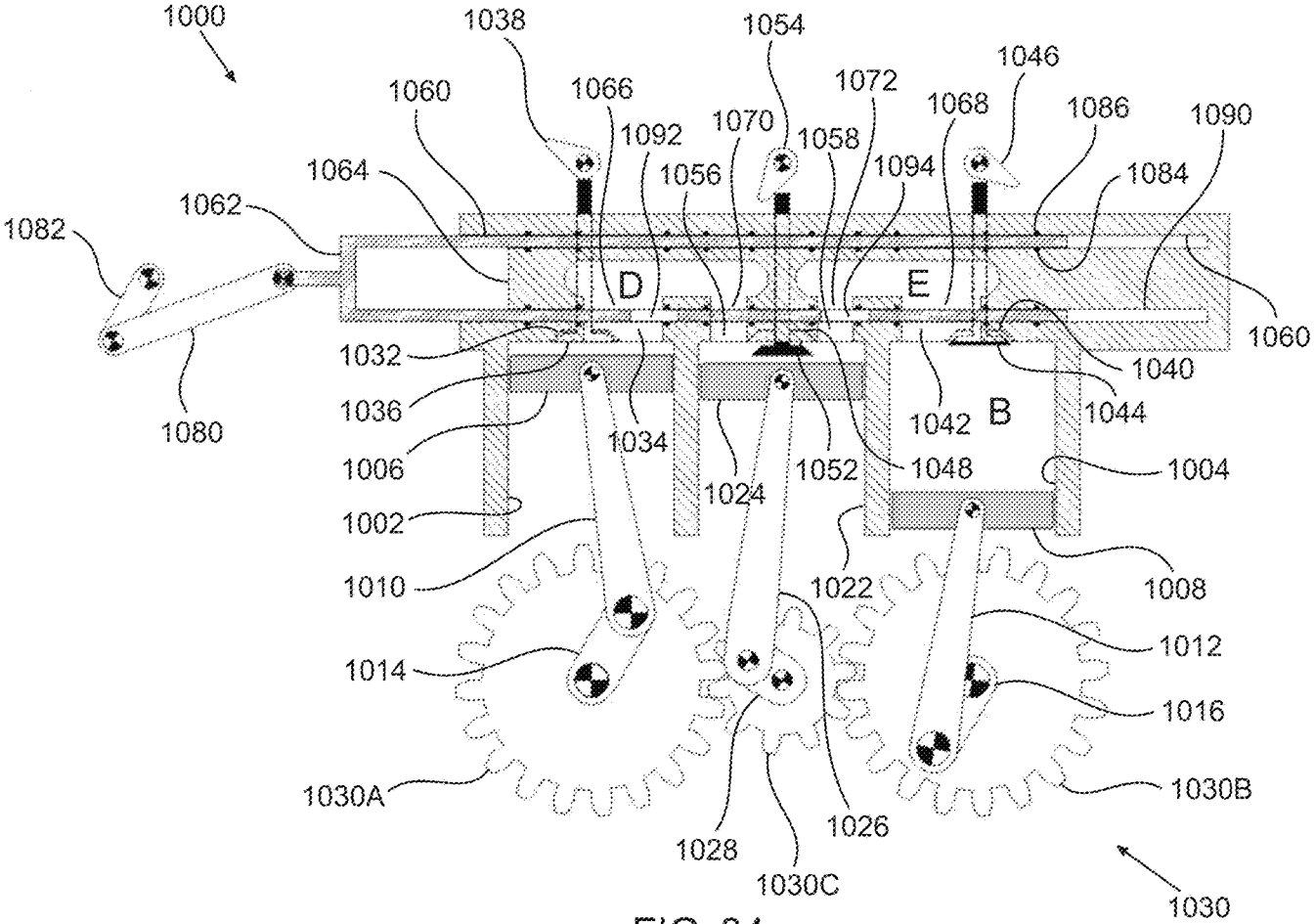
FIG. 84 schematically depicts the engine of FIG. 76A wherein the first expansion piston is illustrated at 30 degrees, the second expansion piston is illustrated at 210 degrees, and the compression piston is illustrated at −60 degrees, from their respective TDC points.
Figure 85:
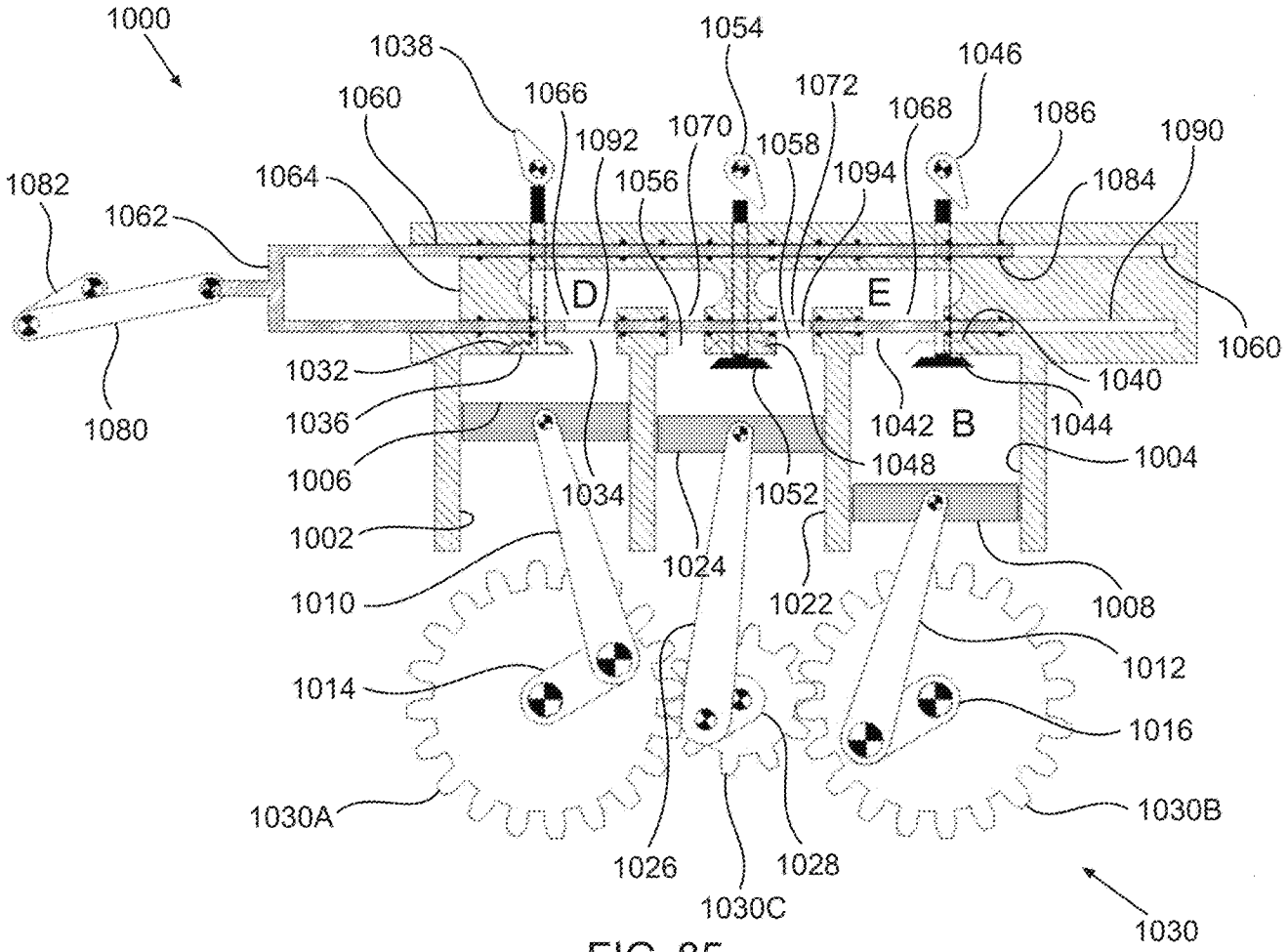
FIG. 85 schematically depicts the engine of FIG. 76A wherein the first expansion piston is illustrated at 60 degrees, the second expansion piston is illustrated at 240 degrees, and the compression piston is illustrated at −120 degrees, from their respective TDC points.
Figure 86:
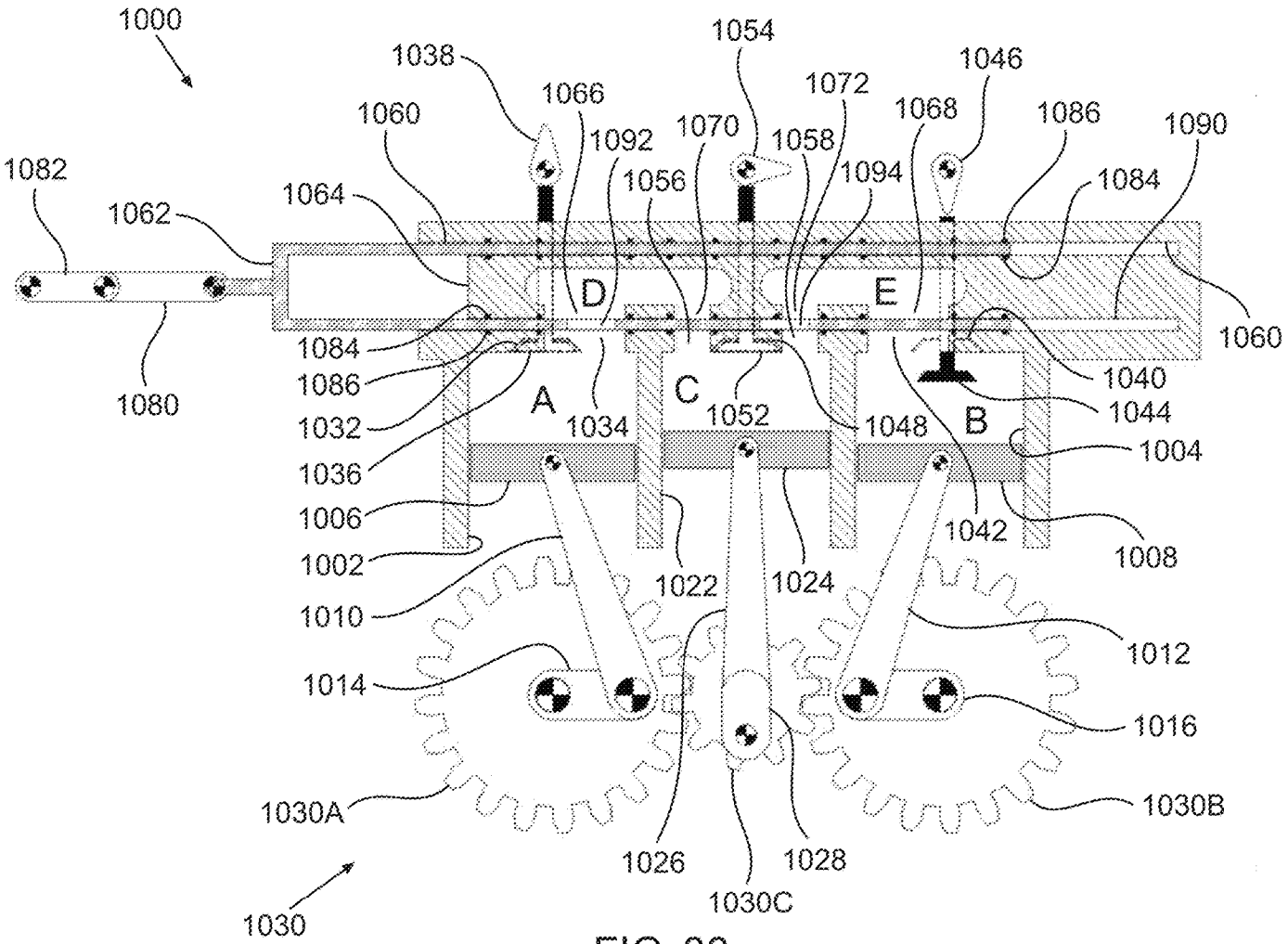
FIG. 86 schematically depicts the engine of FIG. 76A wherein the first expansion piston is illustrated at 90 degrees and the second expansion piston is illustrated at 270 degrees from their respective TDC points, and the compression piston is illustrated at −180 degrees from its respective TDC point, namely at its respective BDC point.

FIGS. 84-86 also depict schematically the second inlet stroke of compression piston 1024. During a portion of the second intake stroke, depicted schematically in FIGS. 84-85, inlet camshaft 1054 operates inlet poppet valve 1052 to open inlet port, and a working fluid flows into chamber C through inlet port 1048 as described above, as the compression piston 1024 approaches its BDC point. Also during the second intake stroke, sleeve shuttle 1062 travels to the left from a center position in sleeve cylinder 1060, thereby fluidly connecting second combustion chamber E to compression chamber C via second combustion chamber compression port 1072, second sleeve port 1094 and second compression port 1058 (and fluidly connecting first combustion chamber D to first expansion chamber A via first combustion chamber expansion port 1066, first sleeve port 1092 and first expansion cylinder port 1034).

Figure 77:
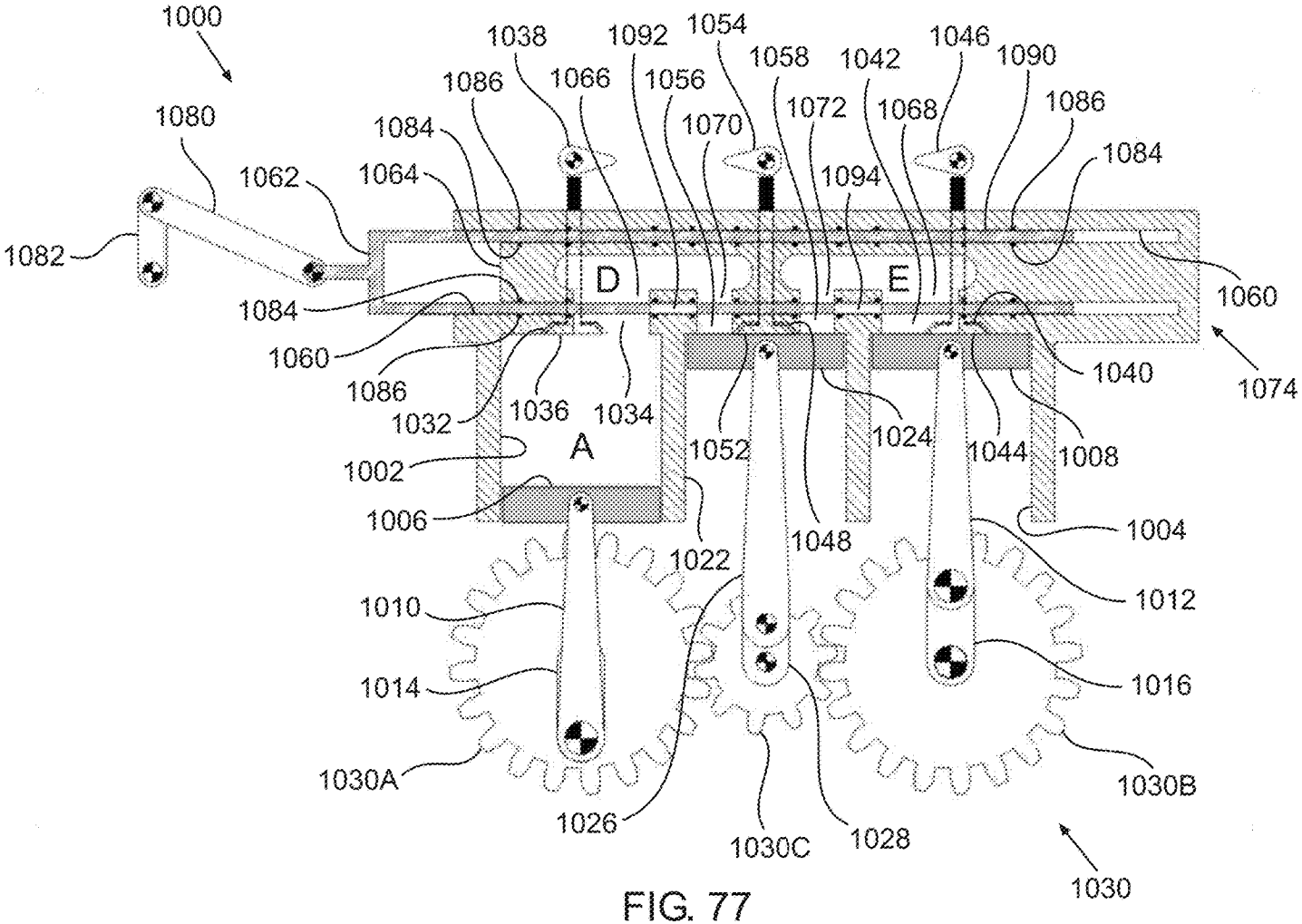
FIG. 77 schematically depicts the engine of FIG. 76A, wherein a first expansion piston is illustrated 180 degrees from its Top Dead Center (TDC) point, that is to say at its respective Bottom Dead Center (BDC) point, whereas a second expansion piston and the compression piston are illustrated at their respective TDC points.
Figure 87:
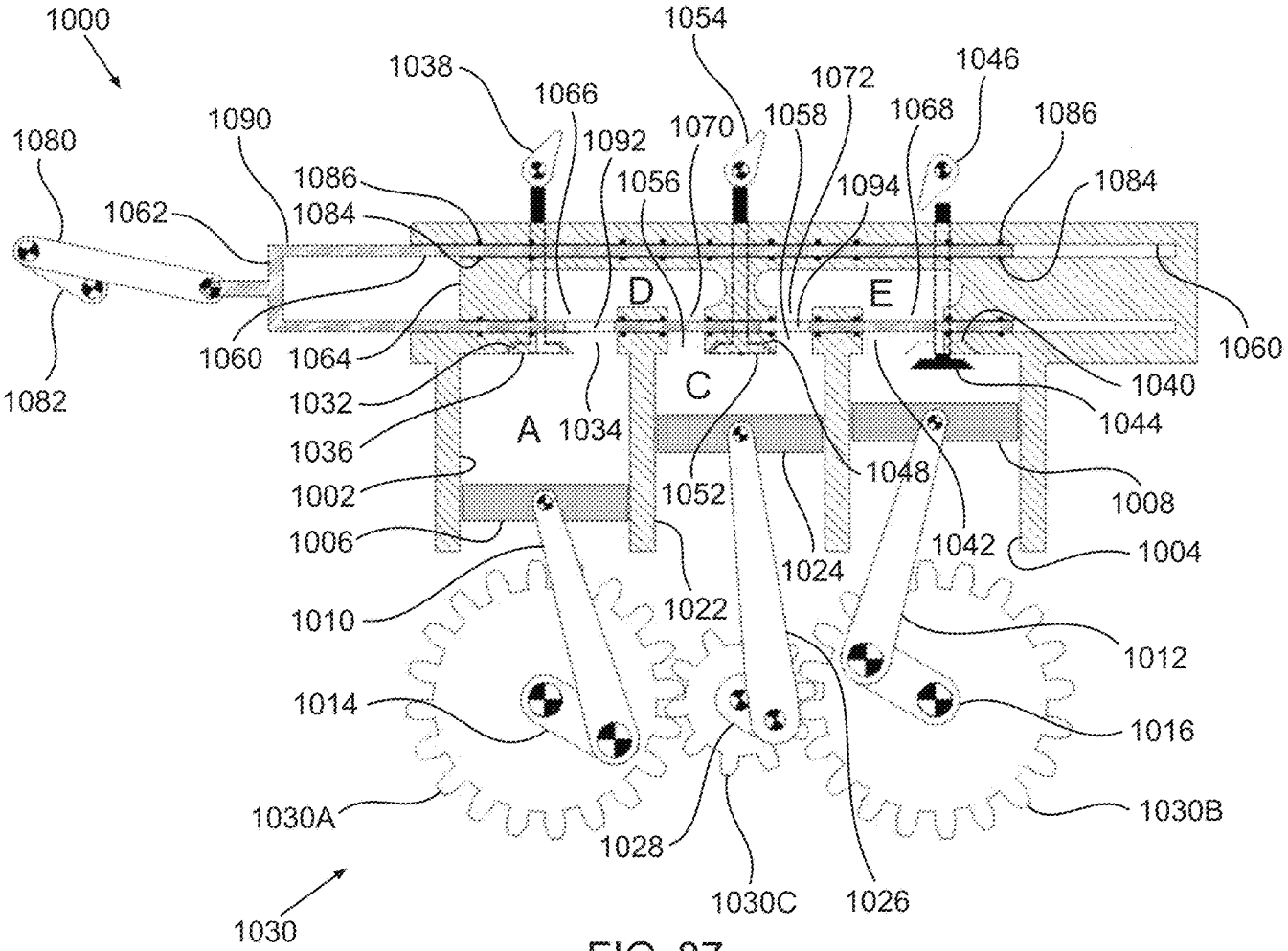
FIG. 87 schematically depicts the engine of FIG. 76A wherein the first expansion piston is illustrated at 120 degrees, the second expansion piston is illustrated at 300 degrees, and the compression piston is illustrated at −240 degrees, from their respective TDC point.
Figure 88:
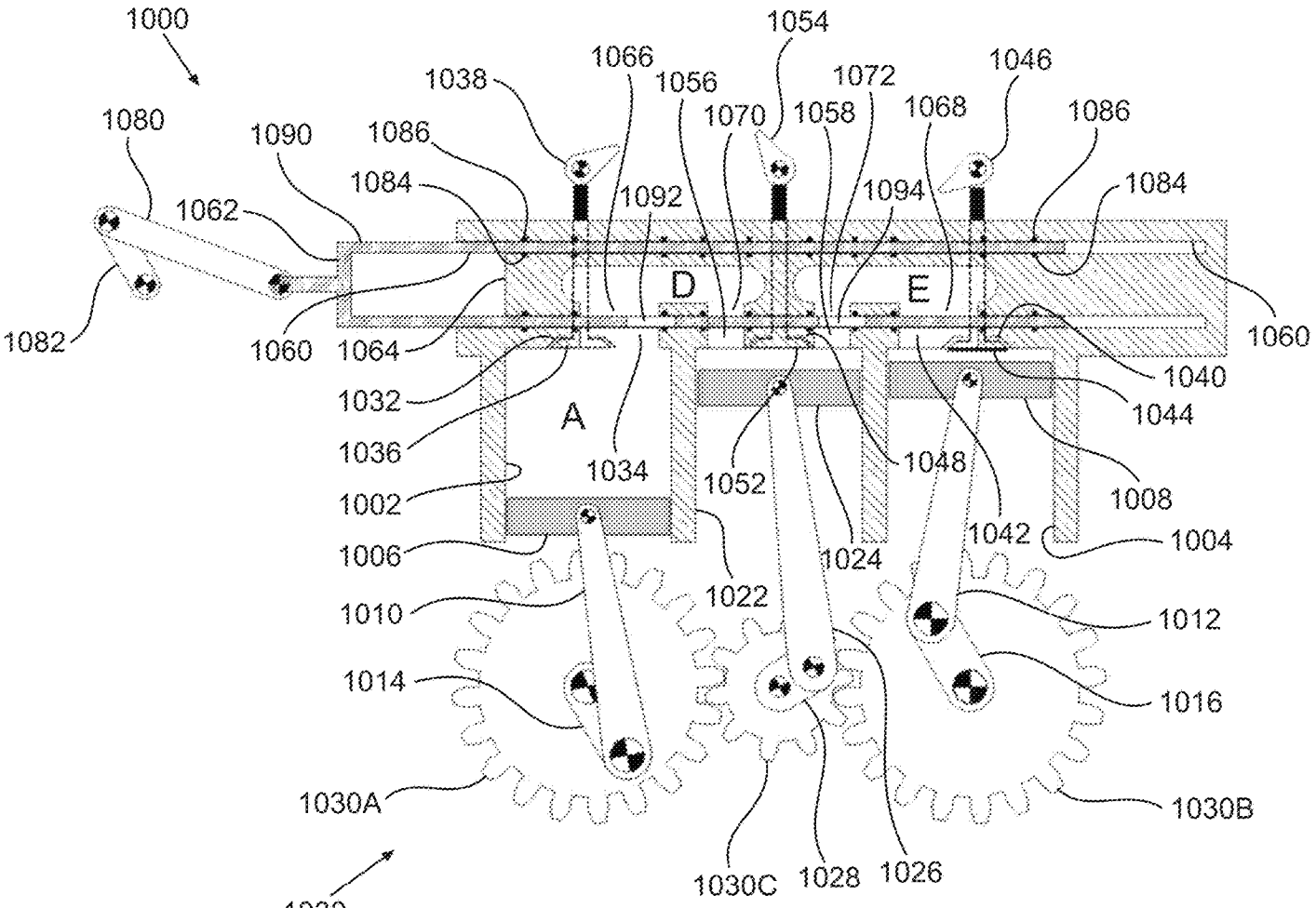
FIG. 88 schematically depicts the engine of FIG. 76A wherein the first expansion piston is illustrated at 150 degrees, the second expansion piston is illustrated at 330 degrees, and the compression piston is illustrated at −300 degrees, from their respective TDC point, and FIG. 89 schematically depicts an embodiment of a cross-sectional side view of a 3-cylinders split-cycle engine, having one compression cylinder and two expansion cylinders and a sleeve shuttle valve, wherein the exhaust ports in the expansion cylinders are regulated by the sleeve shuttle valve and not by poppet valves.

During the second compression stroke, depicted schematically in FIGS. 87, 88 and 77, inlet camshaft 1054 operates inlet poppet valve 1052 to close inlet port 1048, whereas compression piston 1024 approaches its TDC point. Also during the second compression stroke, sleeve shuttle 1062 travels to the right towards the center position in sleeve cylinder 1060, whereas second combustion chamber E remains fluidly connected to compression chamber C via second combustion chamber compression port 1072, second sleeve port 1094 and second compression port 1058 (and whereas first combustion chamber D remains fluidly connected to first expansion chamber A via first combustion chamber expansion port 1066, first sleeve port 1092 and first expansion cylinder port 1034). FIGS. 87 and 88 illustrate schematically an open passageway defined by second compression port 1058, second sleeve port 1094 and second combustion chamber compression port 1072, enabling compression piston 1024 to force the working fluid from compression chamber C into second combustion chamber E there through. The working fluid is ignited in combustion chamber E (e.g. in FIG. 77) as sleeve shuttle 1062 approaches or reaches the center position, from the left.

An expansion stroke of second expansion piston 1008 is illustrated schematically in FIGS. 77-82. As described above regarding the first intake stroke and the first compression stroke, sleeve shuttle 1062 travels to the right from the center position in sleeve cylinder 1060, and then back to the left towards the center position, thereby fluidly connecting second combustion chamber E to second expansion chamber B via second combustion chamber expansion port 1068, second sleeve port 1094 and second expansion cylinder port 1042. Accordingly, FIGS. 78-82 illustrate schematically an open passageway defined by second combustion chamber expansion port 1068, second sleeve port 1094 and second expansion cylinder port 1042, enabling expansion of the ignited working fluid in second combustion chamber E into second expansion chamber B, thereby forcing second expansion piston 1008 towards its BDC point.

An exhaust stroke of second expansion piston 1008 is illustrated schematically in FIGS. 83-88. An exhaust stroke of second expansion piston 1008 begins when the expansion stroke ends, as second expansion piston 1008 departs from its BDC point and approaches its TDC point. During the exhaust stroke, sleeve shuttle 1062 travels to the left from the center position in sleeve cylinder 1060, and then back to the right towards the center position. During a portion of the exhaust stroke of second expansion piston 1008, depicted schematically in FIGS. 84-88, second exhaust camshaft 1046 operates second exhaust poppet valve 1044 to open second exhaust port 1040, thereby fluidly connecting second expansion chamber B to the ambient through second exhaust port 1040. The travel of second expansion piston 1008 towards its TDC point, possibly combined with relatively high pressure of the burnt fluid, thus forces the burnt gas out from second expansion chamber B to the ambient through the open exhaust port 1040.

Figure 89:
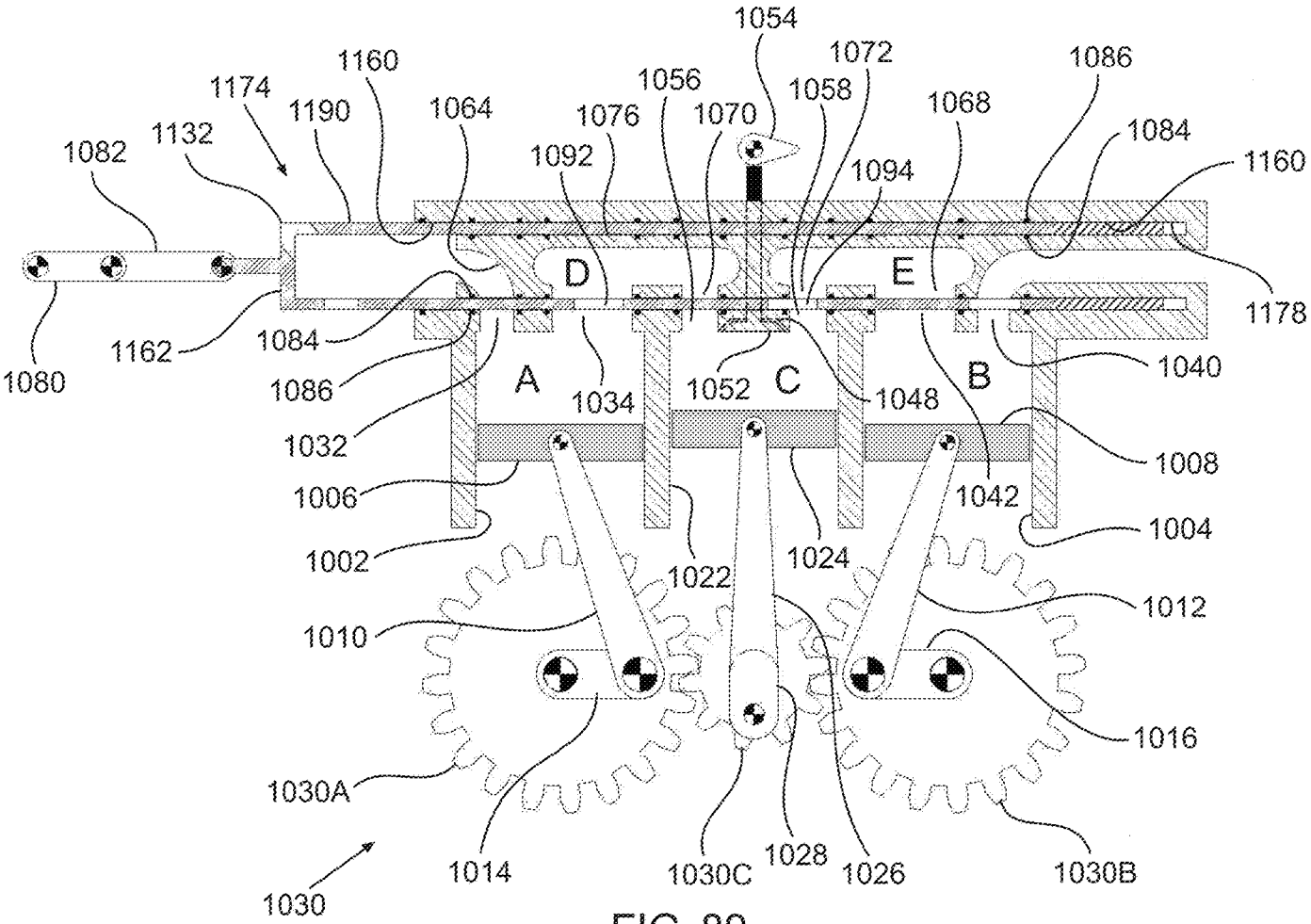

In exemplary embodiments the use of poppet valves to regulate (open and close) exhaust ports in a three-cylinder engine of the invention is evaded, and the exhaust ports are opened and closed by the sleeve shuttle. FIG. 89 schematically depicts a 3-cylinder split-cycle engine 1100, which is different from engine 1000 in lacking (not having) poppet valves (and related camshafts) associated with first exhaust port 1032 and with second exhaust port 1040. Inlet port 1048 is regulated by poppet valve 1052 similarly to engine 1000. First exhaust port 1032 and second exhaust port 1040 are located in first expansion cylinder 1002 and second expansion cylinder 1004, respectively, so that the travel of a sleeve shuttle 1162 in a sleeve cylinder 1160 causes the opening and closing of the ports in synchronization with the exhaust strokes and expansion strokes, respectively of pistons 1006 and 1008. Sleeve shuttle 1162 may be different from sleeve shuttle 1062 in having an exhaust manifold 1132 for exhaling to ambient air burnt gas exhausted from first exhaust port 1032 during the exhaust stroke of first expansion piston 1006.

FIG. 89 illustrates engine 1100 at an instant equivalent to that of engine 1000 illustrated in FIG. 86 above, wherein first expansion piston 1006 is at 90 degrees from its respective TDC point, second expansion piston 1008 is at 270 degrees from its respective TDC point and compression piston 1024 is at −180 degrees from its respective TDC point (namely at its respective BDC point). Accordingly, first expansion piston 1006 is performing an expansion stroke and second expansion piston 1008 is performing an exhaust stroke. Sleeve shuttle 1162 is positioned at its BDC point that is to say at its left most position, thereby maintaining first exhaust port 1032 closed and sealed, and maintaining second exhaust port 1040 open, and thereby fluidly connecting expansion chamber B to the ambient.

As can be understood by those skilled in the art, the principle described herein can be implemented for a split-cycle engine that uses a single compression piston within a single compression cylinder to charge (n) expansion cylinders (for example three expansion cylinders or four expansion cylinders or any other desired number (n) greater than two), in a consecutive manner, while the compression piston crankshaft rate of rotation (Rounds Per Minute, RPM) is higher than the expansion piston crankshaft rotation rate according to the equation: (Compressor RPM)=(expansion RPM)×(n). In such arrangement the (n) power cylinders may be phased from each other by 360/n crankshaft degrees.

It is noted that during operation of engine 1000 or engine 1100, leakage, flow or penetration of fluids through gaps between sleeve cylinder 1160 and sleeve shuttle 1162 and between sleeve cylinder 1060 and sleeve shuttle 1062, respectively, is prevented or at least reduced due to cylinder sealing rings 1086. Likewise, leakage, flow or penetration of fluids through gaps between sleeve shuttle 1162 and combustion chamber structure 1064 in engine 1100 and between sleeve shuttle 1062 and combustion chamber structure 1064 in engine 1000 is prevented or at least reduced due to chamber sealing rings 1084. Specifically, cylinder sealing rings 1086 contribute to maintaining high pressure in compression chamber C during a compression stroke and in expansion chambers A and B during the respective expansion strokes, by preventing or at least reducing leakage or flow or penetration of fluids from an open port (e.g. first compression port 1056, second compression port 1058, first expansion cylinder port 1034 or second expansion cylinder port 1042, respectively) through gaps between sleeve cylinder 1060 and sleeve shuttle 1062 and between sleeve cylinder 1160 and sleeve shuttle 1162 respectively. Likewise, rings 1084 contribute to maintaining high pressure in combustion chambers D and E during combustion, by preventing or at least reducing leakage or flow or penetration of fluids from an open port (e.g. first combustion chamber expansion port 1066 and first combustion chamber compression port 1070, second combustion chamber expansion port 1068 and second combustion chamber compression port 1072, respectively) through gaps between combustion chamber structure 1064 and sleeve shuttle 1062 (or sleeve shuttle 1162 in engine 1100).

It is further noted that the description above regarding operation of engine 1000 and engine 1100 is provided by way of example, and various variations of such operation are contemplated. Specifically, the timing of some of the steps or events relative to other steps or events during a cycle of the engine may be different from what is implied by the description above. For example, the timing of opening and closing of some of the ports of the engine relative to the opening or closing of other ports or relative to strokes carried out by the pistons of the engine may differ from the description. Likewise, the timing of ignition of the working fluid relative to the opening or closing of some or all of the ports, or relative to the strokes of some or all of the pistons of the engine, may differ from the description above. For example, the relative timing of opening and closing of any of the ports of the engine, or the timing of ignition of the working fluid, in terms of the engine's cycle (measured, e.g. by the first crankshaft rotation angle), may differ—advance or retard—by less than about 5 degrees, or less than about 10 degrees, or even less than about 25 degrees, or even less than about 50 degrees relative to what is implied by the description and drawings provided herein.

There is thus provided according to an aspect of some embodiments a split-cycle internal combustion engine (100, 400, 500, 600, 600*a*, 700, 1000, 1100). The engine comprises a first cylinder (102, 602, 602*a*, 702, 1022) housing a first piston (106, 606, 606*a*, 706, 1024), and a second cylinder (104, 604, 604*a*, 704, 1002) housing a second piston (108, 608, 608*a*, 708, 1006), wherein one of the first piston and second piston performs an intake stroke and a compression stroke, whereas the other of the first piston and second piston performs an expansion stroke and an exhaust stroke.

The engine further comprises a crossover valve (174, 574, 674, 674*a*, 774, 1074, 1174) comprising a valve cylinder (132, 506, 632, 632*a*, 732, 1060, 1160) and a shuttle (150, 550, 640, 640*a*, 740, 1062, 1162) comprising at least one port (172, 556, 652, 654, 652*a*, 654*a*, 752, 754, 1092, 1094). The shuttle is configured to slide inside the valve cylinder in a reciprocating motion along the valve cylinder, the crossover valve being thereby configured to selectively fluidly associate and disassociate, via the at least one port, the first cylinder and the second cylinder with a combustion chamber ("E" in engines 100, 400, 500, "J" in engines 600, 600*a*, 700, "D" and "E" in engines 1000 and 1100). The combustion chamber is defined by a combustion chamber structure (134, 520, 634, 634*a*, 734, 1064) which is fixed inside the valve cylinder. According to some embodiments the engine further comprises cylinder sealing rings (154, 644, 744, 1086) positioned between the valve cylinder and the shuttle, the cylinder sealing rings preventing gas leaks between the valve cylinder and the shuttle during the reciprocating motion.

According to some embodiments the shuttle comprises a cylindrical sleeve (170, 570, 650, 650*a*, 750, 1090, 1190). According to some embodiments the combustion chamber structure is positioned inside the cylindrical sleeve so that the cylindrical sleeve slides between an internal surface (192, 592, 672, 672*a*, 772, 1078, 1178) of the valve cylinder and an external surface (190, 590, 670, 670*a*, 770, 1076) of the combustion chamber structure during the reciprocating motion. According to some embodiments the engine further comprises chamber sealing rings (152, 642, 742, 1084) positioned between the cylindrical sleeve and the combustion chamber structure, thereby preventing gas leaks between the cylindrical sleeve and the combustion chamber structure during the reciprocating motion. According to some embodiments the valve cylinder (132, 506, 632, 632*a*, 732, 1060, 1160) of the crossover valve is arranged perpendicular to the first cylinder (102, 602, 602*a*, 702, 1022) and to the second cylinder (104, 604, 604*a*, 704, 1002). According to some embodiments the engine (100, 400, 500, 1000, 1100) is configured in an in-line configuration, the first cylinder (102, 1022) and the second cylinder (104, 1002) being arranged substantially in parallel and the valve cylinder (132, 506, 1060, 1160) is arranged on top of the first cylinder and the second cylinder. According to some embodiments the engine (600, 600*a*, 700) is configured in an opposed configuration, the valve cylinder (632, 632*a*, 732) is arranged between the first cylinder (602, 602*a*, 702) and the second cylinder (604, 604*a*, 704).

According to some embodiments (engine 600*a*) the crossover valve (674*a*) is configured to simultaneously fluidly associate the first cylinder (602*a*) and the second cylinder (604*a*) with the combustion chamber ("J") during a portion of the reciprocating motion.

According to some embodiments (engines 100, 400 and 500 explicitly during the first mode of operation and during the second mode of operation, and engines 600, 600*a*, 700, 1000, 1100), the reciprocating motion of the shuttle is synchronous with the strokes of at least one of the pistons (synchronous herein means completing one cycle of reciprocating motion during an equal time interval). According to some embodiments (engines 600, 600*a*, 700, 1000, 1100) the first piston (606, 606*a*, 706, 1024) performs an intake stroke and a compression stroke but not an exhaust stroke, and the second piston (608, 608*a*, 708, 1006) performs an expansion stroke and an exhaust stroke, but not an intake stroke. According to some embodiments (engines 1000, 1100) the second piston (1006) completes one cycle comprising an expansion stroke and an exhaust stroke, while the first piston (1024) completes n cycles, each cycle comprising an intake stroke and a compression stroke, n being an integer greater than 1. According to some embodiments (e.g. engine 600*a*) the first piston (606*a*) is retarded relative to the second piston (608*a*) by up to about 60 crankshaft degrees, e.g. by about 60 degrees or by less than about 50 degrees or by less than about 30 degrees or by less than about 20 degrees or by less than about 10 degrees. According to some embodiments (e.g. engine 600) the first piston (606) is advanced relative to the second piston (608) by up to about 60 crankshaft degrees, e.g. by about 60 degrees or by less than about 50 degrees or by less than about 30 degrees or by less than about 20 degrees or by less than about 10 degrees. According to some embodiments (engines 100, 500, 700) the first piston (106, 706) reaches its TDC point together with the second piston (108, 708). According to some embodiments the shuttle reciprocating motion is shifted in phase relative to the first piston by about 90 crankshaft degrees e.g. the shuttle is retarded or advanced relative to the first piston by about 90 crankshaft degrees. According to the According to some embodiments (e.g. engines 100, 400, 500, 600, 600*a*, 700, 1000, 1100) the first cylinder and the second cylinder are thermally isolated from one another, thereby having different temperatures when the pistons perform the strokes. According to some embodiments (engines 100, 400, 500, 1000, 1100) the first cylinder (102, 1022) is smaller (i.e. has a smaller volume) than the second cylinder (104, 1002). According to some embodiments (engines 600, 600*a*, 700) the first cylinder (602, 602*a*, 702) and the second cylinder (604, 604*a*, 704) have substantially equal volumes.

There is further provided according to an aspect of some embodiments a split-cycle internal combustion engine (100, 400, 500, 600, 600*a*, 700, 1000, 1100). The engine comprises a first cylinder (102, 602, 602*a*, 702, 1022) housing a first piston (106, 606, 606*a*, 706, 1024) configured to move inside the first cylinder, defining a first chamber in between, and a second cylinder (104, 604, 604*a*, 704, 1002) housing a second piston (108, 608, 608*a*, 708, 1006), configured to move inside the first cylinder, defining a second chamber in between.

The engine further comprises a crossover valve (174, 574, 674, 674*a*, 774, 1074, 1174) comprising a valve cylinder (132, 506, 632, 632*a*, 732, 1060, 1160) and a shuttle (150, 550, 640, 640*a*, 740, 1062, 1162) comprising at least one port (172, 556, 652, 654, 652*a*, 654*a*, 752, 754, 1092, 1094). The shuttle is configured to slide inside the valve cylinder in a reciprocating motion along the valve cylinder, the crossover valve being thereby configured to regulate fluid flow between the first chamber and the second chamber.

According to some embodiments the engine (400) further the first piston (106) is associated with a first crankshaft (114), the second piston (108) is associated with a second crankshaft (116) and the engine comprises a piston phase transmission module gear (410) associating the first crankshaft and the second crankshaft, the piston phase transmission module gear being configured for controllably setting a phase difference between first piston and second piston.

According to some embodiments (engines 100, 400, 500) the reciprocating motion of the shuttle is synchronized with the motion of the first piston and/or with the motion of the second piston via a phase shifting module (160). The phase shifting module controls the reciprocating motion of the shuttle by controllably setting a phase shift between the motion of the shuttle and the motion of the first piston and the second piston, so that, when one phase shift is set, the first piston performs an intake stroke and a compression stroke, but does not perform an exhaust stroke, and the second piston performs an expansion stroke and an exhaust stroke, but does not perform an intake stroke. When another phase shift is set, the second piston performs an intake stroke and a compression stroke, but does not perform an exhaust stroke, and the first piston performs an expansion stroke and an exhaust stroke, but does not perform an intake stroke.

According to some embodiments the phase shifting module comprises a phase shifting transmission gear (180). According to some embodiments the phase shifting module comprises a differential (200). According to some embodiments the differential comprises an input axle (202), an output axle (204) revolving synchronously with the input axle and a control shaft (206) configured to set a phase shift between the input axle and said output axle.

According to some embodiments the engine (100, 400, 500, 600, 600*a*, 700, 1000, 1100) further comprises a combustion chamber structure (134, 520, 634, 634*a*, 734, 1064) housed inside the valve cylinder and the crossover valve regulates fluid flow between the first chamber, the combustion chamber and the second chamber.

There is further provided according to an aspect of some embodiments a split-cycle internal combustion engine (1000, 1100) comprising a compression cylinder (1022) housing a compression piston (1024), defining a compression chamber there between, the piston being configured to perform an intake stroke and a compression stroke, but not perform an exhaust stroke. The engine further comprises a first expansion cylinder (1002) housing a first expansion piston (1006) defining a first expansion chamber there between, and a second expansion cylinder (1004) housing a second expansion piston (1008) defining a second expansion chamber there between, each of the first expansion piston and the second expansion piston being configured to perform an expansion stroke and an exhaust stroke, but not perform an intake stroke.

The engine further comprises a crossover valve (1074, 1174) comprising a valve cylinder (1060, 1160) and a shuttle (1062, 1162) comprising a first port (1092) and a second port (1094). The shuttle is configured to slide inside the valve cylinder in a reciprocating motion along the valve cylinder, the crossover valve being thereby configured to regulate fluid flow between the compression chamber and the first and second expansion chambers.

According to some embodiments the valve cylinder house a first internal chamber and a second internal chamber, and the reciprocating motion of the shuttle intermittently fluidly couples, via the first port, the compression cylinder to the first chamber and the first chamber to the first expansion cylinder and intermittently fluidly couples, via the second port, the compression cylinder to the second chamber and the second chamber to the second expansion cylinder.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable sub-combination or as suitable in any other described embodiment of the invention. No feature described in the context of an embodiment is to be considered an essential feature of that embodiment, unless explicitly specified as such.

Although steps of methods according to some embodiments may be described in a specific sequence, methods of the invention may comprise some or all of the described steps carried out in a different order. A method of the invention may comprise all of the steps described or only a few of the described steps. No particular step in a disclosed method is to be considered an essential step of that method, unless explicitly specified as such.

Although the invention is described in conjunction with specific embodiments thereof, it is evident that numerous alternatives, modifications and variations that are apparent to those skilled in the art may exist. Accordingly, the invention embraces all such alternatives, modifications and variations that fall within the scope of the appended claims. It is to be understood that the invention is not necessarily limited in its application to the details of construction and the arrangement of the components and/or methods set forth herein. Other embodiments may be practiced, and an embodiment may be carried out in various ways.

The phraseology and terminology employed herein are for descriptive purpose and should not be regarded as limiting. Citation or identification of any reference in this application shall not be construed as an admission that such reference is available as prior art to the invention. Section headings are used herein to ease understanding of the specification and should not be construed as necessarily limiting.

The invention claimed is:

1. A split-cycle internal combustion engine comprising:

a first cylinder housing a first piston, and a second cylinder housing a second piston, wherein one of said first piston and second piston performs an intake stroke and a compression stroke, whereas the other of said first piston and second piston performs an expansion stroke and an exhaust stroke, and a crossover valve comprising a valve cylinder and a shuttle comprising at least one port and configured to slide inside said valve cylinder in a reciprocating motion along said valve cylinder, said crossover valve being thereby configured to selectively fluidly associate and disassociate, via said at least one port, said first cylinder and said second cylinder with a combustion chamber defined by a combustion chamber structure fixed inside said valve cylinder.

2. The engine of claim 1 further comprising cylinder sealing rings positioned between said valve cylinder and said shuttle, said cylinder sealing rings preventing gas leaks between said valve cylinder and said shuttle during said reciprocating motion.

3. The engine of claim 1 wherein said shuttle comprises a cylindrical sleeve and said combustion chamber structure is positioned inside said cylindrical sleeve so that said cylindrical sleeve slides between an internal surface of said valve cylinder and an external surface of said combustion chamber structure during said reciprocating motion.

4. The engine of claim 3 further comprising chamber sealing rings positioned between said cylindrical sleeve and said combustion chamber structure, thereby preventing gas leaks between said cylindrical sleeve and said combustion chamber structure during said reciprocating motion.

5. The engine of claim 1 wherein said valve cylinder of said crossover valve is arranged perpendicular to said first cylinder and to said second cylinder.

6. The engine of claim 1 wherein said engine is configured in an in-line configuration, said first cylinder and said second cylinder being arranged substantially in parallel and said valve cylinder is arranged on top of said first cylinder and said second cylinder.

7. The engine of claim 1 wherein said engine is configured in an opposed configuration, said valve cylinder is arranged between said first cylinder and said second cylinder.

8. The engine of claim 1 wherein said crossover valve is configured to simultaneously fluidly associate said first cylinder and said second cylinder with said combustion chamber during a portion of said reciprocating motion.

9. The engine of claim 1 wherein reciprocating motion of said shuttle is synchronous with said strokes of said pistons.

10. The engine of claim 9 wherein said first piston performs an intake stroke and a compression stroke but not an exhaust stroke, and said second piston performs an expansion stroke and an exhaust stroke, but not an intake stroke.

11. The engine of claim 10 wherein said first piston is retarded relative to the second piston by up to 60 crankshaft degrees.

12. The engine of claim 10 wherein said first piston is advanced relative to said second piston by up to 60 crankshaft degrees.

13. The engine of claim 10 wherein said first piston reaches its TDC point together with said second piston.

14. The engine of claim 1 wherein said first cylinder and said second cylinder are thermally isolated from one another, thereby having different temperatures when said pistons perform said strokes.

15. The engine of claim 1 wherein said first cylinder is smaller than said second cylinder.

16. The engine of claim 1 wherein said first cylinder and said second cylinder have substantially equal volumes.

* * * * *